US009079413B2

(12) United States Patent
Kudo et al.

(10) Patent No.: US 9,079,413 B2
(45) Date of Patent: Jul. 14, 2015

(54) LIQUID CONATINER, LIQUID CONSUMING APPARATUS, LIQUID SUPPLY SYSTEM AND LIQUID CONTAINER UNIT

(71) Applicant: Seiko Epson Corporation, Tokyo (JP)

(72) Inventors: Shoma Kudo, Nagano-ken (JP); Takashi Koase, Nagano-ken (JP); Toshiya Okada, Nagano-ken (JP); Yasunori Koike, Nagano-ken (JP); Tetsuya Takamoto, Nagano-ken (JP); Nobutaka Suzuki, Nagano-ken (JP); Satoshi Tamai, Nagano-ken (JP); Toru Nakazawa, Nagano-ken (JP); Katsutomo Tsukahara, Nagano-ken (JP); Masayuki Kanazawa, Nagano-ken (JP); Naofumi Mimura, Nagano-ken (JP); Keigo Iizawa, Nagano-ken (JP); Yutaka Kobayashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/962,172

(22) Filed: Aug. 8, 2013

(65) Prior Publication Data

US 2014/0043408 A1 Feb. 13, 2014

(30) Foreign Application Priority Data

| | | |
|---|---|---|
| Aug. 10, 2012 | (JP) | 2012-178147 |
| Aug. 10, 2012 | (JP) | 2012-178821 |
| Aug. 10, 2012 | (JP) | 2012-178822 |
| Aug. 10, 2012 | (JP) | 2012-178823 |
| Aug. 10, 2012 | (JP) | 2012-178824 |
| Aug. 10, 2012 | (JP) | 2012-178825 |
| Aug. 10, 2012 | (JP) | 2012-178826 |
| Sep. 14, 2012 | (JP) | 2012-203717 |
| Sep. 14, 2012 | (JP) | 2012-203718 |
| Sep. 14, 2012 | (JP) | 2012-203719 |
| Oct. 29, 2012 | (JP) | 2012-237565 |
| Oct. 31, 2012 | (JP) | 2012-240458 |
| Oct. 31, 2012 | (JP) | 2012-241218 |
| Nov. 12, 2012 | (JP) | 2012-248363 |
| Nov. 16, 2012 | (JP) | 2012-252657 |

(51) Int. Cl.
*B41J 2/175* (2006.01)

(52) U.S. Cl.
CPC ..... *B41J 2/17556* (2013.01); *B41J 2/17513* (2013.01); *B41J 2/17553* (2013.01)

(58) Field of Classification Search
CPC ..... B41J 2/17503; B41J 2/1752
USPC ..... 347/84–86
See application file for complete search history.

(56) References Cited

U.S. PATENT DOCUMENTS

| | | | |
|---|---|---|---|
| 5,231,416 | A | 7/1993 | Terasawa et al. |
| 5,619,237 | A | 4/1997 | Inoue et al. |
| 2012/0038719 | A1 | 2/2012 | Shimizu et al. |
| 2012/0050359 | A1 | 3/2012 | Koganehira et al. |

FOREIGN PATENT DOCUMENTS

| | | | |
|---|---|---|---|
| JP | 03-205154 | A | 9/1991 |
| JP | 08-230206 | A | 9/1996 |

(Continued)

*Primary Examiner* — Julian Huffman
*Assistant Examiner* — Sharon A Polk

(57) ABSTRACT

A liquid container includes an ink chamber containing an ink to be supplied via a tube to a liquid ejecting head consuming the ink; an outlet port from which the ink contained in the ink chamber flows to the tube side; an injection port through which the ink can be injected into the ink chamber; and an air intake port taking air into the ink chamber from a further vertically upper position than a liquid level of the ink when the ink is contained in the ink chamber. If the ink equal to 5% of containing capacity containable in the ink chamber flows from the outlet port, the liquid container has an area where a fluctuation range of the liquid level of the ink inside the ink chamber becomes 5% or less of the cubic root of the containing capacity.

9 Claims, 67 Drawing Sheets

(56) References Cited

FOREIGN PATENT DOCUMENTS

| | | | |
|---|---|---|---|
| JP | 10-193639 | A | 7/1998 |
| JP | 2000-301732 | A | 10/2000 |
| JP | 2004-148769 | A | 5/2004 |
| JP | 2010-208264 | A | 9/2010 |
| JP | 2012-051307 | A | 3/2012 |
| JP | 2012-051308 | A | 3/2012 |
| JP | 2012-061624 | A | 3/2012 |
| JP | 2012-066563 | A | 4/2012 |
| JP | 2012-071585 | A | 4/2012 |

FIG. 20
| | MAXIMUM FLUCTUATION RANGE OF LIQUID LEVEL (mm) | | | | | | | |
|---|---|---|---|---|---|---|---|---|
| | 40 | 45 | 50 | 55 | 60 | 65 | 70 | 75 |
| INK SUPPLY | A | B | B | B | C | C | C | D |
FIG. 21
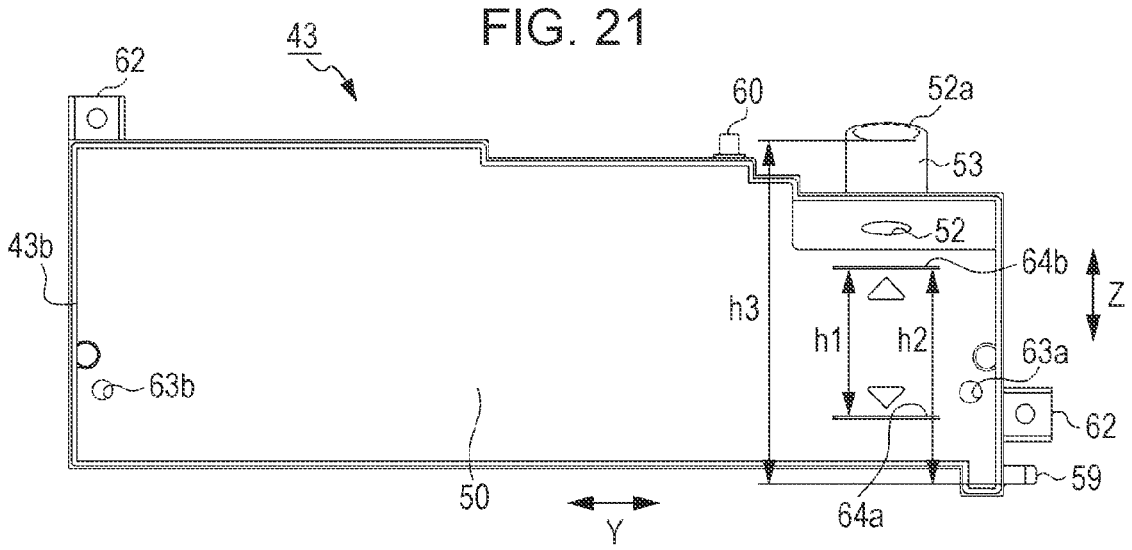
FIG. 22
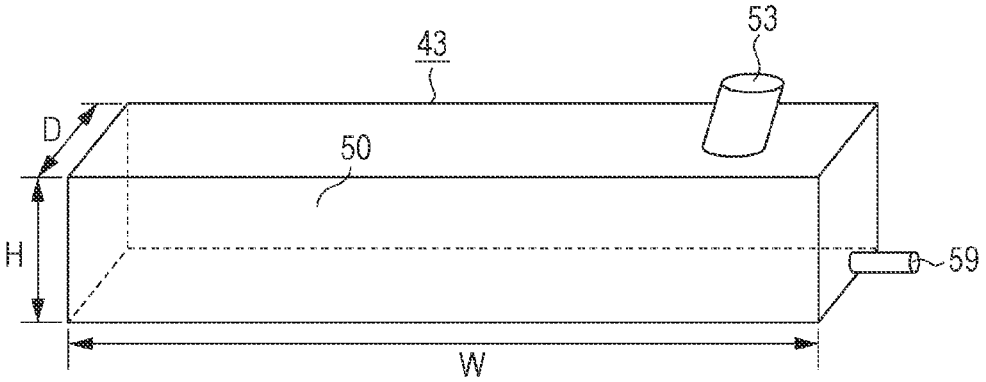

LIQUID CONATINER, LIQUID CONSUMING APPARATUS, LIQUID SUPPLY SYSTEM AND LIQUID CONTAINER UNIT

BACKGROUND

1. Technical Field

The present invention relates to a liquid container, a liquid consuming apparatus, a liquid supply system and a liquid container unit.

2. Related Art

In the related art, an ink jet recording apparatus (liquid consuming apparatus) has been known which includes a main tank (liquid container) containing an ink (liquid) consumed by a recording head (liquid consuming unit, liquid ejecting head) (for example, refer to JP-A-2000-301732). The main tank includes an air communication hole (air intake port) which can take outside air into an ink chamber when the amount of the ink contained in the ink chamber decreases due to the consumption of the ink. The air communication hole is formed at a vertically upper position in the ink chamber in order to suppress the outside intake air from being dissolved into the ink.

In addition, in the related art, an ink jet recording apparatus (liquid consuming apparatus) has been known which includes an ink tank (liquid container) containing an ink (liquid) consumed by an ejecting head (liquid consuming unit) (for example, refer to JP-A-2012-71585). The ink tank has an injection port (liquid injection port) and ink can be injected through the injection port into an ink chamber.

In the related art, an ink jet recording apparatus (liquid consuming apparatus) has been known in which a tank unit (liquid container unit) having a plurality of ink tanks (liquid container) containing an ink (liquid) is mounted to be attachable and detachable on a recording apparatus main body (for example, refer to JP-A-2012-61624). The tank unit is mounted on the recording apparatus main body when supplying the ink to an ink jet head (liquid consuming unit) which performs a printing (consuming) process, and in contrast, the tank unit is detached from the recording apparatus main body when ink is injected to the respective ink tanks.

In addition, in the related art, an ink jet recording apparatus (liquid consuming apparatus) has been known which includes an ink tank (liquid container) containing an ink (liquid) consumed by an ejecting head (liquid consuming unit) (for example, refer to JP-A-2012-66563). The ink tank is provided with a visible check window (visible surface) through which a position of the liquid level of the ink contained inside the ink tank can be observed. Furthermore, in the check window, an upper limit line (upper limit scale) indicating the containable amount of the ink in the ink tank and a lower limit line (lower limit scale) indicating that the ink contained inside the ink tank has been almost all used are displayed so as to extend long in the horizontal direction.

In addition, in the related art, an ink jet recording apparatus (liquid consuming apparatus) has been known which includes an ink tank (liquid container) capable of containing an ink (liquid) consumed by a liquid ejecting head (liquid consuming unit) ejecting the ink (for example, refer to JP-A-2004-148769). In the ink tank of such an ink jet recording apparatus, in order to avoid pressure fluctuations inside the ink tank due to changes in the temperature environment for example, an air opening port which causes the inside of the ink tank to be open to the air is disposed.

In addition, in the related art, an ink jet recording apparatus has been known which includes an ink tank capable of containing an ink (liquid) consumed by a recording head (liquid consuming unit) ejecting the ink. The ink tank includes an ink cartridge (liquid container) as an example (for example, refer to JP-A-2010-208264). In addition, the ink used for such an ink jet recording apparatus, like the pigmented ink for example, may have a certain unevenness in the density with the lapse of time. Therefore, the ink cartridge in the ink jet recording apparatus includes an ink containing chamber (liquid containing chamber) capable of containing the ink, an ink introducing port capable of introducing the ink to the inside of the ink containing chamber from the outside, and an ink outlet port (liquid outlet port) through which the ink from the inside of the ink containing chamber can flow to the ink jet recording apparatus side. Furthermore, between the ink introducing port and the ink outlet port in the bottom surface of the ink containing chamber, a plurality of ribs having a notch is extended. That is, the ink introduced by the ink introducing port flows out from the ink outlet port after a thin ink passing through the upper side of the rib and a thick ink passing through the notch are mixed all together.

In addition, an ink tank (liquid container) in an ink jet recording apparatus (liquid consuming apparatus) including the ink tank has an outlet port (liquid outlet port) for causing an ink to flow out from an ink chamber (liquid containing chamber) containing the ink to a liquid ejecting head side. In many cases, the outlet port is disposed at the bottom portion of the ink chamber (for example, refer to JP-A-2012-51308).

SUMMARY

In the ink jet recording apparatus disclosed in JP-A-2000-301732, when supplying the ink contained in the ink chamber to the recording head by utilizing a water head difference, a pressure applied to the ink supplied to the recording head is changed depending on a positional relationship in the vertical direction between the recording head and the liquid level of the ink. That is, for example, if the recording head is located at a position considerably lower than the liquid level of the ink, there is a possibility that the ink may leak out from the recording head. On the other hand, if the recording head is located at a position considerably higher than the liquid level of the ink, there is a possibility that the ink cannot be supplied to the recording head. That is, the liquid consuming apparatus in the related art has a first problem in that it is difficult to stably supply the liquid to the liquid consuming unit side. A first advantage of some aspects of the invention is to provide a liquid container capable of stably supplying the liquid contained in the liquid containing chamber to the liquid consuming unit (liquid ejecting head) side, a liquid consuming apparatus including the liquid container, and a liquid supply system including the liquid consuming apparatus and the liquid container.

In addition, as similar to the ink jet recording apparatus disclosed in JP-A-2012-71585, the ink tank to which the ink can be injected has a second problem in that the ink is likely to leak out from the injection port when injecting the ink. A second advantage of some aspects of the invention is to provide a liquid container capable of decreasing a possibility that the leaking liquid may contaminate the surrounding of the leaked portion, and a liquid consuming apparatus including the liquid container.

In addition, in the ink jet recording apparatus disclosed in JP-A-2012-71585, the ink tank is assembled with the ink jet recording apparatus in a state of being accommodated inside a tank case (protection case). The tank case in the related art is configured to combine a plurality of members, whereby causing a third problem that the assembling needs labor hours. A third advantage of some aspects of the invention is to provide a liquid container unit capable of improving assembly ability, and a liquid consuming apparatus including the liquid container unit.

In the ink jet recording apparatus disclosed in JP-A-2012-61624, in a case where the tank unit is mounted to be attachable and detachable with respect to the recording apparatus main body, there is a possibility that the tank unit may slip out of the recording apparatus when carrying the recording apparatus. Therefore, it is necessary for a user to carry the recording apparatus while holding the tank unit or taking care of the slip, whereby causing a fourth problem of poor portability. A fourth advantage of some aspects of the invention is to provide a liquid consuming apparatus capable of improving the portability, and a liquid container unit containing the liquid consumed by the liquid consuming apparatus.

In the ink jet recording apparatus disclosed in JP-A-2012-66563, when the ink tank is installed to be tilted, whereas the liquid level of the ink is kept horizontally, the respective lines are tilted together with the ink tank. Therefore, if the lines are displayed so as to extend long in the horizontal direction of the check window, the positions of the liquid level of the ink with respect to the lines, particularly in both end positions of the line, are caused to differ from each other, whereby causing a fifth problem that it is difficult to determine the amount of the contained ink. A fifth advantage of some aspects of the invention is to provide a liquid container enabling a user to easily recognize the amount of the liquid contained in the liquid container, and a liquid consuming apparatus including the liquid container.

In the ink jet recording apparatus disclosed in JP-A-2012-71585, the injection port is formed so as to extend in the vertical direction when injecting the ink to the ink tank. Therefore, there is a sixth problem in that it is difficult to inject the ink through the injection port. A sixth advantage of some aspects of the invention is to provide a liquid container to which the liquid can be easily injected, and a liquid consuming apparatus including the liquid container.

In addition, the air opening port of the ink tank in the ink jet recording apparatus disclosed in JP-A-2004-148769 is sealed at the time of shipment of the product. When the ink is injected into the ink tank in order that a printer can be used, the sealed state is released and the ink is open to the air. Therefore, when transporting the ink jet recording apparatus in which the usable ink is contained in the ink tank, for example, when the ink tank is inverted, there is a possibility that the ink may leak out from the ink tank through the air opening port to the outside, whereby causing a seventh problem. Such a problem is not limited to a case of the ink tank provided in the ink jet recording apparatus, but is generally common to a case of the liquid container having the air opening port which causes the inner space containing the liquid to be open to the air. A seventh advantage of some aspects of the invention is to provide a liquid container capable of suppressing the liquid contained therein from leaking outward through the air opening port, even if the liquid container is inverted, and a liquid consuming apparatus including the liquid container.

In addition, in the ink jet recording apparatus disclosed in JP-A-2010-208264, it is necessary to increase the size of the ink containing chamber in the horizontal direction in order to increase the amount of the ink which can be contained in the ink containing chamber while suppressing a water head change occurring in the ink supplied to the recording head. Furthermore, if the contained ink amount is increased, the required time is prolonged until the ink is used completely, whereby increasing unevenness in the density of the ink. However, the ink is unlikely to flow in a portion horizontally far away from the ink outlet port in the ink containing chamber. Therefore, there is an eighth problem in that the unevenness in the density of the ink cannot be sufficiently eliminated only by shaking the ink which has passed through different positions in the direction of gravity. Such a problem is not limited to a case of the ink tank provided in the ink jet recording apparatus, but is generally common to a case of the liquid container containing the liquid. An eighth advantage of some aspects of the invention is to provide a liquid container capable of easily eliminating the unevenness in the density of the liquid contained in the liquid containing chamber, and a liquid consuming apparatus including the liquid container.

In addition, in the ink jet recording apparatus disclosed in JP-A-2012-51308, in order to continuously perform a large amount of printing, it is necessary to increase the capacity of the ink chamber. In addition, if the ink chamber is horizontally enlarged in order to increase the capacity of the ink chamber, the bottom area of the ink chamber is also increased. Then, if the outlet port is disposed at a first end side in a direction following the horizontal direction in the bottom portion of the ink chamber, it is not possible to cause the ink accumulated at the bottom surface side which is lowered by being tilted to flow out, when the ink jet recording apparatus is tilted and placed such that the first end side is located higher. In particular, if the outlet port is disposed in the vicinity of the end portion of the ink chamber in the longitudinal direction, a large amount of the ink remains without flowing out when the ink chamber is tilted. Such a problem is not limited to a case of the ink tank in which the ink chamber containing the ink is disposed in the ink jet recording apparatus, but is generally common to a case of the liquid container in which the liquid outlet port is disposed at the bottom portion of the liquid containing chamber containing the liquid consumed by the liquid consuming apparatus. A ninth advantage of some aspects of the invention is to provide a liquid container capable of decreasing the amount of the liquid remaining at the bottom portion of the liquid containing chamber, and a liquid consuming apparatus including the liquid container.

According to a first aspect of the invention, there is provided a liquid container including a liquid containing chamber containing a liquid to be supplied via a tube to a liquid consuming unit consuming the liquid; a liquid outlet port from which the liquid contained in the liquid containing chamber flows to the tube side; a liquid injection port through which the liquid can be injected into the liquid containing chamber; and an air intake port taking air into the liquid containing chamber from a further vertically upper position than a liquid level of the liquid when the liquid is contained in the liquid containing chamber. If the liquid equal to 5% of containing capacity containable in the liquid containing chamber flows out from the liquid outlet port, the liquid container has an area where a fluctuation range of the liquid level of the liquid inside the liquid containing chamber becomes 5% or less of the cubic root of the containing capacity.

In this case, it is possible to decrease a change in a pressure applied to the liquid to be supplied to the liquid consuming unit by suppressing the fluctuation range of the liquid level with respect to the amount of the liquid from the liquid containing chamber. Therefore, it is possible to stably supply the liquid contained in the liquid containing chamber to the liquid consuming unit side.

In the above-described liquid container, in the size of the liquid containing chamber, it is preferable that the width in a direction intersecting with the vertical direction be larger than the height in the vertical direction.

In this case, in the liquid containing chamber, since the width in the direction intersecting with the vertical direction is larger than the height in the vertical direction, it is possible to decrease the fluctuation in the liquid level with respect to the amount of the liquid to be used, compared to a case where the width in a direction intersecting with the vertical direction is smaller than the height in the vertical direction.

In the above-described liquid container, it is preferable that the height from the bottom surface to the liquid injection port in the vertical direction of the liquid containing chamber be 70 mm or less.

In this case, it is possible to suppress the height from the bottom surface to the liquid injection port by allowing the height from the bottom surface to the liquid injection port to be 70 mm or less.

The liquid container may further include a visible surface through which the liquid level of the liquid contained in the liquid containing chamber can be visually recognized from a direction intersecting with the vertical direction. It is preferable that the visible surface have an upper limit scale indicating an upper limit amount of the liquid which is injected through the liquid injection port and contained in the liquid containing chamber, and the height from the bottom surface of the liquid containing chamber in the vertical direction to the upper limit scale be 55 mm or less.

In this case, it is possible to set the range where the liquid level is located in the liquid containing chamber to 55 mm or less. Therefore, it is possible to further decrease the fluctuation in the vertical direction of the liquid level of the liquid to be contained in the liquid containing chamber.

In the liquid container, it is preferable that the visible surface further have a lower limit scale at a position vertically lower than that of the upper limit scale, and the height in the vertical direction from the lower limit scale to the upper limit scale be 40 mm or less.

In this case, a user can use the lower limit scale as a reference in injecting the liquid to the liquid containing chamber. Furthermore, it is possible to set the range where the liquid level is located in the liquid containing chamber to 40 mm or less. Therefore, it is possible to further decrease the fluctuation in the vertical direction of the liquid level of the liquid to be contained in the liquid containing chamber.

According to the first aspect of the invention, there is provided a liquid consuming apparatus including the liquid consuming unit; the tube; and the liquid container having the above-described configurations.

In this case, it is possible to obtain the same advantageous operation effects as those of the invention relating to the above-described liquid container.

According to the first aspect of the invention, there is provided a liquid supply system including a liquid ejecting apparatus including a liquid ejecting head movable in a main scanning direction; a transportation mechanism transporting a recording medium in the front/rear direction intersecting with the left/right direction which is the main scanning direction; and a tube that is drawn to the front side which is the further downstream side of the recording medium in the transportation direction than a movement area of the liquid ejecting head, and supplies a liquid to the liquid ejecting head; and a liquid container containing the liquid arranged following the front/rear direction outside the movement area of the liquid ejecting head in the main scanning direction. The liquid container includes a liquid containing chamber capable of containing the liquid; a liquid injection port through which the liquid can be injected into the liquid containing chamber; an air intake port taking air into the liquid containing chamber; and a liquid outlet port from which the liquid contained in the liquid containing chamber flows to the tube side. The size of the liquid containing chamber in the left/right direction is set to be smaller than the size in the height direction orthogonal to the left/right direction and the front/rear direction. The size of the liquid containing chamber in the height direction is set to be smaller than the size in the front/rear direction, and the liquid outlet port is arranged at the further front side than the center of the liquid containing chamber in the front/rear direction.

In this case, the liquid container provided with the liquid containing chamber is arranged following the front/rear direction further outward from the left/right direction than the movement area of the liquid ejecting head which is movable in the left/right direction. Therefore, it is possible to form the liquid containing chamber to be provided in the associated liquid container to be long in the front/rear direction, without being interrupted by the movement area of the liquid ejecting head. In addition, in the liquid containing chamber provided in the liquid container, the size thereof in the left/right direction is smaller than the size of the height direction orthogonal to the left/right direction and the front/rear direction, and the size thereof in the height direction is smaller than the size in the front/rear direction. Therefore, compared to a case where the size of the liquid containing chamber in the height direction is larger than the size in the left/right direction and the front/rear direction, it is possible to suppress the fluctuation range of the liquid level inside the liquid containing chamber with respect to the liquid ejecting head when the liquid flows out from the liquid containing chamber. Therefore, it is possible to decrease a change in the pressure to be applied to the liquid to be supplied to the liquid ejecting head. Thus, it is possible to stably supply the liquid contained in the liquid containing chamber to the liquid ejecting head. Furthermore, in the liquid container, the liquid outlet port from which the liquid inside the liquid containing chamber flows to the tube side is arranged at a further front side than the center of the liquid containing chamber in the front/rear direction. Accordingly, it is possible to connect the liquid containing chamber and the tube by utilizing a front side space to which the recording medium is to be discharged, whereby enabling the liquid supply system to be miniaturized.

In the liquid supply system, it is preferable that in the front surface of the liquid container, an operation portion of a valve capable of crushing the tube connected to the liquid outlet port depending on an operation from outside be disposed.

In this case, it is possible to easily operate the valve to be operated when blocking the supply of the liquid through the tube.

In the liquid supply system, it is preferable that the liquid container be arranged outside a housing which accommodates the liquid ejecting head in a movable state, in the liquid ejecting apparatus.

In this case, compared to a case where the liquid container is arranged inside the housing of the liquid ejecting apparatus, it is possible to further eliminate the restrictions relating to a shape or size of the liquid container.

According to a second aspect of the invention, there is provided a liquid container including a liquid containing chamber containing a liquid to be supplied via a tube to a liquid consuming unit consuming the liquid; a liquid outlet port from which the liquid contained in the liquid containing chamber to the tube side; a liquid injection port through which the liquid can be injected into the liquid containing chamber; and a barrier portion located on a flow channel of a leaked liquid leaking from the liquid injection port.

In this case, the leaked liquid leaking from the liquid injection port is blocked by the barrier portion located on the flow channel of the leaked liquid. Therefore, it is possible to decrease a possibility that the leaking liquid may contaminate the surrounding of the leaked portion.

The liquid container may further include a visible surface through which the liquid level of the liquid contained in the liquid containing chamber can be visually recognized from a direction intersecting with the vertical direction. It is preferable that the barrier portion be located at the further vertically upper position than that of the visible surface.

In this case, since the barrier portion is located at the further vertically upper position than the visible surface, it is possible to decrease a possibility that the visible surface may be contaminated by the leaked liquid.

It is preferable that a stepped portion be provided between the barrier portion and the visible surface in the liquid container.

In this case, even if the leaked liquid crosses over the barrier portion, the stepped portion can decrease a possibility that the leaked liquid flows onto the visible surface.

In the liquid container, it is preferable that the width in a direction intersecting with the vertical direction of the barrier portion and intersecting with a leak direction which is a flowing direction of the leaked liquid be wider than the width of the liquid injection port.

In this case, even if the liquid injected through the liquid injection port leaks from any direction, it is possible to block the leakage by using the barrier portion.

In the liquid container, it is preferable that the barrier portion be located at the further vertically lower position than the liquid injection port, and an injection port forming surface on which the liquid injection port is formed be a descending slope from the liquid injection port toward the barrier portion.

In this case, it is possible to use the injection port forming surface as a flow channel of the leaked liquid. Therefore, since the leaked liquid is received by the injection port forming surface, it is possible to decrease a possibility that a portion other than the injection port forming surface may be contaminated by the liquid.

In the liquid container, it is preferable that the barrier portion be a protruding portion protruding from the injection port forming surface.

In this case, the protruding portion protruding from the injection port forming surface can block the leaked liquid.

In the liquid container, it is preferable that the barrier portion be a groove portion formed to be recessed on the injection port forming surface.

In this case, since the groove portion formed to be recessed on the injection port forming surface can capture the leaked liquid, it is possible to block the leaked liquid.

In the liquid container, it is preferable that the injection port forming surface be formed to face one direction intersecting with the vertical direction.

In this case, since the liquid injection port and the barrier portion are formed on the injection port forming surface facing one direction, it is possible to set the flowing direction of the leaked liquid to one direction.

In the liquid container, it is preferable that slopes of the liquid injection port and the barrier portion with respect to the vertical direction be the same as each other.

In this case, for example, when the liquid container is subjected to injection molding, it is possible to mold the liquid injection port and the barrier portion to have the same shape as each other.

According to the second aspect of the invention, there is provided a liquid consuming apparatus including the liquid consuming unit, the tube and the liquid container having the above-described configurations.

In this case, it is possible to obtain the same advantageous operation effects as those of the invention relating to the above-described liquid container.

According to a third aspect of the invention, there is provided a liquid container unit including a liquid container including a liquid containing chamber containing a liquid to be supplied via a tube to a liquid consuming unit consuming the liquid; a liquid outlet port from which the liquid contained in the liquid containing chamber flows to the tube side; and a liquid injection port through which the liquid can be injected into the liquid containing chamber, and a protection case capable of protecting the liquid container to be covered from outside. The protection case is integrally molded.

In this case, since the protection case covering the liquid container is integrally molded, it is possible to improve assembly ability of the liquid container unit.

In the liquid container unit, it is preferable that the protection case have an opening at a position corresponding to the liquid injection port.

In this case, aligning the liquid injection port and the opening facilitates the liquid container's mounting on the protection case. In addition, since the peripheral portion of the liquid injection port is covered by the protection case, the liquid adhering to the liquid injection port can enter the inside of the protection case from a gap between the protection case and the liquid injection port, whereby suppressing the liquid from being touched from outside.

In the liquid container unit, it is preferable that the protection case, five surfaces of which are integrally molded, have a larger opening portion than the liquid container.

In this case, it is possible to easily accommodate the liquid container in the protection case through the opening portion formed in the protection case.

In the liquid container unit, it is preferable that the liquid container and the protection case have a positioning portion whose concavity and convexity are fitted to each other.

In this case, since the liquid container and the protection case are positioned by the positioning portion, it is possible to decrease a possibility that the liquid container and the protection case may be deviated from each other.

In the liquid container unit, it is preferable that two or more positioning portions be formed, and at least one positioning portion out of the positioning portions have a horizontally long slotted hole.

In this case, the liquid container and the protection case are positioned by being fitted to the long slotted hole in such a manner that and the concavity and convexity are fitted to each other. Accordingly, it is possible to position the liquid container and the protecting case, even if the molding accuracy of the liquid container and the protection case is low. Furthermore, since the long slotted hole is long in the horizontal direction, it is possible to position the liquid container and the protection case by suppressing the slope in the horizontal direction.

In the liquid container unit, it is preferable that the protection case have a handle portion.

In this case, since the protection case has the handle portion, it is possible to easily carry the liquid container unit.

In the liquid container unit, it is preferable that at both side positions of the handle portion, the protection case have locking portions which lock a fixing member when the protection case is fixedly attached to an apparatus main body accommodating the liquid consuming unit.

In this case, when the liquid container unit is fixedly attached to the apparatus main body, the fixing member is locked by the locking portions formed at both side positions of the handle portion. Accordingly, a user can grip the handle portion and stably carry the apparatus main body and the liquid container unit.

In the liquid container unit, it is preferable that the protection case include one of a first engagement portion and a second engagement portion, at least one of which is elastically deformed to be engaged, when the protection case is fixedly attached to an apparatus main body accommodating the liquid consuming unit, whereas the apparatus main body include the other.

In this case, when the protection case is fixedly attached to the apparatus main body, at least one of the first engagement portion provided in one side and the second engagement portion provided in the other side is elastically deformed such that the first engagement portion and the second engagement portion are engaged with each other. Therefore, it is possible to easily and fixedly attach the liquid container unit to the apparatus main body.

In the liquid container unit, it is preferable that the protection case include one of a first engagement portion and a second engagement portion, at least one of which is elastically deformed to be engaged with each other, whereas the other protection case covering the other liquid container include the other.

In this case, at least one of the first engagement portion provided in one protection case and the second engagement portion provided in the other protection case is elastically deformed to be engaged with each other. Accordingly, it is possible to perform additional installation by connecting the adjacent protection cases to each other.

According to the third aspect of the invention, there is provided a liquid consuming apparatus including the liquid consuming unit; the tube; and the liquid container unit having the above-described configurations.

In this case, it is possible to obtain the same advantageous operation effects as those of the invention relating to the above-described liquid container unit.

The liquid container unit includes a liquid container having a liquid containing chamber to be connected to a liquid consuming unit via a flow channel, a liquid outlet port connected to the flow channel, and a liquid injection port through which a liquid can be injected into the liquid containing chamber; and a protection case which covers at least a portion of the liquid container and is fixedly attached to an apparatus main body accommodating the liquid consuming unit. The protection case includes an opening portion to which the liquid container can be inserted, on a surface becoming the apparatus main body side when the protection case is fixedly attached to the apparatus main body. The liquid container and the protection case are fixedly attached to the apparatus main body in a state where the liquid container is inserted to the opening portion and accommodated inside the protection case.

In this case, the liquid container and the protection case are fixedly attached to the apparatus main body in a state where the liquid container is accommodated inside the protection case via the opening portion. Accordingly, it is possible to improve the assembly ability of the liquid container unit.

In the liquid container unit, it is preferable that in a state of accommodating one or two or more liquid containers, the protection case be fixedly attached to the apparatus main body.

In this case, it is possible to easily and additionally install the liquid container by fixedly attaching the protection case accommodating two or more liquid containers, for example, to the apparatus main body.

In the liquid container unit, it is preferable that two of the liquid container which are adjacent to each other in a direction intersecting with the longitudinal direction in a state where two or more liquid containers are accommodated in the protection case be disposed at positions where the liquid injection ports are offset by each other in the longitudinal direction.

In this case, compared to a case where the respective liquid injection ports in two adjacent liquid containers are arrayed side by side in the direction intersecting with the longitudinal direction, it is possible to suppress the other liquid injection port from becoming an obstacle. Accordingly, it is possible to easily inject the liquid into the liquid injection ports. In addition, since the liquid injection ports are not arrayed side by side, it is possible to prevent the liquid from being erroneously injected to another liquid injection port.

In the liquid container unit, it is preferable that the protection case have an accommodation portion forming an opening at a position corresponding to the liquid injection port in the liquid container to be accommodated inside the protection case.

In this case, for example, even if the liquid injection port is disposed at the front end of a cylinder portion, when accommodating the liquid container inside the protection case, the liquid container is inserted through the opening portion side of the protection case, and the cylinder portion of the liquid injection port is inserted to the opening of the accommodation portion. Accordingly, it is possible to easily accommodate the liquid container inside the protection case.

In the liquid container unit, it is preferable that in the protection case, in a state where two or more liquid containers are accommodated inside the protection case, the accommodation portion located at a position corresponding to a liquid injection port in a liquid container other than a liquid container located closest to the opening portion side within the respective liquid containers be formed to have a size to be overlapped with the other liquid container adjacent to the liquid container located closest to the opening portion side.

In this case, for example, even if the cylinder portions where the respective liquid injection ports in two adjacent liquid containers are disposed at the front end are arrayed side by side in the horizontal direction intersecting with the longitudinal direction, the respective cylinder portions in the two adjacent liquid containers inside one accommodation portion can be easily inserted through the opening portion side.

In the liquid container unit, it is preferable that the liquid container include a connection portion enabling connection in a state where the liquid container is adjacent to the other liquid container.

In this case, after pre-connecting two or more liquid containers so as to be adjacent to each other in the direction intersecting with the longitudinal direction, these two or more liquid containers are inserted into the protection case all together. In this manner, it is possible to easily accommodate two or more liquid containers inside the protection case.

In the liquid container unit, it is preferable that the protection case have locking portions which lock a fixing member when the protection case is fixedly attached to the apparatus main body.

In this case, the locking portions are formed in the protection case. Therefore, it is possible to easily and fixedly attach the liquid container unit to the apparatus main body by using the fixing member.

In the liquid container unit, it is preferable that the protection case include one of a first engagement portion and a second engagement portion, at least one of which is elastically deformed to be engaged with each other, when the protection case is fixedly attached to an apparatus main body accommodating the liquid consuming unit, whereas the apparatus main body includes the other.

In this case, when the protection case is fixedly attached to the apparatus main body, at least one of the first engagement portion provided in one side and the second engagement portion provided in the other side is elastically deformed such that the first engagement portion and the second engagement portion are engaged with each other. Therefore, it is possible to easily and fixedly attach the liquid container unit to the apparatus main body.

In the liquid container unit, it is preferable that an operation portion of a valve which is attached to the flow channel be disposed in the protection case in a state where two or more liquid containers are accommodated in the protection case, as a common operation portion with respect to each flow channel corresponding to two or more liquid containers.

In this case, by operating the common operation portion, it is possible to open and close valves of the respective flow channels corresponding to two or more liquid containers all together. Accordingly, it is possible to reduce the number of parts.

In the liquid container unit, it is preferable that the liquid container have a visible surface through which a liquid level of the liquid contained in the liquid container can be visually recognized from outside, and the protection case have a window portion at a position corresponding to the visible surface, and has the opening portion at an opposing side to the window portion.

In this case, when the liquid container is mounted on the protection case, the liquid container can be inserted through the opening portion disposed at the side opposing the window portion of the protection case. Accordingly, it is easy to align the visible surface and the window portion.

According to the third aspect of the invention, there is provided a liquid consuming apparatus including the liquid consuming unit; the flow channel; and the liquid container unit having the above-described configurations.

In this case, it is possible to obtain the same advantageous operation effects as those of the invention relating to the above-described liquid container.

According to the second aspect of the invention, there is provided a liquid supply system including a liquid container having a liquid containing chamber containing a liquid to be supplied via a tube to a liquid consuming unit consuming the liquid, a liquid outlet port from which the liquid contained in the liquid containing chamber flows to the tube side, and a liquid injection port through which the liquid can be injected into the liquid containing chamber; a protection member capable of protecting the liquid container by covering the liquid container from outside; and an absorbent material for absorbing the liquid by being interposed between the protection member and the liquid container.

In this case, since the absorbent material is interposed between the protection member and the liquid container, even if the leaked liquid leaking from the liquid injection port permeates through a portion between the protection member and the liquid container, the leaked liquid can be absorbed by the absorbent material. Therefore, it is possible to decrease a possibility that the leaking liquid may contaminate the surrounding of the leaked portion.

In the liquid supply system, it is preferable that the absorbent material be disposed at a position between the liquid injection port and the protection member.

In this case, by disposing the absorbent material between the liquid injection port having a possibility of the liquid leakage and the protection member, it is possible to efficiently absorb the leaked liquid leaking from the liquid injection port by means of the absorbent material.

In the liquid supply system, it is preferable that the absorbent material be compressed by the protection member and the liquid container, subjected to compressive deformation and then interposed therebetween.

In this case, it is possible to fill the gap between the protection member and the liquid container with the absorbent material. Therefore, it is possible to decrease a possibility that foreign substances may be mixed into the gap between the protection member and the liquid container.

In the liquid supply system, it is preferable that the absorbent material be continuously arranged from the liquid injection port to a position between the protection member and the liquid container.

In this case, by using one absorbent material, it is possible to absorb the leaked liquid leaking from the liquid injection port or the leaked liquid flowing between the liquid container and the protection member.

According to the second aspect of the invention, there is provided a liquid container including a liquid containing chamber containing a liquid to be supplied via a tube to a liquid consuming unit consuming the liquid; a liquid outlet port from which the liquid contained in the liquid containing chamber flows to the tube side; a liquid injection port through which the liquid can be injected into the liquid containing chamber; and an absorbent material attached thereto so as to absorb the liquid leaking from the liquid injection port.

In this case, it is possible to absorb the leaked liquid by using the absorbent material attached thereto so as to absorb the liquid leaking from the liquid injection port. Therefore, it is possible to decrease a possibility that the leaking liquid may contaminate the surrounding of the leaked portion.

According to the second aspect of the invention, there is provided a liquid consuming apparatus including the liquid consuming unit; the tube; and the liquid supply system having the above-described configurations.

In this case, it is possible to obtain the same advantageous operation effects as those of the invention relating to the above-described liquid container.

According to the second aspect of the invention, there is provided a liquid consuming apparatus including the liquid consuming unit; an apparatus main body accommodating the liquid consuming unit; the tube; and the liquid container having the above-described configurations. The absorbent material is interposed between the liquid container and the apparatus main body.

In this case, since the absorbent material is interposed between the protection member and the liquid container, even if the leaked liquid leaking from the liquid injection port permeates through a portion between the apparatus main body and the liquid container, the leaked liquid can be absorbed by the absorbent material.

According to the second aspect of the invention, there is provided a liquid container including a liquid containing chamber containing a liquid to be supplied to a liquid consuming unit via a flow channel; a liquid outlet port connected to the flow channel; and a liquid injection port communicating with the inside of the liquid containing chamber. An absorbent material capable of absorbing the liquid is arranged on the outer surface of the liquid container.

In this case, since the absorbent material is arranged on the outer surface of the liquid container, the liquid adhering around the liquid injection port during the injection or the liquid flowing from around the liquid injection port after adhering to the vicinity of the liquid injection port can be absorbed by the absorbent material. Therefore, it is possible to decrease a possibility that the leaking liquid may contaminate the surrounding of the leaked portion.

In the liquid container, it is preferable that the absorbent material be arranged on a surface intersecting with an injection port forming surface on which the liquid injection port is disposed, within the outer surface of the liquid container.

The liquid adhering around the liquid injection port when injecting the liquid flows down on the outer surface of the liquid container. In this regard, in this case, the liquid adhering around the injection port can be absorbed by the absorbent material before the liquid reaches the installation surface of the liquid container. Accordingly, it is possible to decrease a possibility that the leaking liquid may contaminate the surrounding of the leaked portion.

In the liquid container, it is preferable that the surface intersecting with the injection port forming surface be configured to have a surface where the liquid level of the liquid inside the liquid container can be visually recognized from outside, and the absorbent material be disposed at the liquid injection port side of the surface.

In this case, the liquid adhering around the liquid injection port when injecting the liquid is suppressed from reaching the surface where the liquid level inside the liquid container can be visually recognized. Accordingly, it is possible to decrease a possibility of an impaired visibility of the liquid level.

In the liquid container, it is preferable that the absorbent material be arranged on the injection port forming surface on which the liquid injection port is disposed, within the outer surface of the liquid container.

In this case, since the absorbent material is arranged on the injection port forming surface on which the liquid injection port is disposed, the liquid adhering to the liquid injection port forming surface or the liquid flowing on the liquid injection port forming surface after the adhering to the liquid injection port forming surface can be efficiently absorbed by the absorbent material.

In the liquid container, it is preferable that the absorbent material be arranged on a bottom surface within the outer surface of the liquid container.

In this case, since the absorbent material is arranged on the bottom surface, it is possible to decrease a possibility that the liquid adhering to the liquid container when injecting the liquid may contaminate the installation surface of the liquid container.

According to a fourth aspect of the invention, there is provided a liquid consuming apparatus including an apparatus main body; a liquid consuming unit consuming a liquid contained inside the apparatus main body; a liquid container unit that is externally and fixedly attached to the apparatus main body and contains the liquid consumed by the liquid consuming unit; and a tube for supplying the liquid contained in the liquid container unit to the liquid consuming unit. The liquid container unit includes the liquid container having a liquid containing chamber containing the liquid; a liquid outlet port from which the liquid contained in the liquid containing chamber flows to the tube side; a liquid injection port through which the liquid can be injected into the liquid containing chamber; and a cover capable of hiding the liquid injection port.

In this case, it is possible to inject the liquid to the liquid containing chamber through the liquid injection port formed in the liquid container. In addition, since the liquid container unit is fixedly attached to the apparatus main body, it is possible to decrease a possibility that the liquid container unit may be detached from the apparatus main body when a user carries the apparatus main body. Therefore, it is possible to improve the portability of the liquid consuming apparatus including the liquid container unit to which the liquid can be injected.

In the liquid consuming apparatus, it is preferable that the cover be disposed to be slidable between a hiding position for hiding the liquid injection port with respect to the liquid container and a non-hiding position different from the hiding position.

In this case, since the cover is disposed to be slidable, for example, compared to a case where the hiding position and the non-hiding position are displaced by pivoting the cover about the center of the axis, it is possible to reduce the cover's passing area. Therefore, even if the liquid consuming apparatus is installed in a narrow space, it is possible to open and close the cover.

In the liquid consuming apparatus, it is preferable that the liquid container unit have a placement portion capable of placing a closing member for closing the liquid injection port on a position appearing when the cover is located at the non-hiding position.

In this case, when the liquid is injected to the liquid containing chamber through the liquid injection port, it is possible to place the closing member on the placement portion. Therefore, even if the liquid adheres to the closing member, it is possible to decrease a possibility that the liquid may adhere to a portion other than the placement portion.

In the liquid consuming apparatus, it is preferable that the liquid injection port be formed at the front end of a cylinder portion protruding outward from the liquid containing chamber, and the cylinder portion protrude toward a direction non-orthogonal to the vertical direction.

In this case, the liquid injection port is formed in the cylinder portion protruding outward from the liquid containing chamber. Accordingly, when injecting the liquid to the liquid containing chamber, it is possible to decrease a possibility that members located around the cylinder portion may come into contact with the liquid containing substances and thereby the injection of the liquid may be inhibited. Furthermore, since the cylinder portion protrudes toward the direction non-orthogonal to the vertical direction, a user is able to easily check a state of injecting the liquid.

In the liquid consuming apparatus, it is preferable that the liquid container further include a barrier portion on the flow channel of the leaked liquid leaking from the liquid injection port.

In this case, it is possible to block the liquid leaking from the liquid injection port by means of the barrier portion disposed on the flow channel of the leaked liquid.

In the liquid consuming apparatus, it is preferable that the size of the cover be smaller than the size of the liquid container.

In this case, since the size of the cover is smaller than the size of the liquid container, the cover can be accommodated on the liquid container. Therefore, even if the liquid container unit is provided with the cover, it is possible to decrease a possibility that the cover may be caught by something during the transportation.

According to the fourth aspect of the invention, there is provided a liquid container unit including a liquid container having a liquid containing chamber containing a liquid to be supplied via a tube to a liquid consuming unit consuming the liquid; a liquid outlet port from which the liquid contained in the liquid containing chamber flows to the tube side; and a liquid injection port through which the liquid can be injected into the liquid containing chamber; and a protection case capable of protecting the liquid container by covering the liquid container from outside. The protection case has a support portion supporting a cover which is slidable between a hiding position for hiding the liquid injection port and a non-hiding position different from the hiding position, and a locking portion which locks a fixing member when the liquid container is fixedly attached to an apparatus main body of a liquid consuming apparatus having a liquid consuming unit.

In this case, it is possible to obtain the same advantageous operation effects as those of the invention relating to the above-described liquid consuming apparatus.

According to the fourth aspect of the invention, there is provided a liquid container unit including a liquid container having a liquid containing chamber containing a liquid to be supplied via a tube to a liquid consuming unit consuming the liquid; a liquid outlet port from which the liquid contained in the liquid containing chamber flows to the tube side; and a liquid injection port through which the liquid can be injected into the liquid containing chamber; and a cover which is provided in the liquid container and is capable of hiding the liquid injection port.

In this case, it is possible to obtain the same advantageous operation effects as those of the invention relating to the above-described liquid consuming apparatus.

In the liquid container unit, the cover is provided so as to be slidable in the longitudinal direction of the liquid container.

In this case, when a user hides or exposes the liquid injection port, the user easily operates the cover.

In the liquid container unit, the liquid injection port is provided further to one side than the center of the liquid container in the longitudinal direction.

In this case, it is possible to reduce the movement amount of the cover when a user slides the cover to hide or expose the liquid injection port. In addition, it is also possible to dispose a support portion supporting the cover to be slidable at the opposite side to the liquid injection port in the longitudinal direction.

According to a fifth aspect of the invention, there is provided a liquid container including a liquid containing chamber containing a liquid to be supplied via a tube to a liquid consuming unit consuming the liquid; a liquid outlet port from which the liquid contained in the liquid containing chamber flows to the tube side; a liquid injection port through which the liquid can be injected into the liquid containing chamber; and a visible surface through which the liquid level of the liquid contained in the liquid containing chamber can be visually recognized from a direction intersecting with the vertical direction. A scale is formed further to one side than the intermediate position of the visible surface in the horizontal direction.

In this case, the scale is formed further to one side than the intermediate position in the horizontal direction. Therefore, even if the liquid container is obliquely installed, it is possible to decrease a possibility that in a plurality of different positions in the horizontal direction, positions of the liquid level with respect to the scales in the vertical direction may differ from each other for each position. Therefore, a user can easily recognize the amount of the liquid contained in the liquid container.

It is preferable that on the visible surface of the liquid container, a lower limit scale be formed at the liquid outlet port side in the horizontal direction and at the further vertically upper position than the liquid outlet port.

In this case, since the lower limit scale is formed at the liquid outlet port side, it is possible to compare the liquid level of the liquid located in the vicinity of the liquid outlet port and the lower limit scale. Therefore, a user uses the lower limit scale as a reference in injecting the liquid to the liquid containing chamber. Accordingly, it is possible to decrease a possibility that the air may be supplied through the liquid outlet port, since the liquid level of the liquid is located at the further vertically lower position than the liquid outlet port.

It is preferable that on the visible surface of the liquid container, a lower limit scale be formed at the liquid outlet port side in the horizontal direction and at the further vertically lower position than the liquid outlet port.

In this case, the lower limit scale is formed at the same side as the liquid injection port and is formed at the further lower position than the liquid injection port. Accordingly, when the liquid is injected through the liquid injection port, it is possible to easily check the injected liquid.

In the liquid container, on the visible surface, it is preferable that the width in a direction intersecting with the vertical direction be larger than the height in the vertical direction.

In the liquid container having the visible surface in which the width in a direction intersecting with the vertical direction is larger than the height in the vertical direction, when the liquid container is obliquely installed, in the different positions in the horizontal direction, positions of the liquid level with respect to the scale in the vertical direction is likely to considerably differ from each other. In this regard, in this case, since the scale is formed further to one side than the intermediate position in the horizontal direction, it is possible to easily recognize the amount of the liquid even if the liquid container is obliquely installed.

It is preferable that on the visible surface of the liquid container, an upper limit scale indicating an upper limit amount of the liquid injected through the liquid injection port and contained inside the liquid containing chamber be formed at the liquid injection port side in the horizontal direction and at the further vertically lower position than the liquid injection port.

In this case, since the upper limit scale is formed at the liquid injection port side, for example, even if the liquid container is obliquely installed, by comparing the liquid level of the injected liquid and the upper limit scale, it is possible to decrease a possibility that the liquid may overflow from the liquid injection port.

In the liquid container, it is preferable to form the visible surface to face one direction intersecting with the vertical direction.

In this case, since the visible surface is formed to face one direction intersecting with the vertical direction, it is possible to recognize and compare the liquid level of the liquid and the scale from one direction.

In the liquid container, it is preferable that two or more scales be formed with being apart from each other in the vertical direction, at the same side on the visible surface in the horizontal direction.

In this case, since two or more scales are formed at the same side, it is possible to easily recognize the remaining amount of the liquid contained in the liquid containing chamber by comparing the liquid level of the liquid and the respective scales.

According to a fifth aspect of the invention, there is provided a liquid consuming apparatus including the liquid consuming unit, the tube and the liquid container having the above-described configurations.

In this case, it is possible to obtain the same advantageous operation effects as those of the invention relating to the above-described liquid container.

According to a sixth aspect of the invention, there is provided a liquid container including a liquid containing chamber containing a liquid to be supplied via a tube to a liquid consuming unit consuming the liquid; a liquid outlet port from which the liquid contained in the liquid containing chamber flows to the tube side; and a liquid injection port through which the liquid can be injected into the liquid containing chamber. The end surface of the liquid injection port is non-orthogonal to the vertical direction.

In this case, since the end surface of the liquid injection port is non-orthogonal to the vertical direction, compared to a case where the end surface of the liquid injection port is orthogonal to the vertical direction, it is possible to more easily inject the liquid.

In the liquid container, it is preferable that the liquid injection port be formed at the front end of a cylinder portion protruding outward from the liquid containing chamber.

In this case, since the liquid injection port is formed at the cylinder portion protruding outward from the liquid containing chamber, when injecting the liquid to the liquid containing chamber, it is possible to decrease a possibility that members located around the cylinder portion may come into contact with the liquid containing substances and thereby the injection of the liquid may be inhibited.

In the liquid container, it is preferable that the cylinder portion protrude toward the direction non-orthogonal to the vertical direction.

In this case, since the cylinder portion protrudes toward the direction non-orthogonal to the vertical direction, a user is able to easily check a state of injecting the liquid.

In the liquid container, it is preferable that the cylinder portion be tilted in a separated direction from the apparatus main body which accommodates the liquid consuming unit and to which the liquid container is fixedly attached.

In this case, when the liquid container is fixedly attached to the apparatus main body, since the cylinder portion is formed to be tilted in the separated direction from the apparatus main body, it is possible to more easily inject the liquid.

In the liquid container, it is preferable that the injection port forming surface on which the liquid injection port is formed be non-orthogonal to the vertical direction.

In this case, since the injection port forming surface is non-orthogonal to the vertical direction, even if the liquid leaks from the liquid injection port, it is possible to allow the liquid to flow down on the injection port forming surface. Therefore, it is possible to decrease a possibility that the liquid may flow in a direction unwanted by a user.

In the liquid container, it is preferable that the respective slopes of the cylinder portion and the injection port forming surface with respect to the vertical direction be the same as each other.

In this case, for example, when the liquid container is subjected to injection molding, it is possible to mold the cylinder portion and the injection port forming surface by using the same molding die.

In the liquid container, it is preferable that the liquid injection port be formed at the front end of the cylinder portion which internally has a flow channel extending in a direction non-orthogonal to the vertical direction.

For example, in a case of the flow channel extending in the vertical direction, if the liquid is injected through the liquid injection port which is non-orthogonal to the vertical direction, there is a possibility that the injected liquid may be bumped against the wall of the flow channel and the rebounding may cause the surrounding to be contaminated. In this regard, in this case, since the flow channel extends in the direction non-orthogonal to the vertical direction, it is possible to decrease the contamination occurring due to the rebounding of the liquid.

In the liquid container, it is preferable that the liquid injection port be formed at the front end of the cylinder portion which internally has a flow channel extending in the vertical direction.

In this case, since the flow channel extends in the vertical direction, it is also possible to form the cylinder portion so as to extend in the vertical direction. Therefore, since the cylinder portion protrudes only in the vertical direction, the cylinder portion does not become an obstacle.

In the liquid container, it is preferable that the cylinder portion extend inward of the liquid containing chamber.

In this case, the cylinder portion does not become the obstacle compared to a case of extending outward from the liquid containing chamber.

In the liquid container, it is preferable that in a case where the liquid container is fixed to the liquid consuming apparatus provided with the liquid consuming unit, the end surface of the liquid injection port be tilted so as to face a direction separated from the liquid consuming apparatus.

In this case, in a case where the liquid container is fixed to the liquid consuming apparatus, since the end surface of the liquid injection port is formed to be tilted so as to face a direction separated from the apparatus main body, it is possible to more easily inject the liquid.

According to the sixth aspect of the invention, there is provided a liquid consuming apparatus including the liquid consuming unit, the tube, and the liquid container having the above-described configurations.

In this case, it is possible to obtain the same advantageous operation effects as those of the invention relating to the above-described liquid container.

The liquid container according to the sixth aspect of the invention may include a liquid containing chamber containing a liquid to be supplied via a first flow channel to a liquid consuming unit consuming the liquid; a liquid outlet port from which the liquid contained in the liquid containing chamber flows to the flow channel side; and a liquid injection port communicating with the inside of the liquid containing chamber. The end surface of the liquid injection port is preferably orthogonal to the vertical direction, and the liquid injection port is preferably formed at the front end of a second flow channel extending in a direction non-orthogonal to the vertical direction.

In this case, the second flow channel having the liquid injection port at the front end extends in the direction non-orthogonal to the vertical direction. Therefore, when ejecting the liquid to the liquid containing chamber by aligning a spout of the other product containing the liquid inside with the liquid injection port, it is possible to decrease a possibility that a member located around the liquid injection port may come into contact with the other product to inhibit the injection work of the liquid. Furthermore, since the end surface of the liquid injection port is orthogonal to the vertical direction, when a user injects the liquid, the spout of the other product containing the liquid inside can be supported in a placed state on the liquid injection port. Therefore, it is possible to easily inject the liquid.

In the liquid container, it is preferable that the second flow channel extend outward from the liquid containing chamber.

In this case, since the second flow channel is located outside the liquid containing chamber, it is possible to more easily inject the liquid through the liquid injection port formed at the front end of the second flow channel.

In the liquid container, it is preferable that the second flow channel extend inward of the liquid containing chamber.

In this case, since the second flow channel extends inward of the liquid containing chamber, the second flow channel is unlikely to become an obstacle compared to a case where the second flow channel extends outward from the liquid containing chamber.

In the liquid container, it is preferable that in a case where the liquid container is fixed to the liquid consuming apparatus provided with the liquid consuming unit, the second flow channel be tilted in a direction separated from the liquid consuming apparatus.

In this case, in a case where the liquid container is fixed to the liquid consuming apparatus, since the second flow channel is formed to be tilted in a direction separated from the liquid consuming apparatus, it is possible to more easily inject the liquid.

In the liquid container, it is preferable that the injection port forming surface on which the liquid injection port is formed be non-orthogonal to the vertical direction.

In this case, since the injection port forming surface is non-orthogonal to the vertical direction, even if the liquid leaks from the liquid injection port, it is possible to allow the liquid to flow down on the injection port forming surface. Therefore, it is possible to decrease a possibility that the liquid may flow in a direction unwanted by a user.

According to the sixth aspect of the invention, there is provided a liquid consuming apparatus including the liquid consuming unit, the first flow channel, and the liquid container having the above-described configurations.

In this case, it is possible to obtain the same advantageous operation effects as those of the invention relating to the above-described liquid container.

According to a seventh aspect of the invention, there is provided a liquid container including a liquid containing chamber containing a liquid to be supplied to a liquid consuming unit consuming the liquid; an air chamber having an inner space partitioned via a partition wall with the liquid containing chamber; an air opening port causing the inside of the air chamber to be open to the air; and a communication port allowing the liquid containing chamber and the air chamber to communicate with each other. In a posture state when in use, the air chamber is located above the liquid containing chamber, regarding the partition wall as a boundary.

In this case, in the posture state when in use, the air chamber is located above the liquid containing chamber, and the liquid is unlikely to enter the air chamber side via the communication port from the liquid containing chamber side. Accordingly, it is possible to suppress the liquid from leaking outward through the air opening port. In addition, even if the posture state when in use is inverted, the liquid inside the liquid containing chamber is received in the inner space of the air chamber via the communication port for the time being. Thus, it is possible to suppress the liquid from leaking outward directly from the liquid containing chamber. Therefore, even if inverted, it is possible to suppress the liquid contained inside thereof from leaking outward through the air opening port.

In the liquid container, the air chamber includes at least a first small air chamber and a second small air chamber. The first small air chamber and the second small air chamber are divided by a first division wall, and the first small air chamber and the second small air chamber communicate with each other via a first communication channel. The cross-sectional area of the first communication channel is smaller than an area of a wall surface facing the first small air chamber on the first division wall.

In this case, even if the liquid flows in the first small air chamber communicating via the communication port from the liquid containing chamber, in order to reach the second small air chamber communicating with the first small air chamber, it is necessary for the liquid to pass through the first communication channel whose cross-sectional area of the flow channel is smaller than the area of the wall surface facing the first small air chamber on the first division wall dividing the first small air chamber and the second small air chamber. Accordingly, flowing of the liquid is suppressed from the second small air chamber further to another small air chamber side in which the air opening is formed. Therefore, it is possible to further suppress the liquid contained inside thereof from leaking outward through the air opening port.

In the liquid container, the first communication channel allows a first opening located at a surface portion other than the first division wall in the inner surface of the first small air chamber to communicate with a second opening located at a surface portion other than the first division wall in the inner surface of the second small air chamber. The length of the first communication channel is longer than the distance between the first small air chamber and the second small air chamber.

In this case, in a case where the liquid which has flowed in the first small air chamber from the liquid containing chamber tries to further flow in the second small air chamber from the first small air chamber, it is necessary for the liquid to flow from the first opening to the second opening in the first communication channel whose distance is longer than the distance between the first small air chamber and the second small air chamber. Accordingly, since the long distance thereof increases flow channel resistance, the liquid is suppressed from flowing in the second small air chamber. Therefore, in this regard, it is possible to further suppress the liquid contained inside thereof from leaking outward through the air opening port.

In the liquid container, the distance from the partition wall to the first opening is equal to the distance from the partition wall to the second opening.

In this case, even if the liquid flows in the air chamber side from the liquid containing chamber side due to the inverting of the liquid container, and further the liquid flows into the first communication channel which allows the first small air chamber to communicate with the second small air chamber, if the liquid container returns to the posture state when in use, the liquid inside the first communication channel flows out from the first communication channel via the first opening and the second opening. Therefore, it is possible to avoid a possibility that solidified substances may be generated inside the first communication channel due to the dried liquid remaining inside the first communication channel.

In the liquid container, the distance from the partition wall to at least a portion of the first communication channel is longer than the distance from the partition wall to the first opening.

In this case, even if the liquid container is inverted in a state where the air-liquid interface is present near the first opening, the first communication channel connecting the first opening and the second opening has the flow channel portion away from the air-liquid interface at least in a portion thereof by being further separated from the partition wall than the first opening and the second opening. Accordingly, it is possible to preclude the air-liquid exchange at the portion. Therefore, it is possible to generate a greater negative pressure at the liquid containing chamber side than the first communication channel, and thus it is possible to stop the leakage of the liquid from the liquid containing chamber side.

In the liquid container, the first communication channel is configured to include a long meandering groove portion in which one end side communicates with the first opening and the other end side communicates with the second opening, and a covering member arranged so as to cover the long groove portion.

In this case, in a case of the inverted liquid container, it is possible to simply obtain the communication channel which preferably exerts an advantageous effect in that the liquid can be suppressed from leaking from the liquid containing chamber side.

In the liquid container, the first communication channel is formed so as to pass through the first division wall.

In this case, it is possible to simply form a communication channel allowing the small air chambers divided by the division wall to communicate with each other.

In the liquid container, the air chamber is configured to further include a third small air chamber. The second small air chamber and the third small air chamber are divided by a second division wall, and the second small air chamber and the third small air chamber communicate with each other via a second communication channel. The distance from the partition wall to the first communication channel is different from the distance from the partition wall to the second communication channel.

In this case, even if the liquid container is inverted in a state where the air-liquid interface is present near any one between the first communication channel and the second communication channel, the other communication channel between the first communication channel and the second communication channel is located away from the air-liquid interface at that time. Accordingly, it is possible to preclude the air-liquid exchange at a portion of the other communication channel. Therefore, it is possible to generate a greater negative pressure at the liquid containing chamber side than at the communication channel, and thus it is possible to stop the leakage of the liquid from the liquid containing chamber side.

In the liquid container, the first communication channel and the second communication channel are arranged at a mutually different position in a parallel direction of the first division wall and the partition wall.

In this case, not only when the liquid container is inverted upside down, but also when the liquid container is placed sideways, it is possible to preclude the air-liquid exchange at a portion of the communication channel away from the air-liquid interface between the first communication channel and the second communication channel. Therefore, it is possible to generate a greater negative pressure at the liquid containing chamber side than in the communication channel, and thus it is possible to stop the leakage of the liquid from the liquid containing chamber side.

In the liquid container, a wall surface facing the second small air chamber on the first division wall and a wall surface facing the second small air chamber on the second division wall form a rectangular shape. The first communication channel is formed at one corner in the wall surface of the first division wall, and the second communication channel is formed at one corner in the wall surface of the second division wall.

In this case, in a case of the inverted liquid container, it is possible to simply obtain the communication channel which preferably exerts an advantageous effect in that the liquid can be suppressed from leaking from the liquid containing chamber side.

In addition, according to the seventh aspect of the invention, there is provided a liquid container including a liquid containing chamber containing a liquid to be supplied to a liquid consuming unit consuming the liquid; an air chamber having an inner space partitioned via a partition wall with the liquid containing chamber; an air opening port causing the inside of the air chamber to be open to the air; and a communication port allowing the liquid containing chamber and the air chamber to communicate with each other. The air chamber includes at least a first small air chamber and a second small air chamber. The first small air chamber and the second small air chamber are divided by a first division wall. The first small air chamber has a first opening located at a surface portion other than the first division wall in the inner surface of the first small air chamber, and the second small air chamber has a second opening located at a surface portion other than the first division wall in the inner surface of the second small air chamber. The first opening and the second opening communicate with each other via a first communication channel. The first communication channel has a long groove portion formed on the wall surface of the air chamber, and a covering member arranged on the wall surface of the air chamber so as to cover the long groove portion.

In the liquid container, the length of a portion in the direction following the partition wall within the long groove portion is longer than the distance between the first opening and the second opening.

In addition, according to the seventh aspect of the invention, there is provided a liquid consuming apparatus including a liquid consuming unit consuming a liquid, and the liquid container having the above-described configurations.

In this case, when the liquid consuming apparatus is inverted, it is possible to suppress the liquid from leaking outward from the liquid container.

According to an eighth aspect of the invention, there is provided a liquid container including a liquid containing chamber containing a liquid to be supplied to a liquid consuming unit consuming the liquid; a liquid outlet port causing the liquid to flow from the inside of the liquid containing chamber to the liquid consuming unit side; a liquid injection port through which the liquid can be injected into the liquid containing chamber from outside; and at least two of first ribs disposed inside the liquid containing chamber. At least two of the first ribs are disposed further apart from a bottom surface located in the direction of gravity than the liquid injection port, and are disposed so as to extend in a second direction orthogonal to both directions of a first direction following a direction intersecting with the direction of gravity and separating from the liquid injection port and the direction of gravity. In at least one of the first ribs of at least two of the first ribs, at least a portion is located between the bottom surface and an upper surface located further in the direction opposite of the direction of gravity side than the bottom surface in the direction of gravity. At least two of the first ribs are disposed at the opposite side to the liquid outlet port when seen from the liquid injection port in the first direction.

The liquid injected through the liquid injection port flows from the liquid outlet port. Therefore, the liquid from the liquid outlet port is unlikely to flow at the position opposite side to the liquid outlet port when seen from the liquid injection port, compared to a position between the liquid injection port and the liquid outlet port. In this regard, in this case, the first ribs are disposed at the opposite side to the liquid outlet port when seen from the liquid injection port. Accordingly, following the injection of the liquid through the liquid injection port, it is possible to stir the liquid which is present at a position where the liquid is unlikely to flow. That is, since the first ribs are disposed apart from the bottom surface inside the liquid containing chamber, the liquid injected to the liquid containing chamber through the liquid injection port flows between the bottom surface and the first ribs so as to flow along the bottom surface. Then, if the flowing of the liquid is inhibited by the first ribs or the side surface intersecting with the bottom surface of the liquid containing chamber, the liquid has a tendency to flow in the direction intersecting with the bottom surface. Therefore, even if there is the unevenness in the density of the liquid contained in the liquid containing chamber, the liquid contained in the liquid containing chamber is stirred by the flowing of the liquid newly injected to the liquid containing chamber. That is, it is possible to cause the liquid to flow in the direction intersecting with the bottom surface even at the position apart from the liquid injection port in the horizontal direction. In addition, since at least two of the first ribs are formed, it is possible to increase an area capable of stirring the liquid. Accordingly, it is possible to increase the size of the liquid containing chamber. Therefore, by injecting the liquid into the liquid containing chamber, it is possible to efficiently eliminate the unevenness in the density of the liquid contained inside the liquid containing chamber.

In the liquid container, it is preferable that at least two of the first ribs be formed to protrude from the side surface extending in the first direction inside the liquid containing chamber.

In this case, it is possible to easily form the first ribs by forming the first ribs to protrude from the side surface inside the liquid containing chamber.

In the liquid container, it is preferable that at least two of the first ribs extend in the direction along the bottom surface of the liquid containing chamber.

In this case, after the flowing of the liquid flowing along the bottom surface is changed to the direction intersecting with the bottom surface by means of the first ribs extending in the direction along the bottom surface, it is possible to further cause the liquid to flow along the first ribs. Therefore, since the flowing of the liquid is suppressed from being collided, it is possible to increase the flow rate of the liquid flowing in the direction along the bottom surface.

In the liquid container, it is preferable that at least two of the first ribs extend in the direction intersecting with the bottom surface of the liquid containing chamber.

In this case, by means of the first ribs extending in the direction intersecting with the bottom surface, it is possible to inhibit the liquid from flowing along the first direction which is the separating direction from the liquid injection port. That is, it is possible to stir the liquid by generating vortex-shaped flowing in the liquid.

In the liquid container, it is preferable that at least two of the first ribs be disposed apart from each other in the first direction, and out of at least two of the first ribs, the first rib located at the position apart from the liquid injection port be far apart from the bottom surface of the liquid containing chamber, compared to the first rib located at the position close to the liquid injection port.

In this case, since the first rib located at the position apart from the liquid injection port is far apart from the bottom surface, it is possible to generate the vortex at the position apart from the bottom surface. Therefore, at the position apart from the liquid injection port, where the great unevenness in the density of the liquid is likely to occur, it is possible to stir the thickly concentrated liquid near the bottom surface with the thinly concentrated liquid near the liquid level. Accordingly, it is possible to further decrease the unevenness in the density of the liquid.

In the liquid container, it is preferable that in the first ribs, three or more of the first ribs be disposed with a distance in the first direction of the liquid containing chamber, and out of the first ribs, the first ribs located at the position apart from the liquid injection port have the larger interval between the adjacent first ribs in the first direction, compared to the first ribs located at the position close to the liquid injection port.

The vortex-shaped flowing generated as a result of the flowing inhibited by the first rib is generated between the adjacent first ribs in the first direction which is the flowing direction of the liquid. Then, if the interval between the first ribs is wider, the larger vortex-shaped flowing is generated. In this regard, in this case, since the interval between the adjacent first ribs at the position apart from the liquid injection port is wide, it is possible to generate the large vortex-shaped flowing at the position apart from the injection port. Therefore, at the position apart from the liquid injection port, where the great unevenness in the density of the liquid is likely to occur, it is possible to further cause the thinly concentrated liquid near the liquid level to flow. Accordingly, it is possible to further decrease the unevenness in the density of the liquid.

In the liquid container, it is preferable that a second rib different from at least one of the first ribs be further disposed inside the liquid containing chamber, the second rib be located at the position between the liquid injection port and the liquid outlet port in the first direction, the second rib be disposed so as to extend along the second direction, and the second rib include a first communication portion which partitions the liquid containing chamber into a first area of the liquid outlet port side and a second area of the opposite side to the liquid outlet port in the first direction, and which allows the first area and the second area to communicate with each other.

In this case, since the second rib is disposed between the liquid injection port and the liquid outlet port, it is possible to inhibit the liquid from flowing from the liquid injection port to the liquid outlet port. Therefore, for example, even if the liquid is vigorously injected through the liquid injection port, it is possible to decrease a pressure applied to the liquid near the liquid outlet port.

In the liquid container, it is preferable that at least two of the second ribs be disposed with a distance in the first direction, each of at least two of the second ribs protrude from the bottom surface to partition a portion of the bottom surface side in the liquid containing chamber into the first area and the second area, the first communication portion be disposed between the bottom surface of the liquid containing chamber and each of at least two of the second ribs, a second communication portion be disposed between the upper surface and each of at least two of the second ribs, the first area and the second area be allowed to communicate with each other by the first communication portion and the second communication portion, and the distance of each of at least two of the second ribs from the upper surface be different from each other.

In this case, if the liquid contained in the liquid containing chamber flows through the liquid outlet port, the liquid has a tendency to flow to pass through the communication portion located at a different position in the direction of gravity. Therefore, even if there is the unevenness in the density of the liquid contained in the liquid containing chamber, it is possible to cause the differently concentrated liquids to pass through the respective communication portions to flow. Furthermore, since the positions of the communication portions are different from each other, at least two of the second ribs can cause the liquids located at the different position in the direction of gravity to flow. Therefore, even if the liquid contained in the liquid containing chamber flows out and then the liquid level is lowered, it is possible for the liquid to flow by mixing the thinly concentrated liquid near the liquid level and the thickly concentrated liquid near the bottom surface.

In the liquid container, it is preferable that out of at least two of the second ribs, the second rib located at the position apart from the liquid injection port have a higher protrusion height from the bottom surface, compared to the second rib located at the position close the liquid injection port.

In this case, by increasing the protrusion height from the bottom surface of the second rib located apart from the liquid injection port, it is possible to further inhibit the liquid from flowing from the liquid injection port to the liquid outlet port. On the other hand, since the protrusion height of the second rib located at the position close to the liquid injection port, from the bottom surface is low, the liquid blocked by the second rib having the high protrusion height is allowed to flow toward the separating direction from the liquid outlet port. Therefore, it is possible to further stir the liquid in the side apart from the liquid outlet port when seen from the liquid injection port.

In the liquid container, it is preferable that at least one out of at least two of the second ribs have an extension portion extending to the opposite side to the liquid outlet port.

In this case, since the second rib has the extension portion, it is possible to decrease a possibility that the liquid injected through the liquid injection port may cross over the second rib. Therefore, it is possible to decrease the pressure applied to the liquid near the liquid outlet port.

In the liquid container, it is preferable that a reinforcement rib be disposed on the bottom surface separately from at least two of the first ribs, and a surface of the liquid injection port side in the reinforcement rib intersect with the bottom surface so as to form an acute angle toward the separating direction from the liquid injection port.

In this case, the liquid injected through the liquid injection port flows along the bottom surface. Then, the surface of the liquid injection port side in the reinforcement rib intersects with the bottom surface of the liquid containing chamber so as to form the acute angle toward the direction apart from the liquid injection port which becomes the flowing direction of the liquid. That is, since the flow channel resistance is decreased, it is possible to cause the liquid injected to the liquid containing chamber to satisfactorily flow in the separating direction from the liquid injection port, while ensuring rigidity of the liquid container.

In the liquid container, it is preferable that a reinforcement rib be disposed on the bottom surface separately from at least two of the first ribs, three or more of the first ribs be disposed with a distance in the first direction, by including two of the first ribs arranged so as to interpose the reinforcement rib therebetween in the first direction, and out of three or more of the first ribs, the interval between the first ribs arranged to interpose the reinforcement rib therebetween in the first direction be wider than the interval between the other first ribs.

In this case, by increasing the interval between the first ribs arranged to interpose the reinforcement rib therebetween, it is possible to decrease a possibility that the flowing of the liquid whose flowing direction is changed by the reinforcement rib may be inhibited by the first rib. That is, compared to a case of decreasing the interval of the first ribs arranged to interpose the reinforcement rib therebetween, it is possible to decrease the flow channel resistance flowing in the separating direction from the liquid injection port. Therefore, it is possible to cause the liquid injected to the liquid containing chamber to satisfactorily flow in the separating direction from the liquid injection port, while ensuring rigidity of the liquid container.

In addition, according to the eighth aspect of the invention, there is provided a liquid consuming apparatus including a liquid consuming unit consuming a liquid and the liquid container having the above-described configurations.

In this case, it is possible to use a liquid consuming apparatus capable of easily eliminating the unevenness in the density of the liquid contained inside the liquid containing chamber.

According to a ninth aspect of the invention, there is provided a liquid container including a liquid containing chamber containing a liquid to be supplied to a liquid consuming unit consuming the liquid; and a liquid outlet port from which the liquid from the inside of the liquid containing chamber flows to the liquid consuming unit side. The liquid containing chamber has one surface side along the longitudinal direction becoming a bottom portion, and includes a basal surface which is disposed at the bottom portion, a stepped bottom surface which has a step so as to be higher than the basal surface and is aligned with the basal surface in the longitudinal direction, and a stepped side surface where an upper end side intersects with the stepped bottom surface while a lower end side intersects with the basal surface. The liquid outlet port is disposed on the basal surface side in the longitudinal direction of the bottom portion.

In this case, in a case where the liquid containing chamber is in a tilted state such that the stepped bottom surface side becomes higher than the basal surface side, it is possible to cause the liquid to flow from the stepped bottom surface side to the basal surface side and to flow out from the liquid outlet port. On the other hand, in a case where the liquid containing chamber is in a tilted state such that the basal surface side becomes higher than the stepped bottom surface side, the liquid is suppressed from flowing to the stepped bottom surface side by the stepped side surface.

Then, the liquid outlet port is disposed on the basal surface side in the longitudinal direction of the bottom portion. Accordingly, it is possible to cause the liquid blocked in the basal surface by the stepped side surface to flow out from the outlet port. That is, when the liquid container is in a tilted state, it is possible to avoid a possibility that all of the liquid inside the liquid containing chamber may not flow out and may remain at the bottom portion. Therefore, even if the liquid container is in a tilted state, it is possible to decrease the amount of the liquid remaining at the bottom portion of the liquid containing chamber.

In the liquid container, the basal surface has the shorter length in the longitudinal direction than the stepped bottom surface, and the liquid outlet port is disposed at a position which is an end portion side of the basal surface in the longitudinal direction.

In this case, the basal surface has the shorter length in the longitudinal direction than that of the stepped bottom surface. Thus, when the basal surface is in a tilted state, it is possible to reduce the amount of the remaining liquid which has not flowed out from the liquid outlet port disposed at a position which is the end portion side of the basal surface in the longitudinal direction.

In the liquid container, the length of the stepped side surface in the up and down direction is shorter than the length of the basal surface and the stepped bottom surface. The basal surface and the stepped side surface are disposed at a first end side of the bottom portion in the longitudinal direction, and the liquid outlet port is disposed at the position which is the first end side of the basal surface in the longitudinal direction.

In this case, if the liquid containing chamber is in a tilted state such that the first end side in the longitudinal direction is high, as the stepped side surface is arranged closer to the first end side, the upper end position of the stepped side surface is higher. Accordingly, it is possible to maintain a high liquid level position near the liquid outlet port disposed at the first end side. Therefore, even if the tilt angle of the liquid containing chamber is increased, it is possible to cause the liquid blocked in the basal surface by the stepped side surface to flow out from the liquid outlet port.

In the liquid container, in the bottom portion, at least two or more of the stepped bottom surfaces are disposed in a step shape along the longitudinal direction.

In this case, in the bottom portion, at least two or more of the stepped bottom surfaces are disposed in the step shape along the longitudinal direction. Accordingly, by a portion of the formed step in volume, it is possible to reduce the amount of the liquid remaining in the stepped bottom surface side rather than the stepped side surface due to the tilt. Therefore, when the liquid containing chamber is in the tilted state, it is possible to reduce the amount of the remaining liquid which has not flowed out from the liquid outlet port.

In the liquid container, in the liquid containing chamber, the direction intersecting both of the longitudinal direction and the up and down direction is the short direction, the stepped bottom surface aligned with the basal surface in the longitudinal direction is a first stepped bottom surface, and the stepped side surface whose upper end side intersects with the first stepped bottom surface is a first stepped side surface. Then, the liquid containing chamber further has a second stepped bottom surface which has a step so as to be higher than the basal surface and to be lower than the first stepped bottom surface and which is aligned with the basal surface in the short direction, and a second stepped side surface where the upper end side intersects with the second stepped bottom surface while the lower end side intersect with the basal surface. The liquid outlet port is disposed on the basal surface side of the bottom portion in the short direction.

In this case, when the liquid containing chamber is in the tilted state such that the basal surface side is higher than the second stepped bottom surface side in the short direction, the second stepped side surface controls the flowing of the liquid to the second stepped bottom surface side. Then, since the liquid outlet port is disposed on the basal surface side of the bottom portion in the short direction, it is possible to cause the liquid blocked in the basal surface side by the second stepped side surface to flow out from the liquid outlet port. Therefore, even when the liquid containing chamber is in the tilted state in the short direction, it is possible to reduce the amount of the liquid remaining in the bottom portion.

In the liquid container, a liquid collecting recess portion which is open on the basal surface is recessed at the bottom portion. In the opening portion of the liquid collecting recess portion, the length in the short direction intersecting both of the up and down direction and the longitudinal direction is shorter than the length of the basal surface. The liquid outlet port is disposed at a position corresponding to the inner side surface of the liquid collecting recess portion.

In this case, it is possible to cause the liquid to flow out through the liquid outlet port by collecting the liquid blocked in the basal surface side by the stepped side surface in the liquid collecting recess portion. Therefore, it is possible to reduce the amount of the liquid caused to remain in the basal surface side by the stepped side surface in the bottom portion of the liquid containing chamber.

The liquid container further includes an injection port arranged above the basal surface in order to inject the liquid to the liquid containing chamber.

In this case, the injection port is arranged above the basal surface, which is located at the lower position than that of the stepped bottom surface. Accordingly, when injecting the liquid, the liquid rarely overflows.

In the liquid container, the basal surface is tilted such that the liquid outlet port side is low.

In this case, the basal surface is tilted such that the liquid outlet port side is low. Accordingly, it is possible to cause the liquid blocked in the basal surface side by the stepped side surface to flow to the liquid outlet port side along the tilt. Therefore, even when the liquid containing chamber is in the tilted state, it is possible to reduce the amount of the liquid remaining in the bottom portion of the liquid containing chamber.

According to the ninth aspect of the invention, there is provided a liquid consuming apparatus including a liquid consuming unit consuming a liquid and the liquid container having the above-described configurations.

In this case, even when the liquid consuming apparatus is in the tilted state, it is possible to reduce the amount of the liquid remaining in the bottom portion of the liquid containing chamber.

BRIEF DESCRIPTION OF THE DRAWINGS

The invention will be described with reference to the accompanying drawings, wherein like numbers reference like elements.

FIG. 20 is a Table indicating the maximum fluctuation range of a liquid level and an ink supply state.

FIG. 21 is a left side view of an ink tank.

FIG. 22 is a schematic diagram of an ink tank.

DESCRIPTION OF EXEMPLARY EMBODIMENTS

First Embodiment

Hereinafter, a first embodiment of a recording apparatus which is an example of a liquid consuming apparatus will be described with reference to the accompanying drawings.

Figure 1:
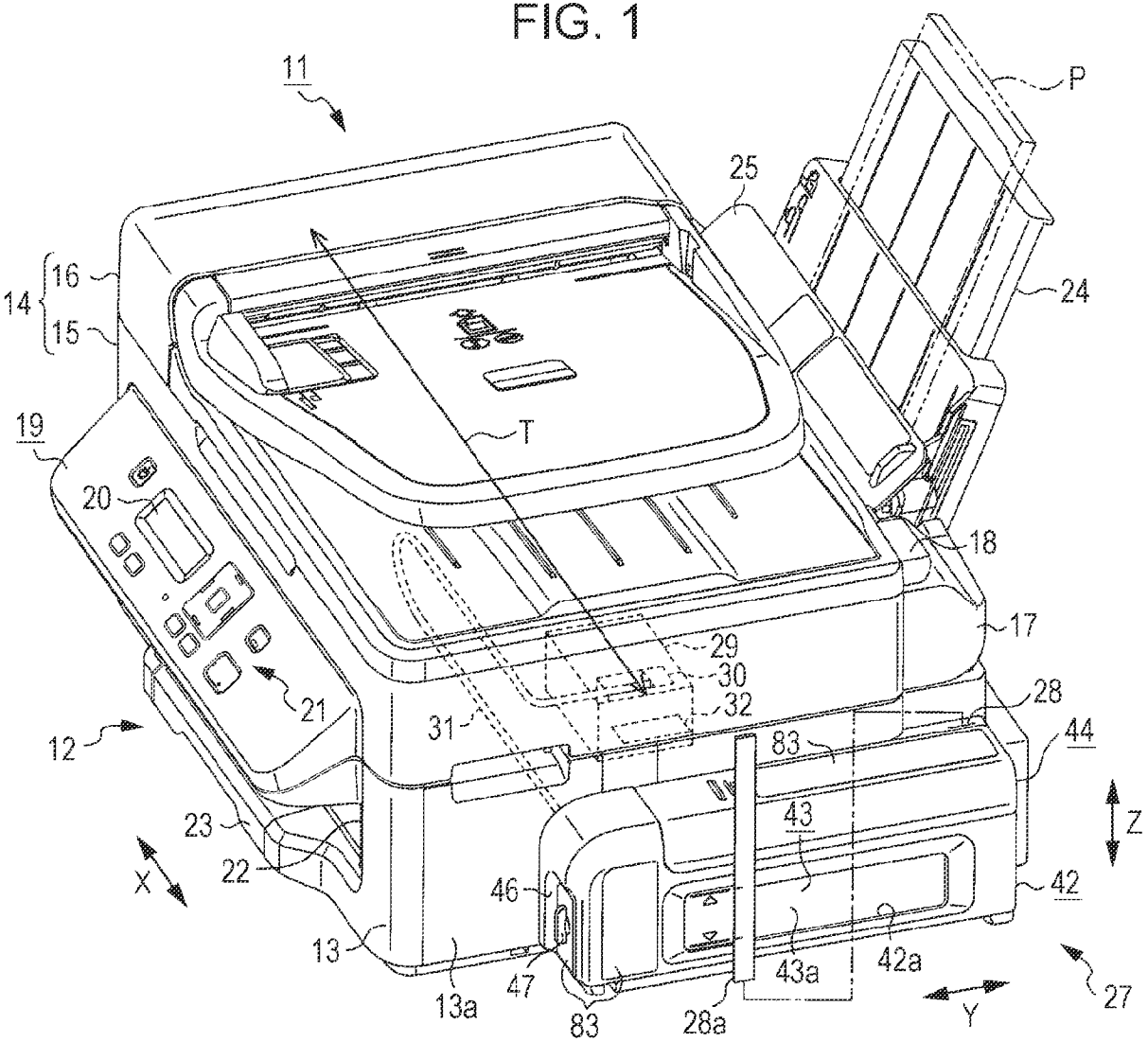
FIG. 1 is a perspective view of a multi-function printer in a first embodiment.

As illustrated in FIG. 1, a multi-function printer 11 includes a recording apparatus 12 and a scanner unit 14 mounted on an apparatus main body 13, which is an example of a housing of the recording apparatus 12.

The recording apparatus 12 can perform recording on a sheet P which is an example of a recording medium, while the scanner unit 14 can read out an image recorded on a manuscript. In the description, the direction opposite to the direction of gravity is referred to as an upward direction, and the direction of gravity is referred to as a downward direction. In addition, the direction in the upward direction and downward direction are illustrated by an vertical direction Z, which is an example of the vertical direction.

The scanner unit 14 includes a scanner main body 15, a portion of which is pivotably connected to the apparatus main body 13 of the recording apparatus 12, and a transportation unit 16 arranged above the scanner main body 15. The scanner main body 15 is attached to the recording apparatus 12 via a rotation mechanism 17 such as a hinge disposed at one end side thereof, so as to be displaceable between a closing position for covering the upper side of the apparatus main body 13 and an opening position for opening the upper side of the apparatus main body 13. In addition, the transportation unit 16 is attached to the scanner main body 15 via a rotation mechanism 18 such as a hinge disposed at one end side thereof, so as to be displaceable between a position for covering the upper side of the scanner main body 15 and a position for opening the upper side of the scanner main body 15.

In the following description, in the multi-function printer 11, the side in which the rotation mechanisms 17 and 18 are disposed is referred to as a rear side or rear surface side, and the opposite side is referred to as a front side. In addition, a forward direction and rearward direction are illustrated as a front/rear direction Y. Then, in the scanner unit 14, the scanner main body 15 and the transportation unit 16, a front end side thereof is rotatable upward.

Furthermore, the direction in the right direction and the left direction when viewed from the front side to the rearward direction (in a front view) is illustrated as a left/right direction X. The left/right direction X, the front/rear direction Y and the vertical direction Z intersect with each other (orthogonal in the present embodiment). Therefore, the left/right direction X and the front/rear direction Y in the embodiment are directions in the horizontal direction.

An operation panel 19 is arranged in the front surface side of the multi-function printer 11. The operation panel 19 includes a display portion (for example, a liquid crystal display) 20 for displaying a menu screen, and various operation buttons 21 disposed around the display portion 20.

A discharge port 22 for discharging the sheet P from the inside of the apparatus main body 13 is open at a position below an operation panel 19 in the recording apparatus 12. In addition, a sheet discharge tray 23 which can be drawn out is accommodated below the discharge port 22 in the recording apparatus 12.

A drawer type medium support body 24 on which a plurality of the sheets P can be loaded and which has a substantially rectangular plate-shape is attached to the rear surface side of the recording apparatus 12. In addition, an inlet port cover 25 which is rotatable about the base end side (front end side in the embodiment) is attached to the rear portion of the scanner main body 15.

In addition, a tank unit 27, which is an example of a liquid container unit containing an ink (example of a liquid), is fixedly attached to an attachment surface 13*a* which is the outside portion and the right side surface of the apparatus main body 13. That is, the tank unit 27 is arranged outside of the apparatus main body 13. In addition, a scale accommodation portion 28 accommodating a scale 28*a* is disposed at a position between the apparatus main body 13 and the tank unit 27, which is the position near the rear side of the attachment surface 13*a*. The scale accommodation portion 28 is formed to be recessed on the attachment surface 13*a* so as to form a groove shape in a long rectangular shape in the vertical direction Z with the depth in the left/right direction X corresponding to the thickness of the scale 28*a* and the width in the front/rear direction Y corresponding to the width of the scale 28*a*.

In contrast, a carriage 29 held in a reciprocally movable state within a movement area T in the left/right direction X, which is the main scanning direction, and a relay adapter 30 mounted on the carriage 29 are disposed inside the apparatus main body 13. One end side of a flexible tube 31, which is an example of a first flow channel, is connected to the tank unit 27, and the other end side is connected to the relay adapter 30. In addition, a liquid ejecting head 32, which is an example of a liquid consuming unit which can eject the ink supplied from the tank unit 27, is supported in the lower surface side of the carriage 29. That is, the tank unit 27 is arranged outside of the movement area T of the liquid ejecting head 32 in the left/right direction X.

The ink contained in the tank unit 27 is supplied to the liquid ejecting head 32 via the tube 31 by utilizing a water head difference. The material of the tube 31 can be a soft material, a hard material, or configured from both. Then, the ink supplied to the liquid ejecting head 32 is ejected onto the sheet P transported by a transport mechanism (not illustrated) to perform recording (an example of liquid consumption).

Figure 2:
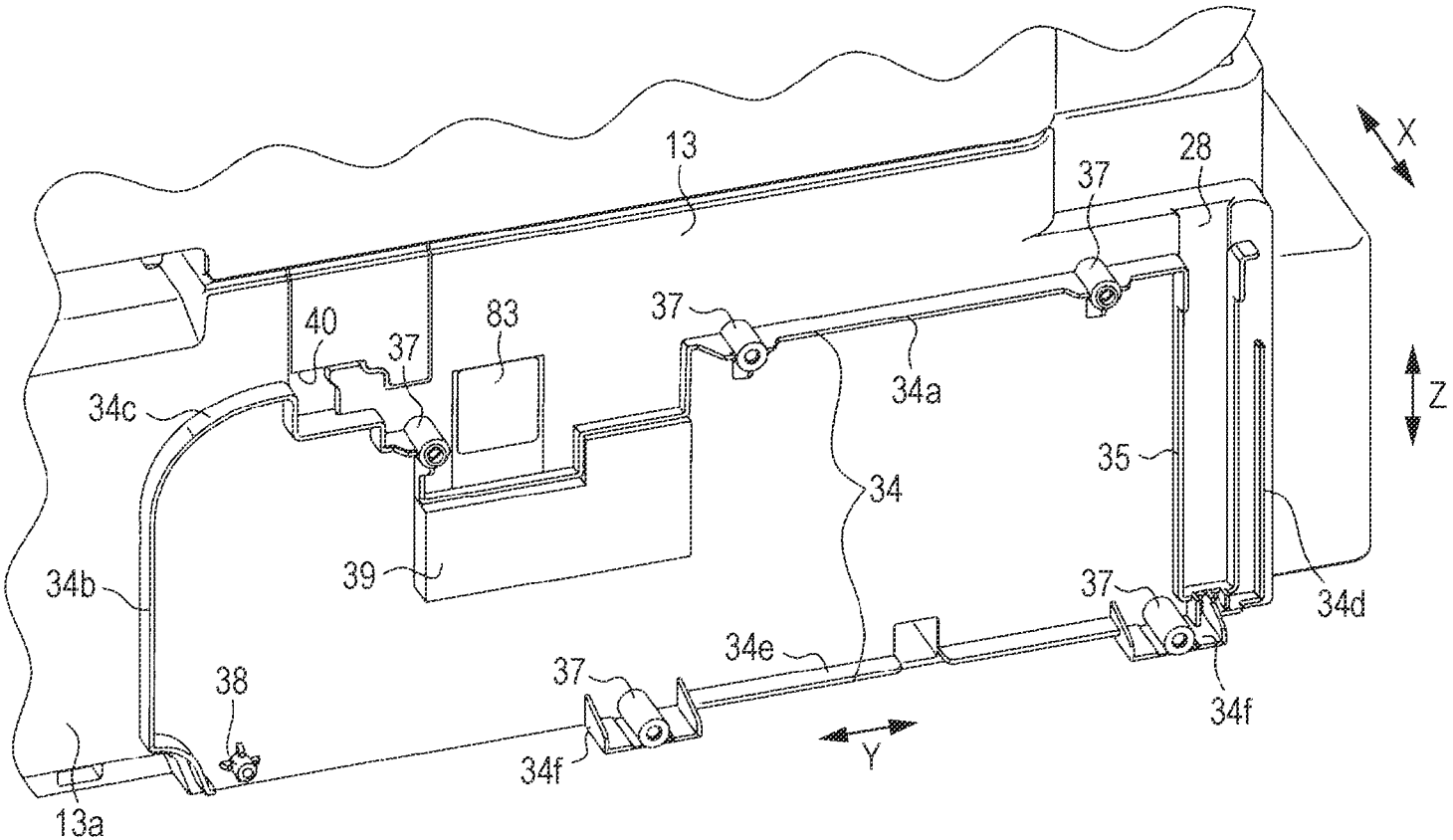
FIG. 2 is a cutaway perspective view of an attachment surface to which a tank unit is attached in an apparatus main body.

As illustrated in FIG. 2, a first rib 34 and a second rib 35 are formed so as to protrude from the attachment surface 13*a*, at an attachment position in the attachment surface 13*a* to which the tank unit 27 is attached. The first rib 34 is formed following the outer shape of the tank unit 27. In addition, the second rib 35 is formed along the edge of the scale accommodation portion 28.

The first rib 34 has an upper rib portion 34*a* located at the upper end side of the attachment surface 13*a* and extending in the front/rear direction Y, a front rib portion 34*b* located at the further front side than the upper rib portion 34*a* and extending in the vertical direction Z, and a curved rib portion 34*c* connecting the front end of the upper rib portion 34*a* and the upper end of the front rib portion 34*b*. Furthermore, the first rib 34 has a rear rib portion 34*d* located at the further rear side than the upper rib portion 34*a* and extending in the vertical direction Z, and a lower rib portion 34*e* located at the lower end side of the attachment surface 13*a* and extending in the front/rear direction Y.

The upper rib portion 34*a* is formed in a shape where a plurality of locations is bent, such that the front side portion is located further below than the rear side portion. The rear end is connected to the upper end of the front side portion of the second rib 35 extending in the vertical direction Z of the second rib 35. On the other hand, the rear side portion, which extends in the vertical direction Z, has an end portion that extends rearward from the scale accommodation portion 28, and that is spaced apart from the upper end of the rear rib portion 34*d* in the vertical direction Z. Furthermore, whereas in the first rib 34 the lower end of the rear rib portion 34*d* and the rear end of the lower rib portion 34*e* are connected to each other, the lower end of the front rib portion 34*b* and the front end of the lower rib portion 34*e* are spaced apart by a gap therebetween. Furthermore, reinforcement rib portions 34*f*, which protrude greatly from the attachment surface 13*a* compared to the intermediate position of the lower rib portion 34*e*, are respectively formed at the front side position and the rear side position of the lower rib portion 34*e*.

In addition, in the first rib 34, at least one (five in the embodiment) screw boss portion 37 to which a screw 36 (refer to FIG. 12) can be screwed, which is an example of a fixing member, is formed to protrude further from the attachment surface 13*a* than the upper rib portion 34*a* and the lower rib portion 34*e*. That is, screw boss portions 37 are formed at the front side position, the rear side position, and the intermediate position between the front side position and the rear side position, in the upper rib portion 34*a*. Furthermore, screw boss portions 37 are formed at the reinforcement rib portions 34*f* in the lower rib portion 34*e*. In addition, at the rear side position of the front rib portion 34*b*, a boss portion 38 protruding from the attachment surface 13*a* is formed separated from the lower end of the front rib portion 34*b* by a space in the front/rear direction Y.

As illustrated in FIG. 2, the attachment surface 13*a* has adhered thereto an absorbent material 39 that is adjacent to the upper rib portion 34*a* from the lower side and that is thicker than the upper rib portion 34*a* in the left/right direction X. Furthermore, a substantially rectangular-shaped communication hole 40 allowing the inside and outside of the apparatus main body 13 to communicate with each other is formed at the further upper side position than the front end portion of the upper rib portion 34*a* in the attachment surface 13*a*. The tube 31 is inserted into the communication hole 40.

Hereinafter, the tank unit 27 illustrated in FIG. 3 will be described.

The left/right direction X, the front/rear direction Y and the vertical direction Z refer to each direction in a state where the tank unit 27 is attached to the apparatus main body 13. That is, the tank unit 27 forms a substantially rectangular parallelepiped shape which is larger in the front/rear direction Y compared to the left/right direction X and the vertical direction Z.

Figure 3:
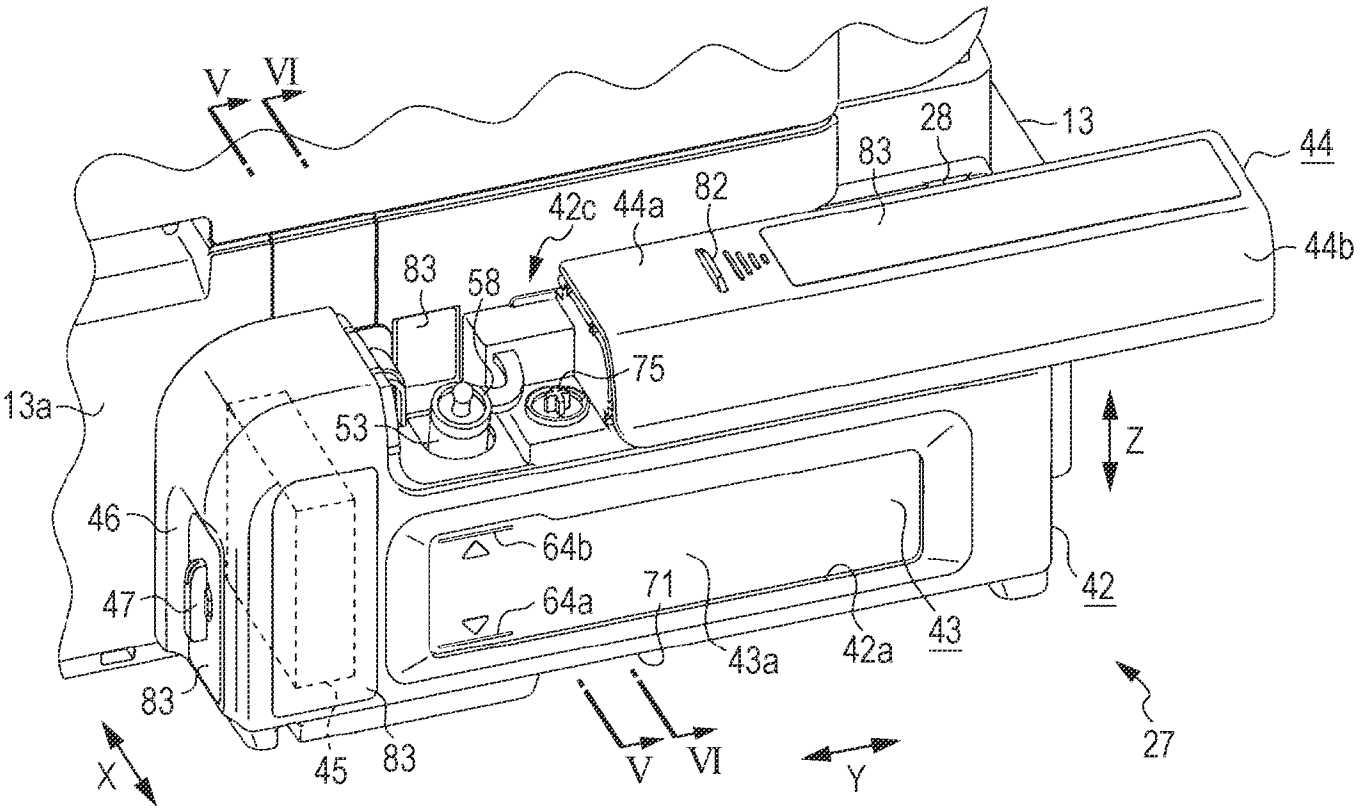
FIG. 3 is a perspective view seen from a right front position of a tank unit.

As illustrated in FIG. 3, the tank unit 27 includes a tank case 42, which is an example of a protection case, and an ink tank 43, which is an example of a liquid container to be accommodated inside the tank case 42. A substantially rectangular-shaped window portion 42*a* allowing the inside and outside the tank case 42 to communicate with each other is formed on a wall portion forming an outer surface (in this case, the right side surface) in the front/rear direction Y and the vertical direction Z in the tank case 42. Therefore, when accommodated inside the tank case 42, a portion of the ink tank 43 can be visually recognized through the window portion 42*a* from the outside of the tank case 42. The periphery of the window portion 42*a* in the tank case 42 is chamfered. Furthermore, the tank unit 27 includes a cover 44 which is slidable in the front/rear directions Y with respect to the tank case 42, and a choke valve 45 to be accommodated inside the tank case 42.

A concave portion 46 is formed on the front surface of the tank case 42, and a valve lever 47, which is an example of an operation portion for operating the choke valve 45, is disposed inside the concave portion 46. The choke valve 45 squeezes the tube 31 by following a user's operation of the valve lever 47 to block the ink supply from the ink tank 43 to the liquid ejecting head 32.

Next, the ink tank 43 will be described.

Figure 4:
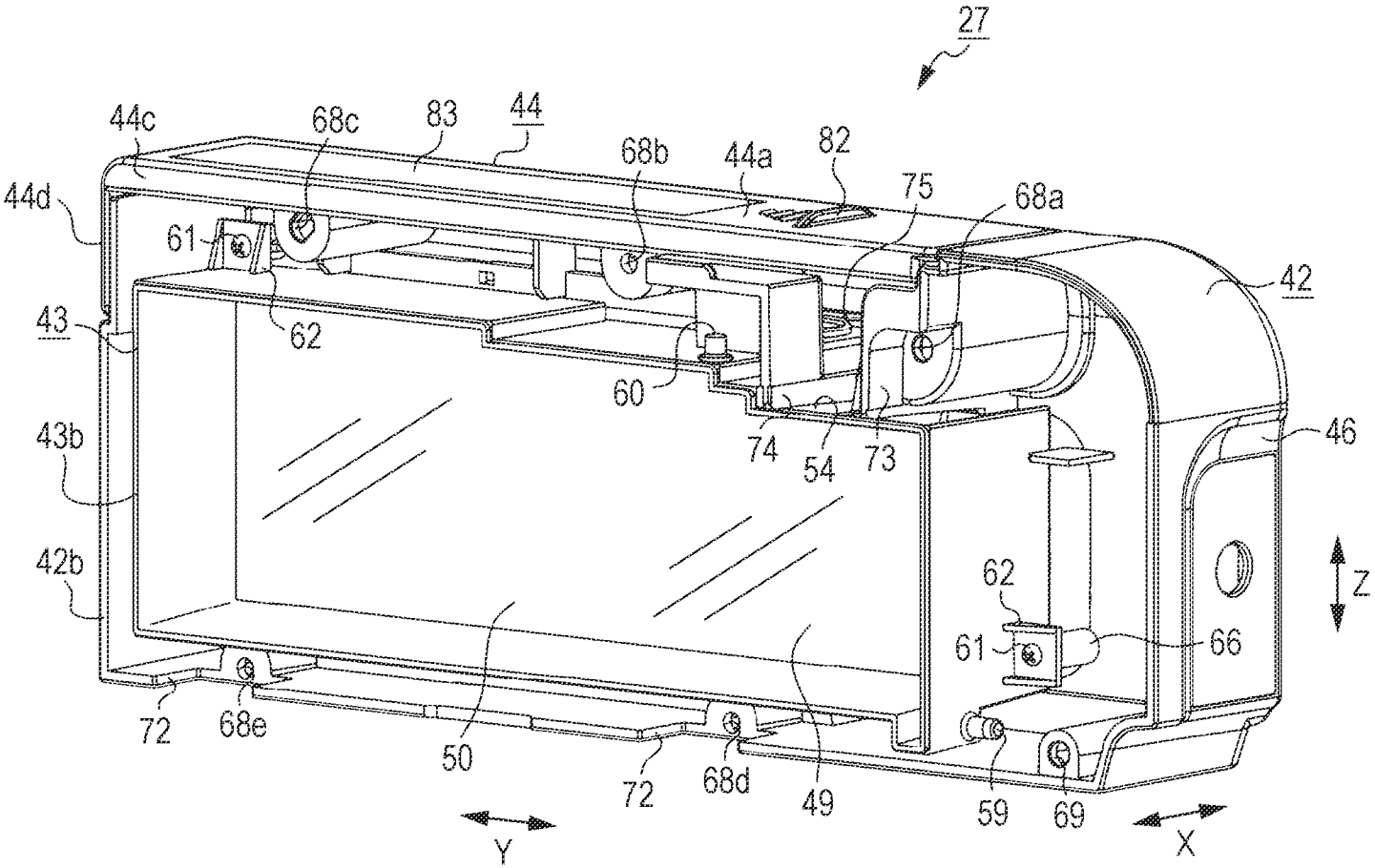
FIG. 4 is a perspective view seen from a left front position of a tank unit.
Figure 5:
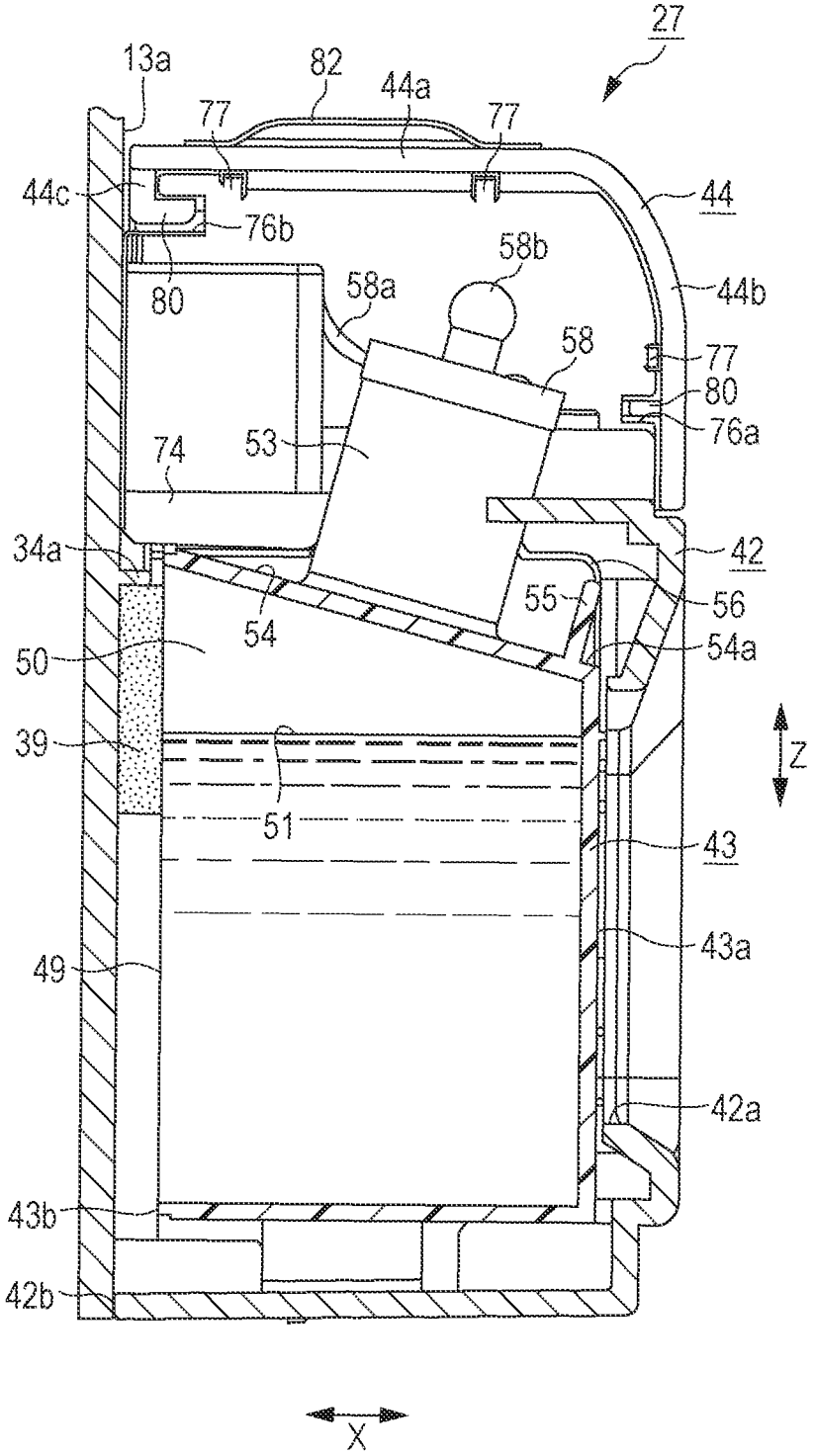
FIG. 5 is a cross-sectional view taken along the line V-V in FIG. 3.

As illustrated in FIGS. 4 and 5, the ink tank 43 has five integrally molded surfaces, and a film 49 adhered to a tank opening portion 43*b* to form an ink chamber 50, which is an example of a liquid containing chamber containing the ink. The ink chamber 50 forms a substantially rectangular parallelepiped shape in which the width in the front/rear direction Y is larger than the height in the vertical direction Z and the depth in the left/right direction X.

In addition, the ink tank 43 is made of a transparent or translucent resin, and allows the ink contained inside the ink chamber 50 and a liquid level 51 of the ink to be visually recognized from the outside of the ink tank 43. Therefore, if the ink tank 43 is mounted on the tank case 42, the ink contained in the ink chamber 50 can be visually recognized from the outside through the window portion 42*a* of the tank case 42.

That is, as illustrated in FIGS. 3 and 5, an area corresponding to the window portion 42*a* on the right side surface of the ink tank 43 is formed toward the right direction (one direction), and functions as a visible surface 43*a* which allows the liquid level 51 of the ink contained in the ink chamber 50 to be visually recognized from the right direction. In the visible surface 43*a*, the width in the front/rear direction Y is larger than the height in the vertical direction Z.

Figure 6:
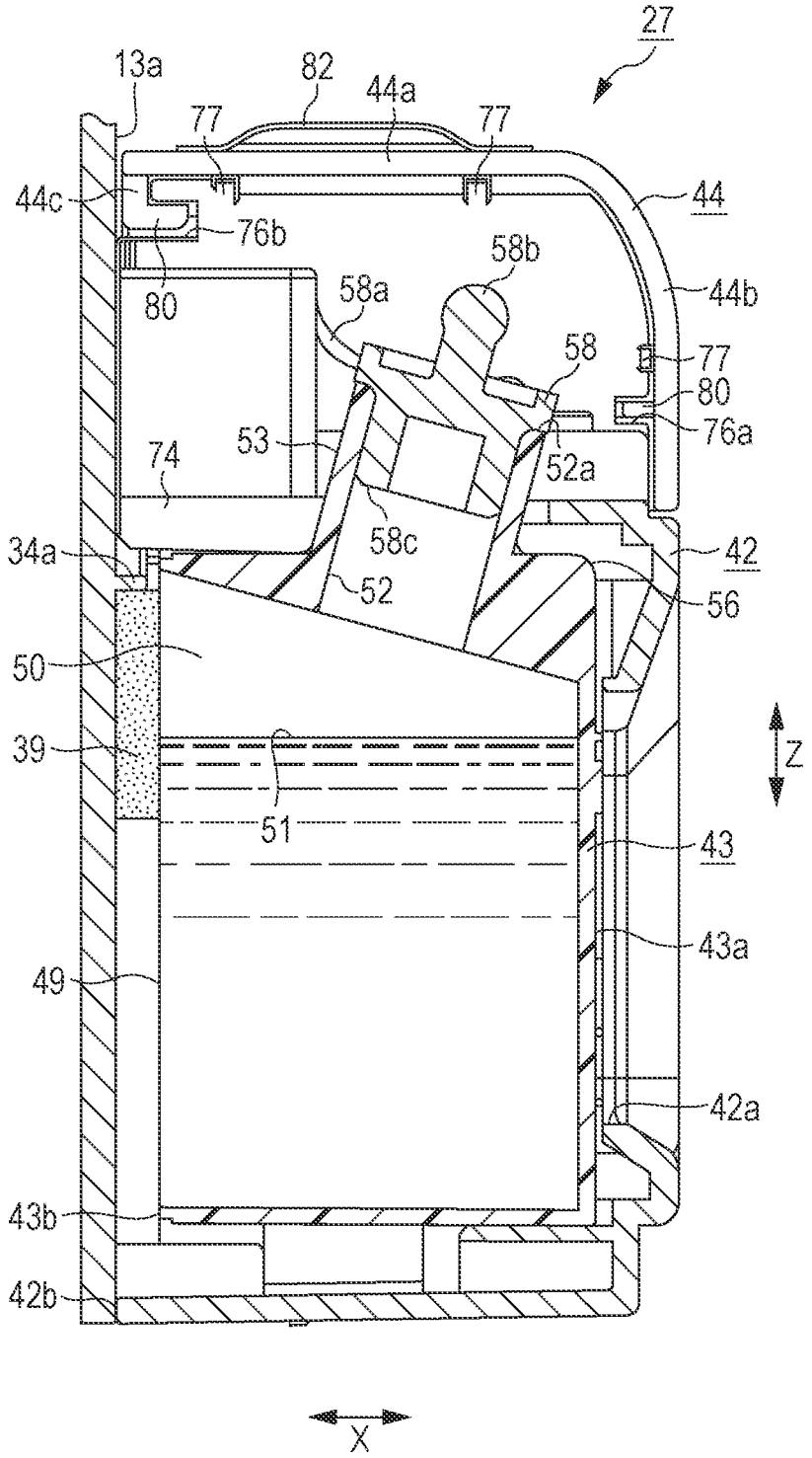
FIG. 6 is a cross-sectional view taken along the line VI-VI in FIG. 3.

As illustrated in FIG. 6, an injection port 52, which is an example of a liquid injection port through which the ink can be injected into the ink chamber 50, is formed on the upper portion of the ink tank 43. The injection port 52 is formed further to one side position (front side in the embodiment) than the intermediate position in the front/rear direction Y in the ink tank 43, and further one side position (front side in the embodiment) than the intermediate position in the front/rear direction Y of the visible surface 43*a*. Furthermore, the injection port 52 is formed so as to protrude outward from the ink chamber 50. The injection port 52 is opened in the front end of a cylinder portion 53 that protrudes in an upward right direction, which is non-orthogonal to the vertical direction Z and which is more in the upward direction than is the horizontal direction. Therefore, an end surface 52*a* of the injection port 52 is non-orthogonal to the vertical direction Z.

In addition, when the tank unit 27 is attached to the apparatus main body 13, the cylinder portion 53 tilts in a direction in which the front end (end surface 52*a*) of the cylinder portion 53 separates from the attachment surface 13*a* and approaches the visible surface 43*a*. Therefore, the end surface 52*a* of the injection port 52 is tilted toward a direction separating from the apparatus main body 13 of the recording apparatus 12.

Figure 7:
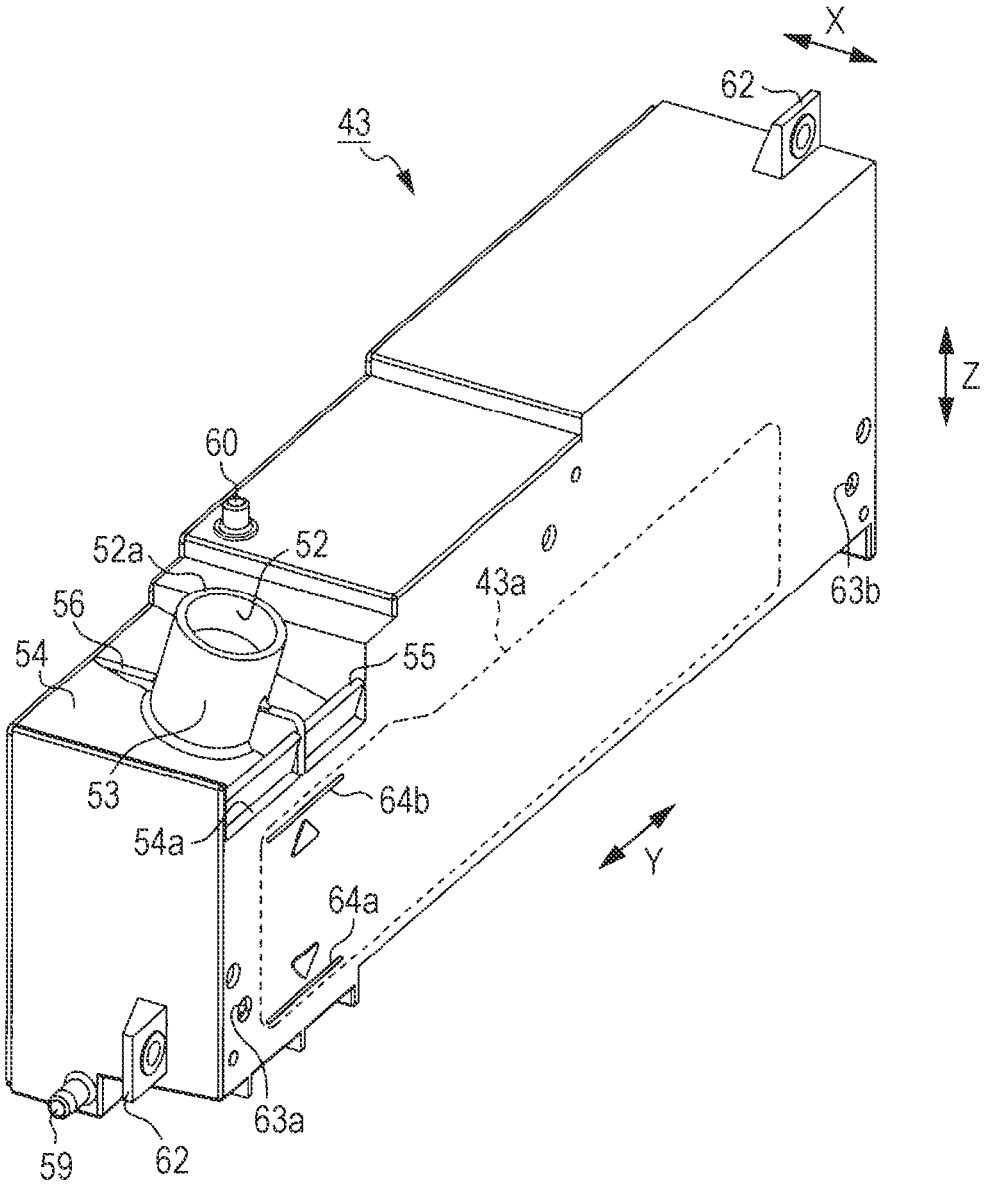
FIG. 7 is a perspective view seen from a right front position of an ink tank.

As illustrated in FIGS. 5 and 7, an injection port forming surface 54, where the injection port 52 and the cylinder portion 53 are formed in the upper portion of the ink tank 43, is formed toward an upward right direction (one direction), which intersects with the vertical direction Z. That is, the injection port forming surface 54 is tilted so as to be non-orthogonal to the vertical direction Z and such that the visible surface 43*a* is located at a lower position than the position of a base end portion of the cylinder portion 53.

In the embodiment, the tilt of the injection port forming surface 54 is the same as the tilt of the cylinder portion 53 with respect to the vertical direction Z. Furthermore, at the further upper position than the visible surface 43*a*, at a position between the injection port 52 and the visible surface 43*a*, a convex barrier portion 55, which is an example of a plate-shaped barrier portion and of a protrusion portion, is formed to protrude from the injection port forming surface 54. The convex barrier portion 55 is tilted toward the same direction as the cylinder portion 53 (injection port 52), and is orthogonal to the injection port forming surface 54. Furthermore, the convex barrier portion 55 is formed to protrude from a position closer to the cylinder portion 53 than the right end which is the visible surface 43*a* side of the injection port forming surface 54. The right end of the injection port forming surface 54 is a stepped portion 54*a* located at the further upper position than the visible surface 43*a*, at a position between the convex barrier portion 55 and the visible surface 43*a*.

Figure 8:
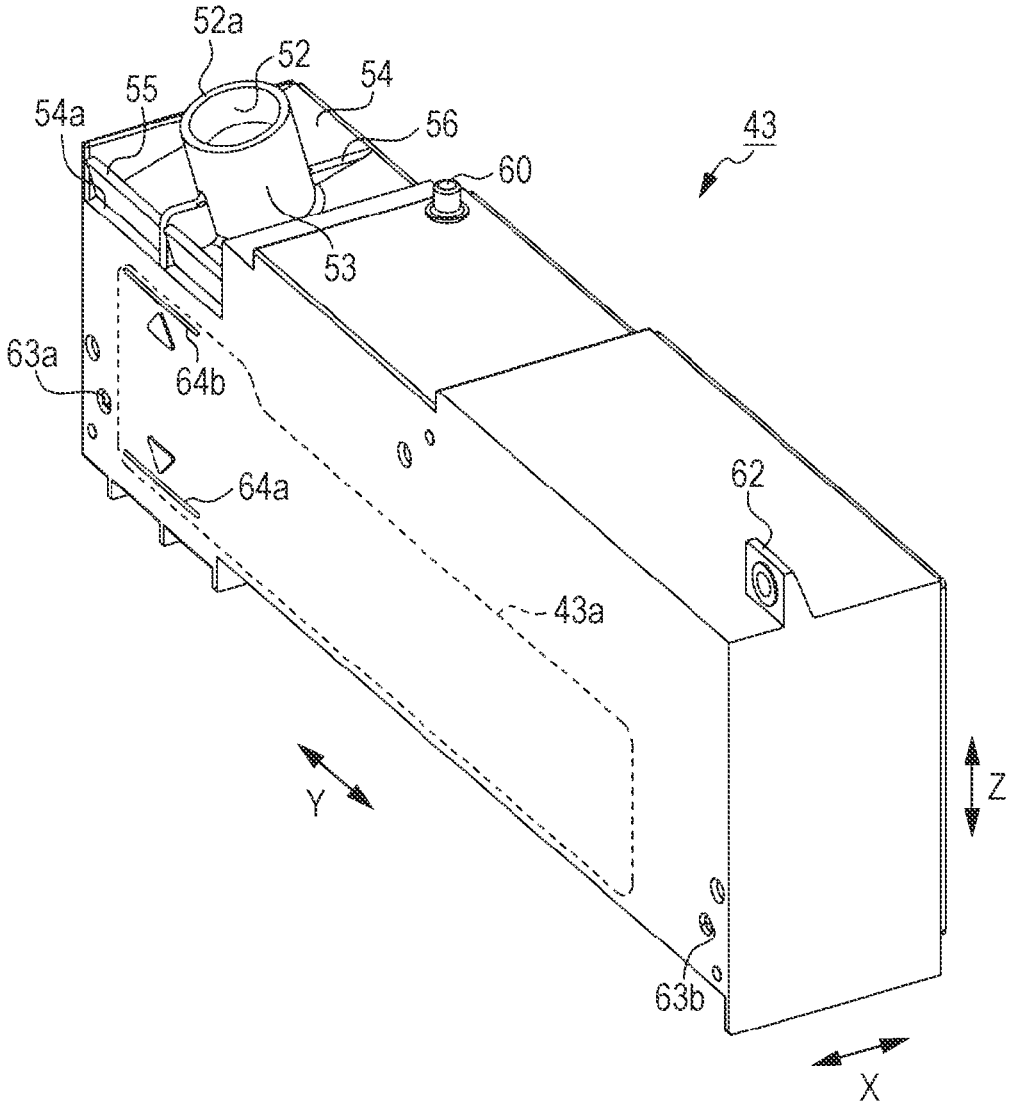
FIG. 8 is a perspective view seen from a right rear position of an ink tank.

As illustrated in FIGS. 7 and 8, the injection port forming surface 54 is formed in a descending slope shape from the injection port 52 to the convex barrier portion 55 in the upper portion of the ink tank 43 and is located at a lower position in the vertical direction Z than both adjacent sections in the front/rear direction Y. That is, both the front and rear sides of the injection port forming surface 54 are interposed between walls. Therefore, when the ink leaks from the injection port 52, the leaked ink (as a leaked liquid) flows down onto the injection port forming surface 54. Accordingly, the injection port forming surface 54 functions as a flow channel for the leaked ink, and the convex barrier portion 55 is located on the flow channel of the leaked ink.

In addition, on the injection port forming surface 54, rib portions 56 respectively extending in the left/right direction X at the left and right sides of the cylinder portion 53 are formed to interpose the cylinder portion 53 therebetween from both sides in the left/right direction X by being located on the same line. Therefore, the injection port forming surface 54 is divided into front and rear portions by the ribs 56.

Figure 9:
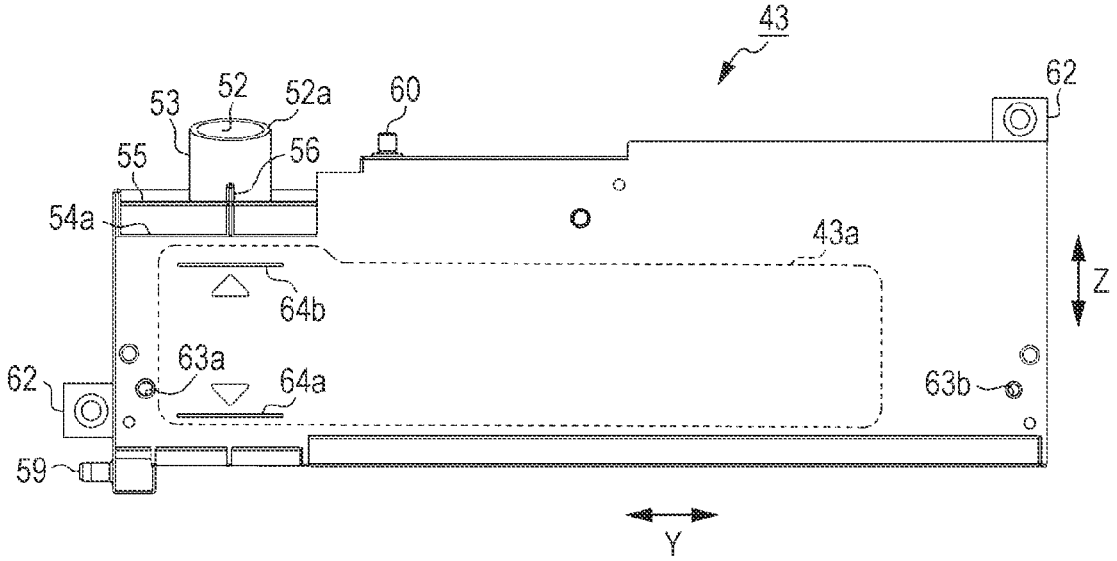
FIG. 9 is a right side view of an ink tank.
Figure 10:
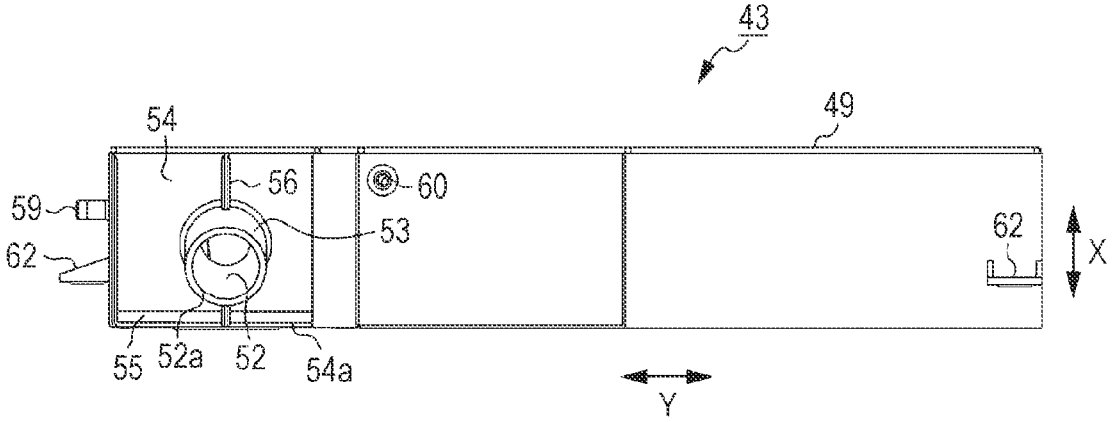
FIG. 10 is a top view of an ink tank.

Furthermore, as illustrated in FIGS. 9 and 10, the width of the convex barrier portion 55 and the stepped portion 54*a* in the front/rear direction Y, which intersects the downward right direction (an example of a leaking direction), which is the flowing direction of the leaked ink, is wider than the width of the injection port 52 and the cylinder portion 53.

As illustrated in FIGS. 5 and 6, a closing member 58 capable of closing the injection port 52 is detachably attached to the front end of the cylinder portion 53. One end of an anchoring portion 58*a* is connected to the tank case 42, and the other side is connected to the closing member 58. Furthermore, in the closing member 58, a knob portion 58*b* is formed in the upper side, and a circular tube-shaped fitting portion 58*c* is formed in the lower side and fitted to the injection port 52.

In addition, as illustrated in FIG. 9, an outlet port 59, which is an example of a liquid outlet port from which the ink contained in the ink chamber 50 flows to the tube 31, is formed at the lower position of the front surface (left side in FIG. 9) of the ink tank 43. The outlet port 59 is formed further to one side position (front side in the embodiment) of the ink tank 43 than the intermediate position in the front/rear direction Y, and is further to one side position (front side in the embodiment) than the intermediate position in the front/rear direction Y of the visible surface 43*a*. Furthermore, an air intake port 60 is formed in the ink tank 43 for letting air into the ink chamber 50 from position higher up than the liquid level 51 of the ink, while ink is contained in the ink chamber 50. That is, when the ink contained in the ink chamber 50 decreases by being consumed through the liquid ejecting head 32, the air intake port 60 lets in ambient air into the ink chamber 50 from a position higher up than the liquid level 51.

The ink tank 43 has at least one (two in the embodiment) tank locking portion 62 which locks a mounting screw 61 (refer to FIG. 4), which is screwed into place when the ink tank 43 is fixedly attached to the tank case 42. In addition, concave positioning portions 63*a* and 63*b*, which are examples of at least one (two in the embodiment) positioning portion, are formed on the right side surface of the ink tank 43. Between the concave positioning portions 63*a* and 63*b*, one concave positioning portion 63*a* (located at the front side in the embodiment) is formed in an elongated hole shape which is long in the front/rear direction Y.

In addition, a lower limit scale 64*a*, which is an example of a scale, and an upper limit scale 64*b*, which is an example of the scale, are formed to protrude at the front side position in the visible surface 43*a*. The lower limit scale 64*a* and the upper limit scale 64*b* are formed further to one side (front side in the embodiment) than the intermediate position in the front/rear direction Y in the visible surface 43*a*. Incidentally, in the window portion 42*a*, in order not to hide the upper limit scale 64*b*, the width in the vertical direction Z in the front side is wider than the width in the vertical direction Z in the rear side (refer to FIG. 3). Therefore, similarly to the window portion 42*a*, the visible surface 43*a* is also configured such that the width in the vertical direction Z of the front side is wider than the width in the vertical direction Z of the rear side.

The lower limit scale 64*a* is formed further to the outlet port 59 side than the intermediate position in the front/rear direction Y, and at a position further upper than the outlet port 59. On the other hand, the upper limit scale 64*b* is formed further toward the injection port 52 side than the intermediate position in the front/rear direction Y, and is at a position lower than the injection port 52 and the air intake port 60. The outlet port 59 and the injection port 52 are formed at the same side as each other (front side) in the front/rear direction Y. Therefore, the lower limit scale 64*a* is formed further to the injection port 52 side than the intermediate position in the front/rear direction Y, is at a position lower than the injection port 52 and the upper limit scale 64*b*. Accordingly, the visual surface 43*a* has a plurality of scales spaced apart in the vertical direction Z at the same side in the front/rear direction Y.

The lower limit scale 64*a* is a scale indicating a lower limit amount as a reference for injecting the ink to the ink chamber 50. In addition, the upper limit scale 64*b* is a scale indicating an upper limit amount of the ink to be injected through the injection port 52 and contained inside the ink chamber 50.

Next, the tank case 42 will be described.

Figure 11:
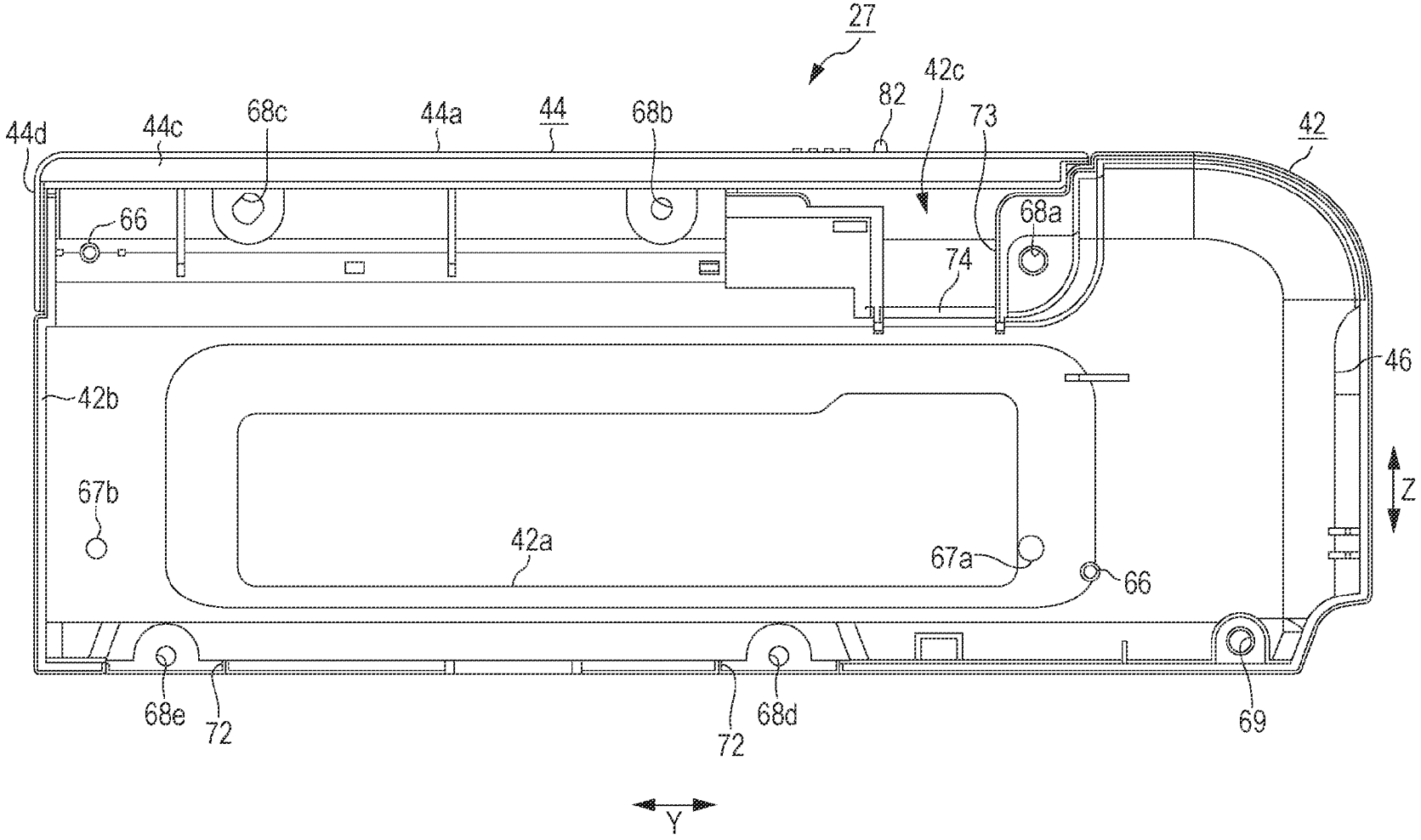
FIG. 11 is a left side view of a tank case and a cover.

As illustrated in FIGS. 4 and 11, the tank case 42 has five integrally molded surfaces and a case opening portion 42*b*, which is an example of an opening portion, at the left side which is the apparatus main body 13 side when the tank case 42 is fixedly attached to the recording apparatus 12. The tank case 42 is formed to be larger than the ink tank 43, and the case opening portion 42*b* is larger than the ink tank 43 in the front/rear direction Y and in the vertical direction Z.

In addition, at least one (two in the embodiment) screw portion 66 to which the mounting screw 61 can be screwed is formed on the inner side of the right side wall portion, which is where the tank case 42 is formed with the window portion 42*a*, and at a position corresponding to the tank locking portion 62 of the ink tank 43. Furthermore, at least one (two in the embodiment) of convex positioning portions 67*a* and 67*b*, which is an example of a positioning portion, is formed at a position corresponding to the concave positioning portions 63*a* and 63*b* of the ink tank 43.

At least one (five in the embodiment) of case locking portions 68*a* to 68*e*, which is an example of a locking portion which locks the screw 36 (refer to FIG. 12) inserted when the tank case 42 is fixedly attached to the apparatus main body 13, is formed in the tank case 42. That is, the respective first to fifth case locking portions 68*a* to 68*e* are formed to correspond to the screw boss portions 37 formed on the attachment surface 13*a*. In addition, an engagement portion 69 capable of engaging with the boss portion 38 is formed at a position corresponding to the boss portion 38 of the apparatus main body 13 in the tank case 42.

Figure 12:
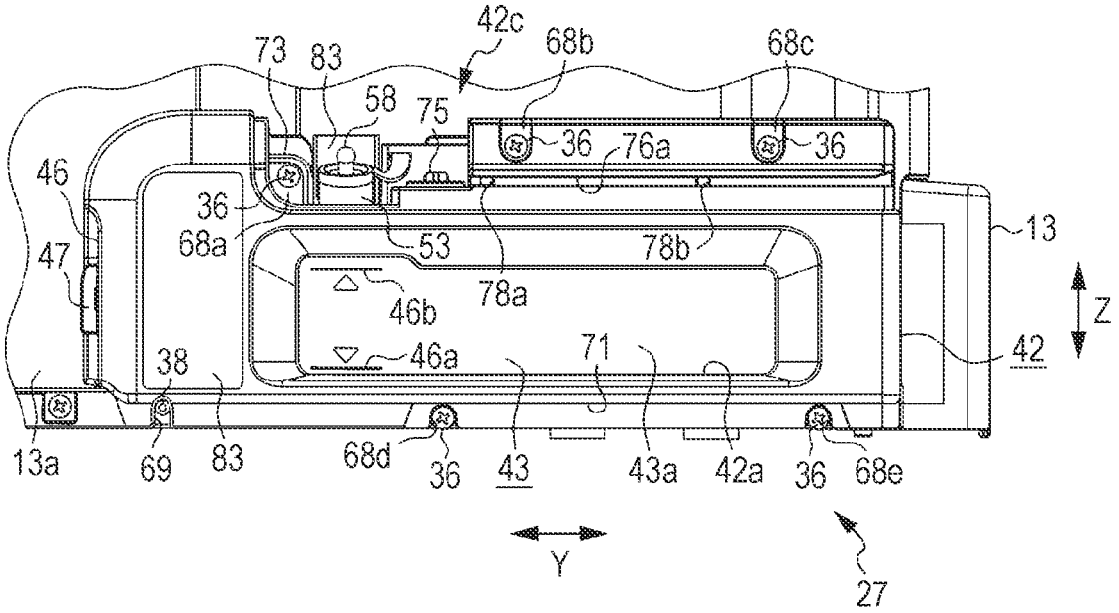
FIG. 12 is a right side view illustrating an attachment surface to which a tank case is fixedly attached.
Figure 13:
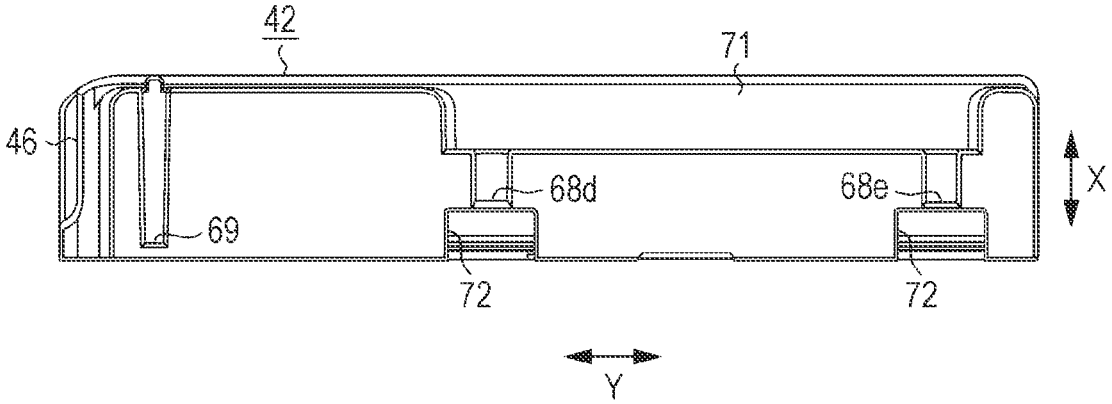
FIG. 13 is a bottom view of a tank case.

In addition, as illustrated in FIGS. 12 and 13, a handle portion 71 is formed at position that is lower than the window portion 42*a* in the tank case 42, and between the fourth case locking portion 68*d* and the fifth case locking portion 68*e*. Furthermore, a concave engagement portion 72 engaging with the reinforcement rib portion 34*f* of the attachment surface 13*a* side is formed at the case opening portion 42*b* side, at a position where the fourth case locking portion 68*d* and the fifth case locking portion 68*e* are formed in the lower surface of the tank case 42.

Figure 14:
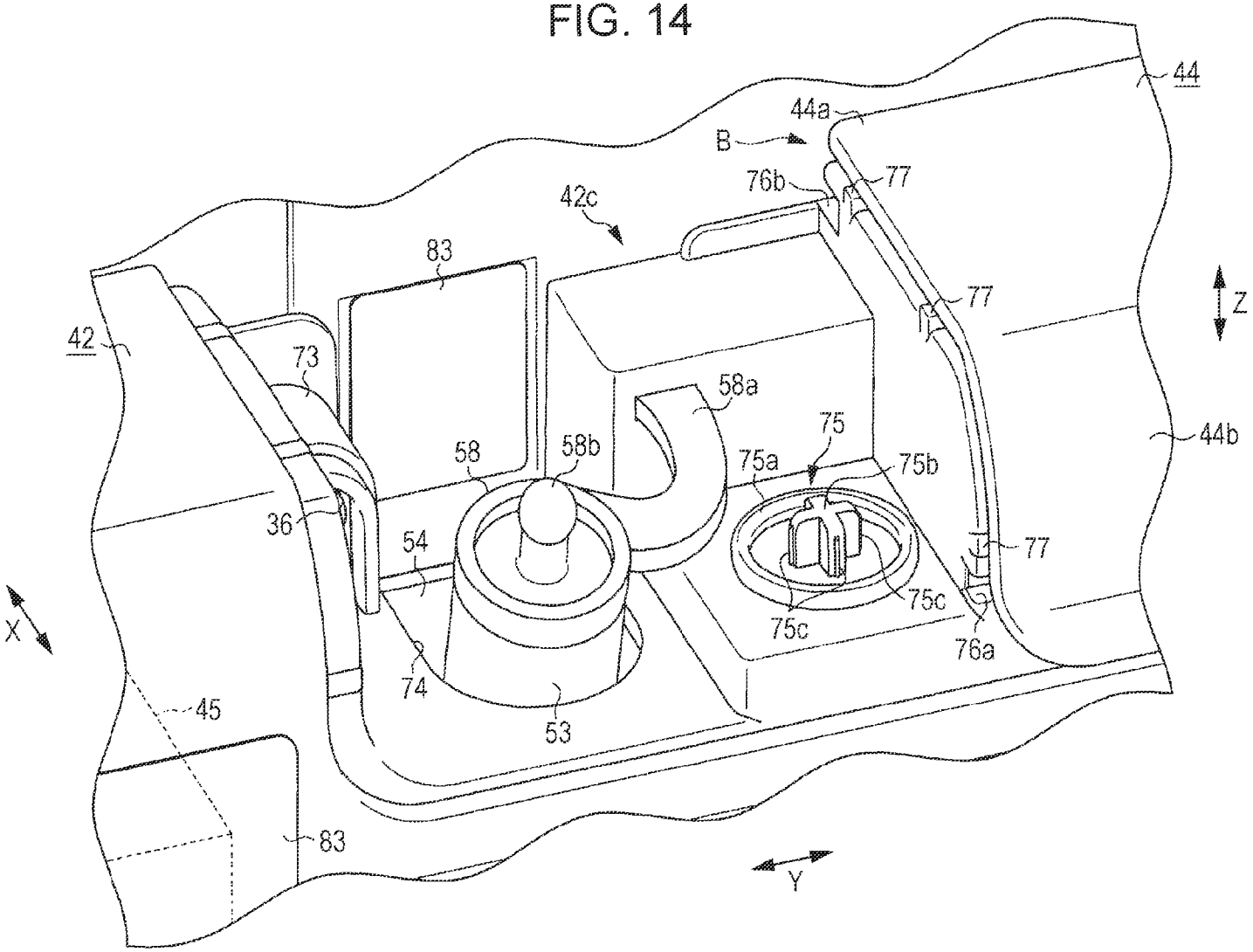
FIG. 14 is a perspective view of a trough portion in a tank unit.

In addition, as illustrated in FIGS. 12 and 14, a trough portion 42*c*, whose height in the vertical direction Z is lower by one step than the upper surface, is formed at the front side position on the upper surface of the tank case 42. The first case locking portion 68*a* is formed to be located inside the trough portion 42*c*. Then, a covering portion 73, whose right side is open while covering the first case locking portion 68*a* from the rear and upper side, is formed around the first case locking portion 68*a*. Therefore, the screw 36 screwed to the first case locking portion 68*a* is hidden by the covering portion 73 with respect to a user looking down on the tank unit 27.

Furthermore, as illustrated in FIG. 14, an accommodation portion 74 is formed in the trough portion 42*c*. The accommodation portion 74 has a U-shape in a top view, and receives entry of the cylinder portion 53 into the trough portion 42*c* from the left side, which is the case opening portion 42*b* side when the ink tank 43 is mounted on the tank case 42. Furthermore, a placement portion 75 is formed inside the trough portion 42*c* to the rear of the accommodation portion 74 so as to be higher by one step than the position at which the accommodation portion 74 is formed, and to be capable of placing the closing member 58 thereon. Therefore, the length of the anchoring portion 58*a* is set to a length sufficient to enable the closing member 58 to be selectively located on the cylinder portion 53 and on the placement portion 75.

The placement portion 75 has a ring portion 75*a* formed in an annular shape in which the inner peripheral shape is slightly larger than the outer peripheral shape of the fitting portion 58*c* of the closing member 58, and a cross portion 75*b* which is located inside the ring portion 75*a* and is slightly smaller than the inner peripheral shape of the fitting portion 58*c*. The cross portion 75*b* has a shape in which vertical plate portions extending in the front/rear direction Y and the left/right direction X intersect with each other in a cross shape. The cross portion 75*b* are formed with projections 75*c* at each side surface of the respective vertical plate portions in the front/rear direction Y and the left/right direction X. The projections 75*c* have a substantially triangular shape in a top view, and project from each side surface of the vertical plate portions and extend in the vertical direction Z. Therefore, when the closing member 58 is placed on the placement portion 75, the fitting portion 58*c* is located inside of the ring portion 75*a*, and the closing member 58 is supported in a state where the inner peripheral surface thereof is in contact with the projections 75*c* of the cross portion 75*b*.

As illustrated in FIGS. 12 and 14, in the tank case 42, a pair of rail portions 76*a* and 76*b*, which is an example of a support portion which supports the cover 44 to be slidable in the front/rear direction Y, is formed so as to extend in the front/rear direction Y. Furthermore, a plurality of (three in the embodiment) ridges 77 extending in the front/rear direction Y is formed between a pair of the rail portions 76*a* and 76*b*. The pair of the rail portions 76*a* and 76*b* are chamfered at the rear end upper surface of the first rail portion 76*a*, which is located at the right side, and at the rear end upper surface (not illustrated) of the second rail portion 76*b*, which is located at the left side.

As illustrated in FIG. 12, a pair of concave stopper portions 78*a* and 78*b* are formed in the first rail portion 76*a*, with a space therebetween in the front/rear direction Y. The pair of the concave stopper portions 78*a* and 78*b* are each chamfered at an inner surface thereof that is, amongst both the front and rear inner surfaces, toward a concave portion side of the other. That is, the first concave stopper portion 78*a* at the front side has the rear side inner surface chamfered, and the second concave stopper portion 78*b* at the rear side has the front side inner surface chamfered.

Figure 15:
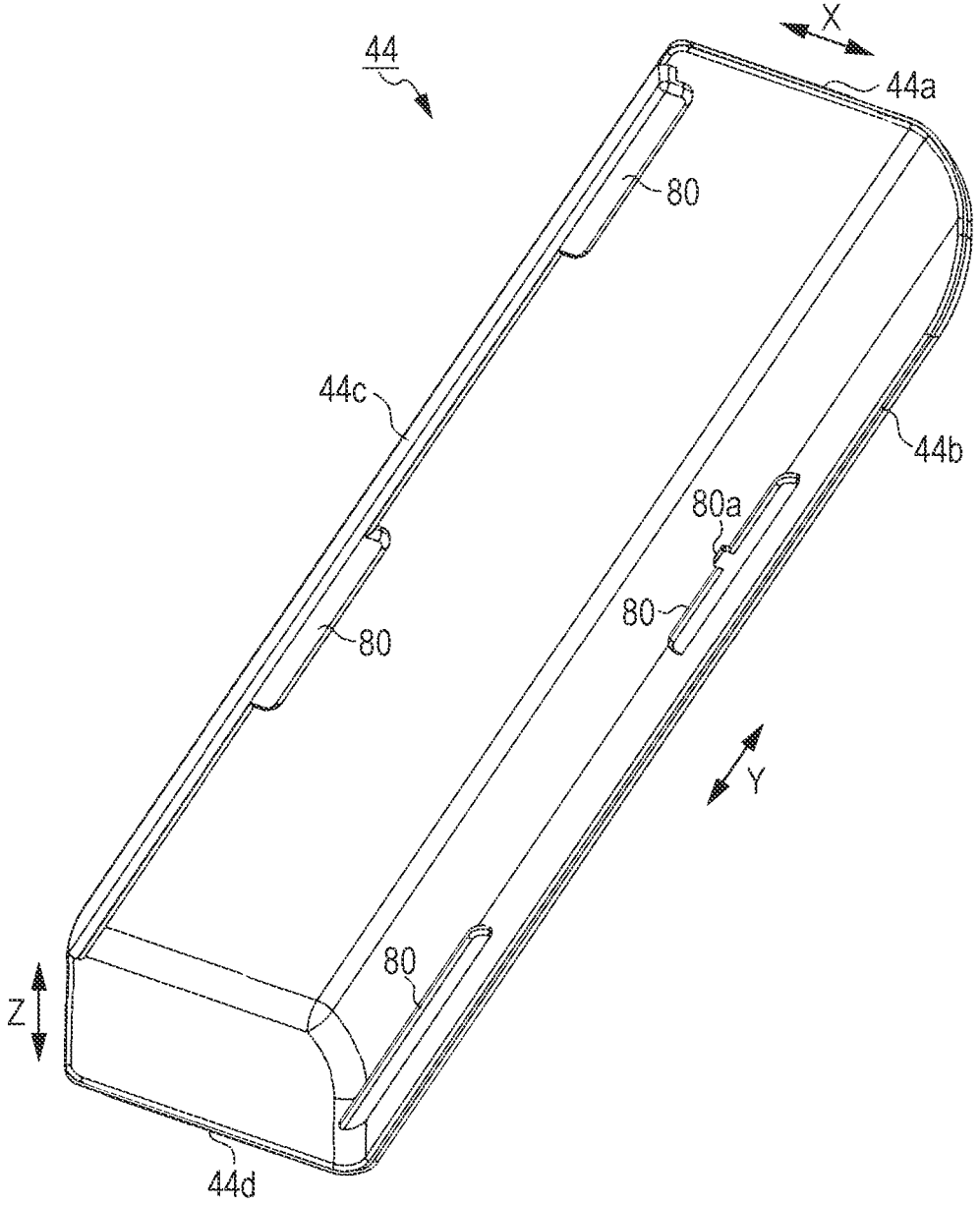
FIG. 15 is a perspective view seen from a lower left position of a cover.

As illustrated in FIG. 15, the cover 44 has an upper wall 44*a*, and a right wall 44*b*, a left wall 44*c*, and a rear wall 44*d*, which are respectively continuous with the upper wall 44*a*. The heights of the right wall 44 and the rear wall 44*d* in the vertical direction Z are substantially the same as each other, whereas the height of the left wall 44*c* is lower than that of the right wall 44*b* and of the rear wall 44*d*.

A pair of sliding contact portions 80, which engage and comes into sliding contact with the first rail portion 76*a*, is formed on the inner surface of the left wall 44*c* side in the right wall 44*b*, with a gap therebetween in the front/rear direction Y. In addition, a pair of sliding contact portions 80, which engages and comes into sliding contact with the second rail portion 76*b*, is formed on the inner surface which is a surface of the right wall 44*b* side in the left wall 44*c*, with a gap therebetween in the front/rear direction Y. The sliding contact portions 80 are alternately formed at different positions in the front/rear direction Y. Furthermore, the sliding contact portion 80 that is located at the front side of a pair of the sliding contact portions 80 formed on the right wall 44*b* has a convex stopper portion 80*a* which can engage with the concave stopper portions 78*a* and 78*b*.

Figure 16:
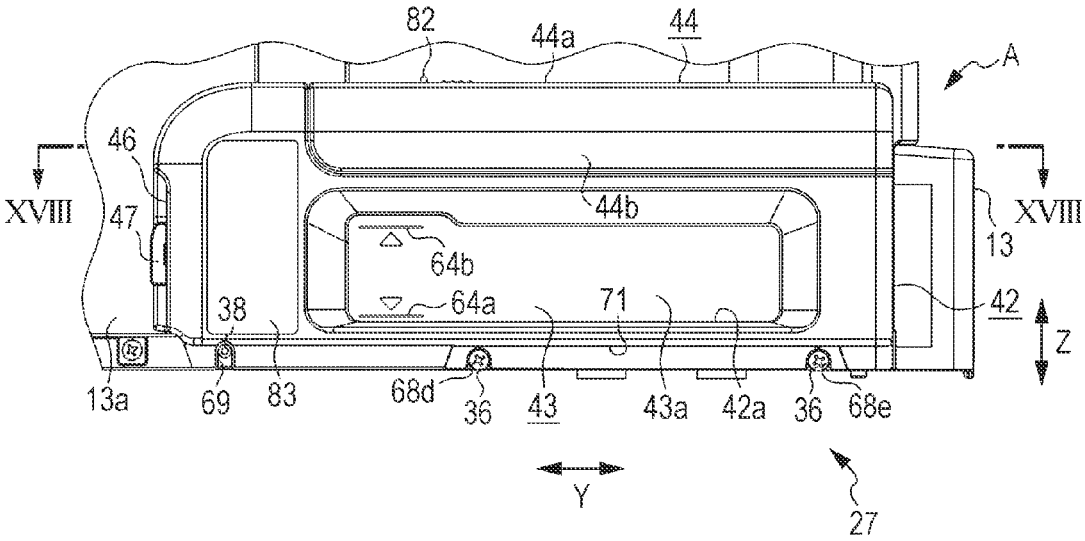
FIG. 16 is a right side view of a tank unit in which a cover is located at a hiding position.
Figure 17:
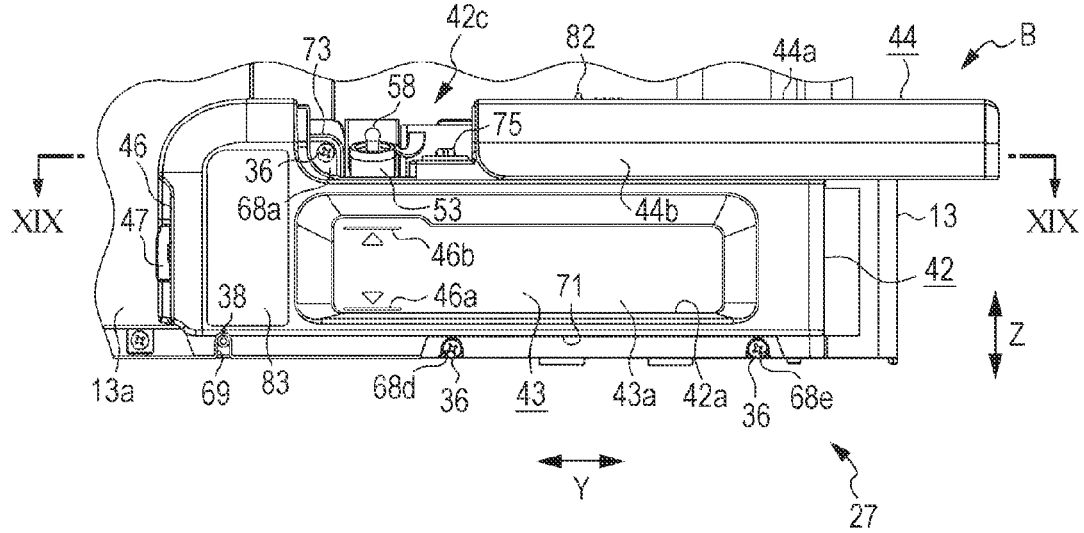
FIG. 17 is a right side view of a tank unit in which a cover is located at a non-hiding position.

Then, the cover 44 slides in the front/rear direction Y between a hiding position A illustrated in FIG. 16, wherein the convex stopper portion 80*a* engages with the concave stopper portion 78*a*, and a non-hiding position B illustrated in FIG. 17, wherein the convex stopper portion 80*a* engages with the concave stopper portion 78*b*.

Figure 18:
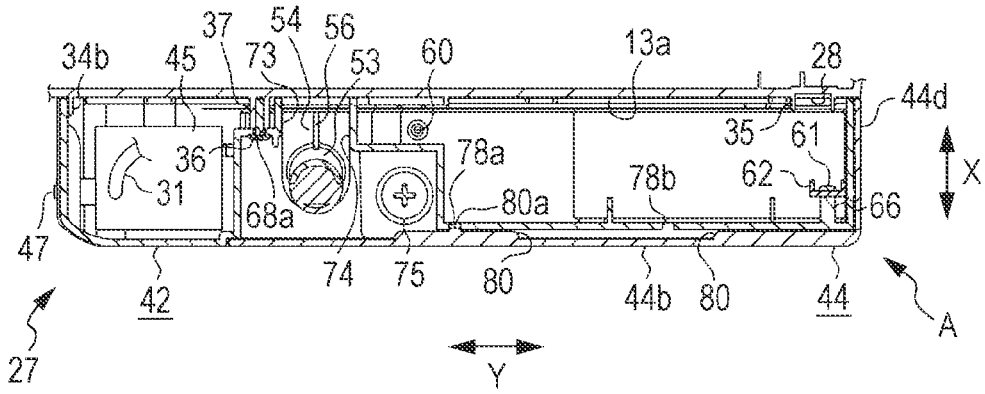
FIG. 18 is a cross-sectional view taken along the line XVIII-XVIII in FIG. 16.

More specifically, as illustrated in FIGS. 16 and 18, when the convex stopper portion 80*a* engages with the first concave stopper portion 78*a*, the cover 44 is located at the hiding position A for hiding the cylinder portion 53, in which the injection port 52 is formed, and the placement portion 75.

Figure 19:
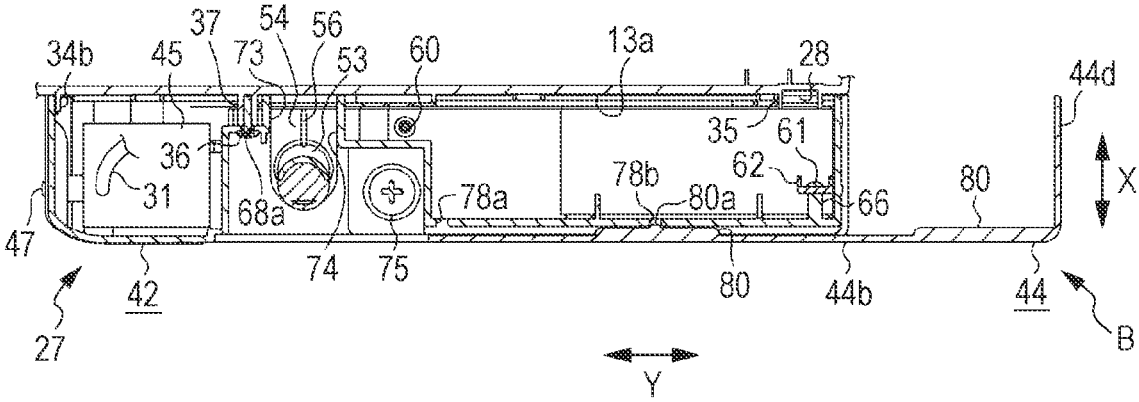
FIG. 19 is a cross-sectional view taken along the line XVIIII-XVIIII in FIG. 17.

On the other hand, as illustrated in FIGS. 17 and 19, when the convex stopper portion 80*a* engages with the second concave stopper portion 78*b*, the cover 44 is located at the non-hiding position B which is different from the hiding position A, and the cylinder portion 53, in which the injection port 52 is formed, and the placement portion 75 are exposed.

As illustrated in FIGS. 16 and 18, the size of the cover 44 in the front/rear direction Y is smaller than the size of the tank case 42, and when the cover 44 is located at the hiding position A, the cover 44 is accommodated on the tank case 42. In addition, the cylinder portion 53 is formed such that, when the ink tank 43 is fixedly attached to the tank case 42, the end surface 52*a* of the injection port 52 is located higher than the accommodation portion 74 of the tank case 42, and the height of the closing member 58 fitted to the cylinder portion 53 is lower than the cover 44, when it is located at the hiding position A.

In addition, as illustrated in FIGS. 12, 16 and 17, the screws 36 screwed to respective ones of the second case locking portion 68*b* and the third case locking portion 68*c* are hidden by the cover 44 attached to the tank case 42. Furthermore, the screws 36 screwed to respective ones of the fourth case locking portion 68*d* and the fifth case locking portion 68*e* are hidden by the tank unit 27 itself, with respect to a user looking down on the tank unit 27.

In addition, as illustrated in FIG. 3, a slip resistance portion 82 protruding upward so as to form a substantially triangular shape as a whole shape is formed on the upper wall 44*a* of the cover 44. Furthermore, a label 83 is adhered at the rear side position of the slip resistance portion 82 in the cover 44 The label 83 includes an indicator such as a character or figure indicating types of the ink contained in the tank unit 27, an indicator to alert the injection of a different type of the ink, and a written injection method or warnings about the ink. Similar labels 83 are also adhered to the right side surface of the tank case 42, the front surface concave portion 46 and the attachment surface 13*a*, at a location which is hidden by the cover 44 when the cover 44 is located at the hiding position A and exposed when the cover 44 is located at the non-hiding position B.

Next, the maximum fluctuation range of the liquid level 51 of the ink and the supply state of the ink from the ink tank 43 to the liquid ejecting head 32 will be described.

Incidentally, the recording apparatus 12 of the embodiment supplies ink contained inside the ink chamber 50 to the liquid ejecting head 32 by utilizing a water head difference. Therefore, if the liquid level 51 varies greatly in the vertical direction Z, it is not possible to stably supply ink from the ink tank 43 to the liquid ejecting head 32. Specifically, if the liquid ejecting head 32 is located considerably lower than the liquid level 51, there is a possibility that the ink may leak from the liquid ejecting head 32. In contrast, if the liquid ejecting head 32 is located considerably higher than the liquid level 51, there is a possibility that the ink may not be supplied to the liquid ejecting head 32.

As illustrated in FIG. 20, in the recording apparatus 12 of the embodiment, if the maximum fluctuation range of the liquid level 51 of the ink in the vertical direction Z is 75 mm or more, it is not possible to stably supply the ink to the liquid ejecting head 32. That is, for example, if the liquid ejecting head 32 is arranged to meet the case where the maximum amount of the ink is contained in the ink chamber 50, then it will not possible to supply ink to the liquid ejecting head 32 once the ink is consumed and the liquid level 51 lowers, even if the ink remains in the ink chamber 50. In addition, for example, if the liquid ejecting head 32 is arranged to meet a case where the ink inside the ink chamber 50 is consumed and the liquid level 51 lowers, ink will leaks from the liquid ejecting head 32 when the maximum amount of the ink is contained.

On the other hand, if the maximum fluctuation range of the liquid level 51 of the ink in the vertical direction Z is set to 70 mm or less, it is possible to supply the ink to the liquid ejecting head 32 even when the maximum amount of the ink is contained in the ink chamber 50, or when the liquid level 51 of the ink inside the ink chamber 50 lowers.

However, in a case where the maximum fluctuation range of the liquid level 51 is set to 70 mm, the stable supply can sometimes not be made due to assembling errors or manufacturing errors of the liquid ejecting head 32 and the ink tank 43. Thus, if the maximum fluctuation range is set to 55 mm or less, it is possible to stably supply the ink to the liquid ejecting head 32, even if there are some assembling errors or manufacturing errors. Furthermore, if the maximum fluctuation range is set to 40 mm or less, for example, even if an installation surface of the recording apparatus 12 is slightly tilted, it is possible to stably supply the ink from the ink tank 43 to the liquid ejecting head 32.

Therefore, as illustrated in FIG. 21, in the embodiment, a height h1 in the vertical direction Z from the lower limit scale 64*a* to the upper limit scale 64*b* is set to 40 mm or less. That is, if the liquid level 51 of the ink lowers to the lower limit scale 64*a*, a user injects the ink through the injection port 52 such that the liquid level 51 of the ink rises to the upper limit scale 64*b*. Accordingly, since the fluctuation range of the liquid level 51 of the ink when normally using the liquid ejecting head 32 becomes equal to the height h1, the ink inside the ink chamber 50 is stably supplied to the liquid ejecting head 32 if the height h1 is set to 40 mm or less.

In addition, a height h2 in the vertical direction Z from the lower end (an example of the bottom surface) of the opening of the outlet port 59 formed in the ink chamber 50 to the upper limit scale 64*b* is set to 55 mm or less. Therefore, for example, even if a user continues printing without noticing that the liquid level 51 of the ink lowers to the lower limit scale 64*a*, ink will be supplied to the liquid ejecting head 32 while ink remains in the ink chamber 50.

Furthermore, a height h3 in the vertical direction Z from the lower end of the opening of the outlet port 59 formed in the ink chamber 50 to end surface 52*a* of the injection port 52 is set to 70 mm or less. That is, the height h3 corresponds to the maximum fluctuation range of the ink contained in the ink tank 43. Therefore, for example, even if a user causes the ink to overflow from the injection port 52 when injecting ink into the ink chamber 50, the leakage of the ink from the liquid ejecting head 32 is suppressed.

Next, a shape of the ink chamber 50 will be described.

If the height of the ink chamber 50 in the vertical direction Z is limited, it is possible to stably supply the ink to the liquid ejecting head 32, but the ink chamber 50 will be able to contain less ink. Thus, the ink tank 43 of the embodiment secures the amount of the ink containable in the ink chamber 50 by increasing the width in the front/rear direction Y to enlarge the horizontal cross-sectional area.

Specifically, as illustrated in FIG. 22, the dimension of the ink chamber 50 in the left/right direction X is referred to as a depth D, the dimension thereof in the front/rear direction Y is referred to as a width W, and the dimension thereof in the vertical direction Z is referred to as a height H. Then, the dimensions of the ink tank 50 are such that the height H is larger than the depth D, and the width W is larger than the height H (D<H<W). The width W of the ink chamber 50 in the front/rear direction Y is wider than the width of the carriage 29 in the front/rear direction Y, and is narrower than the width of the apparatus main body 13 in the front/rear direction Y.

The ink chamber 50 has an area (for example, the area having at least the height h1 in FIG. 21) wherein, when the ink equal to 5% of the containing capacity of the ink chamber 50 flows from the outlet port 59, the fluctuation range of the liquid level 51 of the ink inside the ink chamber 50 is 5% or less of the cubic root of the containing capacity in the ink chamber 50. In the following description, a condition relating to the shape of the ink chamber 50 is referred to as a shape condition, and a containing amount containable in the ink chamber 50 is referred to as a maximum containing capacity.

For example, if the chamber 50 has a cubic shape where the depth D in the left/right direction X, the width W in the front/rear direction Y and the height H in the vertical direction Z are respectively equal to each other (D=W=H), the shape condition is satisfied regardless of where the liquid level 51 of the ink is located. Specifically, in a case of the cubic shape, the fluctuation range of the liquid level 51 when 5% of the maximum containing capacity (0.05×D×W×H/(D×W)) flows is equal to 5% of the cubic root of the maximum containing capacity (0.05×(D×W×H)1/3).

Therefore, the shape condition is satisfied in the case of a rectangular parallelepiped shape, which is longer in the front/rear direction Y or in the left/right direction X than a cubic shape. That is, the shape condition is satisfied when the height H of the ink chamber 50 is smaller than the depth D and the width W. Specifically, the shape condition is satisfied if a bottom surface area (D×W) of the ink chamber 50 or an area of the liquid level 51 (horizontal cross-sectional area of the ink chamber 50) is the square of the height H or more. However, in some cases, the shape condition is satisfied even if the height H is larger than any one of the depth D and the width W. For example, the shape condition is satisfied even if the depth D is half of the height H, as long as the width W is twice the height H or more.

Next, the fluctuation range of the liquid level 51 of the ink inside the ink chamber 50 when ink flow equals 5% of the maximum containing capacity will be described.

If a minimum fluctuation range of the liquid level 51 of the ink inside the ink chamber 50 when ink flow equals 5% of the maximum containing capacity (hereinafter, simply referred to as a "minimum fluctuation range") is 6% or more of the cubic root of the maximum containing capacity, it is not possible to sufficiently secure the amount of ink containable in the ink chamber 50.

In contrast, if the minimum fluctuation range is 5% or less of the cubic root of the maximum containing capacity, it is possible to contain sufficient xxx ink in the ink chamber 50, but it is more preferable to set the minimum fluctuation range to 4% or less of the cubic root of the maximum containing capacity.

Hereinafter, an operation when the ink tank 43 is fixedly attached to the apparatus main body 13 will be described.

As illustrated in FIG. 4, the ink tank 43 is first inserted through the case opening portion 42*b* of the tank case 42, the convex positioning portions 67*a* and 67*b* are fitted into the concave positioning portions 63*a* and 63*b* to be positioned. Furthermore, the mounting screw 61 is screwed to the tank locking portion 62 and the screw portion 66 and to fixedly attach the ink tank 43 attached to the tank case 42. That is, the tank case 42 protects the ink tank 43 by covering the ink tank 43 from outside.

Subsequently, as illustrated in FIG. 12, the tank case 42 to which the ink tank 43 is fixedly attached is positioned on the attachment surface 13*a*. That is, the tank case 42 is positioned around the first rib 34, the boss portion 38 and the engagement portion 69 are engaged with each other, and further the reinforcement rib portion 34*f* and the concave engagement portion 72 are engaged with each other.

In addition, as illustrated in FIG. 6, when the tank case 42 to which the ink tank 43 is attached is positioned on the attachment surface 13*a*, the absorbent material 39 is located at a position between the injection port 52 and the apparatus main body 13, and can absorb ink that clings around the injection port 52 from injecting ink or, once the ink clings there, that flows from around the injection port 52. The absorbent material 39 has a larger thickness in the left/right direction X than the upper rib 34*a*. Therefore, the absorbent material 39 interposed between the apparatus main body 13 and the ink tank 43 is sandwiched between the apparatus main body 13 and the ink tank 43 and subjected to compressive deformation.

Furthermore, as illustrated in FIG. 12, when the tank case 42 is positioned on the attachment surface 13*a*, the case locking portions 68*a* to 68*e* and the screw boss portion 37 are matched with each other. Therefore, if screws 36 are screwed into the case locking portions 68*a* to 68*e*, the respective case locking portions 68*a* to 68*e* and the screw boss portion 37 are fixedly screwed and the tank case 42 and the apparatus main body 13 are fixedly attached to each other.

When the tank case 42 is attached to the apparatus main body 13, the case opening portion 42*b* of the tank case 42 is covered with the apparatus main body 13. Therefore, the apparatus main body 13 and the tank case 42 function as an example of a protection member capable of protecting the ink tank 43 by covering it from outside. An example of the liquid supply system is configured to include the apparatus main body 13, the tank case 42, the ink tank 43 and the absorbent material 39.

Subsequently, in a state where the tank case 42 is fixedly attached to the apparatus main body 13, the cover 44 is mounted thereon such that the rail portions 76*a* and 76*b* and the sliding contact portion 80 are engaged with each other from the rear side of the tank case 42.

As illustrated in FIGS. 17 and 19, the cover 44 is located at the non-hiding position B after the convex stopper portion 80*a* first engages with the second concave stopper portion 78*b* located at the rear side. Then, if the cover 44 located at the non-hiding position B is further pushed forward, the convex stopper portion 80*a* rides over the chamfered front side inner surface of the second concave stopper portion 78*b*, so that the convex stopper portion 80*a* and the second concave stopper portion 78*b* disengage from each other and the cover 44 moves forward.

Then, as illustrated in FIGS. 16 and 18, the cover 44 is located at the hiding position A after the convex stopper portion 80*a* engages with the first concave stopper portion 78*a*. Since the first concave stopper portion 78*a* has the chamfered rear side inner surface, when the cover 44 located at the hiding position A is pressed rearward, the convex stopper portion 80*a* rides over the chamfered rear side inner surface of the first concave stopper portion 78*a*, so that the convex stopper portion 80*a* and the first concave stopper portion 78*a* disengage from each other and the cover 44 moves rearward.

Next, an operation when injecting the ink to the ink tank 43 will be described.

When the liquid level 51 of the ink contained inside the ink tank 43 lowers to the lower limit scale 64*a*, the user slides the cover 44 rearward from the hiding position A to the non-hiding position B (refer to FIG. 17). Then, the closing member 58 and the placement portion 75, which were hidden by the cover 44 in the hiding position A, are exposed.

Further, the user moves the closing member 58 fitted to the front end of the cylinder portion 53 to the placement portion 75, and injects ink through the injection port 52. The injected ink can be checked through the window portion 42*a* of the tank case 42.

Incidentally, when ink overflows due to the injection of the ink, the leaked ink flows down on the injection port forming surface 54 in the direction away from the apparatus main body 13, and then is trapped by the convex barrier portion 55. Even if the amount of the leaked ink is large and thus the ink crosses over the convex barrier portion 55, the leaked ink changes direction by spreading over the stepped portion 54*a*. In addition, for example, even if the ink spatters onto the apparatus main body 13 side, the leaked ink is absorbed by the absorbent material 39 interposed between the apparatus main body 13 and the tank unit 27.

Then, when the liquid level 51 rises to the upper limit scale 64*b* from injection of the ink, the user completes the injection of the ink, returns the closing member 58 placed on the placement portion 75 to the cylinder portion 53, and slides the cover 44 forward to the hiding position A.

According to the first embodiment, the following advantageous effects can be obtained.

(1) It is possible to inject ink into the ink chamber 50 through the injection port 52 on the ink tank 43. In addition, since the tank unit 27 is fixedly attached to the apparatus main body 13, it is possible to decrease the possibility that the tank unit 27 may be detached from the apparatus main body 13 when a user carries the recording apparatus 12. Therefore, the recording apparatus 12, including the tank unit 27 into which ink can be injected, can have improved portability.

(2) Since the cover 44 is disposed to be slidable, it is possible to reduce the spatial area required for displacing the cover 44 compared to, for example, a cover that is displaced between the hiding position and the non-hiding position by being pivoted about an axis. Therefore, even when the recording apparatus 12 is installed in a narrow space, it is possible to open and close the cover 44.

(3) When injecting the ink into the ink chamber 50 through the injection port 52, it is possible to place the closing member 58 on the placement portion 75. Therefore, even when the ink clings to the closing member 58, it is possible to decrease the possibility that the ink may adhere to a location other than the placement portion 75.

(4) Since the injection port 52 is formed on the cylinder portion 53 protruding outward from the ink chamber 50, it is possible to decrease a possibility that, when injecting ink into the ink chamber 50, members located around the cylinder portion 53 contact the container for injecting ink (for example, a large size ink container), and interferes with ink injection. Furthermore, since the cylinder portion 53 protrudes toward the upward right direction non-orthogonal to the vertical direction Z, a user is able to easily check the state of the ink injection operation.

(5) The convex barrier portion 55, which is disposed on the injection port forming surface 54 along which leaked ink will flow, can block ink that leaks from the injection port 52.

(6) By suppressing the fluctuation range of the liquid level 51 with respect to the amount of the ink that flows from the ink chamber 50, it is possible to decrease change in pressure applied to the ink to supply it the liquid ejecting head 32. Therefore, it is possible to stably supply ink contained in the ink chamber 50 to the liquid ejecting head 32.

(7) In the ink chamber 50, the width in the front/rear direction Y, which intersects the vertical direction Z, is larger than the height in the vertical direction Z. Accordingly, compared to a case in which the width in the front/rear direction Y is smaller than the height in the vertical direction Z, it is possible to decrease fluctuation of the liquid level 51 with respect to the ink amount.

(8) It is possible to suppress the height from the outlet port 59 to the injection port 52 by setting the height h3 from the outlet port 59 to the injection port 52 to 70 mm or less. Therefore, it is possible to decrease the fluctuation in the vertical direction Z of the liquid level 51 of the ink contained in the ink chamber 50.

(9) It is possible to set the range in which the liquid level 51 is located in the ink chamber 50 to 55 mm or less by setting the height h2 from the outlet port 59 to the upper limit scale 64*b* to 55 mm or less. Therefore, it is possible to further decrease fluctuation in the vertical direction Z of the liquid level 51 of the ink contained in the ink chamber 50.

(10) A user can use the lower limit scale 64*a* as a reference for injecting ink into the ink chamber 50. Furthermore, it is possible to set the range in which the liquid level 51 is located in the ink chamber 50 to 40 mm or less by setting the height h1 from the lower limit scale 64*a* to the upper limit scale 64*b* to 40 mm or less. Therefore, it is possible to further decrease fluctuation in the vertical direction Z of the liquid level 51 of the ink contained in the ink chamber 50.

(11) The lower limit scale 64*a* and the upper limit scale 64*b* are formed further to the front side, that is, further to one side in the visible surface 43*a* than the intermediate position in the front/rear direction Y. Therefore, unlike a case of forming them at both sides, it is possible to decrease the possibility that position of the liquid level 51 with respect to the scales 64*a* and 64*b* in the vertical direction Z may differ in a plurality of different positions in the front/rear direction Y from each other for each position even if the ink tank 43 is installed at a slant. Therefore, a user can easily recognize the amount of the ink contained in the ink tank 43.

(12) It is possible to compare the liquid level 51 of the ink located in the vicinity of the outlet port 59 and the lower limit scale 64*a* by forming the lower limit scale 64*a* at the outlet port 59 side. Therefore, a user uses the lower limit scale 64*a* as a reference for injecting ink into the ink chamber 50. In this manner, it is possible to decrease a possibility that air is supplied through the outlet port 59 because the liquid level 51 of the ink is lower in the vertical direction Z than the outlet port 59.

(13) The lower limit scale 64*a* is formed on the same side as the injection port 52, and is formed at a position lower than the injection port 52. Therefore, when injecting the ink through the injection port 52, it is possible to easily check the injected ink.

(14) In the ink tank 43 having the visible surface 43*a* in which the width in the front/rear direction Y is larger than the height in the vertical direction Z, the position of the liquid level 51 with respect to the scales 64*a* and 64*b* in the vertical direction Z is likely to greatly differ at different positions in the front/rear direction Y when the ink tank 43 is installed at a slant. In this regard, since the scales 64*a* and 64*b* are installed further to the front side than the intermediate position in the horizontal direction, even when the ink tank 43 is installed at a slant, it is possible to easily recognize the amount of the ink.

(15) Since the upper limit scale 64*b* is formed at the injection port 52 side, for example, even when the ink tank 43 is installed at a slant, by comparing the liquid level 51 of the injected ink and the upper limit scale 64*b*, it is possible to decrease the possibility that the ink may leak from the injection port 52.

(16) Since the visible surface 43*a* is formed facing the right direction, which intersects the vertical direction Z, it is possible to recognize and compare the liquid level 51 of the ink and the scales 64*a* and 64*b* from one direction.

(17) Since a plurality of the scales 64*a* and 64*b* is formed at the same side as each other, it is possible to easily recognize the remaining amount of ink contained in the ink chamber 50 by comparing the liquid level 51 of the ink and the scales 64*a* and 64*b*.

(18) Since the end surface 52*a* of the injection port 52 is non-orthogonal to the vertical direction Z, it is possible to inject ink more easily than if the end surface 52*a* of the injection port 52 were orthogonal to the vertical direction Z.

(19) When the ink tank 43 is fixedly attached to the apparatus main body 13, it is possible to more easily inject the ink because the cylinder portion 53 is formed to be tilted in a direction away from the apparatus main body 13.

(20) Since the injection port forming surface 54 is non-orthogonal to the vertical direction Z, even if the ink leaks from the injection port 52, the ink can flow down on the injection port forming surface 54. Therefore, it is possible to decrease a possibility that the ink may flow in a direction the user does not want.

(21) When the ink tank 43 is fixed to the recording apparatus 12, since the end surface 52*a* of the injection port 52 is formed to be tilted in a direction away from the apparatus main body 13, it is possible to more easily inject ink.

(22) The slopes of the cylinder portion 53 and of the injection port forming surface 54 are the same with respect to the vertical direction Z. Therefore, for example, when the ink tank 43 is injection molded, it is possible to mold the cylinder portion 53 and the injection port forming surface 54 using the same molding die.

(23) The leaked ink from the injection port 52 is trapped by the convex barrier portion 55 located on the injection port forming surface 54 which is where the leaked ink flows. Therefore, it is possible to decrease a possibility that the leaking ink may dirty the periphery of the leaked portion.

(24) Since the convex barrier portion 55 is located at the further upper side than the visible surface 43*a*, it is possible to decrease a possibility that the visible surface 43*a* may be dirtied by the leaked ink.

(25) Even if the leaked ink crosses over the convex barrier portion 55, the stepped portion 54*a* can decrease a possibility that the leaked ink flows to the visible surface 43*a*.

(26) The width of the convex barrier portion 55 in the front/rear direction Y is wider than the width of the injection port 52. Therefore, even if the ink injected through the injection port 52 leaks from any direction, it is possible to block the leaked ink by using the convex barrier portion 55.

(27) The injection port forming surface 54 may be used as the channel over which the leaked ink flows. Therefore, by receiving the leaked ink with the aid of the injection port forming surface 54, it is possible to decrease a possibility that ink may dirty a location other than the injection port forming surface 54.

(28) The leaked ink can be trapped by the convex barrier portion 55 protruding from the injection port forming surface 54.

(29) Since the injection port 52 and the convex barrier portion 55 are formed on the injection port forming surface 54 facing one direction, it is possible to set the flowing direction of the leaked ink to one direction.

(30) The slopes of the injection port 52 and of the convex barrier portion 55 are the same as each other with respect to the vertical direction Z. Therefore, it is possible to mold the injection port 52 and the convex barrier portion 55 by using the same molding die when, for example the ink tank 43 is injection molded.

(31) The absorbent material 39 is interposed between the apparatus main body 13 and the ink tank 43. In this manner, even when the leaked ink leaking from the injection port 52 permeates in between the apparatus main body 13 and the ink tank 43, the absorbent material 39 can absorb the leaked ink. Therefore, it is possible to decrease a possibility that that the leaking ink may dirty the surrounding of the leaked portion.

(32) By disposing the absorbent material 39 between the injection port 52 where the ink is likely to leak and the apparatus main body 13, the absorbent material 39 can efficiently absorb the leaked ink leaking from the injection port 52.

(33) It is possible to fill the gap between the apparatus main body 13 and the ink tank 43 with the absorbent material 39. Therefore, it is possible to decrease a possibility that foreign substances may be mixed into the gap between the apparatus main body 13 and the ink tank 43.

(34) It is possible to improve the assembly ability of the tank unit 27 by integrally molding the tank case 42 covering the ink tank 43.

(35) It is possible to easily accommodate the ink tank 43 in the tank case 42 through the case opening portion 42*b* formed on the tank case 42.

(36) The ink tank 43 and the tank case 42 are positioned by the concave positioning portions 63*a* and 63*b* and the convex positioning portions 67*a* and 67*b*. Therefore, it is possible to decrease a possibility that the ink tank 43 and the tank case 42 may deviate from each other.

(37) The ink tank 43 and the tank case 42 are positioned by being fitted into the long slotted hole-shaped concave positioning portion 63*a* in such a manner that the concavity and convexity are fitted to each other. Therefore, even when molding accuracy of the ink tank 43 and the tank case 42 is poor, it is possible to position the ink tank 43 and the tank case 42. Furthermore, since the concave positioning portion 63*a* is long in the front/rear direction Y, it is possible to position the ink tank 43 and the tank case 42 by suppressing the slopes in the horizontal direction.

(38) Since the tank case 42 has the handle portion 71, it is possible to easily carry the tank unit 27.

(39) When the tank unit 27 is fixedly attached to the apparatus main body 13, the screws 36 lock the fourth case locking portion 68*d* and the fifth case locking portion 68*e* which are formed at both end positions of the handle portion 71. Therefore, a user can grip the handle portion 71 and stably carry the apparatus main body 13 and the tank unit 27.

(40) Since the cover 44 is smaller sized than the tank case 42, it is possible to accommodate the cover 44 on the tank case 42. Therefore, even when the tank unit 27 is provided with the cover 44, it is possible to decrease a possibility that the cover 44 may be caught by something during the transportation.

(41) It is possible to decrease the fluctuation range of the liquid level 51 with respect to the amount of the ink from the outlet port 59 by increasing the horizontal cross-sectional area of the ink chamber 50. That is, since small fluctuation in the liquid level 51 enables more ink to flow, it is possible to stably supply the ink contained in the ink chamber 50 to the liquid ejecting head 32.

(42) Since the tank unit 27 is fixedly attached to the apparatus main body 13, it is possible to miniaturize the tank unit 27, compared to an independent tank unit disposed to be attachable to and detachable from the apparatus main body 13. Furthermore, it is possible to provide the tank unit 27 and the apparatus main body 13 with a sense of unity.

(43) The cover 44 moves between the hiding position A and the non-hiding position B in a state of being supported by the tank case 42. Therefore, it is possible to decrease a possibility that the cover 44 may be separated during transportation of the multi-function printer 11.

(44) The upper surfaces in the rear end of the rail portions 76*a* and 76*b* are chamfered, and the sliding contact portions 80 of the cover 44 are alternately formed in the front/rear direction Y. Therefore, it is possible to easily mount the cover 44 on the tank case 42.

(45) In the tank case 42, the periphery of the window portion 42*a* is chamfered. Therefore, it is possible to easily see the entire surface of the visible surface 43*a* from outside through the window portion 42*a*, even from a lateral direction that is not directly facing the window portion 42*a*.

(46) Since the valve lever 47 is disposed within the concave portion 46, it is possible to suppress an erroneous operation by the valve lever 47 bumping a surrounding object when the multi-function printer 11, to which the tank unit 27 is fixed, is carried.

(47) Since the tank case 42 is an integrally molded product with no seam, it is possible to decrease the possibility that a flow channel is inadvertently made through which ink can leak.

(48) Since the absorbent material 39 is interposed between the apparatus main body 13 and the ink tank 43, it is possible to protect the film 49 by using the absorbent material 39.

(49) Even when the ink clings to the closing member 58 placed on the placement portion 75, and the ink drips from the closing member 58, it is possible to suppress the ink from spreading over the surrounding by using the ring portion 75*a* because the closing member 58 is placed inside of the ring portion 75*a*.

(50) By covering the air intake port 60 with the tank case 42, it is possible to decrease a possibility that a user may erroneously inject ink into the air intake port 60.

(51) The water head position of the liquid level 51 of ink inside the ink tank 43 needs to be managed with respect to the nozzle surface of the liquid ejecting head 32 in which ink-ejection nozzles are formed. In this regard, the ink tank 43 is attached to the apparatus main body 13 via the tank case 42, which is integrally molded with the convex positioning portions 67*a* and 67*b*. That is, the ink tank 43 can be attached to the apparatus main body 13 while more accurately maintaining the positional relationship between the ink tank 43 and the liquid ejecting head 32, compared to a case in which the tank case 42 were assembled from a plurality of members.

(51) The ink tank 43 provided with the ink chamber 50 is arranged in the front/rear direction Y at a position to the outside of the liquid ejecting head 32 further in the left/right direction X front/rear direction Y than the movement area T of the liquid ejecting head 32, which is movable in the left/right direction X. Therefore, it is possible to form the ink chamber 50, which is provided in the ink tank 43, long in the front/rear direction Y without the ink chamber 50 being interrupted by the movement area T of the liquid ejecting head 32.

(52) In addition, the ink chamber 50 provided in the ink tank 43 is smaller in size in the left/right direction X than in the vertical direction (height direction) Z, which is orthogonal to the left/right direction X and to the front/rear direction Y, and is smaller in size in the vertical direction (height direction) Z than in the front/rear direction Y. Therefore, compared to a case where the size of the ink chamber 50 in the vertical direction (height direction) Z is larger than the size in the left/right direction X and the front/rear direction Y, it is possible to suppress the fluctuation range of the liquid level 51 inside the ink chamber 50 with respect to the liquid ejecting head 32 when the ink flows from the ink chamber 50. Therefore, it is possible to decrease a change in pressure applied to the ink to be supplied to the liquid ejecting head 32, and it is possible to stably supply the ink contained in the ink chamber 50 to the liquid ejecting head 32.

(53) Furthermore, in the ink tank 43, the outlet port 59 from which the ink inside the ink chamber 50 flows to the tube 31 is arranged further to the front side of the ink chamber 50 in the front/rear direction Y than the center. Therefore, the ink chamber 50 and the tube 31 can be connected by utilizing the front side space to which the recording medium is discharged. Accordingly, it is possible to build a compact liquid supply system.

(54) The valve lever 47 of the choke valve 45, which can squeeze the tube 31 connected to the outlet port 59 by an external operation, is disposed on the front surface of the ink tank 43. Therefore, the choke valve 45 can be easily operated to block the supply of the ink through the tube 31.

(55) Compared to a case where the ink tank 43 is arranged inside the apparatus main body 13, it is possible to further relax the restrictions on the shape and size of the ink tank 43.

(56) The ink tank 43 is fixedly attached to the apparatus main body 13 together with the tank case 42, while being accommodated inside the tank case 42, through the case opening portion 42*b*. Therefore, it is possible to improve the assembly ability of the tank unit 27.

(57) The case locking portions 68*a* to 68*e* are formed in the tank case 42. Therefore, it is possible to easily and fixedly attach the tank unit 27 to the apparatus main body 13 by using the screws 36.

EXAMPLE 1

An example of the ink tank 43 will be described.

Figure 23:
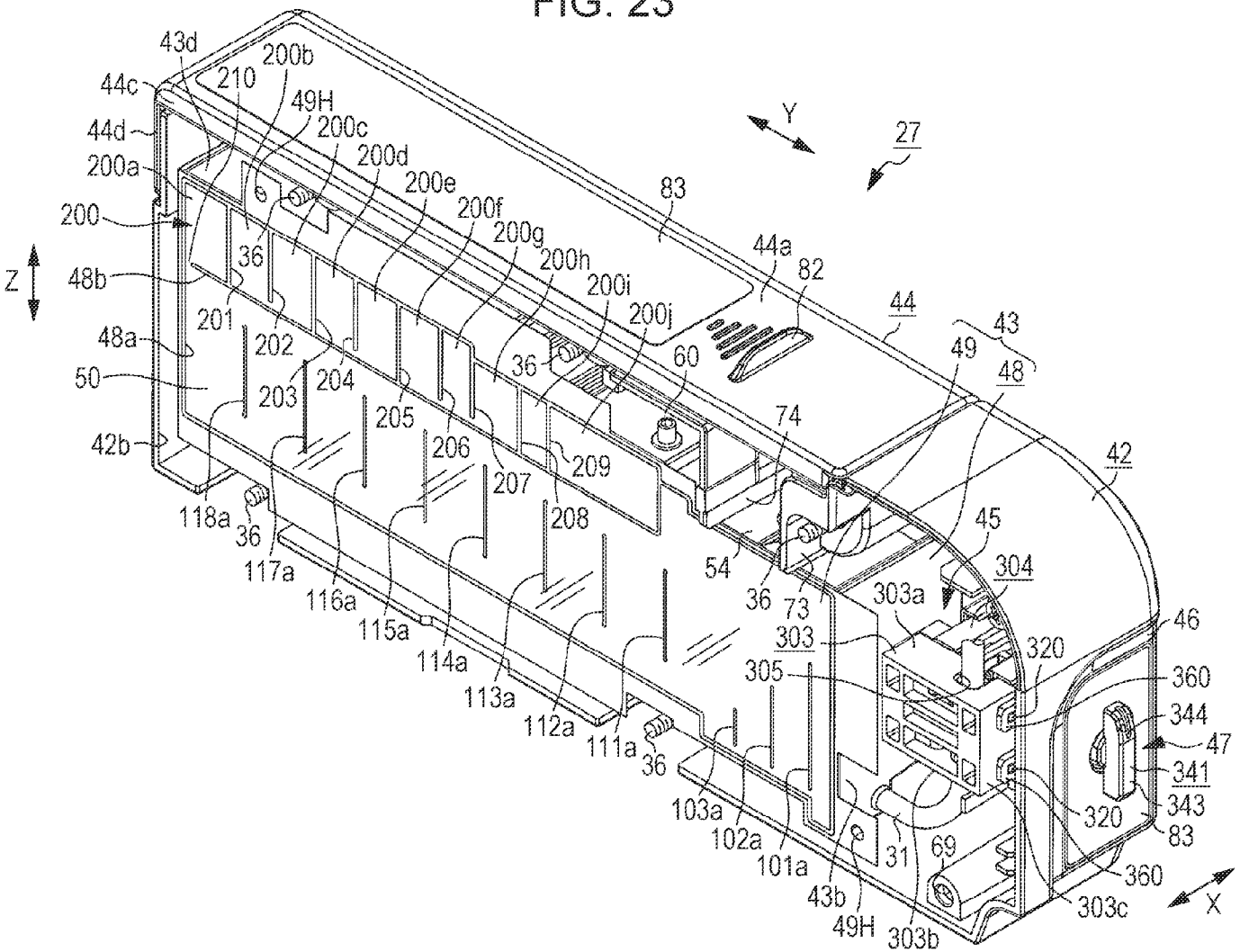
FIG. 23 is a perspective view seen from a left front position of a tank unit.
Figure 24:
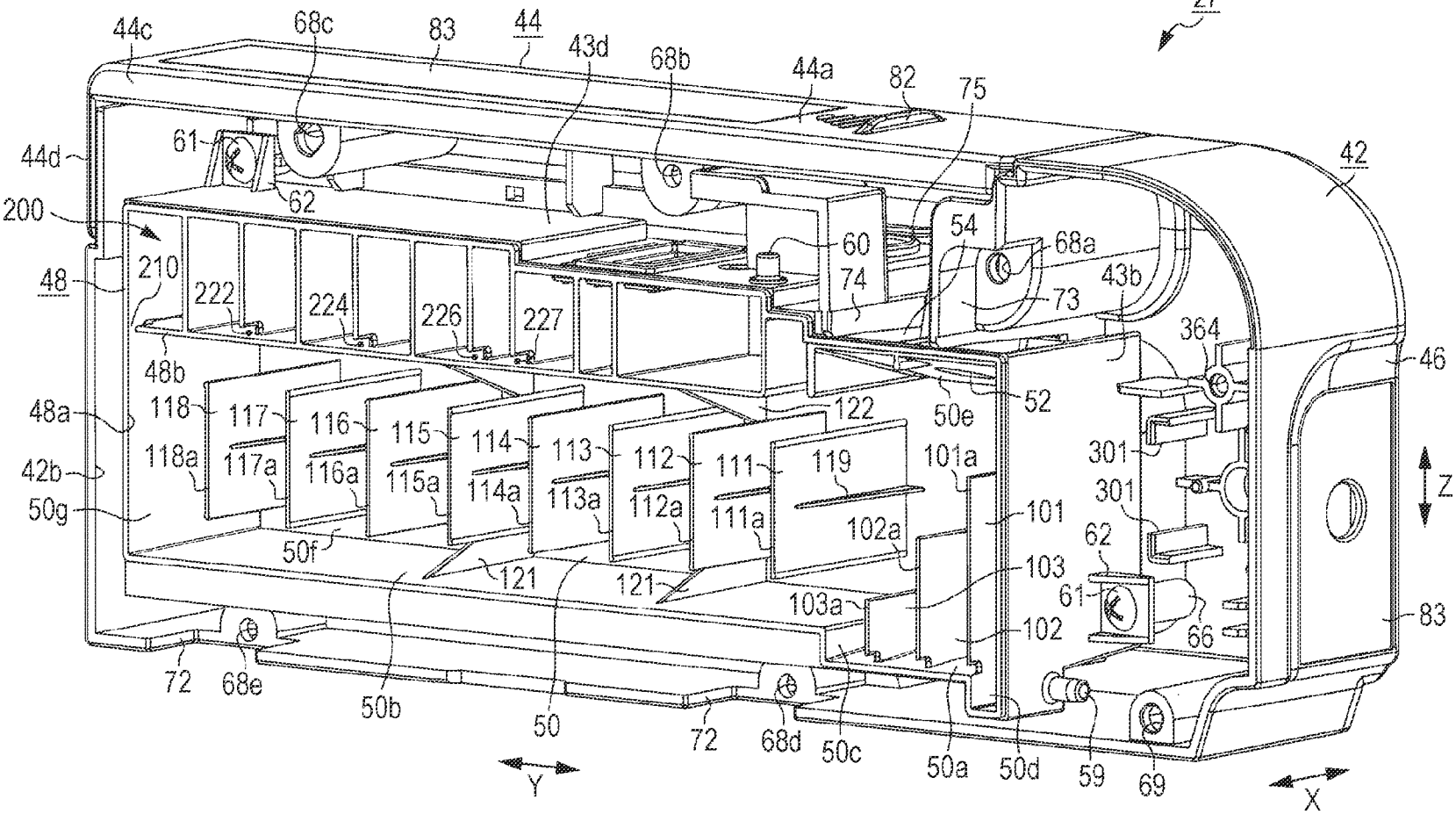
FIG. 24 is a perspective view seen from a left front position of a tank unit where a portion of a member is removed.

As illustrated in FIGS. 23 and 24, the ink tank 43 is configured to include a bottomed box-shaped container case 48 and a film 49. The container case 48 has a container opening portion 48*a*, which is an example of an opening portion, disposed on one surface side. The film 49 is an example of a thin film member. Five surfaces of the container case 48 are integrally molded, and the film 49 is adhered to the container opening portion 48*a* of the container case 48. In this manner, the ink chamber 50, which is an example of a liquid containing chamber containing the ink, and an air chamber 200 allowing the ink chamber 50 to communicate with the air are formed.

The ink chamber 50 and the air chamber 200 are partitioned into an area of the air chamber 200 and an area of the ink chamber 50 by a partition wall 48*b*, which is formed to extend in a direction (front/rear direction Y) following the bottom surface of the container case 48. The partition wall 48*b* is integrally molded with the container case 48 so as to be orthogonal to a side wall 48*c* (refer to FIG. 25) of the right side of the container case 48 and so as to protrude from the side wall 48*c* toward the container opening portion 48*a* side.

In addition, the width of the container case 48 in the front/rear direction Y is larger than the height in the vertical direction Z and than the depth in the left/right direction X. That is, the container case 48 has a substantially rectangular parallelepiped shape in which the front/rear direction Y is the longitudinal direction. To match the shape of the container case 48, the film 49 is also formed in a substantially rectangular parallelepiped shape in which the front/rear direction Y is the longitudinal direction.

In the present embodiment, the container opening portion 48*a* has a shape of a rib formed on the entire circumference following the outer shape of the container case 48, and the film 49 is adhered to the container opening portion 48*a* by welding. In addition, the film 49 is similarly adhered by welding simultaneously with the container opening portion 48*a* to a plurality of ribs (for example, intersecting rib portions 101 to 103, vertical rib 111 to 118 and the like) erected in the left/right direction X inside the ink chamber 50.

In addition, the container case 48 is made of a transparent or translucent resin, and allows the ink contained inside the ink chamber 50 and a liquid level 51 of the ink (refer to FIG. 25) to be visually recognized from the outside of the ink tank 43. Therefore, if the ink tank 43 is mounted on the tank case 42, the ink contained in the ink chamber 50 can be visually recognized from the outside through the window portion 42*a* of the tank case 42.

Figure 25:
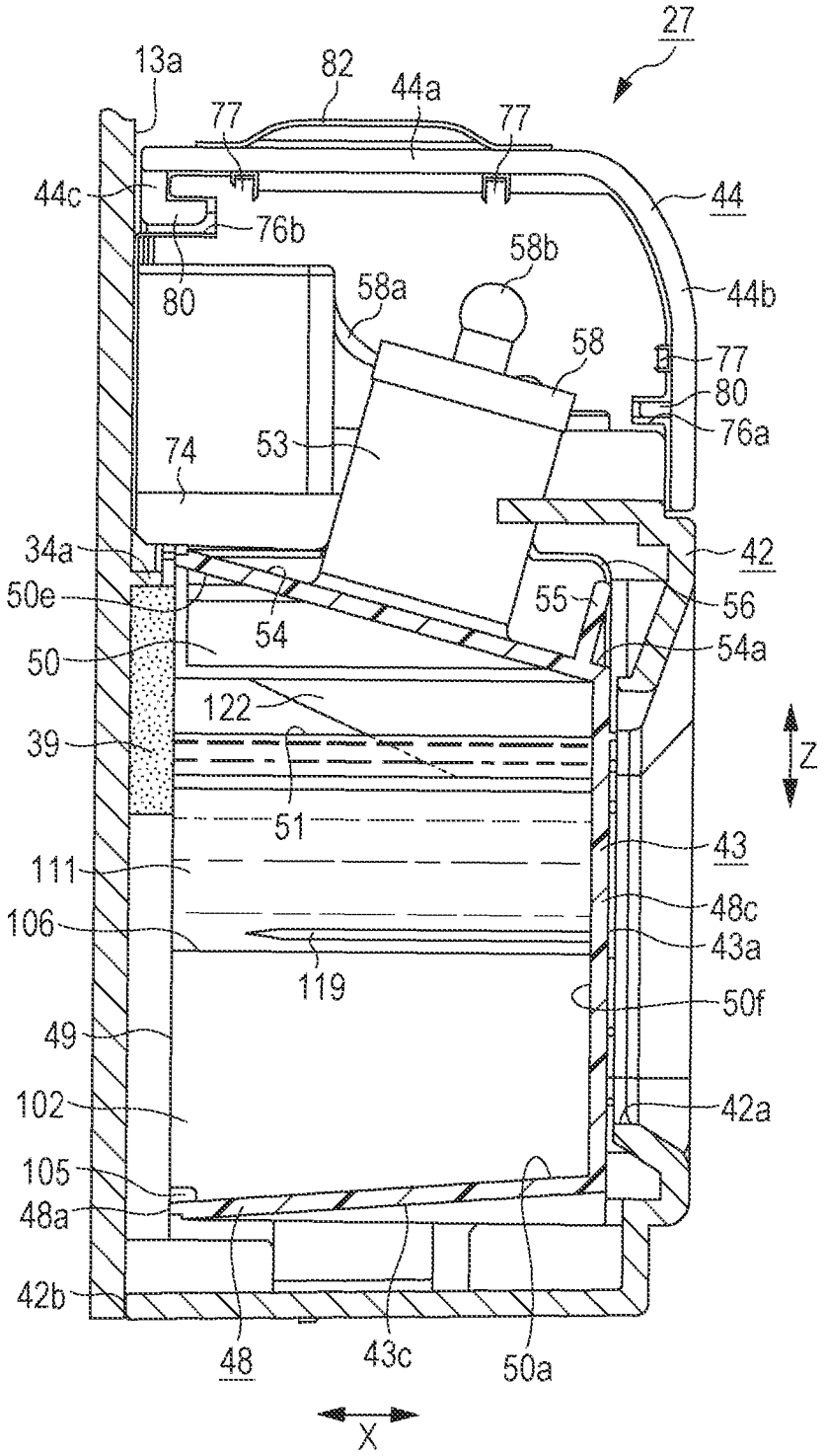
FIG. 25 is a cross-sectional view taken along the line XXV-XXV in FIG. 3.

That is, as illustrated in FIGS. 3 and 25, an area corresponding to the window portion 42*a* on the right side surface of the ink tank 43 (container case 48) is formed toward the right direction (one direction), and functions as the visible surface 43*a* which allows the liquid level 51 of the ink contained in the ink chamber 50 to be visually recognized from the right direction. The width of the visible surface 43*a* in the front/rear direction Y is larger than the height in the vertical direction Z.

Figure 26:
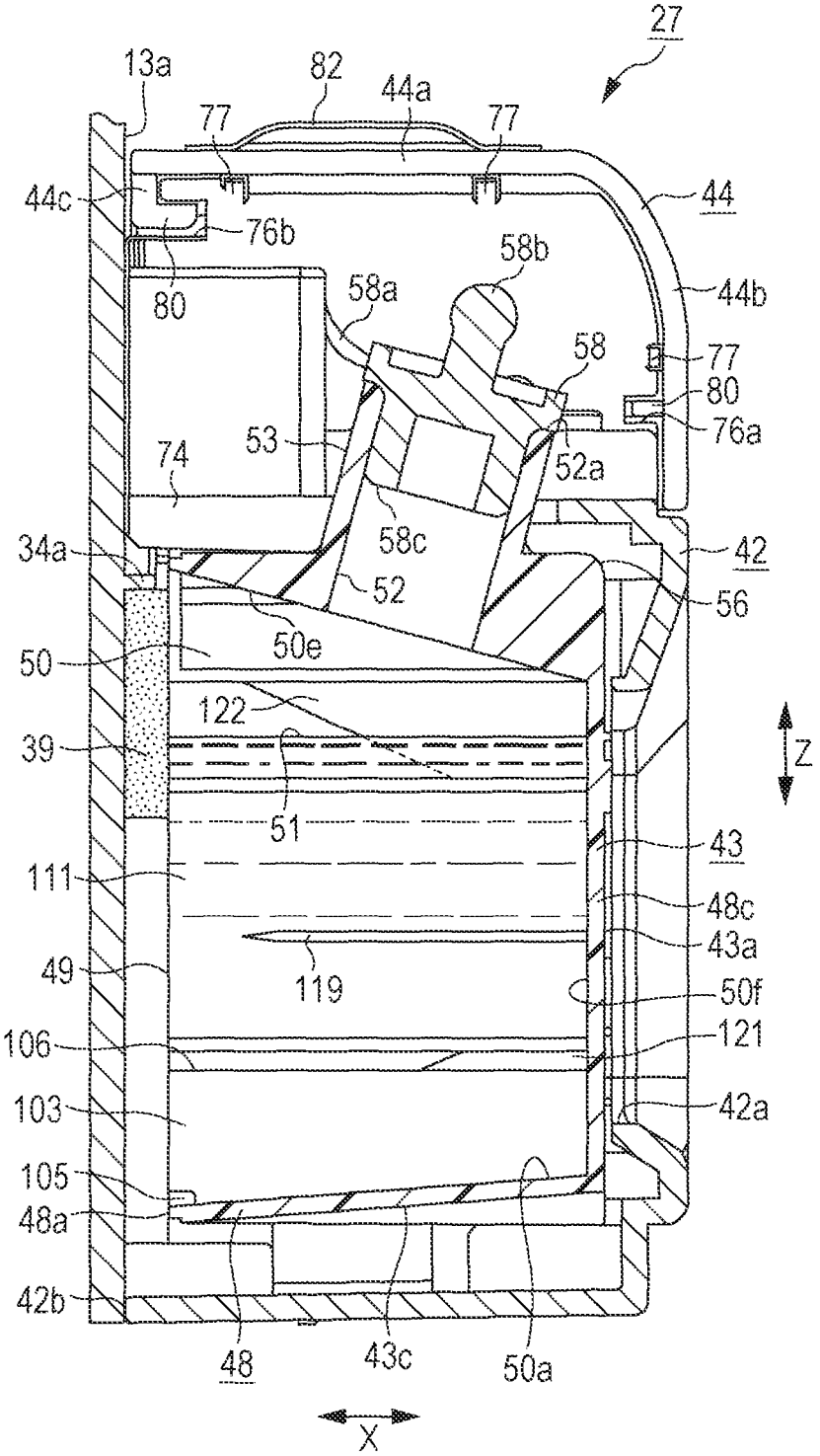
FIG. 26 is a cross-sectional view taken along the line XXVI-XXVI in FIG. 3.
Figure 27:
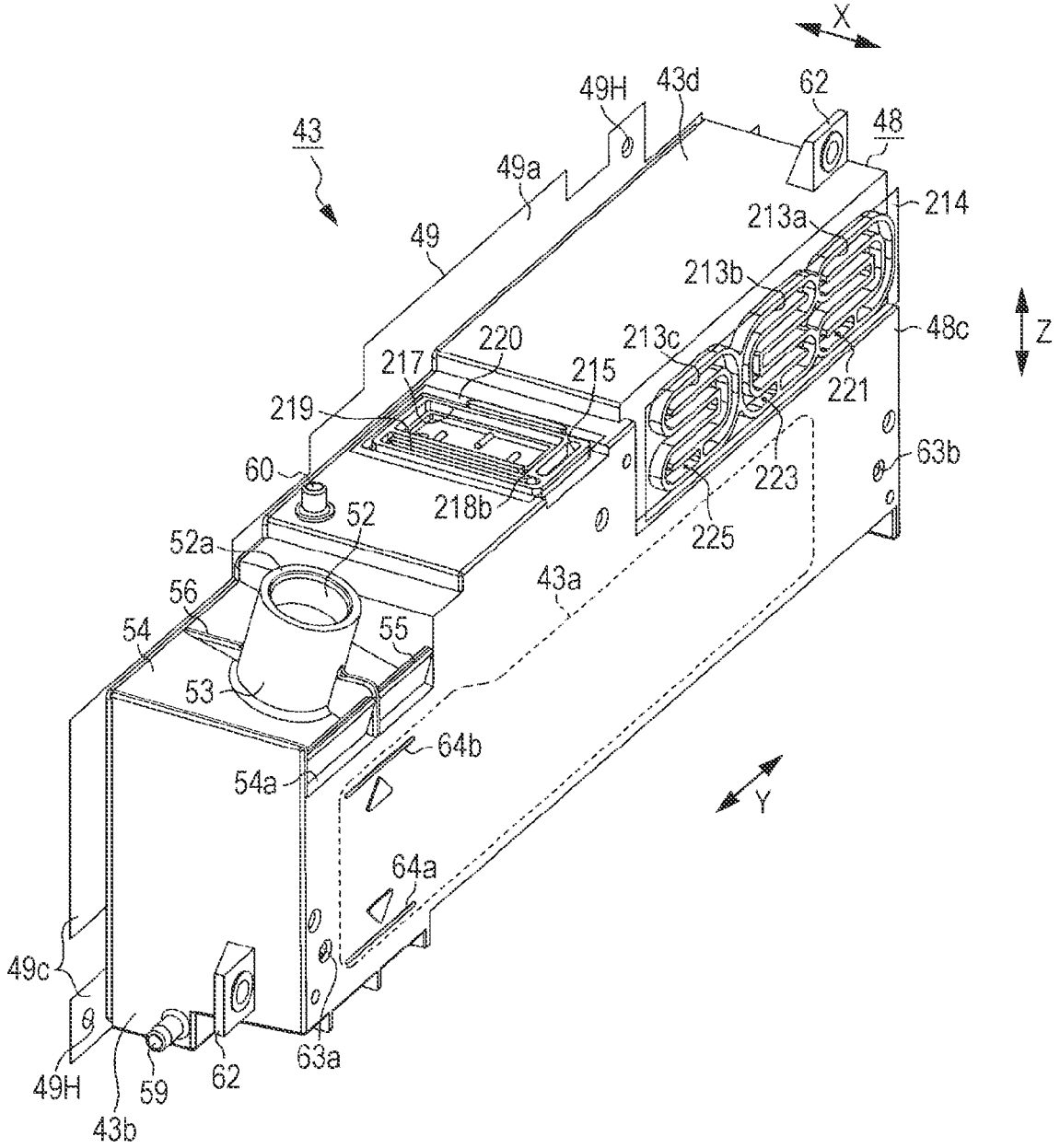
FIG. 27 is a perspective view seen from a right front position of an ink tank.

As illustrated in FIGS. 26 and 27, the injection port 52, which is an example of a liquid injection port through which the ink can be injected into the ink chamber 50, is formed on the upper portion of the container case 48. The injection port 52 is formed in the container case 48 further to one side position (front side in the embodiment) than the intermediate position in the front/rear direction Y, and further to one side position (front side in the embodiment) than the intermediate position in the front/rear direction Y of the visible surface 43*a*. Furthermore, the injection port 52 is formed so as to protrude outward from the ink chamber 50 and to be open in the front end of a cylinder portion 53 protruding toward the upward right direction, which is non-orthogonal to the vertical direction Z and which is a further upward direction than the horizontal direction. Therefore, an end surface 52*a* of the injection port 52 is non-orthogonal to the vertical direction Z.

In addition, when the tank unit 27 is attached to the apparatus main body 13, a tilting direction of the cylinder portion 53 is a direction to which the front end (front surface 52*a*) of the cylinder portion 53 is separated from the attachment surface 13*a*, and a direction approaching the visible surface 43*a*.

As illustrated in FIGS. 25 and 27, the injection port forming surface 54 where the injection port 52 and the cylinder portion 53 are formed in the upper portion of the container case 48 is formed toward the upward right direction (one direction), which intersects the vertical direction Z. That is, the injection port forming surface 54 is tilted so as to be non-orthogonal to the vertical direction Z and such that the visible surface 43*a* is located at a lower position than the position where a base end portion of the cylinder portion 53 is formed.

In the embodiment, the tilt of the injection port forming surface 54 is the same as the tilt of the cylinder portion 53 with respect to the vertical direction Z. Furthermore, the convex barrier portion 55, which is an example of a plate-shaped barrier portion and a protrusion portion, is formed at the further upper position than the visible surface 43*a*, which is the position between the injection port 52 and the visible surface 43*a*. The convex barrier portion 55 is formed to protrude from the injection port forming surface 54. The convex barrier portion 55 is tilted in the same direction as the cylinder portion 53 (injection port 52), and is orthogonal to the injection port forming surface 54. Furthermore, the convex barrier portion 55 is formed to protrude from a position closer to the cylinder portion 53 than the right end, that is, the visible surface 43*a* side, of the injection port forming surface 54. The right end of the injection port forming surface 54 is a stepped portion 54*a*, which is located at a position that is higher up than the visible surface 43*a* and that is between the convex barrier portion 55 and the visible surface 43*a*.

Figure 28:
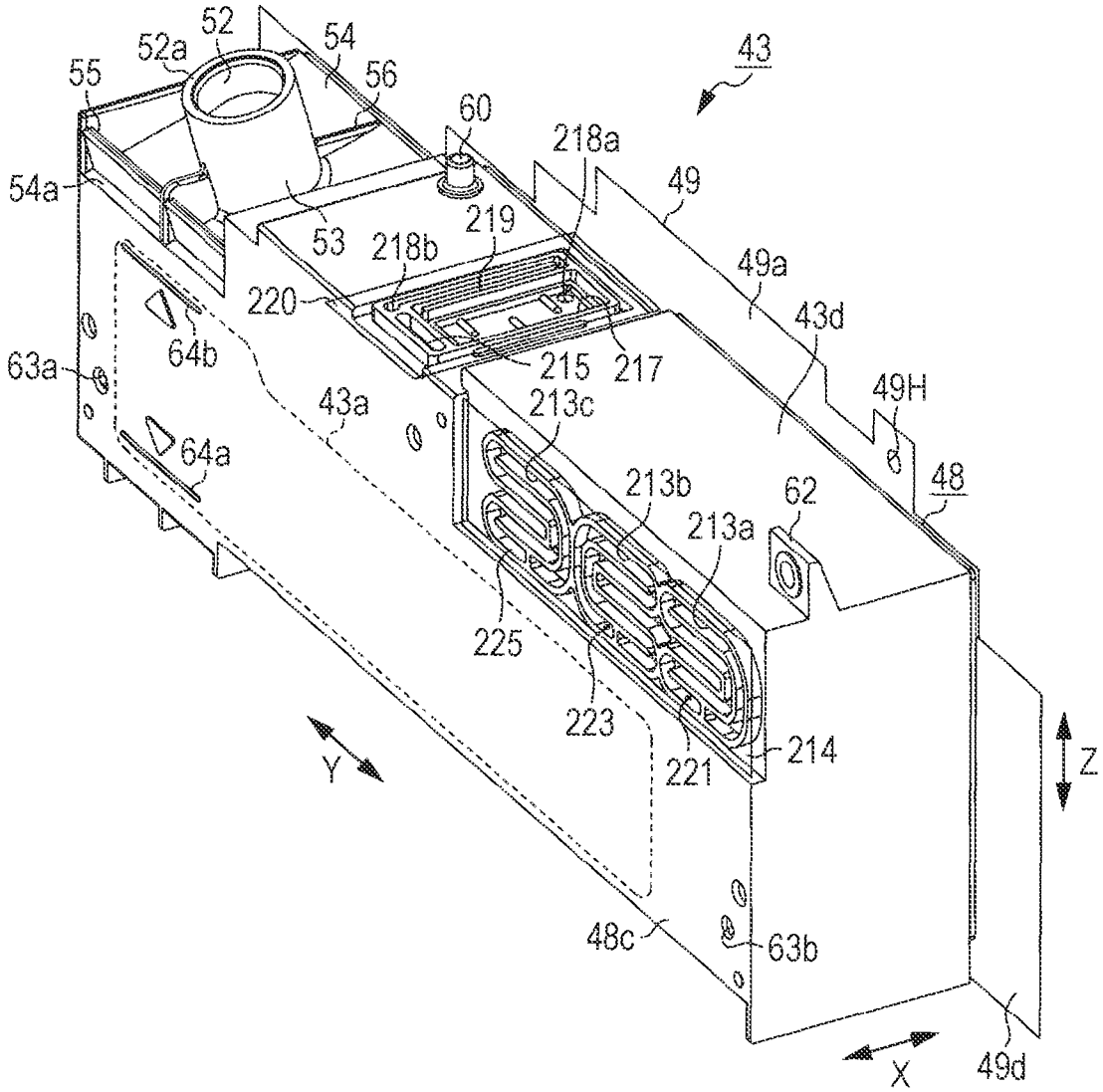
FIG. 28 is a perspective view seen from a right rear position of an ink tank.

As illustrated in FIGS. 27 and 28, the injection port forming surface 54, which is formed in the upper portion of the container case 48 in a descending slope shape from the injection port 52 to the convex barrier portion 55, is located at a lower position in the vertical direction Z than the positions of both side adjacent sections in the front/rear direction Y. That is, both of the front side and the rear side of the injection port forming surface 54 are interposed between walls. Therefore, when ink leaks from the injection port 52, the leaked ink flows down as a leaked liquid on the injection port forming surface 54. Accordingly, the injection port forming surface 54 functions as a flow channel of the leaked ink, and the convex barrier portion 55 is located on the flow channel of the leaked ink.

In addition, the rib portions 56, which respectively extend in the left/right direction X at the left side and the right side of the cylinder portion 53, are formed located on the same line on the injection port forming surface 54 to sandwich the cylinder portion 53 therebetween from both sides in the left/right direction X. Therefore, the injection port forming surface 54 is divided into the front and rear portion by the ribs 56.

Figure 29:
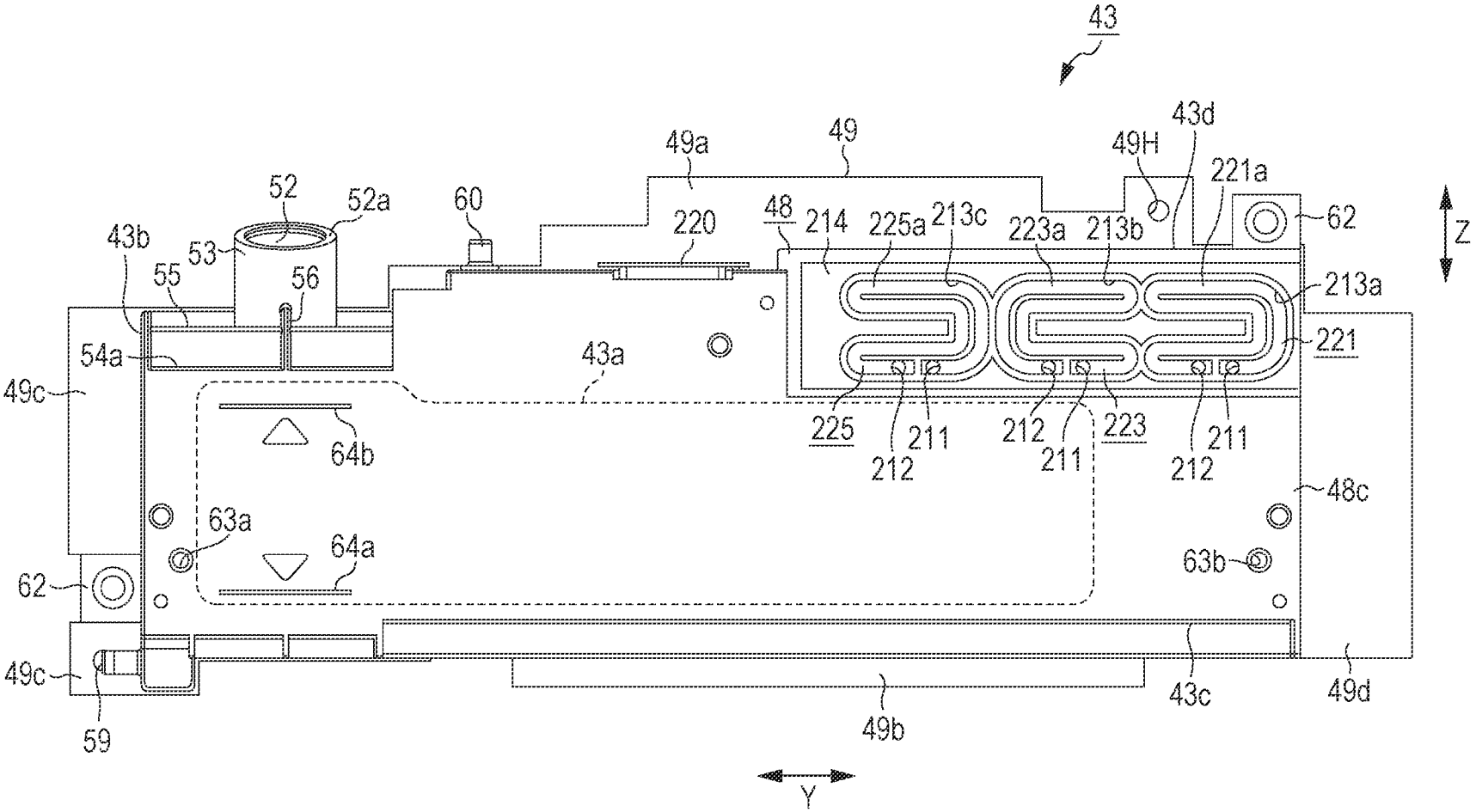
FIG. 29 is a right side view of an ink tank.
Figure 30:
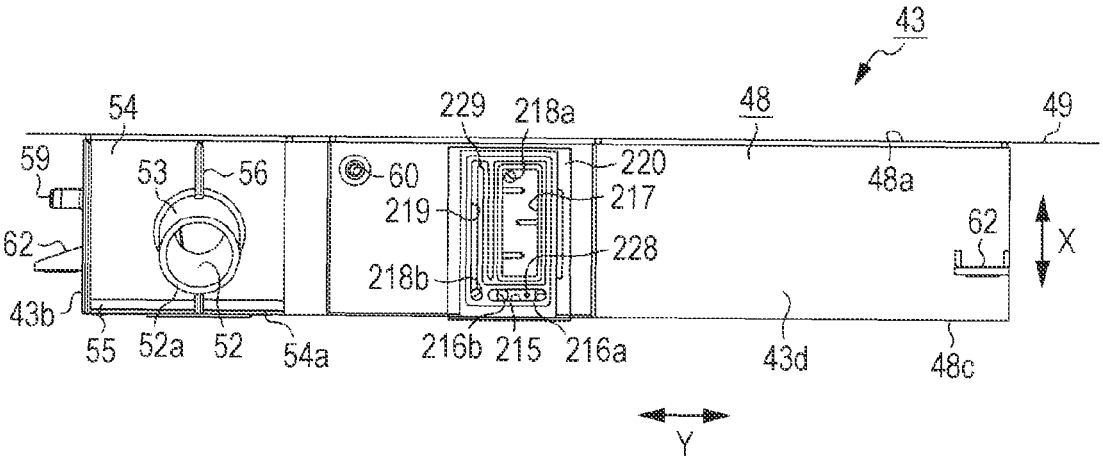
FIG. 30 is a top view of an ink tank.

Furthermore, as illustrated in FIGS. 29 and 30, the widths of the convex barrier portion 55 and the stepped portion 54*a* in the front/rear direction Y, which intersects with the downward right direction (an example of leaking direction) in which leaked ink flows, are wider than the widths of the injection port 52 and the cylinder portion 53.

As illustrated in FIGS. 25 and 26, the closing member 58, which is capable of closing the injection port 52, is detachably attached to the front end of the cylinder portion 53. One end side of the anchoring portion 58*a* is connected to the tank case 42 and the other end side is connected to the closing member 58. Furthermore, the knob portion 58*b* is formed in the upper side of the closing member 58, and the circular tube-shaped fitting portion 58*c* fitted to the injection port 52 is formed in the lower side.

In addition, as illustrated in FIG. 29, the outlet port 59, which is an example of a liquid outlet port from which the liquid contained in the liquid containing chamber flows to the ink contained in the ink chamber 50 to the tube 31 side, is formed at the lower position of the front surface (left side in FIG. 29) of the container case 48. The outlet port 59 is formed further to one side position (front side in the embodiment) in the container case 48 than the intermediate position in the front/rear direction Y, and further to one side position than the intermediate position in the front/rear direction Y of the visible surface 43*a* (front side in the embodiment).

Furthermore, an air opening port 60 which takes the air into the ink chamber 50 to be open to the air is formed on the upper surface having the injection port 52 of the container case 48. The container case 48 has at least one (two in the embodiment) tank locking portion 62 which locks the mounting screw 61 (refer to FIG. 24), which is attached when the container case 48 is fixed to the tank case 42. In addition, the concave positioning portions 63*a* and 63*b*, which are examples of an at least one positioning portion (two in the embodiment), are formed on the right side surface of the container case 48. The concave positioning portion 63*a* (located at the front side in the embodiment) of the concave positioning portions 63*a* and 63*b*, is formed as an elongated hole which is longer in the front/rear direction Y.

In addition, the lower limit scale 64*a*, which is an example of a scale, and the upper limit scale 64*b*, which is an example of the scale, are formed to protrude at the front side position in the visible surface 43*a*. The lower limit scale 64*a* and the upper limit scale 64*b* are formed in the visible surface 43*a* further to one side (front side in the embodiment) than the intermediate position in the front/rear direction Y. Incidentally, in order not to hide the upper limit scale 64*b*, the width of the window portion 42*a* in the vertical direction Z in the front side is wider than the width in the vertical direction Z in the rear side (refer to FIG. 3). Accordingly, the visible surface 43*a* is configured similarly to the window portion 42*a*, such that the width in the vertical direction Z of the front side is wider than the width in the vertical direction Z of the rear side.

The lower limit scale 64*a* is formed further to the outlet port 59 side than the intermediate position in the front/rear direction Y, which is a position further up than the outlet port 59. On the other hand, the upper limit scale 64*b* is formed further to the injection port 52 side than the intermediate position in the front/rear direction Y, and at a position lower down than the injection port 52 and the air opening port 60. The outlet port 59 and the injection port 52 are formed at the same side as each other (front side) in the front/rear direction Y. Therefore, the lower limit scale 64*a* is formed further to the injection port 52 side than the intermediate position in the front/rear direction Y, and a position lower down than the injection port 52 and the upper limit scale 64*b*. Accordingly, the visual surface 43*a* has a plurality of scales on the same side in the front/rear direction Y, separated by a space in the vertical direction Z.

The lower limit scale 64*a* is a scale indicating a lower limit amount as a reference for injecting the ink into the ink chamber 50. In addition, the upper limit scale 64*b* is a scale indicating an upper limit amount of the ink to be injected through the injection port 52 and contained inside the ink chamber 50.

Figure 31:
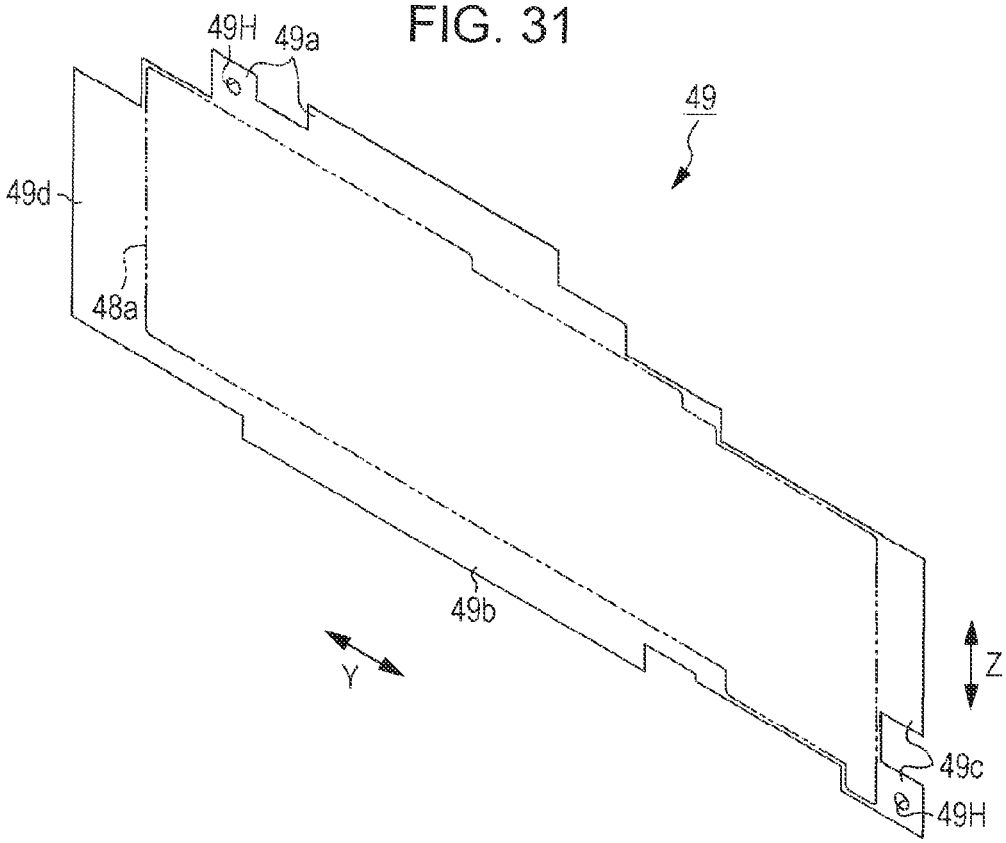
FIG. 31 is a perspective view illustrating a shape of a film.
Figure 32:
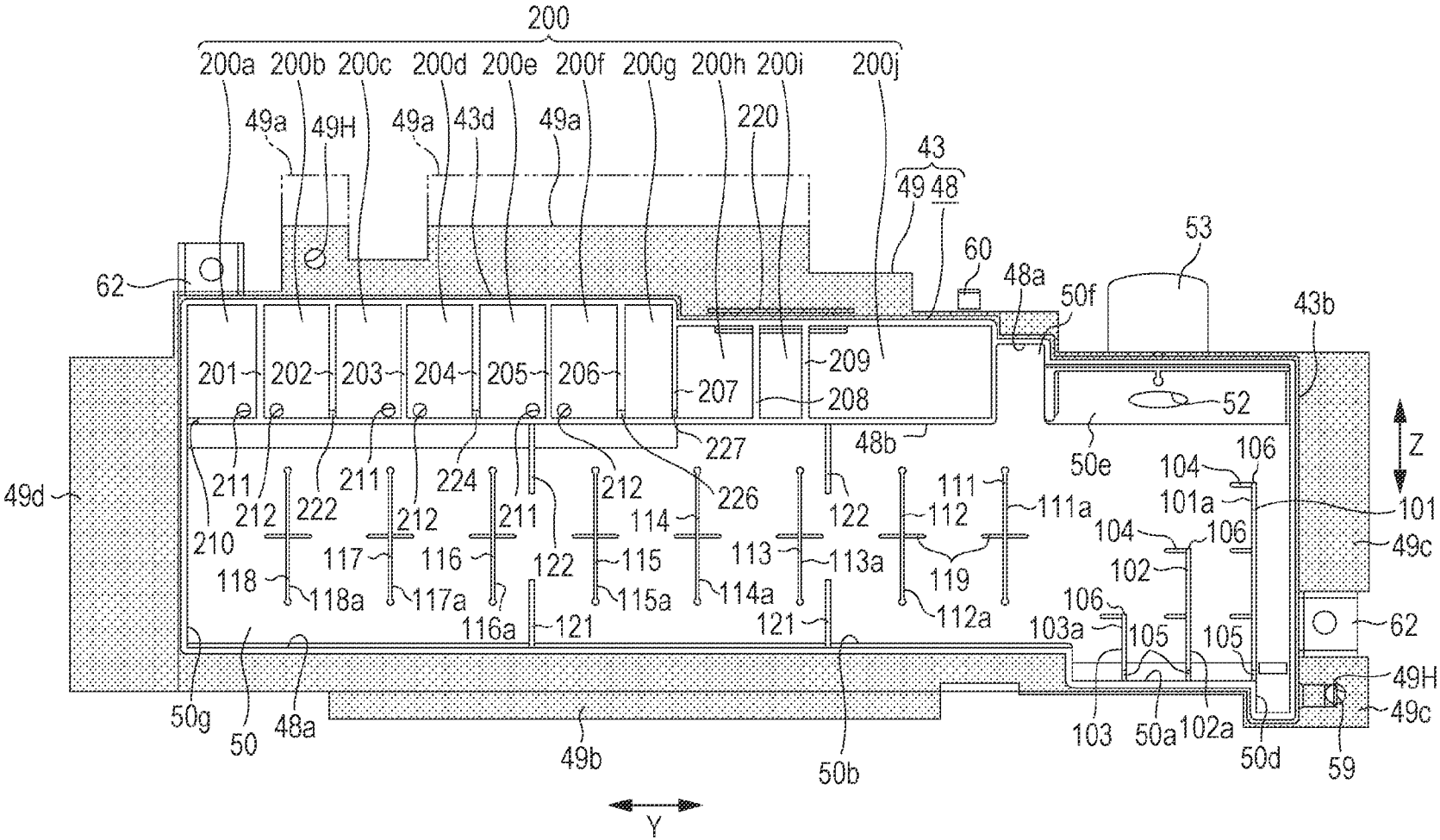
FIG. 32 is a front view of an ink tank seen from an opening portion side thereof.

As illustrated in FIGS. 31 and 32, the film 49 has opening area external portions 49*a*, 49*b*, 49*c* and 49*d* and through holes 49H. The opening area external portions 49*a*, 49*b*, 49*c* and 49*d* are, in the state in which the film 49 is attached to the container case 48, to the outside of the open area of the container opening portion 48*a*, that is, they are positioned to the outside of the container opening portion 48*a* when viewed from the left/right direction X. The through holes 49H are respectively disposed in the opening area external portions 49*a* and 49*c*. In the embodiment, the opening area external portions 49*a* and 49*b* are formed at the two vertical direction Z sides of the container opening portion 48*a*. The opening area external portions 49*c* and 49*d* of the film 49 are formed at the two front/rear direction Y sides of the container opening portion 48*a*. In addition, the through holes 49H disposed in the formed opening area external portions 49*a* and 49*c* are round holes, and are disposed in at least two positions apart from each other in the longitudinal direction (front/rear direction Y) of the ink tank 43. Incidentally, in the embodiment, the through holes 49H are disposed at two positions, that is, positions which are substantially diagonal positions of the container case 48.

Figure 33:
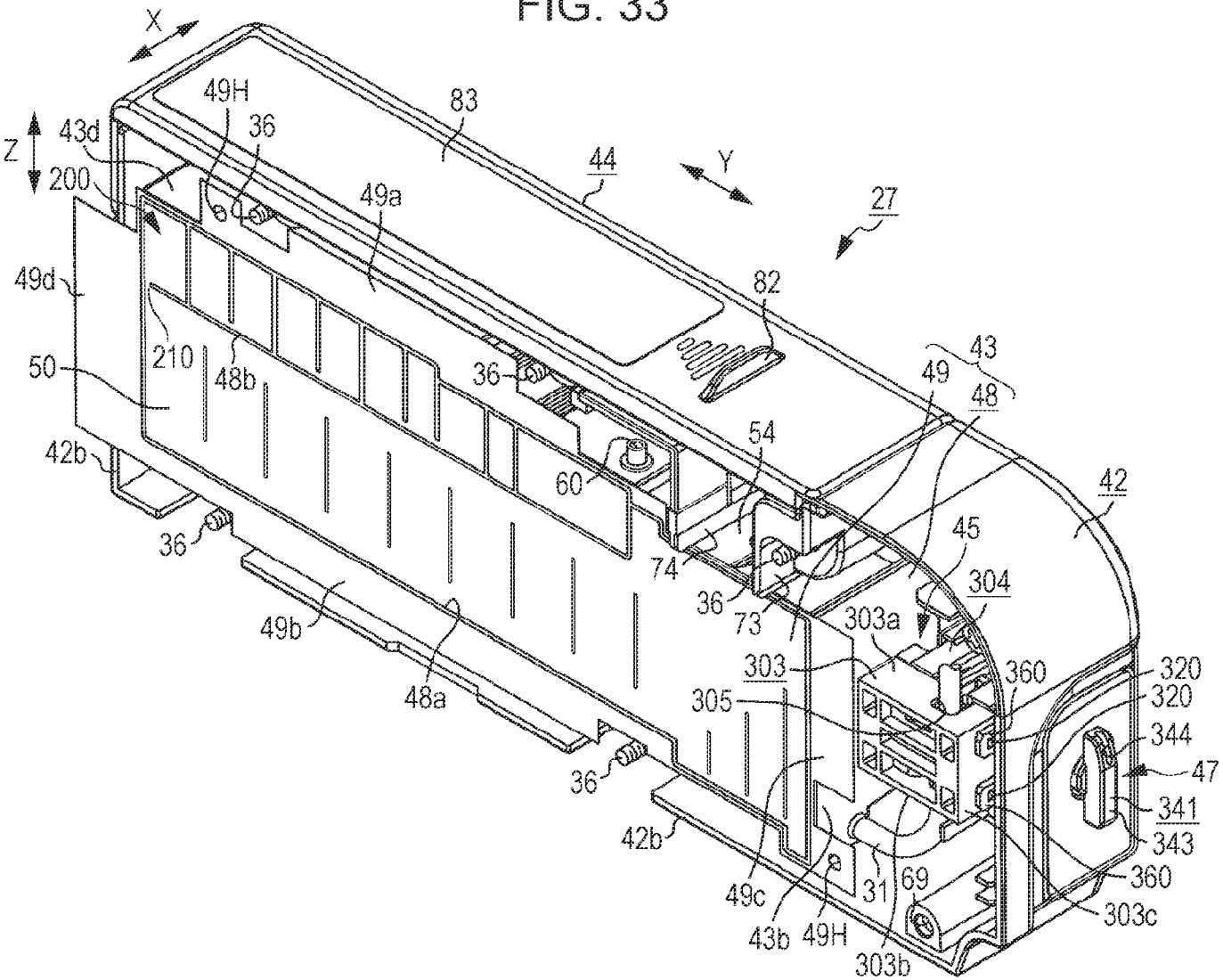
FIG. 33 is a perspective view seen from a left front position of a tank unit to which an ink tank is attached.
Figure 34:
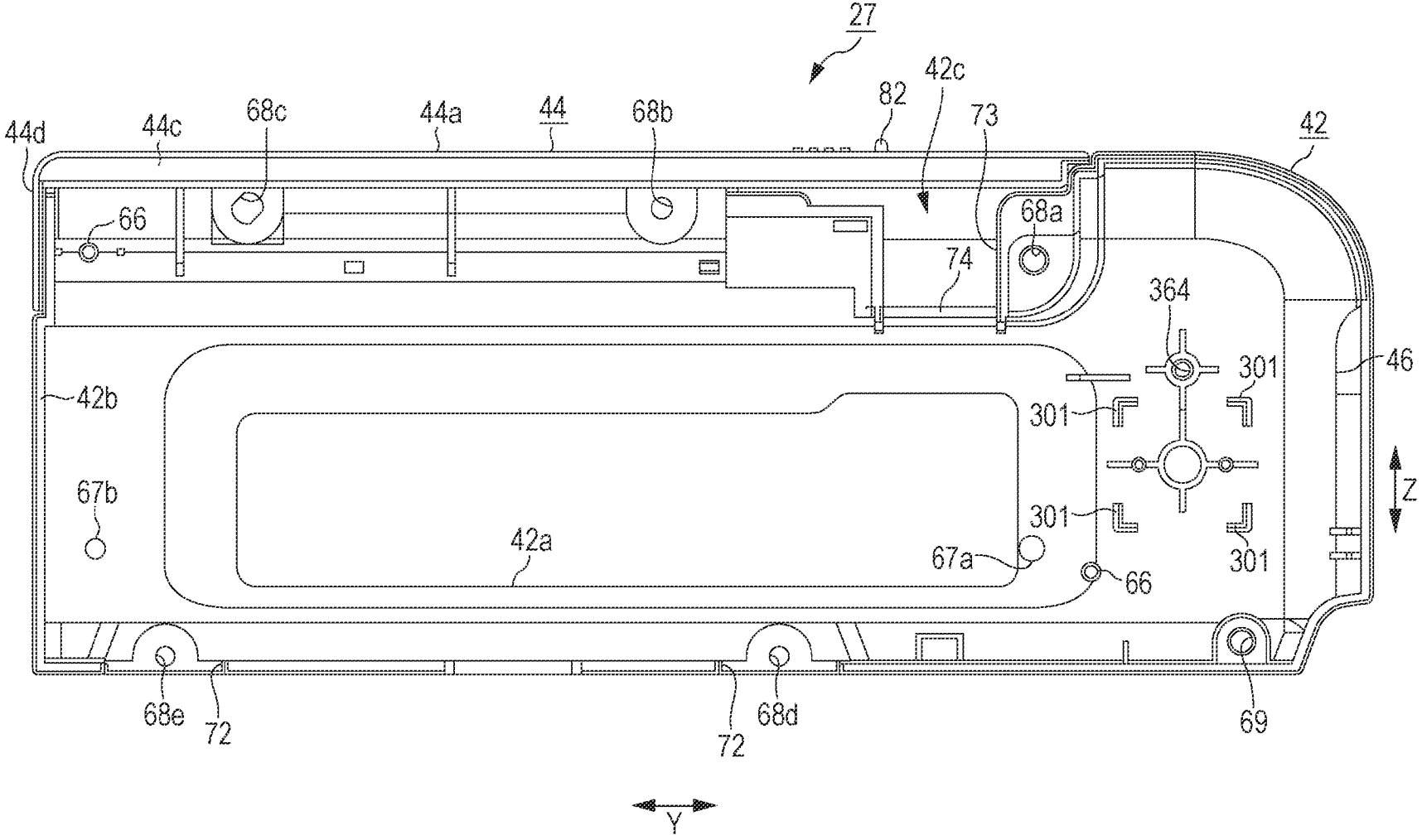
FIG. 34 is a front view of a tank case seen from an opening portion side thereof.

As illustrated in FIGS. 33 and 34, the tank case 42 is five surfaces integrally molded, and has the case opening portion 42*b* at the left side, which is the side attached to the apparatus main body 13. The case opening portion 42*b* is formed larger than the container case 48 in the front/rear direction Y in and the vertical direction Z. Therefore, the tank case 42 is configured to cover the container case 48 in a state of surrounding the container case 48 from the opposite side from the container opening portion 48*a*. In this regard, the tank case 42 functions as an example of a protection member which protects the container case 48.

In addition, there is a gap between the container case 48 and the tank case 42 at both sides in the vertical direction Z and at both sides in the front/rear direction Y. The opening area external portions 49*a*, 49*b*, 49*c* and 49*d* of the film 49 can be respectively accommodated within in the gap.

Figure 35:
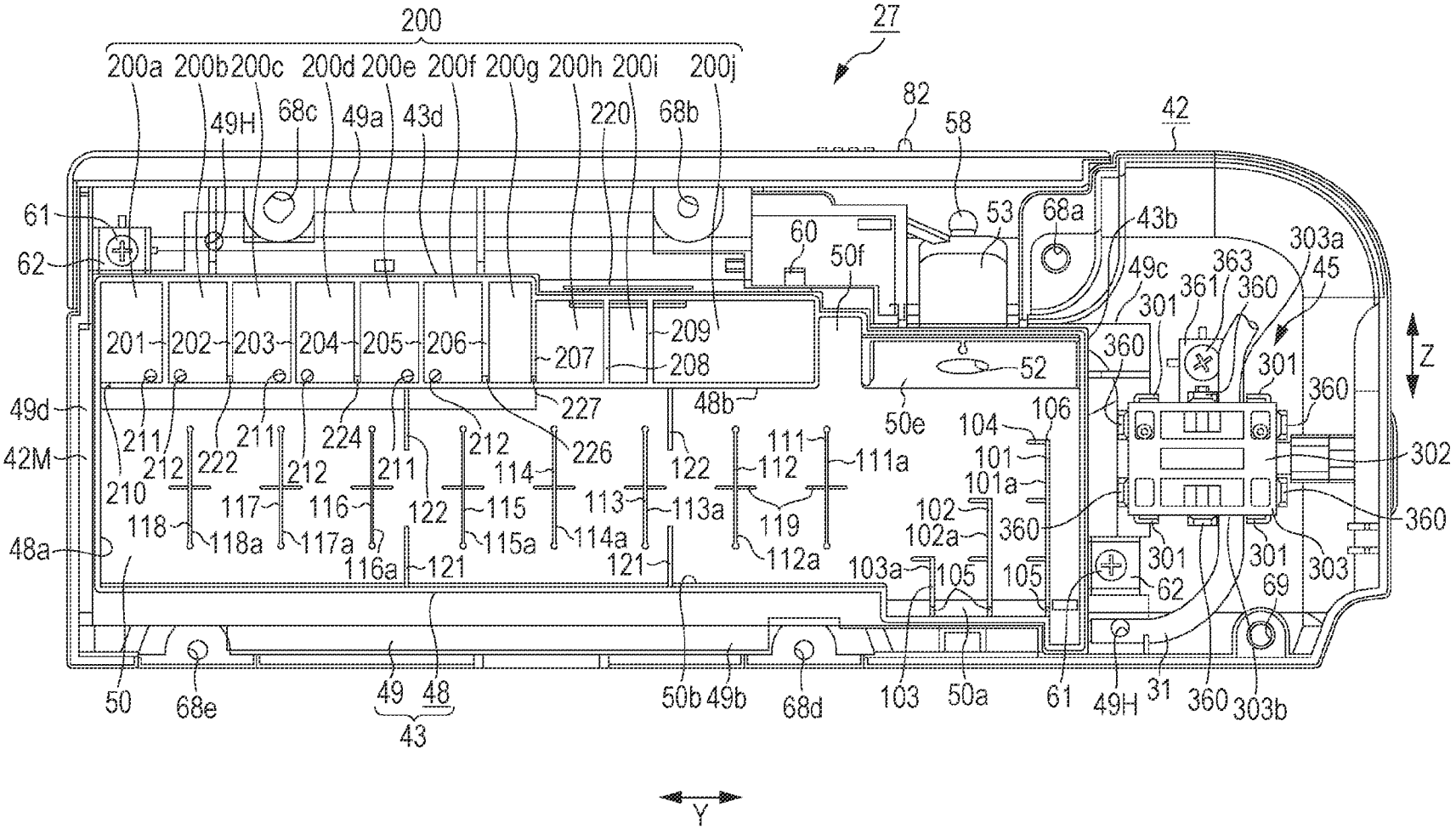
FIG. 35 is a front view of a tank unit seen from an opening portion side of a tank case, and is a view illustrating a state where an opening area external portion of a film is accommodated.

That is, as illustrated in FIGS. 33 and 35, the opening area external portions 49*a* and 49*b* of the film 49 are located within the gap between the container case 48 and the tank case 42 in the vertical direction Z. In addition, the opening area external portion 49*c* is located within the gap between the container case 48 and the tank case 42 at the front side in the front/rear direction Y.

On the other hand, the opening area external portion 49*d* formed on the film 49 has a shape that protrudes outward (to the rear side) from the tank case 42, as illustrated in FIG. 33. The protruding portion is inserted into a groove portion 42M formed as a gap between the tank case 42 and the container case 48, as illustrated in FIG. 35. In this manner, the protruding portion is accommodated inside the groove portion 42M in a folded state. That is, the groove portion 42M is a recessed space having a predetermined width in the front/rear direction Y, a predetermined length in the vertical direction Z, and a predetermined length in the left/right direction X, and is formed as a space for accommodating the opening area external portion 49*d* in a folded state.

Incidentally, as illustrated in FIG. 34, at least one (two in the embodiment) screw portion 66, to which the mounting screw 61 (refer to FIG. 24) can be screwed, is formed at a position that is to the inside of the right side wall portion in which the window portion 42*a* is formed in the tank case 4 and that corresponds to the tank locking portion 62 of the ink tank 432. Furthermore, at least one (two in the embodiment) of the convex positioning portions 67*a* and 67*b*, which are examples of a positioning portion, is formed at a position corresponding to the concave positioning portions 63*a* and 63*b* of the ink tank 43.

In addition, at least one (five in the embodiment) of the case locking portions 68*a* to 68*e* is formed in the tank case 42. The case locking portions 68*a* to 68*e* are examples of a locking portion which locks the screw 36 (refer to FIG. 23) inserted when the tank case 42 is fixedly attached to the apparatus main body 13. That is, the respective first to fifth case locking portions 68*a* to 68*e* are formed to correspond to the screw boss portions 37 formed on the attachment surface 13*a*. In addition, an engagement portion 69 capable of engaging with the boss portion 38 is formed at a position corresponding to the boss portion 38 of the apparatus main body 13 in the tank case 42.

Therefore, as illustrated in FIG. 35, in the embodiment, the opening area external portions 49*a*, 49*b* and 49*c* of the film 49 are in shapes which do not interfere with the attachment of the tank unit 27 to the apparatus main body 13. That is, the screw portion 66 for attaching the ink tank 43 (container case 48) to the tank case 42 and the case locking portions 68*a* to 68*e* for fixedly attaching the tank case 42 to the apparatus main body 13 are formed to be cut out so as not to overlap with each other, when viewed from the inserting direction of the fixing member (screw), that is, from the left/right direction X. In this manner, the film 49 has a shape which does not interfere with an operation to fix the fixing member (screw).

Referring now back to FIG. 32, a method will be described for manufacturing the ink tank 43 of the embodiment, that is, for manufacturing the ink tank 43 by adhering the film 49 to the container opening portion 48*a* of the container case 48. In the embodiment, the film 49 will be described as an example of a film adhered to the container opening portion 48*a* (and the vertical rib portions 111 to 118 formed inside the ink chamber 50) by a welding device (not illustrated) using ultrasonic waves or heat.

First, in a first step, the film 49 is adsorbed and held by a holder (not illustrated, for example, an adsorption pad). At this time, in the film 49, the entire area of the film 49 is adsorbed in such a manner that the opening area external portions 49*a*, 49*b*, 49*c* and 49*d* illustrated by the shaded portion in FIG. 32 are respectively adsorbed. Two pins, which are examples of a positioning member provided in the holder, are inserted into the two through holes 49H respectively disposed at two positions apart from each other in the longitudinal direction. The two through holes 49H are disposed at the substantially diagonal positions of the film 49, which are also the substantially diagonal positions of the container opening portion 48*a*. Accordingly, the film 49 is adsorbed and held by the holder in a stable posture with suppressed rotation.

In the next step, the holder moves the film 49 held by adsorption to a position that opposes, in the vertical direction Z, the container opening portion 48*a* of the container case 48, which is placed on a predetermined placement table with the container opening portion 48*a* facing upward. During this movement, since the pins are inserted into the two through holes 49H, the film 49 is moved without any positional shift that would accompany rotation about an axis in the thickness direction of the film 49.

Then, in the next step, the film 49 which was moved to the position opposing the container opening portion 48*a* is transferred from being held by the holder to closing the container opening portion 48*a*, while being positioned with respect to the container opening portion 48*a* based on the pins inserted into the through holes 49H. Specifically, the container case 48 (container opening portion 48*a*) and the film 49 are aligned by inserting the pins into engagement portions, such as concave portions in the placement table on which the container case 48 is placed. In parallel with this, the adsorption of the holder is stopped, and the opening area external portions 49*a*, 49*b*, 49*c* and 49*d* are adsorbed onto the placement table using a new adsorption pad (not illustrated). In this way, the film 49 is adsorbed in the direction of the placement table, and the film 49 closes the container opening portion 48*a*.

Next, the film 49 covering the container opening portion 48*a* is adhered to the container opening portion 48*a*. In the embodiment, a welding jig (for example, a welding head) comes into contact with the film 49 from the opposite side from the container case 48 placed on the placement table, and welds and adheres the film 49 to the container opening portion 48*a*. During welding to the container opening portion 48*a*, the film 49 is of course also adhered to the respective ribs (for example, the intersecting rib portions 101 to 103 or the vertical rib portions 111 to 118 illustrated in FIG. 24) inside the ink chamber 50.

Incidentally, as illustrated by the two-dot chain line in FIG. 32, the width at which some of the opening area external portions 49*a*, 49*b* and 49*c*, for example, the opening area external portion 49*a*, which serves an adsorption band of the film 49, protrudes from the container opening portion 48*a* may be broadened in order to improve the adsorption ability. In this case, the opening area external portion 49*a* may protrude outward from the tank case 42 in a state where the tank case 42 is fixedly attached to the apparatus main body 13. Thus, in the embodiment, similarly to the opening area external portion 49*d*, the opening area external portion 49*a* of the film 49 is folded and accommodated in the gap disposed between the ink tank 43 and the tank case 42 (refer to FIG. 35). Therefore, in this case, in the embodiment, the gap in which the opening area external portion 49*a* can be folded and accommodated is disposed between the ink tank 43 and the tank case 42. The same configuration can also applied to the opening area external portions 49*b* and 49*c*.

Next, an inner structure of the ink chamber 50 will be described.

As illustrated in FIG. 24, one surface side (lower surface side in FIG. 24) of the ink chamber 50 in the longitudinal direction thereof (front/rear direction Y) is a bottom portion. The bottom portion of the ink chamber 50 is provided with a basal surface 50*a*, a stepped bottom surface 50*b*, and a stepped side surface 50*c*. The stepped bottom surface 50*b* has a step so as to be higher than the basal surface 50*a* and is arrayed in parallel with the basal surface 50*a* in the front/rear direction Y. The stepped side surface 50*c* has an upper end side that intersects with the stepped bottom surface 50*b*, whereas the lower end side intersects with the basal surface 50*a*.

The length of the basal surface 50*a* in the front/rear direction Y is shorter than the length of the stepped bottom surface 50*b*. The basal surface 50*a* and the stepped side surface 50*c* are disposed at a first end side (front end side in the embodiment) of the bottom portion in the front/rear direction Y. In addition, the length of the stepped side surface 50*c* in the vertical direction Z is shorter than the length of the basal surface 50*a* in the front/rear direction Y and the length of the stepped bottom surface 50*b* in the front/rear direction Y.

A liquid collecting recess portion 50*d* is a recess opening up to the basal surface 50*a* in the bottom portion of the ink chamber 50, at a position at the end portion side (front end side) of the basal surface 50*a* in the front/rear direction Y, which is the end portion side (front side obliquely to the left in FIG. 24) in the short direction (left/right direction X). The length of the opening portion of the liquid collecting recess portion 50*d* in the front/rear direction Y and the left/right direction X is shorter than the length of the basal surface 50*a*. The outlet port 59 is disposed on the ink tank 43 at a position corresponding to the inner surface of the liquid collecting recess portion 50*d*, which is the first end side (front end side) of the basal surface 50*a* in the front/rear direction Y.

The basal surface 50*a* is tilted such that the end portion side that is the outlet port 59 side in the left/right direction X (closer side and slanting leftward in FIG. 24) is lower. In addition, the injection port 52 for injecting ink into the ink chamber 50 is arranged above the basal surface 50*a*.

As illustrated in FIGS. 24 and 32, at least one or at least two (three in the embodiment) intersecting rib portions 101 to 103 are disposed inside the ink chamber 50 so as to intersect the basal surface 50*a*, which is located lower than the injection port 52. The intersecting rib portions 101 to 103 protrude upward from the basal surface 50*a* and are separated from each other in the front/rear direction Y (an example of a first direction).

In addition, the intersecting rib portions 101 to 103 are disposed so as to extend in the left/right direction X (an example of a second direction). The front/rear direction Y in the embodiment is a direction in the direction away from the injection port 52 while intersecting with the direction of gravity, and is the longitudinal direction of the ink chamber 50. Furthermore, the left/right direction X is a direction orthogonal to both of the direction of gravity and the front/rear direction Y.

In addition, in the embodiment, the first intersecting rib portion 101 and the second intersecting rib portion 102 of the intersecting rib portions 101 to 103 are formed further to the outlet port 59 side than the injection port 52 in the front/rear direction Y. That is, the first intersecting rib portion 101 and the second intersecting rib portion 102 are formed at a position between the injection port 52 and the outlet port 59 in the front/rear direction Y, and function as an example of a second rib. In addition, the first intersecting rib portion 101 of the first intersecting rib portion 101 and the second intersecting rib portion 102 is located at a position separated further from the injection port 52 than is the second intersecting rib portion 102, and the second intersecting rib portion 102 is located closer to the injection port 52 side than is the first intersecting rib portion 101. The first intersecting rib portion 101 and the second intersecting rib portion 102 partition a portion of the basal surface 50*a* side in the ink chamber 50 into a first area at the outlet port 59 side (front side) and a second area at the opposite side to the area at the front side in the front/rear direction Y.

The intersecting rib portions 101 to 103 protrude upward to different heights from the basal surface 50*a*. That is, among the intersecting rib portions 101 to 103, the first intersecting rib portion 101, which separated from the injection port 52 and located closest to the outlet port 59 side in the front/rear direction Y, protrudes to a higher height than the protruding height of the second intersecting rib portion 102 and the third intersecting rib portion 103. Furthermore, the protruding height of the second intersecting rib portion 102 is higher than the protruding height of the third intersecting rib portion 103, which is located at a position (of the rear side) farther apart from the outlet port 59 in the front/rear direction Y than the second intersecting rib portion 102. In other words, the intersecting rib portions 101 to 103 are arranged so that their heights are gradually lower with separation from the outlet port 59. Therefore, the gaps between the upper surface 50*e* of the ink chamber 50, on which the injection port 52 is arranged, and the intersecting rib portions 101 to 103 are respectively different from each other. Specifically, the gap between the second intersecting rib portion 102 and the upper surface 50*e* is broader than the gap between the first intersecting rib portion 101 and the upper surface 50*e*, and is narrower than the gap between the third intersecting rib portion 103 and the upper surface 50*e*.

The basal surface 50*a* and the stepped bottom surface 50*b*, which is an example of the bottom surface of the ink chamber 50, are located at the further lower side than that of the injection port 52. The upper surface 50*e* of the ink chamber 50 is a surface facing downward, and is located higher up than the basal surface 50*a* and the stepped bottom surface 50*b*. That is, in the embodiment, the injection port 52 is formed in the upper surface 50*e*, and the lower side surface of the partition wall 48*b* is the upper surface 50*e*.

In addition, a first extension portion 104, which is an example of an extension portion extending to the opposite side (rear side) to the outlet port 59, is formed in each of the intersecting rib portions 101 to 103. The first extension portions 104 are formed to be orthogonal to a right side surface 50*f*, in a substantially right-angled triangular shape in a top view, such that their width in the front/rear direction Y gradually broadens from the container opening portion 48*a* side of the container case 48 to the right side surface 50*f* side of the ink chamber 50. The right side surface 50*f* is a surface extending in the front/rear direction Y and extending in the vertical direction Z.

That is, the intersecting rib portions 101 to 103 and the first extension portions 104 are integrally molded with the container case 48 so as to be orthogonal to the right side surface 50*f* of the container case 48 and so as to protrude from the right side surface 50*f* side to the container opening portion 48*a* side. In other words, the intersecting rib portions 101 to 103 and the first extension portions 104 are formed to protrude from the right side surface 50*f* of the ink chamber 50.

Furthermore, the width of the intersecting rib portions 101 to 103 in the left/right direction X is substantially equal to the width from the right side surface 50*f*, which is the inner side surface of the container case 48, to the container opening portion 48*a*. That is, the intersecting rib portions 101 to 103 are formed following the left/right direction X of the ink chamber 50. Therefore, when the film 49 is adhered to the container opening portion 48*a*, the film 49 is also adhered to bonding surfaces 101*a* to 103*a*, which are the left ends of the intersecting rib portions 101 to 103. In addition, the lower end of each intersecting rib portions 101 to 103 is formed to be recessed from the bonding surfaces 101*a* to 103*a* in the direction of the right side surface 50*f*. Accordingly, when the intersecting rib portions 101 to 103 are bonded to the film 49, the recessed portion of the intersecting rib portions 101 to 103 functions as a first communication portion 105. That is, the first communication portions 105 are disposed between the basal surface 50*a* and the respective intersecting rib portions 101 to 103.

In addition, the respective intersecting rib portions 101 to 103 are formed separated from the upper surface 50*e*. Accordingly, when the film 49 is adhered, the upper side of each of the intersecting rib portions 101 to 103 functions as a second communication portion 106. That is, the second communication portion 106 is disposed between the upper surface 50*e* and the respective intersecting rib portions 101 to 103. In addition, the intersecting rib portions 101 to 103 have a plurality of (two in the embodiment) communication portions 105 and 106 at different positions from each other in the vertical direction Z. In addition, the first intersecting rib portion 101 and the second intersecting rib portion 102 protrude to different heights from the basal surface 50*a*. Thus, the protruding heights from each upper surface 50*e* of the first intersecting rib portion 101 and the second intersecting rib portion 102 are different from each other. Therefore, the communication portion 106 of each the first intersecting rib portion 101 and the second intersecting rib portion 102 is located at a different position in the vertical direction Z. Then, the areas partitioned in the front/rear direction Y by the respective intersecting rib portions 101 to 103 communicate with each other via the communication portions 105 and 106.

In addition, at least two or at least three (eight in the embodiment) vertical rib portions 111 to 118, which are examples of a first rib, are formed inside the ink chamber 50, further to the rear side than the injection port 52. That is, the vertical rib portions 111 to 118 extend in the left/right direction X, at positions in the front/rear direction Y opposite from (rear side of) the outlet port 59 as viewed from the injection port 52. Furthermore, the vertical rib portions 111 to 118 are formed to extend in the vertical direction Z, which is the direction intersecting with the stepped bottom surface 50*b*, and separated from each other in the front/rear direction Y.

The vertical rib portions 111 to 118 are formed with a space between themselves and the stepped bottom surface 50*b* and the partition wall 48*b* in the vertical direction Z, and a rear side surface 50*g* of the ink chamber 50 in the front/rear direction Y. That is, at least a portion of the vertical rib portions 111 to 118 is located between the upper surface 50*e* and the stepped bottom surface 50*b* in the vertical direction Z.

In addition, the vertical rib portions 111 to 118 are located further upward so as to be apart from the stepped bottom surface 50*b*. Furthermore, the vertical rib portions 111 to 118 are located further downward so as to be apart from the partition wall 48*b*. In both of the front side and the rear side of the vertical rib portions 111 to 118, the second extension portion 119 is formed to be orthogonal to the right side surface 50*f* in a substantially right-angled triangular shape in a top view, such that the width in the front/rear direction Y gradually broadens from the container opening portion 48*a* side of the container case 48 to the right side surface 50*f* side of the ink chamber 50.

Furthermore, first protruding portions 121, which are examples of a reinforcement rib portion protruding upward from the stepped bottom surface 50*b*, are formed between the second vertical rib portion 112 and the third vertical rib portion 113, and between the fifth vertical rib portion 115 and the sixth vertical rib portion 116. Furthermore, second protruding portions 122, which protrude downward from the partition wall 48*b*, are formed above the first protruding portions 121.

The protruding portions 121 and 122 form a substantially right-angled triangular shape in a front view such that the width in the vertical direction Z gradually narrows from the right side surface 50*f* to the container opening portion 48*a* side (left side).

The vertical rib portions 111 to 118, the second extension portions 119, and the protruding portions 121 and 122 are integrally molded with the container case 48 so as to be orthogonal to the right side surface 50*f* and so as to protrude from the right side surface 50*f* side to the container opening portion 48*a* side. In other words, the vertical rib portions 111 to 118, the second extension portions 119, and the protruding portions 121 and 122 are formed to protrude from the right side surface 50*f*.

Furthermore, the width of the vertical rib portions 111 to 118 in the left/right direction X is substantially equal to the width from the right side surface 50*f* to the container opening portion 48*a*. That is, the vertical rib portions 111 to 118 are formed in the left/right direction X in the ink chamber 50. Therefore, when the film 49 is adhered to the container opening portion 48*a* to, the film 49 is also adhered to the bonding surfaces 111*a* to 118*a*, which are the left ends of the vertical rib portions 111 to 118. Therefore, when the film 49 is adhered to the vertical rib portions 111 to 118, the areas partitioned in the front/rear direction Y by the respective vertical rib portions 111 to 118 communicate with each other via the gap between the vertical rib portions 111 to 118 and the stepped bottom portion 50*b*, and via the gap between the vertical rib portions 111 to 118 and the partition wall 48*b*.

Next, the air chamber 200 will be described.

As illustrated in FIGS. 24 and 32, the air chamber 200 is interposed between the ink chamber 50 and the air opening port 60 in the ink tank 43. When the ink tank 43 is in the orientated as when used (posture state illustrated in FIGS. 3 to 26), wherein the ink tank 43 is fixed to the recording apparatus 12, the air chamber 200 is located at the further upper side than that of the ink chamber 50, with the partition wall 48*b* as the boundary. The air chamber 200 includes a plurality (ten chambers in the embodiment) of small air chambers 200*a* to 200*j* which are partitioned adjacent to each other in the front/rear direction Y by division walls 201 to 209, which have wall surfaces that extend in the left/right direction X.

Within a plurality of the small air chambers 200*a* to 200*j*, the first small air chamber 200*a* at the rearmost side (leftmost in FIGS. 24 and 32) communicates with the ink chamber 50 through a communication port 210 that is formed in the vertical direction Z to pass through the partition wall 48*b*, which is the bottom wall of the first small air chamber 200*a*. On the other hand, within the respective small air chambers 200*a* to 200*j*, the tenth small air chamber 200*j* at the frontmost side (rightmost in FIGS. 24 and 32) communicates with atmosphere through the air opening port 60 formed on the upper wall of the container case 48, which is the upper wall of the tenth small air chamber 200*j*.

The first division wall 201 is the rearmost of the respective division walls 201 to 209 and divides the space into the first small air chamber 200*a* and the second small air chamber 200*b*, which is located one ahead of the first small air chamber 200*a* to the front side. The second division wall 202, which faces the second small air chamber 200*b* from the front side, divides the space into the second small air chamber 200*b* and the third small air chamber 200*c* which is located one ahead of the second small air chamber 200*b* to the front side. Similarly, the respective division walls 203 to 208 from the third division wall 203 to the eighth division wall 208 divide the space into the small air chambers (for example, the small air chamber 200*c* and the small air chamber 200*d*, the small air chamber 200*d*, the small air chamber 200*e*, and the like) located at the respective front and rear sides. The ninth division wall 209 located at the frontmost side divides the space into the tenth small air chamber 200*j*, which is the frontmost, and the ninth small air chamber 200*i*, which is located one behind the tenth small air chamber 200*j*.

The respective small air chambers 200*a* to 200*j* from the first small air chamber 200*a* to the tenth small air chamber 200*j*, which are divided by the respective division walls 201 to 209 and arranged in series in the front/rear direction Y, are linked together to enable communication between adjacent small air chambers in the front/rear direction Y (for example, the small air chamber 200*a* and the small air chamber 200*b*, the small air chamber 200*b* and the small air chamber 200*c*, and the like).

Herein, a communication configuration between the respective small air chambers 200*a* to 200*j* will now be described.

As illustrated in FIG. 32, a first opening 211 is formed in an inner surface of the first small air chamber 200*a* other than the first division wall 201 (surface portion of the innermost side of the first small air chamber 200*a* in FIG. 32) so as to pass through the side wall 48*c* opposite to the container opening portion 48*a* of the container case 48. The first opening 211 has an opening area is smaller than the area of the wall surface facing the first small air chamber 200*a* on the first division wall 201. Similarly, a second opening 212 is formed in in an inner surface of the second small air chamber 200*b* other than the first division wall 201 (surface portion of the innermost side of the second small air chamber 200*b* in FIG. 32), through the side wall 48*c* of the container case 48. The second opening 212 has an opening area smaller than the area of the wall surface facing the second small air chamber 200*b* on the first division wall 201.

The first opening 211 and the second opening 212 are formed at positions where the distance from the partition wall 48*b* to the first opening 211 in the vertical direction Z is equal to the distance from partition wall 48*b* to the second opening 212. Incidentally, in the embodiment, the first opening 211 and the second opening 212 are respectively formed in the surface portion of the innermost side of the first small air chamber 200*a* and the second small air chamber 200*b*, at corners that are in the vicinity of the wall surface of the first division wall 201 and that are in the vicinity of the partition wall 48*b*. That is, the first opening 211 and the second opening 212 are formed at positions where the first opening 211 and the second opening 212 are line-symmetrical to each other on either side of the first division wall 201.

Similarly, as illustrated in FIG. 32, a first opening 211 and a second opening 212 are formed to pass through the side wall 48*c* of the container case 48 in the surface portion at the innermost side of the third small air chamber 200*c* and the surface portion at the innermost side of the fourth small air chamber 200*d*. This first opening 211 and the second opening 212 have opening areas smaller than the area of the wall surface on the third division wall 203 between the small air chambers 200*c* and 200*d*. The first opening 211 and the second opening 212 in this case are also each formed at positions that are in the vicinity of the partition wall 48*b* and that are in the corner in the vicinity of the wall surface of the third division wall 203, that is, at positions where the first opening 211 and the second opening 212 are line-symmetrical to each other on either side of the third division wall 203.

Similarly, as illustrated in FIG. 32, a first opening 211 and a second opening 212 are formed to pass through the side wall 48*c* of the container case 48 in the surface portion at the innermost side of the fifth small air chamber 200*e* and the surface portion at the innermost side of the sixth small air chamber 200*f*. This first opening 211 and second opening 212 have opening areas smaller than the area of the wall surface on the fifth division wall 205 between the small air chambers 200*e* and 200*f*. The first opening 211 and the second opening 212 in this case are also each formed at positions that are in the vicinity of the partition wall 48*b* and that are in the corner in the vicinity of the wall surface of the fifth division wall 205, that is, at positions where the first opening 211 and the second opening 212 are line-symmetrical to each other on either side of the fifth division wall 205.

On the other hand, as illustrated in FIG. 29, in the container case 48 of the ink tank 43, long meandering groove portions 213*a* to 213*c* are formed in the side wall's 48*c* outer surface (right side surface in the embodiment), which is the opposite side from the container opening portion 48*a*. One end side of each of the meandering groove portions 213*a* to 213*c* communicates with the first opening 211 and the other end communicates with the second opening 212. In the embodiment, the first long groove portion 213*a* is formed in the area which is the rearmost side at the upper side on the outer surface on the side wall 48*c* of the container case 48, and connects the first opening 211, which is in communication with the first small air chamber 200*a*, to the second opening 212, which is in communication with the second small air chamber 200*b*.

The second long groove portion 213*b* is formed in the adjacent area to the front side of the first long groove portion 213*a* forming area, and connects the first opening 211, which is in communication with the third small air chamber 200*c*, to the second opening 212, which is in communication with the fourth small air chamber 200*d*. The third long groove portion 213*c* is formed in the adjacent area to the front side of the second long groove portion 213*b* forming area, and connects the first opening 211, which is in communication with the fifth small air chamber 200*e*, to the second opening 212, which is in communication with the sixth small air chamber 200*f*.

A film 214 is adhered (for example, heat welded) to the outer surface of the side wall 48*c* of the container case 48 in order to cover the forming areas of these three long groove portions 213*a* to 213*c*. The film 214 is an example of a covering member arranged so as to cover the respective long groove portions 213*a* to 213*c*. As a result, three communication channels 221, 223 and 225 are formed in the outer surface side of the side wall 48*c* of the container case 48, between three of the communication channels 213*a* to 213*c* and the film 214 covering these. The flow channel cross-sectional areas of the communication channels 221, 223 and 225 are respectively smaller than the area of the wall surface of the respective first, third, and fifth division walls 201, 203 and 205.

These three communication channels 221, 223 and 225 are formed following the long meandering groove portions 213*a* to 213*c*. Accordingly, the respective communication channels 221, 223 and 225 connect the first opening 211 and the second opening 212 together by a longer distance than the distance between small air chambers that are in communication with each other (for example, the small air chamber 200*a* and the small air chamber 200*b*). In addition, as can be understood from FIGS. 29 and 32, these three communication channels 221, 223, and 225 have flow channel portions (in FIG. 29, the portion at the uppermost position of each long groove portion 213*a* to 213*c* that extends in the horizontal direction) 221*a*, 223*a* and 225*a* that are separated higher up from the partition wall 48*b* than the first openings 211 and the second openings 212. That is, the distance from the partition wall 48*b* to at least a portion of the communication channels 221, 223 and 225 (as an example, the above-described flow channel portions 221*a*, 223*a* and 225*a*) is longer than the distance from the partition wall 48*b* to the first opening 211.

As illustrated in FIGS. 24 and 32, the second division wall 202, the fourth division wall 204, the sixth division wall 206, and the seventh division wall 207 of the division walls 201 to 209 have communication channels 222, 224, 226, and 227 which pass through those division walls 202, 204, 206, and 207 in the front/rear direction Y. Specifically, the division walls 202, 204, 206 and 207 each have a rectangular-shaped wall surface. The communication channels 222, 224, 226 and 227 are formed in the rectangular-shaped wall surface as rectangular-shaped cutouts at corner portions that are on the container opening portion 48*a* side of the container case 48 and that are on the partition wall 48*b* side. Adjacent small air chambers, for example, the seventh small air chamber 200*g* and the eighth small air chamber 200*h*, in the front/rear direction Y of the division walls 202, 204, 206, and 207, in which are formed the communication channels 222, 224, 226 and 227, are in communication with each other through the respective communication channels 222, 224. 226 and 227 so as to enable ventilation.

As illustrated in FIGS. 27, 28 and 30, a straight line-shaped narrow groove 215 is narrow is formed on the upper surface on which the air opening port 60 of the container case 48 is formed. The narrow groove 215 has a narrow width in the left/right direction X and extends in the front/rear direction Y at a position spanning across the eighth small air chamber 200*h* and the ninth small air chamber 200*i* in the front/rear direction Y. A communicating hole 216*a* and a communicating hole 216*b* are formed within the narrow groove 215. The communicating hole 216*a* passes through one end portion in the vertical direction Z, which is the upper side position of the eighth small air chamber 200*h*, into communication with the eighth small air chamber 200*h*. The communicating hole 216*b* pass through the other end portion of the narrow groove 215 in the vertical direction Z, which is the upper side position of the ninth small air chamber 200*i*, into communication with the ninth small air chamber 200*i*.

Similarly, a concave groove 217 having a rectangular shape in a plan view from the top is formed in the upper surface of the container case 48 at a position that is to the side (left side in the embodiment) of the narrow groove 215 in the left/right direction X. A filter (not illustrated) is arranged in the concave groove 217. The filter allows gas, such as air, to be permeate, but regulates permeation of liquids, such as ink and water. A communication hole 218*a* is formed in one corner portion of the concave groove 217 so as to pass in the vertical direction Z into communication with the ninth small air chambers 200*i*, the corner portion being the upper side position of the ninth small air chamber 200*i*.

Similarly, a communication hole 218*b* is formed in the upper surface of the container case 48 to pass in the vertical direction Z into communication with the tenth small air chambers 200*j* through a position at the upper side position of the tenth small air chamber 200*j*, on an extension line of the narrow groove 215. Similarly, a narrow meandering groove 219 is formed in the upper surface of the container case 48 at a position that is to the side (the front side in the embodiment) of the concave groove 217 in the front/rear direction Y. The narrow meandering groove 219 connects the inside of the concave groove 217, in which the communication hole 218*a* is formed, to the communication hole 218*b*. The opening areas of each of the communication holes 216*a*, 216*b*, 218*a*, and 218*b* are the same as the opening areas of each of the first opening 211 and the second opening 212. The groove widths of each of the narrow grooves 215 and 219 are the same as the groove widths of each of the respective long groove portions 213*a* to 213*c*.

As illustrated in FIG. 30, a film 220 is adhered (for example, heat welded) to the upper surface of the container case 48. The film 220 is an example of a covering member arranged so as to cover the respective narrow grooves 215 and 219 and the concave groove 217. As a result, two communication channels 228 and 229, which have flow channel cross-sectional areas respectively smaller than the area of the wall surface of the respective eighth and ninth division walls 208 and 209, are formed in the upper surface of the container case 48, between the two narrow grooves 215 and 219, the concave groove 217, and the film 220 covering these. Therefore, the respective small air chambers 200*a* to 200*j* configuring the air chamber 200 communicate with each other via the above-described respective communication channels 221 to 229.

Next, the choke valve 45 will be described.

As illustrated in FIGS. 34 and 35, the choke valve 45 is arranged at an inner portion surrounded by four fixing ribs 301. The four fixing ribs 301 protrude from the inner surface of the tank case 42 at a surface portion to the front side of the ink tank 43. The four fixing ribs 301 each has a substantially L-shape and are spaced apart vertically and horizontally. Therefore, the choke valve 45 is arranged between a front surface 43*b* of the ink tank 43 and the tank case 42. In this case, the front surface 43*b* of the ink tank 43 configures a portion of a side surface of the ink tank 43, without a bottom surface 43*c* (refer to FIG. 29) and a top surface 43*d*, which is opposite to the bottom surface 43*c*. The front surface 43*b* of the ink tank 43 is the surface portion whose width is the narrowest of the side surfaces of the ink tank 43. The choke valve 45 is positioned vertically and horizontally by the fixing ribs 301. The tube 31 extending from the ink tank 43 is inserted into the choke valve 45. The choke valve 45 is configured to be switchable between an open valve state, which allows ink to flow through the tube 31, and a closed valve state, which regulates the flow of ink through the tube 31.

Figure 36:
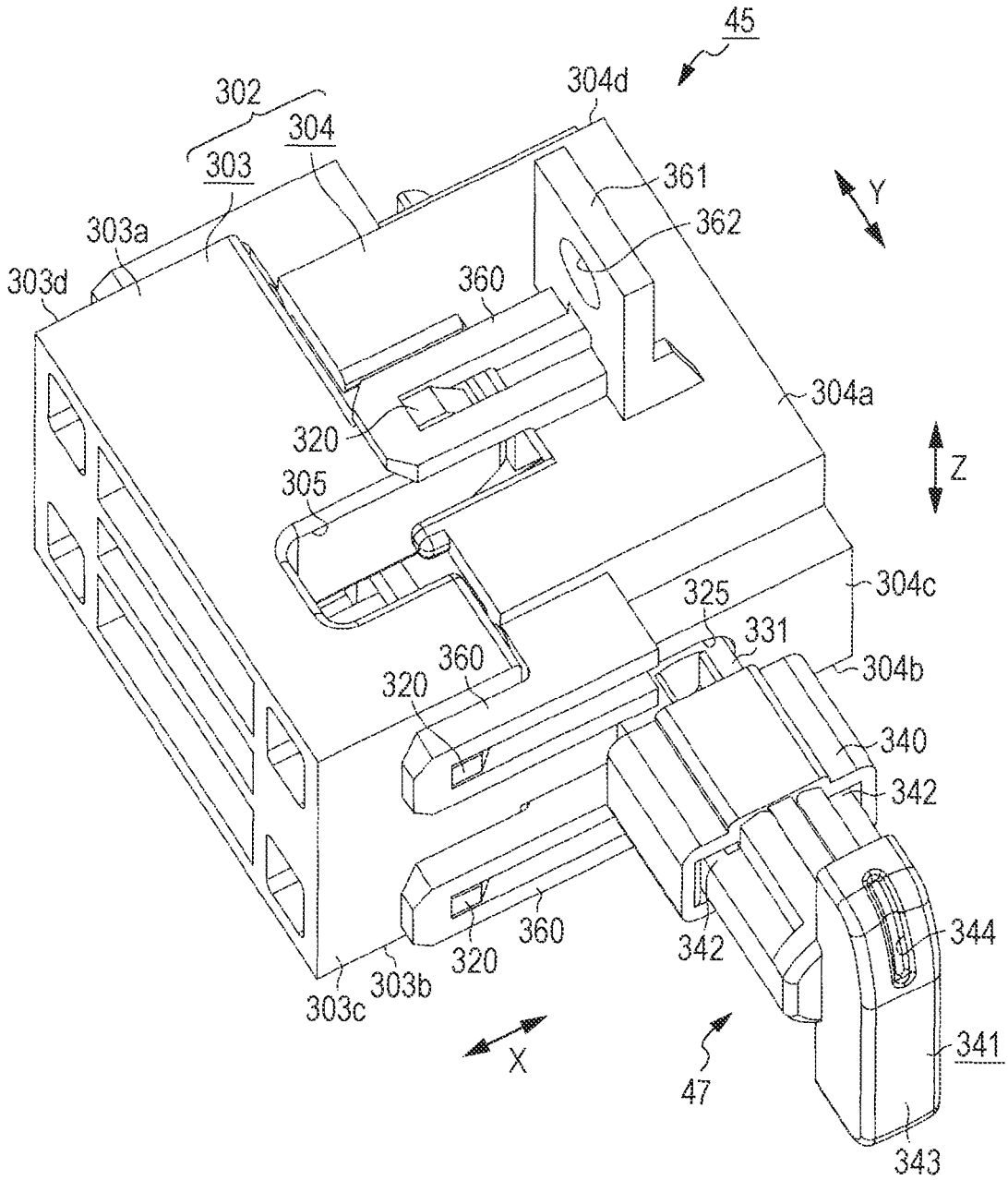
FIG. 36 is a perspective view of a choke valve.

As illustrated in FIG. 36, a case 302 configuring the exterior of the choke valve 45 is configured in a hollow box-shaped by connecting open sides of a pair of substantially rectangular box-shaped case units 303 and 304 so as to overlap the mutual opening ends in the left/right direction X. In this case, in the opening ends of both case units 303 and 304, the front/rear direction Y becomes the longitudinal direction, and the vertical direction Z becomes the short direction.

Figure 37:
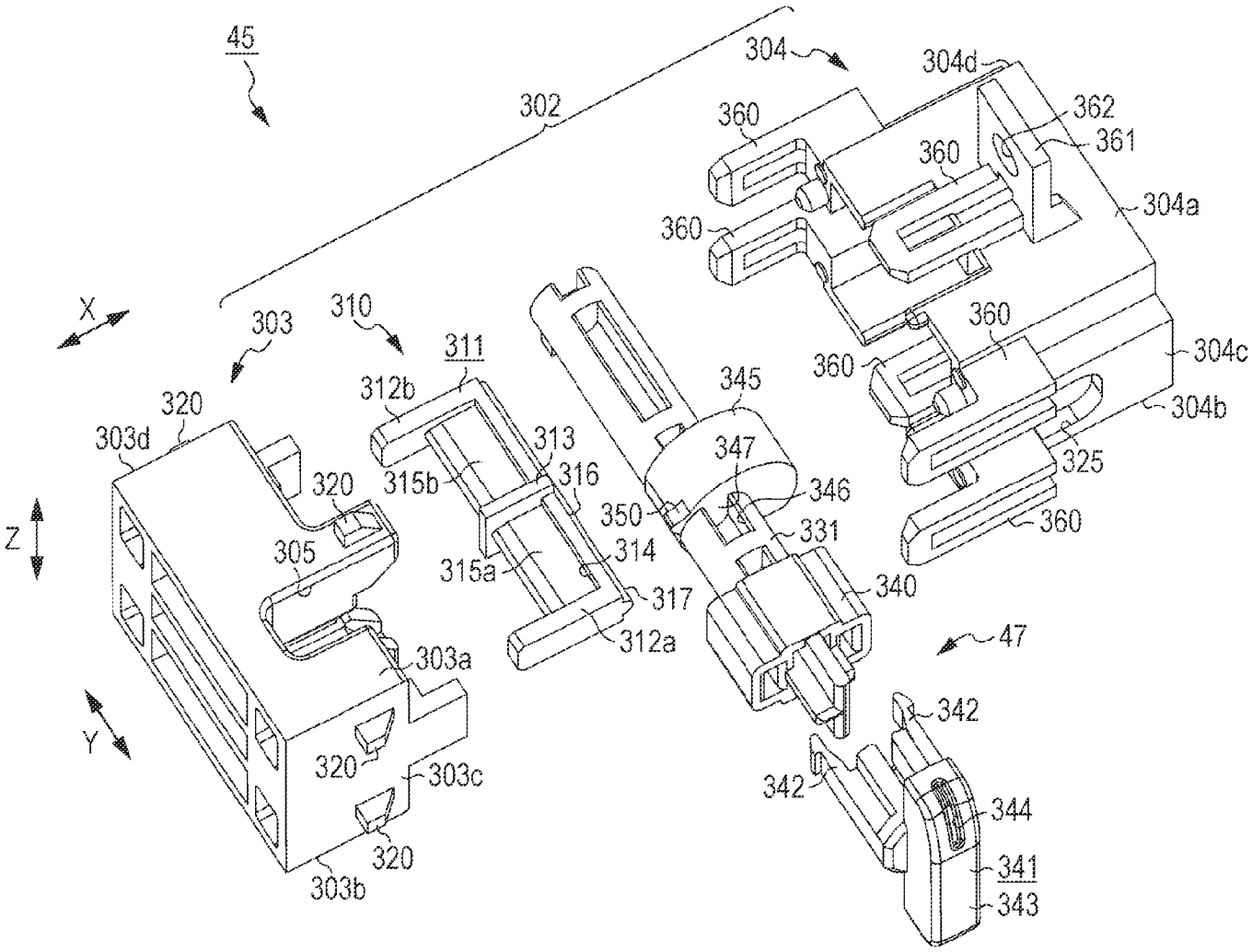
FIG. 37 is an exploded perspective view of a choke valve seen from an obliquely upper left position.
Figure 38:
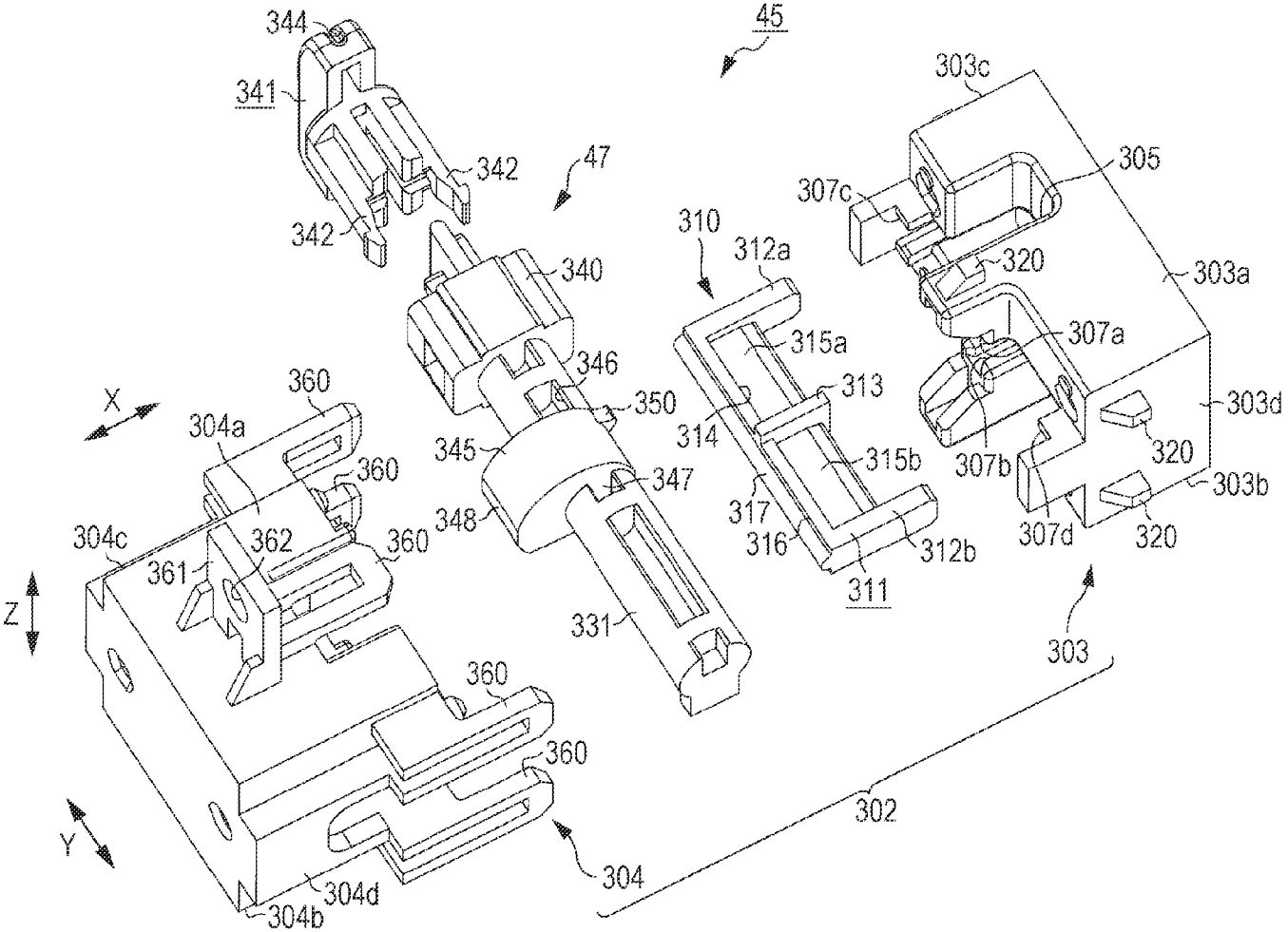
FIG. 38 is an exploded perspective view of a choke valve seen from an obliquely upper right position.

As illustrated in FIGS. 37 and 38, in the pair of case units 303 and 304, wall portions 303*a* and 303*b* at both upper and lower sides of the left side case unit 303 each have a concave portion 305 that is recessed leftward from the opening end of the case unit 303. In both of the wall portions 303*a* and 303*b* of the case unit 303, the concave portions 305 are respectively formed at a position closer to the front side than the center in the longitudinal direction of the opening end of the case unit 303. Each of the concave portions 305 is arranged at the same position as each other in a plan view, and is arranged to oppose each other in the vertical direction Z. Then, when both of the case units 303 and 304 are connected to each other to configure the case 302, the concave portions 305 enable communication between the inside and the outside of the case 302. The tube 31 can be inserted into each of the concave portions 305 and passed through the case 302 in the vertical direction Z.

Concave grooves 307*a* and 307*b* are formed on the inner surface of wall portions 303*a* and 303*b* at both upper and lower sides in the case unit 303. The concave grooves 307*a* and 307*b* are arranged at the central position in the longitudinal direction in the opening end of the case unit 303. The concave grooves 307*a* and 307*b* extend from the opening end of the case unit 303 toward the innermost side of the case unit 303.

Concave grooves 307*c* and 307*d* are formed on the inner surface of wall portions 303*c* and 303*d* of both front and rear sides in the case unit 303. The concave grooves 307*c* and 307*d* are arranged at the central position in the short direction in the opening end of the case unit 303. The concave grooves 307*c* and 307*d* extend from the opening end of the case unit 303 toward the innermost side of the case unit 303.

A slider 310, which is an example of a displacement member, is accommodated inside the case unit 303 through the right side opening of the case unit 303. The slider 310 has a horizontally long and substantially U-shaped base body 311 extending long in the front/rear direction Y. Both end portions of the base body 311 in the front/rear direction Y have quadrangular-prism-shaped projections 312*a* and 312*b*. In addition, at the central position of the base body 311 in the front/rear direction Y, a rectangular-plate-shaped wall portion 313 is disposed to protrude so as to extend in parallel with the protruding direction of the projections 312*a* and 312*b*. In this case, in the wall portion 313, the left/right direction X, which is the protruding direction of the projections 312*a* and 312*b*, is the longitudinal direction, and the vertical direction Z, which is the thickness direction of the base body 311, is the short direction. Then, the dimension of the wall portion 313 in the longitudinal direction is smaller than the protruding dimension of the projections 312*a* and 312*b*. In addition, the dimension of the wall portion 313 in the short direction is larger than the dimension of the base body 311 in the thickness direction. Therefore, the wall portion 313 protrudes from both upper and lower surfaces of the base body 311.

On the outer surface of the base body 311, substantially rectangular-plate-shaped pressing portions 315*a* and 315*b* extend from an inner bottom surface 314 that faces the protruding direction of the projections 312*a* and 312*b* at positions between the projections 312*a* and 312*b*. Specifically, the pressing portion 315*a* extends from a surface portion of the inner bottom surface 314 of the base body 311, that is located between the projection 312*a* and the wall portion 313, and the pressing portion 315*b* extends from a surface portion that is located between the projection 312*b* and the wall portion 313. The front end portion in the extending direction of the pressing portions 315*a* and 315*b* has a tapered shape that is a smoothly curved convex shape. The extending dimension of the pressing portions 315*a* and 315*b* is smaller than the protruding dimension of the projections 312*a* and 312*b*.

A ridge 317 is formed in the base body 311 on an outer bottom surface 316, which is opposite to the inner bottom surface 314 on which the pressing portions 315*a* and 315*b* extend. The ridge 317 forms a semi-circular shape in cross section. The ridge 317 is located at the center of the outer bottom surface 316 of the base body 311 in the vertical direction Z, and extends over the entire area of the outer bottom surface 316 of the base body 311 in the front/rear direction Y.

The projections 312*a* and 312*b* of the base body 311 of the slider 310 engage with the concave grooves 307*c* and 307*d* of the case unit 303 by concavo-convex engagement, and the wall portions 313 of the base body 311 engage with the concave grooves 307*a* and 307*b* of the case unit 303 by concavo-convex engagement. Therefore, the slider 310 is accommodated in the case unit 303 while being positioned in the front/rear direction Y and the vertical direction Z.

Convex-shaped engagement portions 320 are formed on the outer surface of the wall portions 303*a* and 303*b* at both upper and lower sides in the case unit 303, and on the outer surface of the wall portions 303*c* and 303*d* at both front and rear sides in the case unit 303. Specifically, the engagement portions 320 are respectively formed on the outer surface of the wall portions 303*a* and 303*b* of both upper and lower sides in the case unit 303, on the surface portion that is close to the opening end of the case unit 303 and that is central in the longitudinal direction of the opening end of the case unit 303. The engagement portions 320 are formed on the outer surface of the wall portions 303*c* and 303*d* at both front and rear sides in the case unit 303, at two locations that are vertically separated from each other, on a surface portion that is close to the opening end of the case unit 303.

A wall portion 304*c* in the right side case unit 304 of the pair of case units 303 and 304 has a concave portion 325 disposed to be recessed rightward from the opening end of the case unit 304. A pivot shaft 331 of the valve lever 47 is inserted into the inside of the concave portion 325. The pivot shaft 331 is pivotally supported by the inner surface of the concave portion 325 by abutment of the outer peripheral surface of the pivot shaft 331 against the inner surface of the concave portion 325.

A substantially rectangular tubular-shaped attachment portion 340 having one surface side open is fitted, from outside, to a front end portion of the pivot shaft 331, which is one end side of the pivot shaft 331 in the axial direction. Locking hooks 342 disposed to extend from a grip portion 341 of the valve lever 47 engage with the attachment portion 340 from inside, through the opening of the attachment portion 340. In this manner, the grip portion 341 of the valve lever 47 is connected to the attachment portion 340 so as to be integrally rotatable.

Figure 39:
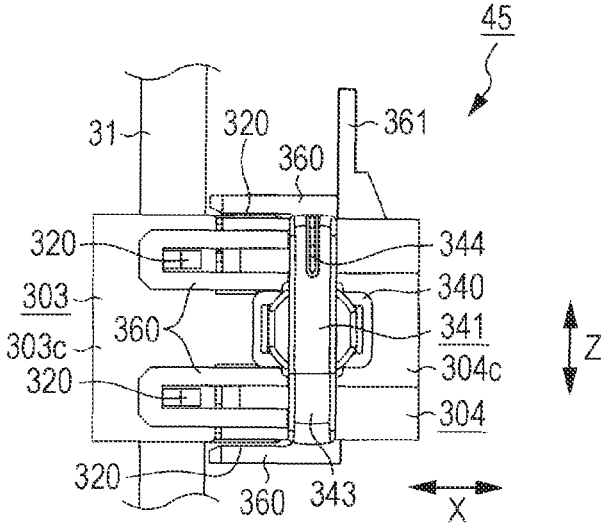
FIG. 39 is a front view of a choke valve in an open valve state.

As illustrated in FIG. 39, the grip portion 341 of the valve lever 47 has a substantially rectangular parallelepiped shape, and is gripped when the pivot shaft 331 of the valve lever 47 is pivotally operated. An outer surface 343 of the grip portion 341 is a curved surface that is smoothly curved at one end side (upper side in FIG. 39) in the longitudinal direction, and a concave groove 344 is formed in the curved surface. The concave groove 344 extends from one end side of the outer surface 343 of the grip portion 341 in the longitudinal direction to the central position.

Figure 40:
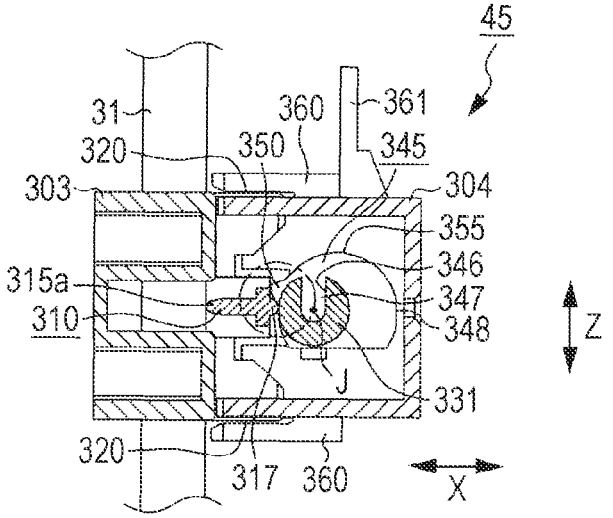
FIG. 40 is a cross-sectional view illustrating an inner configuration of a choke valve in an open valve state.

As illustrated in FIG. 40, a cam 345 is supported at the intermediate position of the pivot shaft 331 in the axial direction. Specifically, a concave fitting portion 346 is formed on the outer peripheral surface of the pivot shaft 331, and a convex fitting portion 347 provided to the cam 345 is fitted into the concave fitting portion 346. In this manner, the cam 345 is supported to be integrally rotatable with the pivot shaft 331.

The cam 345 has a substantially D-shaped contour shape in a side view, as seen from a direction following the axial direction of the pivot shaft 331. Then, the central position of the can 345 is arranged at a position deviated from an axial center J of the pivot shaft 331. That is, the cam 345 is supported in a state of being eccentric with the pivot shaft 331.

The outer peripheral surface of the cam 345 that is farthest from the pivot shaft 331 is a flat surface 348 notched in a flat shape. A convex portion 350 is formed on an outer peripheral surface of the cam 345 that is shifted by approximately a half circumference about the center of the pivot shaft 331 from the flat surface 348.

Figure 41:
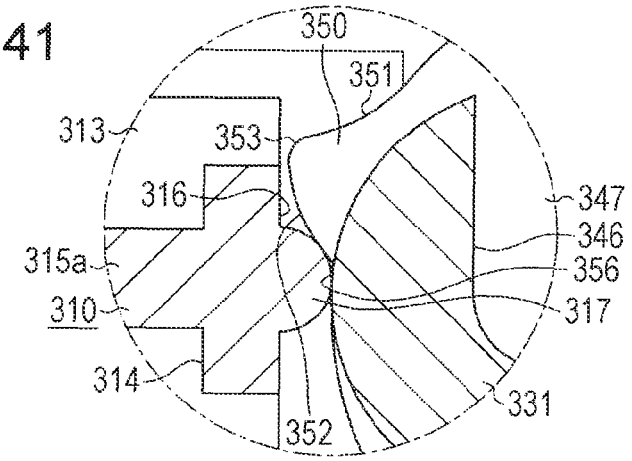
FIG. 41 is an enlarged view of a main portion in FIG. 40.

As illustrated in FIG. 41, the convex portion 350 has a curved surface 351 and a curved surface 352. The curved surface 351 is an example of a first surface in which a surface portion located in the clockwise direction about the center of the pivot shaft 331 in FIG. 40 is curved in a concave shape. The curved surface 352 is an example of a second surface in which a surface portion located in the counterclockwise direction about the center of the pivot shaft 331 in FIG. 40 is curved in a convex shape. A portion of the convex portion 350 where the curved surfaces 351 and 352 intersect with each other is a corner portion 353 pointed so as to form an acute angle in the normal direction of the outer peripheral surface of the cam 345. A surface portion on the outer peripheral surface of the cam 345 between the convex portion 350 and the flat surface 348 is a curved surface 355, where the distance from the axial center J of the pivot shaft 331 gradually increases from the convex portion 350 side toward the flat surface 348 side.

As illustrated in FIGS. 37 and 38, engaged portions 360 are disposed to extend on the outer surface of the wall portions 304*a* and 304*b* at both upper and lower sides in the case unit 304, and on the outer surface of the wall portions 304*c* and 304*d* at both front and rear sides in the case unit 304. The engaged portion 360 are formed at positions corresponding to the respective engagement portions 320 of the case unit 303 in the left/right direction X, which is the overlapping direction of both of the case units 303 and 304. The engagement portion 360 protrudes further leftward than the opening end of the case unit 304. When the opening ends of both of the case units 303 and 304 overlap with each other, the engagement portions 320 of the case unit 303 engage with the engaged portion 360 of the case unit 304. In this manner, both of the case units 303 and 304 are connected to each other. In addition, when the case units 303 and 304 are connected to each other, the slider 310 and the pivot shaft 331 of the valve lever 47 are interposed in a fastened and fixed condition with each other between the case units 303 and 304. In this case, the ridge 317 of the slider 310 and the outer peripheral surface of the pivot shaft 331 of the valve lever 47 are arranged to oppose each other in the left/right direction X.

A rectangular-plate-shaped bracket 361 is disposed to extend vertically at the outer surface of the upper side wall portion 304*a* of the case unit 304. The bracket 361 has a through hole 362 penetrating in its thickness direction. The fixing screw 363 (refer to FIG. 35) is inserted into the through hole 362 of the bracket 361, and screwed to a screw hole 364 (refer to FIG. 34) formed on the inner surface of the tank case 42. By this, the choke valve 45 is attached to the inner surface of the tank case 42. The dimension of the case 302 of the choke valve 45 in the left/right direction X is smaller than the dimension of the tank case 42 in the left/right direction X. Therefore, the choke valve 45 is attached to the inner surface of the tank case 42 in a state of being fitted within the dimension of the tank case 42 in the thickness direction.

Hereinafter, an operation when the ink tank 43 is fixedly attached to the apparatus main body 13 will be described.

As illustrated in FIGS. 24 and 35, the ink tank 43 is first inserted through the case opening portion 42*b* of the tank case 42, the convex positioning portions 67*a* and 67*b* are fitted into the concave positioning portions 63*a* and 63*b* to be positioned. At this time, the left side portion of the film 49 is accommodated inside the tank case 42 in a folded state. Furthermore, the mounting screws 61 are screwed into the tank locking portions 62 and the screw portions 66 so that the ink tank 43 is fixedly attached to the tank case 42. That is, the tank case 42 protects the ink tank 43 by covering the ink tank 43 from the outside. Furthermore, the choke valve 45 into which the tube 31 is inserted is attached to the tank case 42, and the front end of the tube 31 is inserted into the outlet port 59.

Subsequently, as illustrated in FIG. 23, the tank case 42 to which the ink tank 43 is fixedly attached is positioned on the attachment surface 13*a*. That is, the tank case 42 is caused to surround the first rib 34, the boss portion 38 and the engagement portion 69 are engaged with each other, and further the reinforcement rib portion 34*f* and the concave engagement portion 72 are engaged with each other.

In addition, as illustrated in FIG. 26, when the tank case 42 to which the ink tank 43 is attached is positioned on the attachment surface 13*a*, the absorbent material 39 is located at a position between the injection port 52 and the apparatus main body 13. The absorbent material 39 has a larger thickness in the left/right direction X than the upper rib portion 34*a*. Therefore, the absorbent material 39 interposed between the apparatus main body 13 and the ink tank 43 is clamped by the apparatus main body 13 and the ink tank 43 and subjected to compressive deformation.

Furthermore, as illustrated in FIG. 23, in a state where the tank case 42 is positioned on the attachment surface 13*a*, the case locking portions 68*a* to 68*e* and the screw boss portion 37 are matched with each other. Therefore, when the screws 36 are screwed into the case locking portions 68*a* to 68*e*, the respective case locking portions 68*a* to 68*e* and the screw boss portions 37 are fixedly screwed together and the tank case 42 and the apparatus main body 13 are fixedly attached to each other.

In a state where the tank case 42 is fixedly attached to the apparatus main body 13 in this manner, the opening area external portions 49*a*, 49*b* and 49*c* (refer to FIG. 32) of the film 49, which protrude outward from the container opening portion 48*a*, are accommodated in the gap between the ink tank 43 and the tank case 42. The opening area external portion 49*d* (refer to FIG. 33) of the film 49, which protrudes outward from the tank case 42, is accommodated by being folded (refer to FIG. 23) in the gap between the ink tank 43 and the tank case 42. Therefore, in a state where the tank case 42 is fixedly attached to the apparatus main body 13, the film 49 does not protrude outward from the tank case 42.

Next, an operation inside the ink chamber 50 to which the ink is injected will be described.

As illustrated in FIG. 32, if the ink is injected through the injection port 52, the ink is caught by the intersecting rib portions 101 to 103 and guided rearward. The first extension portions 104 are formed to the intersecting rib portions 101 to 103. Therefore, the first extension portions 104 suppress the ink from flowing to the direction crossing over the intersecting rib portions 101 to 103 to the front side, and thus, the ink is likely to flow rearward.

Furthermore, the ink passes through the gap between the vertical rib portions 111 to 118 and the stepped bottom portion 50*b* and flows rearward. Therefore, if the liquid level 51 (refer to FIG. 25) inside the ink chamber 50 rises in accordance with injection of the ink, and reaches the position where the vertical rib portions 111 to 118 are formed, the ink is first inhibited from flowing rearward by the first vertical rib portion 111. Accordingly, the rearward flow of the ink changes.

That is, a vortex is generated in the ink at the rear side position, which is further downstream than the vertical rib portions 111 to 118 in the flowing direction of the ink (rearward following the stepped bottom surface 50*b* in the embodiment). Therefore, the ink has a tendency to flow toward a direction intersecting the stepped bottom surface 50*b* (upward). Accordingly, for example, when the ink is partially injected several times, the previously injected ink is stirred up by the vortex generated by flow of the subsequently injected ink, and is mixed with the subsequently injected ink.

Incidentally, although the ink tank 43 can contain a large amount of ink, a long period of time is required from previous ink injection to a subsequent ink injection. Therefore, if pigment ink, which is an example of ink, is contained in the ink chamber 50, in some cases the pigment components precipitate from the ink. However, when ink is newly injected through the injection port 52, the ink remaining inside the ink chamber 50 is stirred up, so unevenness in the ink density inside the ink chamber 50 decreases.

Next, an operation when transporting the usable multi-function printer 11 (recording apparatus 12) having the ink contained in the ink tank 43 will be described.

When transporting the multi-function printer 11 (recording apparatus 12) having the ink contained in the ink tank 43, the choke valve 45 is first closed. Then, in that state, if for example a cardboard box in which the multi-function printer 11 (recording apparatus 12) is packed is placed upside down, as illustrated in FIG. 42 the ink tank 43 is in an inverted orientation where the ink chamber 50 is located higher up than the air chamber 200.

Then, due to the water head pressure, the ink starts to flow from the ink chamber 50 side of the ink tank 43, through the communication port 210, to the air chamber 200 (specifically, the first small air chamber 200*a*). Then, in a normal case, the water head pressure and the negative pressure of the ink chamber 50 soon achieve balance. Accordingly, ink stops flowing from the ink chamber 50 to the air chamber 200 side through the communication port 210.

Figure 42:
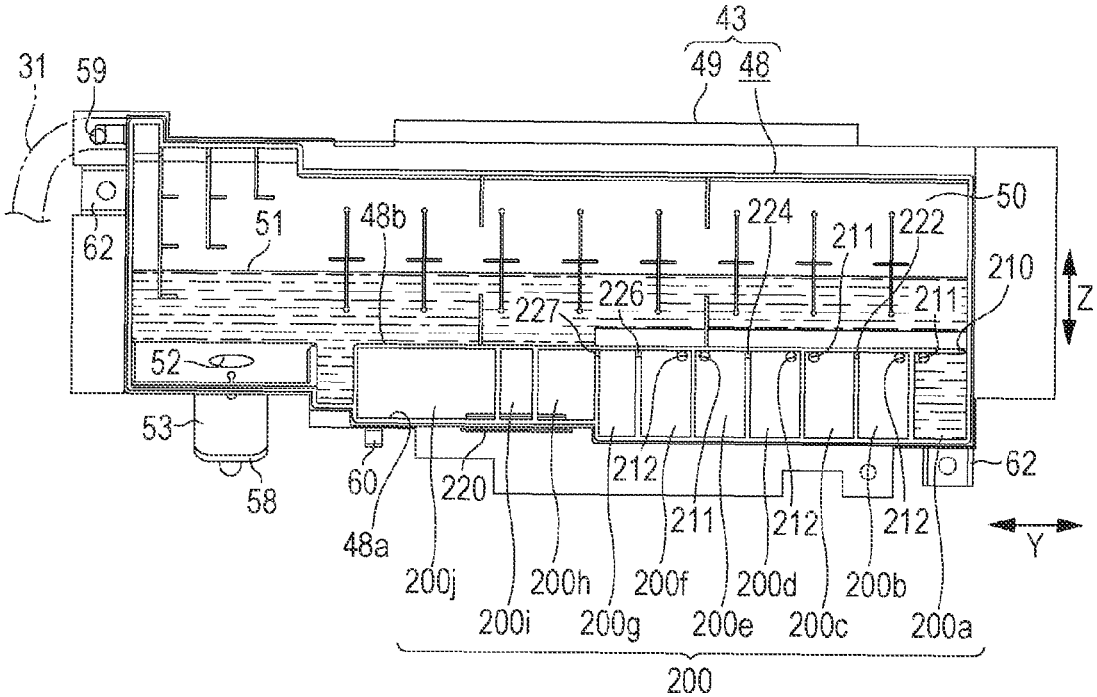
FIG. 42 is a left side view of an ink tank which is inverted upside down.
Figure 43:
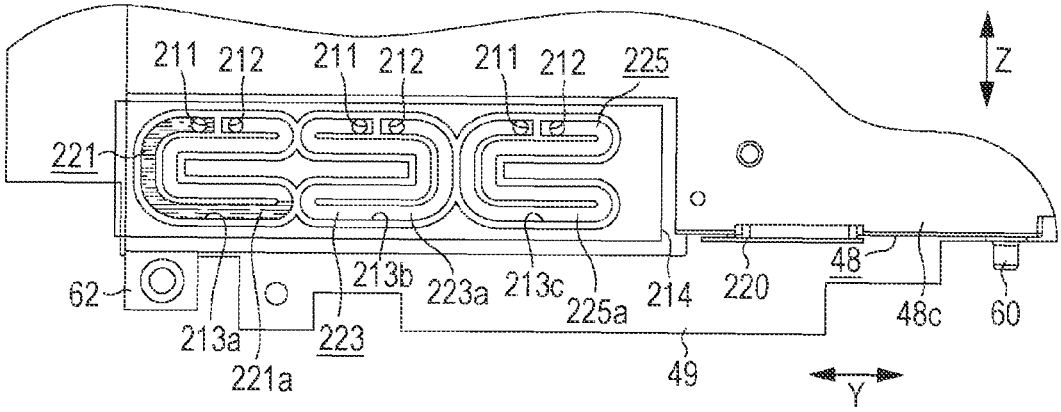
FIG. 43 is a partial cutaway view of a right side surface of the ink tank in the state in FIG. 42.

That is, as illustrated in FIG. 42, at the air chamber 200 side, the first small air chamber 200*a*, which is in direct communication with the ink chamber 50 via the communication port 210, is filled with the ink that flowed in. Furthermore, as illustrated in FIG. 43, the meandering-shaped communication channel 221, which corresponds to the first long groove portion 213*a*, is filled with the ink which has flowed in up to a flow channel portion 221*a*, which is located lowermost at that time. Because air-liquid exchange becomes impossible in the flow channel portion 221*a*, which is located lowermost inside the communication channel 221, negative pressure is generated in the ink chamber 50, and consequently the negative pressure and the water head pressure balance. Therefore, ink stops flowing to the air chamber 200 side.

Figure 44:
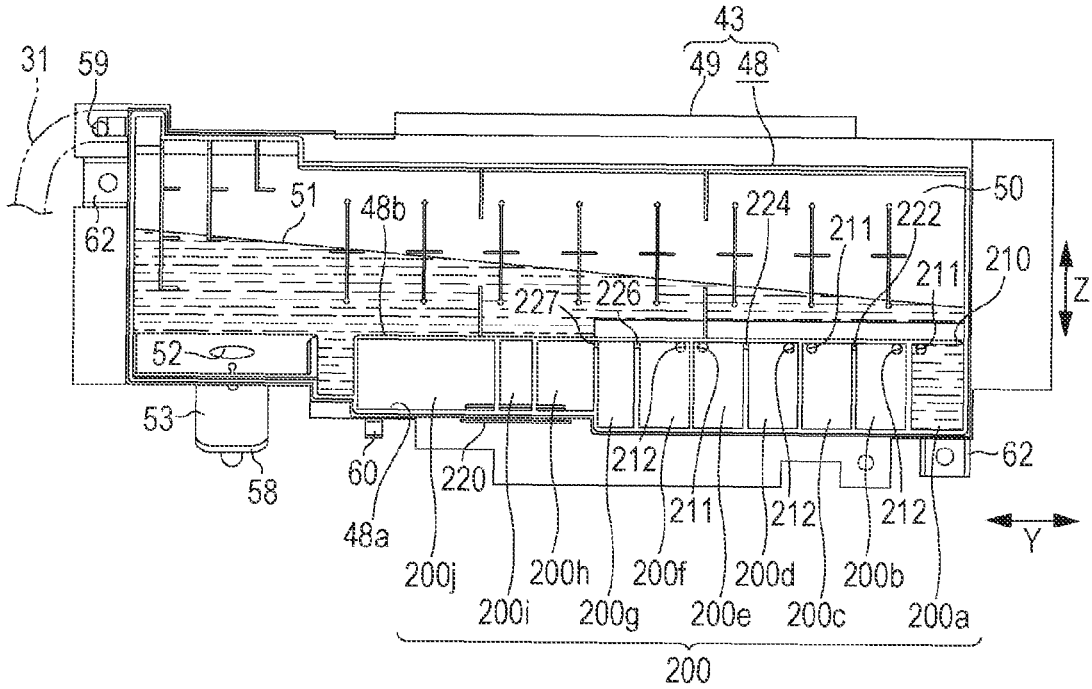
FIG. 44 is a left side view of the ink tank in a case where the ink tank is caused to vibrate so that the acceleration is applied to the rear side in the state in FIG. 42.
Figure 45:
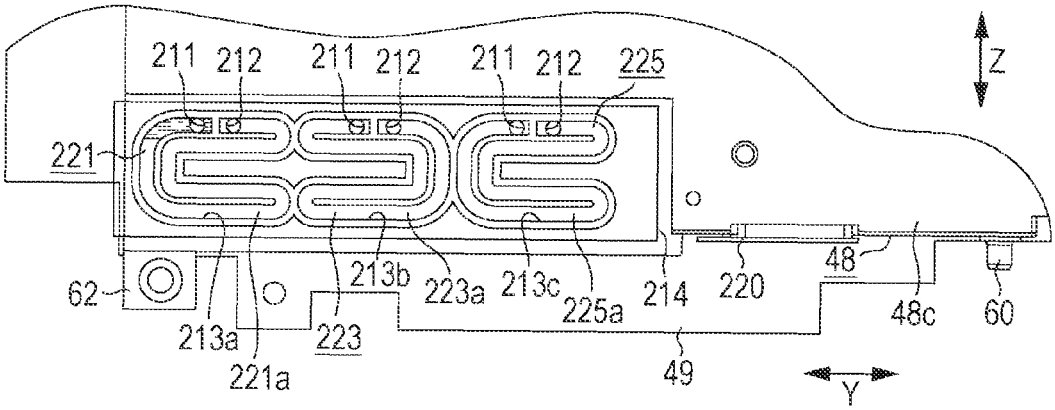
FIG. 45 is a partial cutaway view of a right side surface of the ink tank in the state in FIG. 44.
Figure 46:
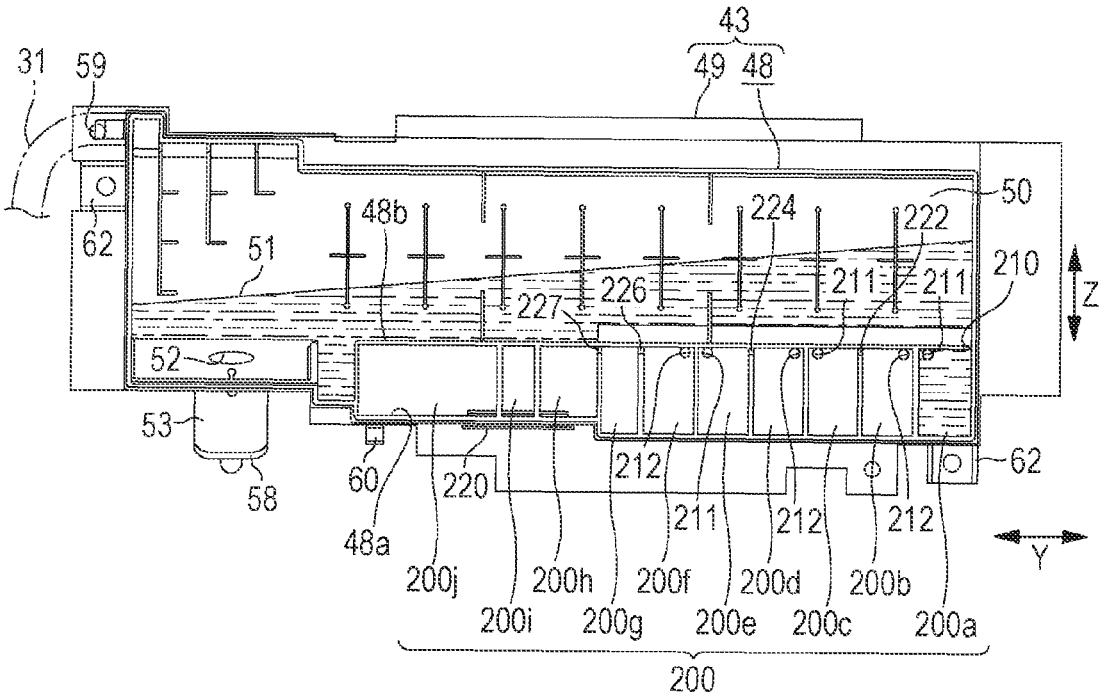
FIG. 46 is a left side view of the ink tank in a case where the ink tank is caused to vibrate so that the acceleration is applied to the front side in the state in FIG. 42.
Figure 47:
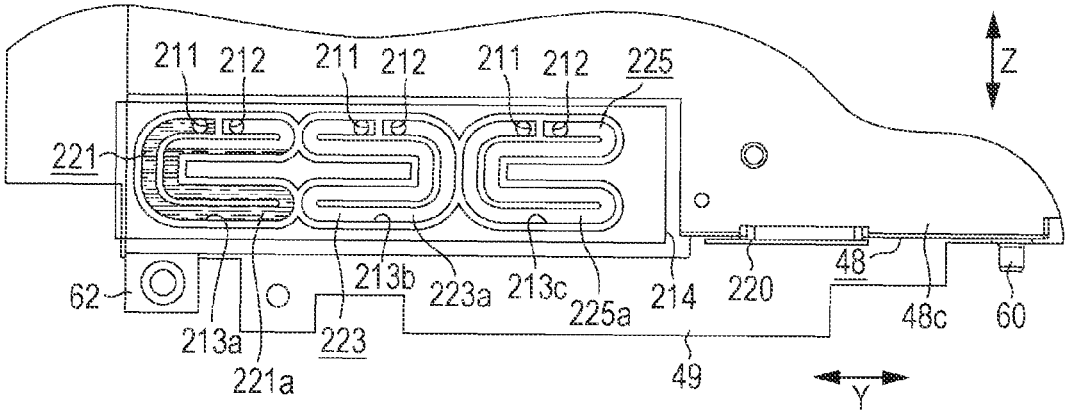
FIG. 47 is a partial cutaway view of a right side surface of the ink tank in the state in FIG. 46.

In addition, as illustrated in FIGS. 44 and 46, if accelerated vibration is further applied to the inverted ink tank 43 in the front/rear direction Y, as illustrated in FIGS. 45 and 47 the ink inside the communication channel 221 illustrated in FIG. 43 moves inside the communication channel 221 in the accelerated direction. However, even in this case, the ink inside the communication channel 221 just reciprocates between one end side (first opening 211 side) inside the communication channel 221 and the other end side (second opening 212 side) in the accelerated direction, but does not flow from the second opening 212 into the second small air chamber 200*b*, which is the air opening port 60 side. The length of the first long groove portion 213*a*, which is a portion of the communication channel 221 in the direction following the partition wall 48*b*, is set to be longer than the distance between the first opening 211 and the second opening 212. However, if the first long groove portion 213*a* is further lengthened, it is possible to further suppress arrival of the ink at the second opening 212 due to the vibration in the front/rear direction Y.

Then, if the ink tank 43 is returned from the inverted orientation, where as illustrated in FIG. 42 the ink chamber 50 is located further up than the air chamber 200, to the orientation when in use, where as illustrated in FIG. 32 the air chamber 200 is located further up than the ink chamber 50, the ink which flowed into the communication channel 221 returns to the respective small air chambers 200*a* and 200*b* from the first opening 211 and the second opening 212. Therefore, it can be avoided that the ink remains dried and solidified inside the communication channel 221, which has a small flow channel cross-sectional area.

Next, an operation when switching the choke valve 45 from a closed valve state to an open valve state will be described.

Figure 48:
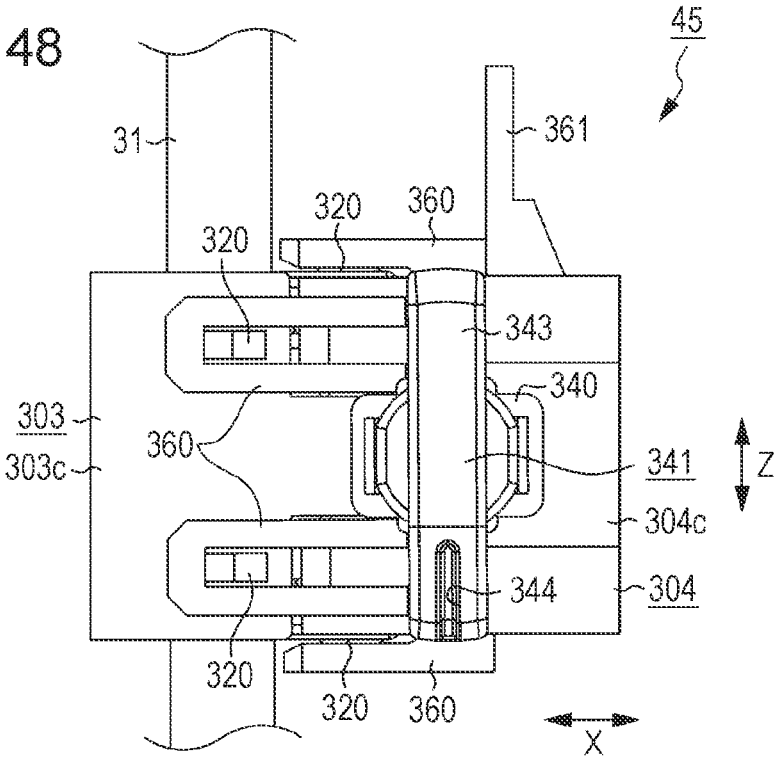
FIG. 48 is a front view of a choke valve in a closed valve state.

In the embodiment, as illustrated in FIG. 48, when the choke valve 45 is in the closed state, the concave groove 344 formed at the grip portion 341 of the valve lever 47 is arranged at the lowest end position of the revolving path about the center of the pivot shaft 331.

Figure 49:
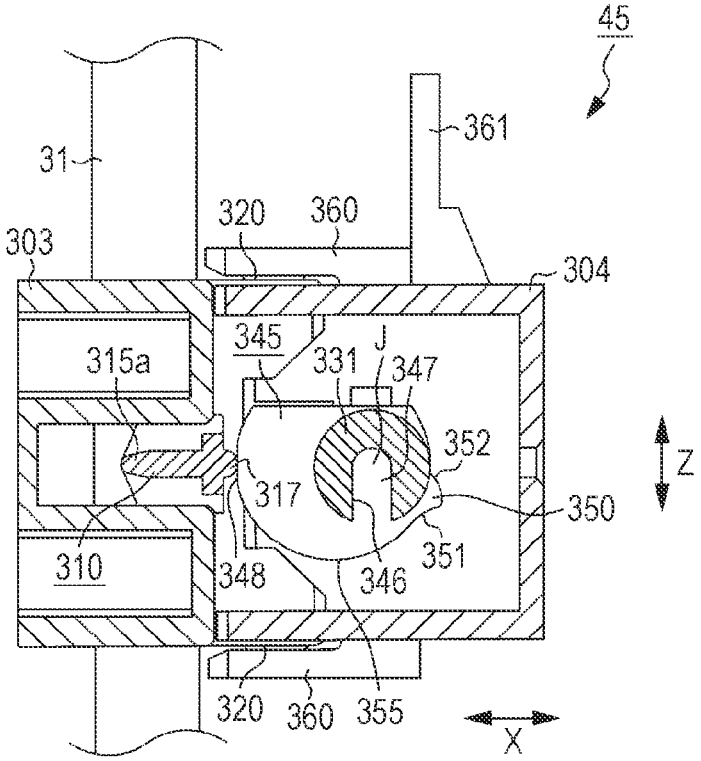
FIG. 49 is a cross-sectional view illustrating an inner configuration of a choke valve in a closed valve state.

In this case, as illustrated in FIG. 49, the front end portion of the ridge 317 of the slider 310 is arranged in the valve closing position, where the front end portion comes into contact with the flat surface 348 at the outer peripheral surface of the cam 345. Then, the slider 310 is pressed against the innermost side of the case unit 303 by the flat surface 348 of the cam 345.

Therefore, the outer surface of the tube 31 vertically inserted to the innermost side of the case unit 303 is pressed and squeezed by the front end portion of the pressing portions 315*a* and 315*b* of the slider 310. As a result, the tube 31 is regulated in the flow of ink from the ink tank 43 side to the liquid ejecting head 32 side, through the portion crushed by the pressing portions 315*a* and 315*b* of the slider 310.

Figure 50:
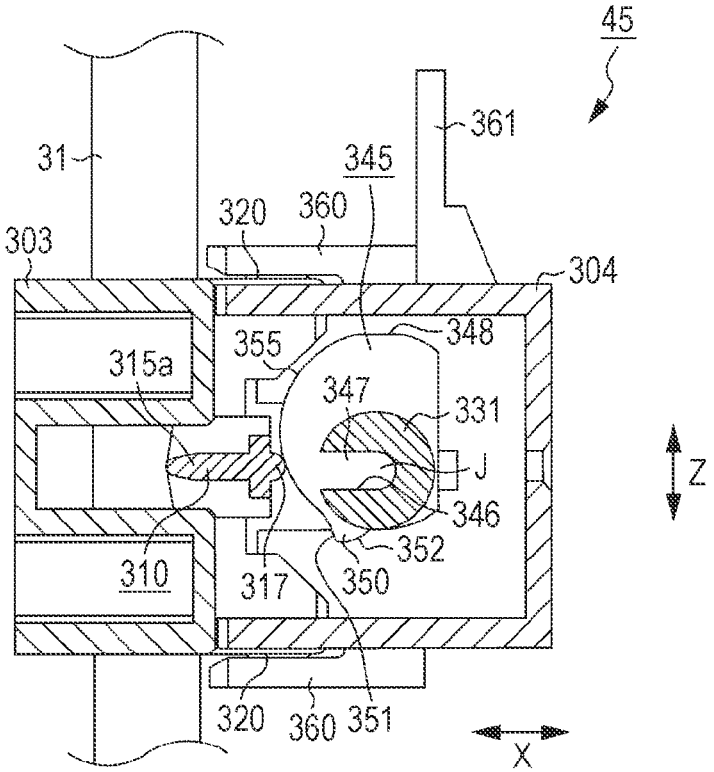
FIG. 50 is a cross-sectional view illustrating an inner configuration of the choke valve displaced to an open valve state from the state illustrated in FIG. 49.

In turn, as illustrated in FIG. 50, the valve lever 47 is operated to pivot about the center of the pivot shaft 331 in the clockwise direction of FIG. 50. Then, the ridge 317 of the slider 310 moves from the flat surface 348 of the cam 345 onto the curved surface 355 and is disposed at an intermediate position.

In this case, different pivotal resistances are applied from the slider 310 to the outer peripheral surface of the cam 345 when the ridge 317 of the slider 310 rides onto the curved surface 355 from the flat surface 348 of the cam 345, and when the ridge 317 of the slider 310 slides across the curved surface 355 of the cam 345. Therefore, it is easy to recognize that the choke valve 45 is switched over from the closed valve state to the open valve state, based on the change in resistance when the valve lever 47 is operated to pivot in the valve opening direction.

Figure 51:
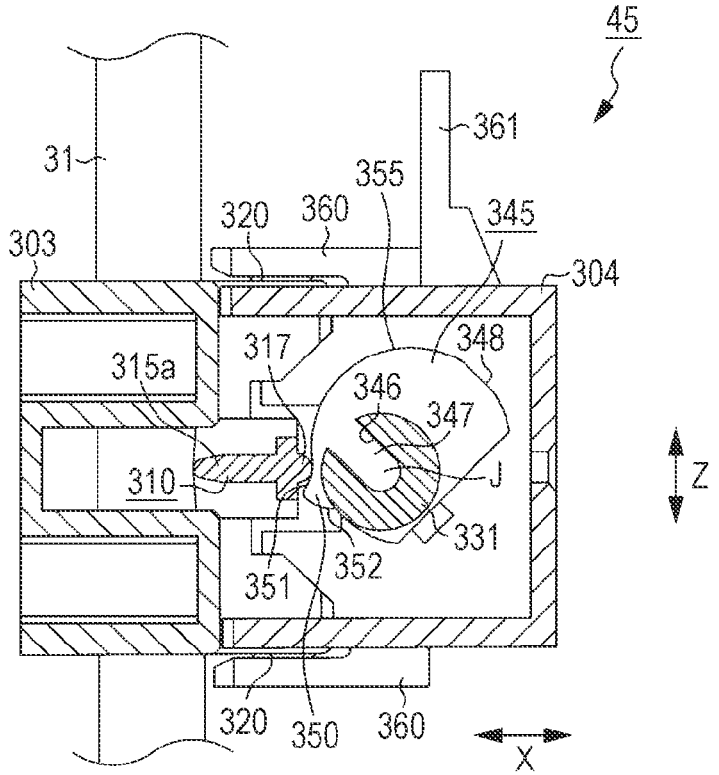
FIG. 51 is a cross-sectional view illustrating an inner configuration of the choke valve displaced to an open valve state from the state illustrated in FIG. 50.

Next, as illustrated in FIG. 51, the valve lever 47 is further operated to pivot about the center of the pivot shaft 331 in the clockwise direction of FIG. 51. In this case, the distance in the curved surface 355 of the cam 345 from the axial center J of the pivot shaft 331 gradually decreases from the flat surface 348 side to the convex portion 350 side. Therefore, pressing force applied from the curved surface 355 of the cam 345 toward the direction in which the slider 310 squeezes the tube 31 gradually decreases in accordance with the pivotal movement of the cam 345. In this case, the front end portion of the pressing portion 315*a* of the slider 310 in contact with the outer surface of the tube 31 is pressed back by the elastic restoring force of the tube 31. Therefore, the ridge 317 of the slider 310 maintains a state in sliding contact with the curved surface 355 of the cam 345 during the pivotal movement of the cam 345.

In turn, when the valve lever 47 is further operated to pivot about the center of the pivot shaft 331 in the clockwise direction illustrated in FIG. 51, the ridge 317 of the slider 310 rides across the convex portion 350 of the cam 345.

Then, as illustrated in FIGS. 40 and 41, the front end portion of the ridge 317 of the slider 310 is arranged at the valve opening position where the front end portion abuts against a surface portion 356 (refer to FIG. 41), which is closest of the outer peripheral surface of the cam 34 5 to the pivot shaft 331. That is, in the embodiment, when the slider 310 is displaced from the intermediate position to the valve opening position, the cam 345 has a convex portion 350 on the surface portion with which the ridge 317 of the slider 310 comes into sliding contact. Then, the pressing force applied to the slider 310 from the outer peripheral surface of the cam 345 in the direction for squeezing the tube 31 further decreases. As a result, the tube 31 is hardly squeezed by the pressing portion 315*a* of the slider 310. Accordingly, the choke valve 45 is in the open valve state which allows the ink to flow from the ink tank 43 side to the liquid ejecting head 32 side.

Here, the pivotal resistance applied from the slider 310 to the outer peripheral surface of the cam 345 when the ridge 317 of the slider 310 rides over the convex portion 350 of the cam 345 is greater than when the ridge 317 of the slider 310 slides over the curved surface 355 of the cam 345. Therefore, it is easy to recognize that the choke valve 45 switched from the closed valve state to the open valve state, based on the change in resistance when the valve lever 47 is operated to pivot in the valve opening direction.

In addition, if the ridge 317 of the slider 310 rides over the convex portion 350 of the cam 345, the ridge 317 collides with the outer peripheral surface of the cam 345 to produce a sound. Therefore, it is easy to recognize that the valve lever 47 switched over to the open valve state.

In addition, when the choke valve 45 switches over to the open valve state, the choke valve 45 is temporarily fixed to the open valve state because the convex portion 350 of the cam 345 is locked by the ridge 317 of the slider 310. Accordingly, even if an external force applied to pivot the valve lever 47 is released, the choke valve 45 is reliably maintained in the open valve state.

Then, as illustrated in FIG. 39, when the choke valve 45 is in the open valve state, the concave groove 344 formed in the grip portion 341 of the valve lever 47 is arranged at the uppermost end position on the revolving path about the center of the pivot shaft 331.

Incidentally, similarly to when the choke valve 45 is switched over from the open valve state to the closed valve state, the ridge 317 of the slider 310 rides over the convex portion 350 of the cam 345. However, when the choke valve 45 is switched from the closed valve state to the open valve state, the curved surface 351 with which the ridge 317 of the slider 310 comes into sliding contact in the convex portion 350 is curved so as to form a concave shape. In contrast, when the choke valve 45 is switched from the open valve state to the closed valve state, the curved surface 352 with which the ridge 317 of the slider 310 comes into sliding contact in the convex portion 350 is curved so as to form a convex shape.

As a result, the pivotal resistance applied from the slider 310 to the outer peripheral surface of the cam 345 when the ridge 317 of the slider 310 rides across the convex portion 350 of the cam 345 is greater when the choke valve 45 is switched from the closed valve state to the open valve state, than when the choke valve 45 is switched from the open valve state to the closed valve state. Therefore, when the choke valve 45 is switched over to the open valve state, the magnitude of the pivotal torque applied to the cam 345 is relatively large. Accordingly, it is easier to recognize that the choke valve 45 is switched to the open valve state, because the amount of change in resistance during the pivotal operation of the cam 345 increases.

Next, an operation of the ink tank 43 when the multi-function printer 11 is obliquely installed will be described. FIGS. 23 and 24 illustrate a configuration of the ink tank 43.

The ink tank 43 may be in a tilted state when the installation surface of the multi-function printer 11 thereof is tilted, or the tank unit 27 (refer to FIG. 1) is attached to the apparatus main body 13 in a tilted state.

When the ink tank 43 is in the tilted state wherein the stepped bottom surface 50*b* side of the ink chamber 50 is higher than the basal surface 50*a* side, the ink flows from the stepped bottom surface 50*b* side to the basal surface 50*a* side. In this case, the ink contained in the ink chamber 50 collects in the liquid collecting recess portion 50*d* and then flows out through the outlet port 59.

Figure 52:
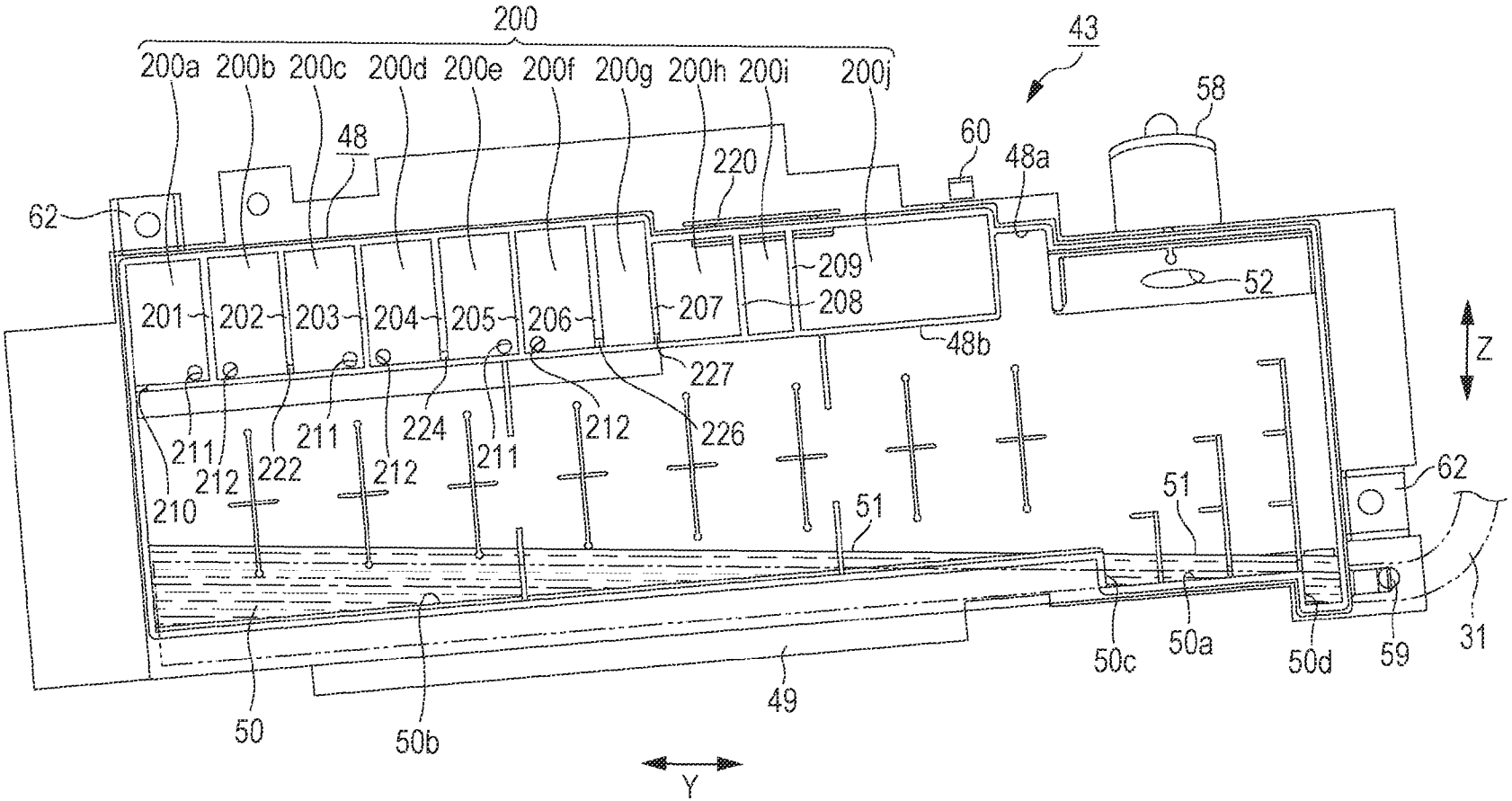
FIG. 52 is a side view illustrating an operation of an ink tank.

On the other hand, as illustrated in FIG. 52, when the ink chamber 50 is in the tilted state wherein the basal surface 50*a* side of the ink chamber 50 is higher than the stepped bottom surface 50*b* side, the ink is kept from flowing to the stepped bottom surface 50*b* side by the stepped side surface 50*c*. Since the outlet port 59 is disposed on the basal surface 50*a* side (right end side in FIG. 52) in the longitudinal direction (front/rear direction Y) of the bottom portion, the ink trapped in the basal surface 50*a* side by the stepped side surface 50*c* flows out from the outlet port 59.

If the stepped bottom surface 50*b* and the stepped side surface 50*c* were not disposed in the ink tank 43, as illustrated by two-dot chain line in FIG. 52, the ink accumulated at the lowered bottom portion side remains there and does not flow out through the outlet port 59. In contrast, in the embodiment, the ink trapped in the basal surface 50*a* side by the stepped side surface 50*c* collects in the liquid collecting recess portion 50*d* and then flows out from the outlet port 59.

As a result, the ink accumulated at the stepped bottom surface 50*b* side remains there and does not flow out from the outlet port 59, but the remaining amount is less compared to if the stepped bottom surface 50*b* and the stepped side surface 50*c* were not provided. That is, when the ink tank 43 is in the tilted state wherein the first end side in the longitudinal direction that has the outlet port 59 is higher, the remaining amount of the ink at the bottom portion of the ink chamber 50 is reduced.

In the recording apparatus 12, if it is recognized through the visible surface 43*a* (refer to FIG. 1) disposed on the container case 48 (refer to FIG. 1) that the liquid level 51 inside the ink chamber 50 is low, the ink is replenished by injecting the ink through the injection port 52.

However, if ink remains at the bottom portion of the ink chamber 50 without flowing out from the outlet port 59, it might occur that the liquid level 51 can be visually recognized through the visible surface 43*a* disposed on the container case 48, but ink may not be supplied to the liquid ejecting head 32 (refer to FIG. 1).

In this case, the ink is ejected in a state where the ink is not supplied through the outlet port 59, thereby causing a possibility of poor printing. Even if the remaining amount of ink in the ink chamber 50 is managed by estimating the amount of ink ejected from the liquid ejecting head 32, there is also a possibility of poor printing if the ink does not flow out from the outlet port 59 and remains at the bottom portion of the ink chamber 50. In this regard, in the embodiment, since the amount of ink remaining at the bottom portion of the ink chamber 50 is reduced, such a possibility can be decreased.

In addition, in the recording apparatus 12, the ink contained in the ink chamber 50 is supplied to the liquid ejecting head 32 by utilizing the water head difference. Accordingly, the ink tank 43 has a laterally long shape wherein the width in the front/rear direction Y is increased while the height in the vertical direction Z is suppressed. Therefore, when injecting ink into the ink chamber 50, there is a possibility that ink might splash up from the bottom portion of the ink chamber 50 and spill out from the injection port 52. In this regard, in the embodiment, since the injection port 52 is arranged above the basal surface 50*a* located at a lower position than the stepped bottom surface 50*b*, the ink is unlikely to spill out from the injection port 52.

Next, an operation when the ink contained in the ink chamber 50 flows from the outlet port 59 will be described.

As described above, ink contained in the ink chamber 50 has less unevenness in density because the ink is stirred up during injection. However, the pigment components can precipitate from the ink over time, thereby causing the unevenness in the density of the ink. That is, the ink located at the lower side has a higher density (hereinafter, referred to as a "thick ink"), and the ink located at the upper side has a lower density (hereinafter, referred to as a "thin ink").

Therefore, if the liquid level 51 of the ink is located at a higher position than the position of the first intersecting rib portion 101, the thin ink passes through the communication portion 106 between the first intersecting rib portion 101 and the upper surface 50*e* and flows to the outlet port 59 side. On the other hand, the thick ink passes through the communication portion 105 located at the lower end of the first intersecting rib portion 101 and flows to the outlet port 59 side. Accordingly, the ink flows from the outlet port 59 in a state where the thick ink and the thin ink are mixed together.

Then, if the ink flows out so that the liquid level 51 drops to a lower position than the position of the upper end of the first intersecting rib portion 101, the thin ink passes between the second intersecting rib portion 102 and the upper surface 50*e* and flows to the outlet port 59 side. On the other hand, the thick ink passes through the communication portion 105 located at the lower end of the second intersecting rib portion 102 and flows to the outlet port 59 side. The ink passes through the communication portion 105 between the first intersecting rib portion 101 and flows from the outlet port 59 in a state where the thick ink and the thin ink are mixed together.

Furthermore, if the ink flows out so that the liquid level 51 drops to a lower position than the position of the upper end of the second intersecting rib portion 102, the thin ink passes through the communication portion 106 between the third intersecting rib portion 103 and the upper surface 50*e* and flows to the outlet port 59 side. On the other hand, the thick ink passes through the communication portion 105 located at the lower end of the third intersecting rib portion 103 and flows to the outlet port 59 side. That is, the ink passes through the communication portion 105 of the second intersecting rib portion 102 and the communication portion 105 of the first intersecting rib portion 101, and flows from the outlet port 59 in a state where the thick ink and the thin ink are mixed together.

According to Example 1, the following advantageous effects can be obtained.

(1-1) Positioning of the film 49 with respect to a holder when the film 49 is held and moved by, for example, the holder in order to adhere the film 49 to the container opening portion 48*a* of the container case 48, can be easily performed using the through holes 49H into which positioning members such as pins, for example, can be inserted. Therefore, the film 49 is carried to the position to cover the container opening portion 48*a* of the container case 48 in a planned state without misalignment, and then is adhered to the container case 48 by means of welding, for example. Accordingly, misalignment of the film 49 with respect to the container opening portion 48*a* to which the film 49 is adhered so as to seal the container opening portion 48*a* of the container case 48 is suppressed.

(1-2) Even if the film 49 has a long shape in the longitudinal direction which is relatively more easy to misalign, it is possible to position the film 49 by utilizing at least two through holes 49H separated from each other in the longitudinal direction. Accordingly, it is possible to suppress misalignment of the film 49 adhering to the container case 48 with respect to the container opening portion 48*a*.

(1-3) The opening area external portions 49*a*, 49*b*, 49*c* and 49*d* of the film 49 which protrude outward from the container opening portion 48*a* of the container case 48 can be accommodated, by being folded so as not to be exposed, into the gap between the ink tank 43 and the tank case 42. Accordingly, it is possible to obtain the tank unit 27 having a preferable appearance, for example.

(1-4) It is possible to suppress misalignment of the film 49 adhering to the container case 48 with respect to the container opening portion 48*a*. Accordingly, it is possible to obtain the recording apparatus 12 (liquid consuming apparatus) provided with the tank unit 27 having the excellently airtight ink chamber 50.

(1-5) The ink is supplied from the ink chamber 50 of the tank unit 27 via the tube 31 to the liquid ejecting head 32. Accordingly, it is possible to obtain the recording apparatus 12 (liquid consuming apparatus) capable of continuously supplying a large amount of ink to the liquid ejecting head 32.

(1-6) Misalignment of the film 49 with respect to the container opening portion 48*a* when adhering to the container case 48 is suppressed. Accordingly, for example, the reduced welding area with the container case 48 suppresses degradation of adhesion, and an excellently airtight ink tank 43 can be achieved.

(1-7) The vertical rib portions 111 to 118 are disposed separated from the stepped bottom surface 50*b* inside the ink chamber 50. Thus, ink injected into the ink chamber 50 through the injection port 52 flows along the stepped bottom surface 50*b* between the stepped bottom surface 50*b* and the vertical rib portions 111 to 118. Furthermore, if the flow of ink is inhibited by the vertical rib portions 111 to 118 or the rear side surface 50*g* which intersect the stepped bottom portion 50*b* of the ink chamber 50, the ink tends to flow in a direction intersecting the stepped bottom surface 50*b*. Therefore, even if the ink contained in the ink chamber 50 comes to have the unevenness in the density, the ink contained in the ink chamber 50 is stirred up by the flow of ink newly injected to the ink chamber 50. That is, it is possible for ink to flow upward even at positions separated from the injection port 52 in the front/rear direction Y. Accordingly, it is possible to easily eliminate unevenness in the density of the ink contained inside the ink chamber 50 by injecting ink into the ink chamber 50.

(1-8) The ink injected through the injection port 52 flows from out the outlet port 59. Therefore, the ink from the outlet port 59 is less likely to flow to the side position opposite from the outlet port 59 as viewed from the injection port 52, than to the position between the injection port 52 and the outlet port 59. In this regard, the vertical rib portions 111 to 118 are disposed at the opposite from the outlet port 59 as viewed from the injection port 52. Thus, by injecting the ink through the injection port 52, it is possible to stir up the ink present at the position where ink is less likely to flow. Accordingly, it is possible to efficiently eliminate the unevenness in the density of the ink contained inside the ink chamber 50 by injecting the ink into the ink chamber 50.

(1-9) Since the vertical rib portions 111 to 118 are formed to protrude from the right side surface 50*f* inside the ink chamber 50, it is possible to easily form the vertical rib portions 111 to 118. Furthermore, it is possible to increase the area capable of stirring up the ink by forming at least two of the vertical rib portions 111 to 118. Accordingly, it is possible to further increase the size of the ink chamber 50.

(1-10) It is possible to inhibit ink from flowing in the front/rear direction Y, which is the direction away from the injection port 52, by using the vertical rib portions 111 to 118, which extend in the direction intersecting with the stepped bottom surface 50*b*. That is, it is possible to stir up the ink by generating vortex-shaped ink flow.

(1-11) Since the intersecting rib portions 101 to 103 are disposed between the injection port 52 and the outlet port 59, it is possible to inhibit ink from flowing from the injection port 52 to the outlet port 59. Accordingly, for example, even if the ink is vigorously injected through the injection port 52, it is possible to decrease pressure applied to ink near the outlet port 59.

(1-12) If the ink contained in the ink chamber 50 flows through the outlet port 59, the ink tends to flow through the communication portions 105 and 106, which are located at different positions from each other in the vertical direction Z. Therefore, even if there is unevenness in the density of the ink contained in the ink chamber 50, it is possible for the different density ink to flow through the respective communication portions 105 and 106. Furthermore, since at least two of the intersecting rib portions 101 to 103 have the communication portions 105 and 106 that are located at the mutually different positions, it is possible for ink located at different positions in the vertical direction Z can flow. Accordingly, even if the ink contained in the ink chamber 50 flows out so that the liquid level 51 drops, the low concentrate liquid near the liquid level 51 and the high concentrate liquid near the basal surface 50*a* can mix together and flow out.

(1-13) By increasing the height at which the first intersecting rib portion 101, which is located at a position separated from the injection port 52, protrudes from the basal surface 50*a*, it is possible to further inhibit ink from flowing from the injection port 52 to outlet port 59. On the other hand, because the second intersecting rib portion 102, which is located at a position close to the injection port 52, protrudes from the basal surface 50*a* to a low height, the ink caught by the first intersecting rib portion 101, whose protruding height is high, can flow to the rear side away from the outlet port 59. Accordingly, it is possible to further stir up the ink at the side remote from the outlet port 59, as viewed from the injection port 52.

(1-14) Since the intersecting rib portions 101 to 103 have the first extension portion 104, it is possible to decrease the possibility that ink injected through the injection port 52 may flow over the intersecting rib portions 101 to 103. Accordingly, it is possible to decrease the pressure applied to the ink near the outlet port 59.

(1-15) It is possible to use the recording apparatus 12 which can easily eliminate unevenness in density of ink contained in the ink chamber 50.

(1-16) When the ink tank 43 is in the orientation when used, the air chamber 200 is located further up than the ink chamber 50, and the ink is unlikely to enter the air chamber 200 side from the ink chamber 50 side through the communication port 210. Accordingly, it is possible to suppress the ink from leaking outward through the air opening port 60.

(1-17) In addition, even if the orientation of the ink tank 43 is inverted from its orientation when in use, the ink inside the ink chamber 50 is held temporarily in the inner space of the air chamber 200 via the communication port 210. Thus, it is possible to suppress ink from leaking outward directly from the ink chamber 50. Therefore, even if inverted, it is possible to suppress the ink contained inside thereof from leaking outward through the air opening port 60.

(1-18) Even if ink from the ink chamber 50 flows into one small air chamber 200*a* through the communication port 210, the ink must pass through the communication channel 221, whose flow channel cross-sectional area is small, in order to reach the next small air chamber 200*b*, which is in communication with the small air chamber 200*a*. Thus, ink is suppressed from flowing to the small air chamber 200*j* having the air opening port 60. Accordingly, it is possible to further suppress the ink contained inside thereof from leaking outward through the air opening port 60.

(1-19) In order for the ink that has flowed into the first small air chamber 200*a* from the ink chamber 50 side to further flow into the second small air chamber 200*b* from the first small air chamber 200*a*, the ink must flow from the first opening 211 to the second opening 212 in the communication channel 221, whose distance is longer than the distance between the first small air chamber 200*a* and the second small air chamber 200*b*. Accordingly, since the long distance of the communication channel 221 increases flow channel resistance, the liquid is suppressed from flowing from the first small air chamber 200*a* to the second small air chamber 200*b* side. Therefore, in this regard, it is possible to further suppress the liquid contained inside from leaking outward through the air opening port 60.

(1-20) Even if the ink tank 43 is inverted so that ink flows from the ink chamber 50 side to the air chamber 200 side, and further flows into the communication channel 221, which brings the first small air chamber 200*a* and the second small air chamber 200*b* into communicate with each other, if the ink tank 43 is then returned to its orientation when used, the ink inside the communication channel 221 flows out from the communication channel 221 through the first opening 211 and the second opening 212. Therefore, it is possible to avoid a possibility that solidified substances may be generated inside the communication channel 221 because the ink that remains inside the communication channel 221 dries.

(1-21) Even if the ink tank 43 is inverted so that the air-liquid interface is present near a first opening 211, the communication channel 221, which connects the first opening 211 and the second opening 212, separated further from the partition wall 48*b* than from the first opening 211 and the second opening 212 and so has the flow channel portion 221*a* that is separated farther from the air-liquid interface. Accordingly, it is possible to preclude air-liquid exchange of air and ink at the flow channel portion 221*a*, which is the lowermost side when the ink tank 43 is inverted. Therefore, it is possible to generate a greater negative pressure at the ink chamber 50 side than in the communication channel 221, and thus it is possible to stop leakage of ink from the ink chamber 50 side.

(1-22) The film 214 is adhered to close the opening of the long groove portions 213*a* to 213*c* formed in a meandering shape to form the communication channels 221, 223 and 225. Accordingly, when the ink tank 43 is inverted, it is possible to simply obtain the communication channels 221, 223 and 225 which can favorably exhibit the advantageous effect capable of suppressing the leakage of the ink from the ink chamber 50 side.

(1-23) When displacing the slider 310 to the valve opening position, it is necessary for the slider 310 to ride across the convex portion 350 of the cam 345. Thus, the pivotal torque to be applied to the cam 345 increases. Therefore, when the slider 310 is displaced into the valve opening position following pivotal movement of the cam 345 according to a manual operation, a sense of resistance in the pivotal operation of the cam 345 is changed. Accordingly, it is possible to easily recognize that the slider 310, which is to be displaced in order to switch the flowing state of the ink, is displaced into the valve opening position according to the manual operation.

(1-24) Between when the slider 310 is displaced from the valve opening position to the valve closing position, following the pivotal movement of the cam 345 according to the manual operation, and when the slider 310 is displaced from the valve closing position to the valve opening position, there is a difference in the magnitude of the pivotal torque applied to the cam 345 in order for the slider 310 to ride over the convex portion 350 of the cam 345. Therefore, it is possible to easily recognize whether the cam 345 is pivoted to displace the slider 310 either into the valve opening position or into the valve closing position.

(1-25) When the slider 310 is displaced into the valve opening position following the pivotal movement of the cam 345 according to the manual operation, a relatively large magnitude of pivotal torque is applied to the cam 345 in order for the slider 310 to ride over the curved surface 351 of the convex portion 350. Therefore, when the slider 310 is displaced to the valve opening position, the sense of resistance is greatly changed during the pivotal operation of the cam 345. Accordingly, it is possible to more easily recognize that the slider 310 is displaced to the valve opening position.

(1-26) When displacing the slider 310 from the valve closing position to the intermediate position, the cam 345 switches over from a state where the slider 310 comes into contact with the flat surface 348 into a state where the slider 310 comes into contact with the curved surface 355. Therefore, when displacing the slider 310 from the valve closing position to the intermediate position, the pivotal torque applied to the cam 345 changes. Accordingly, since the sense of resistance is changed during the pivotal operation of the cam 345, it is possible to easily recognize that the slider 310 is displaced from the valve closing position to the intermediate position.

(1-27) Since the choke valve 45 is attached to the inner surface of the tank case 42, even if a shock is applied to the choke valve 45 from outside of the tank case 42, it is possible to suppress the shock from being transmitted to the choke valve 45 from the ink tank 43. In addition, since the choke valve 45 is attached to the inner surface of the tank case 42, the vibration due to the valve opening and closing operation is prevented from being directly transmitted to the ink tank 43. Thus, it is possible to prevent a disadvantage such as generation of air bubbles because the liquid level of the ink is vibrated due to the vibration of the ink tank 43. In addition, unlike a case where the choke valve 45 is attached to the inner bottom surface of the tank case 42, there is no need to dispose the bracket 361 for screwing the choke valve 45 to the inner bottom surface of the tank case 42 to extend from the choke valve 45 in the thickness direction of the tank case 42. Accordingly, it is possible to decrease the dimension of the tank case 42 in the thickness direction. In addition, the choke valve 45 can be assembled into the tank case 42 independently from the ink tank 43. Therefore, it is possible to improve ability to assemble the choke valve 45 into the tank case 42.

(1-28) In the ink tank 43, when the ink chamber 50 is in a tilted state wherein the stepped bottom surface 50*b* side is higher than the basal surface 50*a* side, ink can flow from the stepped bottom surface 50*b* side to the basal surface 50*a* side and out from the outlet port 59. On the other hand, when the ink chamber 50 is in the tilted state wherein the basal surface 50*a* side is higher than the stepped bottom surface 50*b* side, the ink is suppressed from flowing to the stepped bottom surface 50*b* side by the stepped side surface 50*c*. Then, since the outlet port 59 is disposed to the basal surface 50*a* side of the bottom portion in the longitudinal direction (front/rear direction Y), ink trapped at the basal surface 50*a* side by the stepped side surface 50*c* can flow out from the outlet port 59. That is, when the ink tank 43 is in a tilted state, it can be avoided that not all the ink inside the ink chamber 50 flows out and some remains at the bottom portion. Accordingly, even if tilted, it is possible to reduce the amount of the ink remaining at the bottom portion of the ink chamber 50.

(1-29) The choke valve 45 is arranged between the tank case 42 and the front surface 43*b*, which is a side surface of the ink tank 43 other than the bottom surface 43*c* and the top surface 43*d*, which opposes the bottom surface 43*c*. Therefore, it is possible to suppress the height of the tank unit 27, compared to a case where the choke valve 45 is arranged between the tank case 42 and the bottom surface 43*c* or the top surface 43*d* of the ink tank 43.

(1-30) The choke valve 45 is arranged between the tank case 42 and the front surface 43*b*, whose width is the narrowest of the side surfaces of the ink tank 43, excluding the bottom surface 43*c* and the top surface 43*d*, which opposes the bottom surface 43*c*. Therefore, since it is possible to accommodate the choke valve 45 within the coverage of the width of the front surface 43*b*, whose width is the narrowest amongst the side surfaces of the ink tank 43, it is possible to suppress the width of the tank unit 27 from increasing.

(1-31) In the ink tank 43, since the length of the basal surface 50*a* in the front/rear direction Y is shorter than the length of the stepped bottom surface 50*b*, when the basal surface 50*a* is in the tilted state, it is possible to reduce the amount of remaining ink which does not flow out from the outlet port 59, which is disposed at a position which is at the end portion side of the basal surface 50*a* in the front/rear direction Y.

(1-32) In the ink tank 43, when the ink chamber 50 is in the tilted state wherein the first end side in the longitudinal direction is high, because the stepped side surface 50*c* is arranged closer to the first end side, the upper end position of the stepped side surface 50*c* becomes higher. Thus, it is possible to maintain a high liquid level position near the outlet port 59, which is disposed at the first end side. Accordingly, even if the tilted angle of the ink chamber 50 increases, ink trapped at the basal surface 50*a* side by the stepped side surface 50*c* can flow out from the outlet port 59.

(1-33) In the ink tank 43, ink trapped at the basal surface 50*a* side by the stepped side surface 50*c* can be collected in the liquid collecting recess portion 50*d* and flow out through the outlet port 59. Accordingly, it is possible to reduce the amount of the ink remaining at the basal surface 50*a* side by using the stepped side surface 50*c* in the bottom portion of the ink chamber 50.

(1-34) In the ink tank 43, since the injection port 52 is arranged at the upper side of the basal surface 50*a*, which is a position lower than the stepped bottom surface 50*b*, ink is unlikely to spill out when injecting the ink.

(1-35) In the ink tank 43, since the basal surface 50*a* is tilted such that the outlet port 59 side is lower, ink trapped at the basal surface 50*a* side by the stepped side surface 50*c* can flow to the outlet port 59 side following the tilt. Accordingly, even if tilted, it is possible to reduce the amount of the ink remaining at the bottom portion of the ink chamber 50.

Second Embodiment

Next, a second embodiment of the invention will be described with reference to the accompanying drawings. The second embodiment is different from the first embodiment in that the scanner unit 14 is not provided. Then, since the other elements are substantially the same as those of the first embodiment, the repeated description will be omitted by giving the same reference numerals to the same configuring elements.

Figure 53:
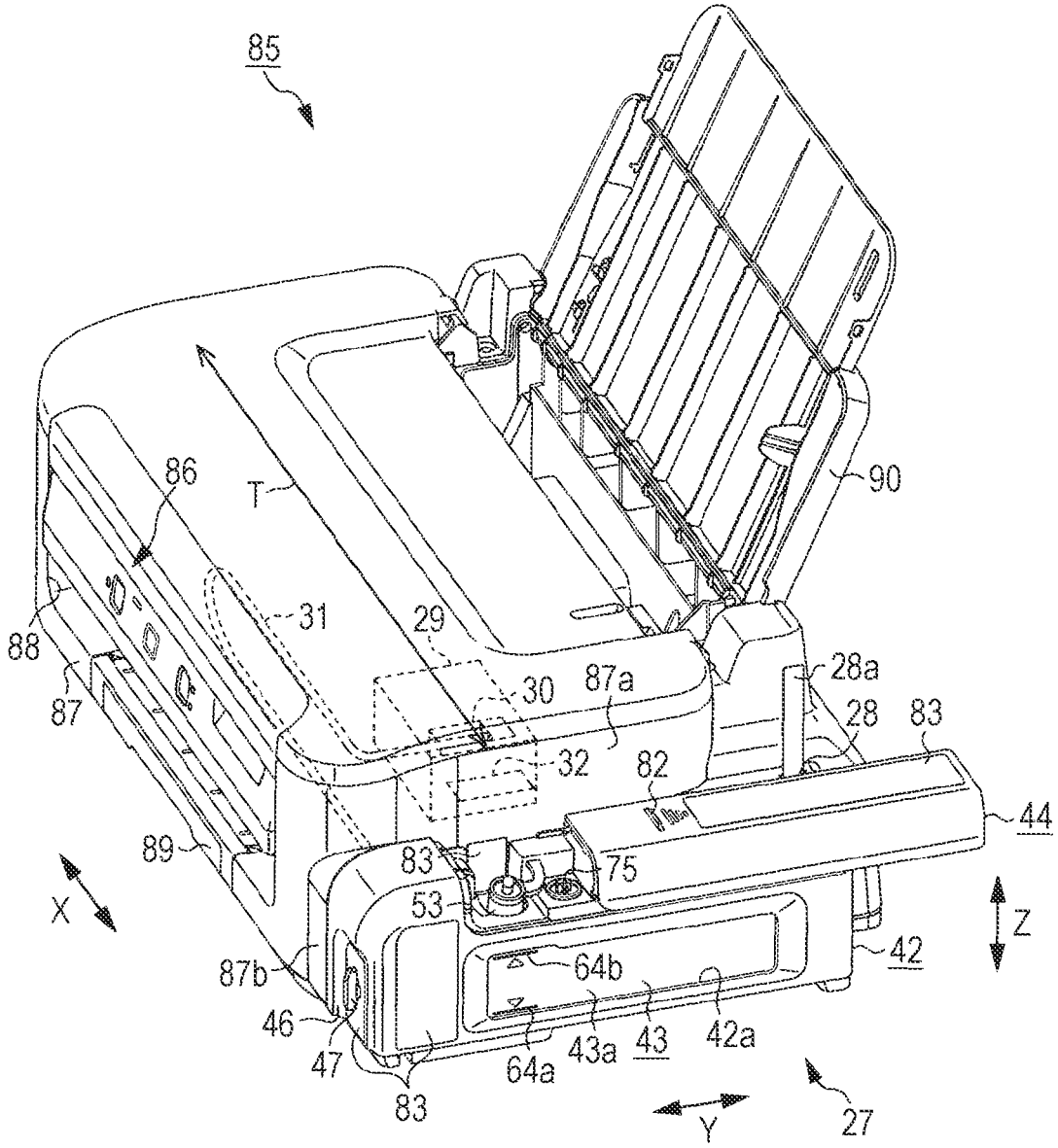
FIG. 53 is a perspective view of a recording apparatus of a second embodiment.

As illustrated in FIG. 53, a recording apparatus 85, which is an example of a liquid consuming apparatus, includes an operation button 86 in the front surface side. At a position which is below the operation button 86 in the recording apparatus 85, a discharge port 88 is open in order to discharge a sheet P from the inside of an apparatus main body 87, which is an example of a housing. In addition, a removable sheet discharge tray 89 is accommodated below the discharge port 88 in the recording apparatus 85. Furthermore, a pivot type medium support body 90 on which a plurality of sheets P can be loaded is attached to the rear surface side of the recording apparatus 85.

Figure 54:
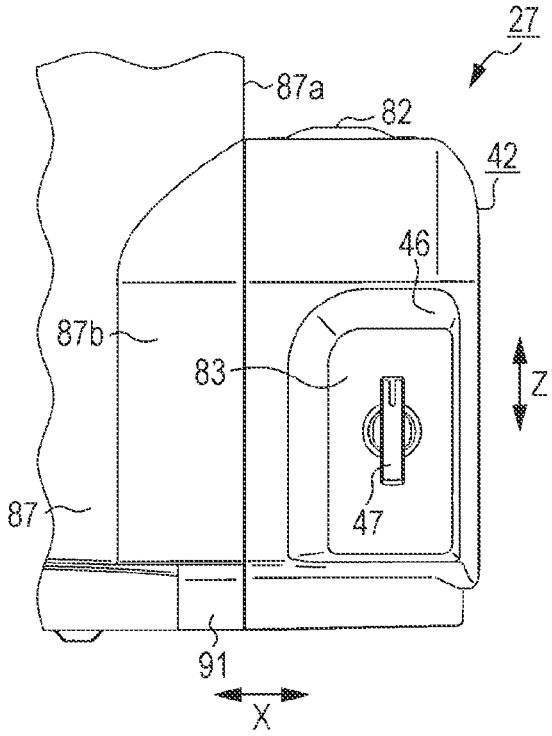
FIG. 54 is a front view of a tank unit.

As illustrated in FIGS. 53 and 54, an overhanging portion 87*b* having a wedge shape in a top view is integrally formed at the front side position of an attachment surface 87*a* to which a tank unit 27 is attached in the apparatus main body 87. The overhanging portion 87*b* is formed to be curved from the upper side to the front side so as to fill the gap between the apparatus main body 87 and the tank unit 27. The front surface of the overhanging portion 87*b* and the front surface of the tank unit 27 are flush with each other.

Figure 55:
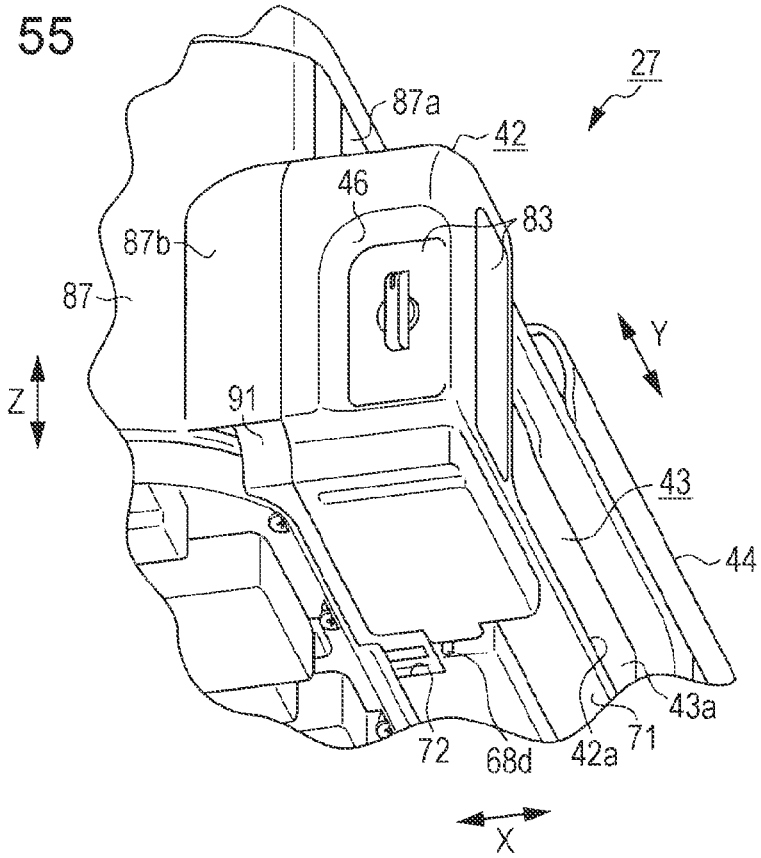
FIG. 55 is a perspective view seen from a lower side of a tank unit.
Figure 56:
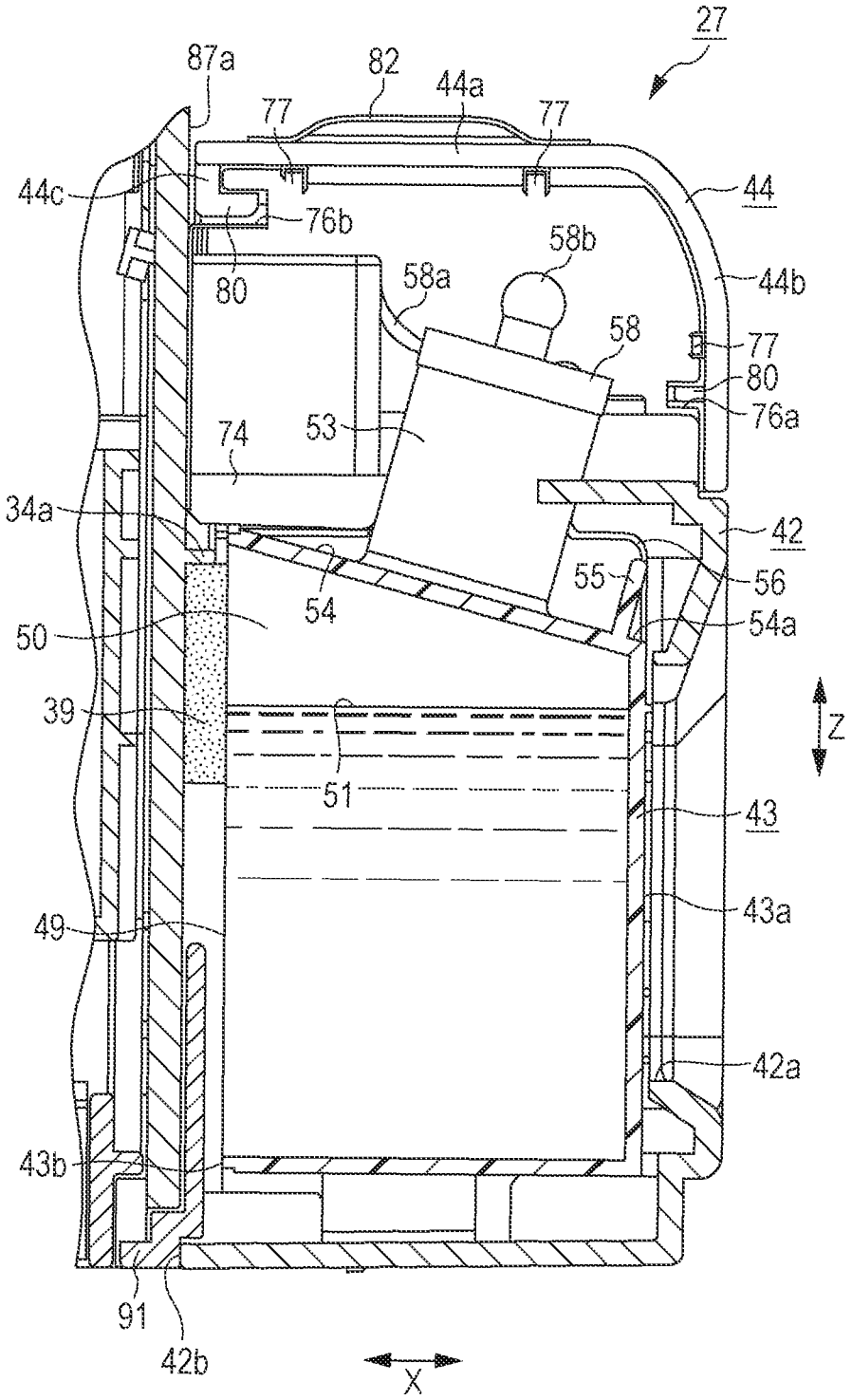
FIG. 56 is a cross-sectional view of a tank unit.

As illustrated in FIGS. 55 and 56, the tank unit 27 is fixedly attached to the apparatus main body 87 via a spacer 91, which has an L-shape in a cross-sectional view and which fills the gap between the tank unit 27 and the lower side portion of the apparatus main body 87. The spacer 91 is disposed from the overhanging portion 87*b* in the front/rear direction Y to an concave engagement portion 72 corresponding to a fourth case locking portion 68*d*. Then, the spacer 91 engages with the concave engagement portion 72 having the fourth case locking portion 68*d*.

Next, an operation when the tank unit 27 is attached to the recording apparatus 85 will be described.

As illustrated in FIG. 55, a tank case 42 to which an ink tank 43 is fixedly attached is first positioned on the attachment surface 87*a* by interposing the spacer 91 between the tank case 42 and the attachment surface 87*a*. At this time, the spacer 91 is positioned by an engagement portion (not illustrated) engaging with a boss portion 38, and the spacer 91 engaging with the concave engagement portion 72, which is formed with the fourth case locking portion 68*d*.

Then, in a state where the tank case 42 is positioned on the attachment surface 87*a*, screws 36 are screwed to case locking portions 68*a* to 68*e*, and the tank case 42 is fixedly attached to the apparatus main body 87.

Next, in a state where the tank case 42 is fixedly attached to the apparatus main body 87, a cover 44 is mounted thereon from the rear side of the tank case 42 such that rail portions 76*a* and 76*b* engage with sliding contact portions 80.

According to the second embodiment, it is possible to obtain the same advantageous operation effects as those of the first embodiment. Furthermore, according to the second embodiment, the following advantageous effects can be obtained.

(58) It is possible to attach the tank unit 27 to different recording apparatuses 12 and 85. That is, it is possible to universally use the tank unit 27, in a plurality of types of recording apparatuses 12 and 85.

The above-described embodiments and examples may be modified as follows.

In the embodiments, the size of the cover 44 may be smaller than the size of the ink tank 43. If the size of the cover 44 is decreased, it is possible to accommodate the cover 44 on the ink tank 43. Accordingly, even when the tank unit 27 is provided with the cover 44, it is possible to decrease a possibility that the cover 44 may be catch on something during transport.

In the embodiments and the examples, the convex barrier portion 55 may not be disposed.

Figure 59:
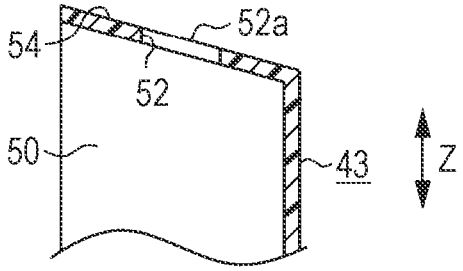
FIG. 59 is a schematic cutaway cross-sectional view of a portion of an injection port in an ink tank in a modification example.

In the embodiments and the examples, as illustrated in FIG. 59, the ink tank 43 may be configured without disposing the cylinder portion 53 (modification example). That is, the end surface 52*a* of the injection port 52 and the injection port forming surface 54 may be matched with each other.

Figure 57:
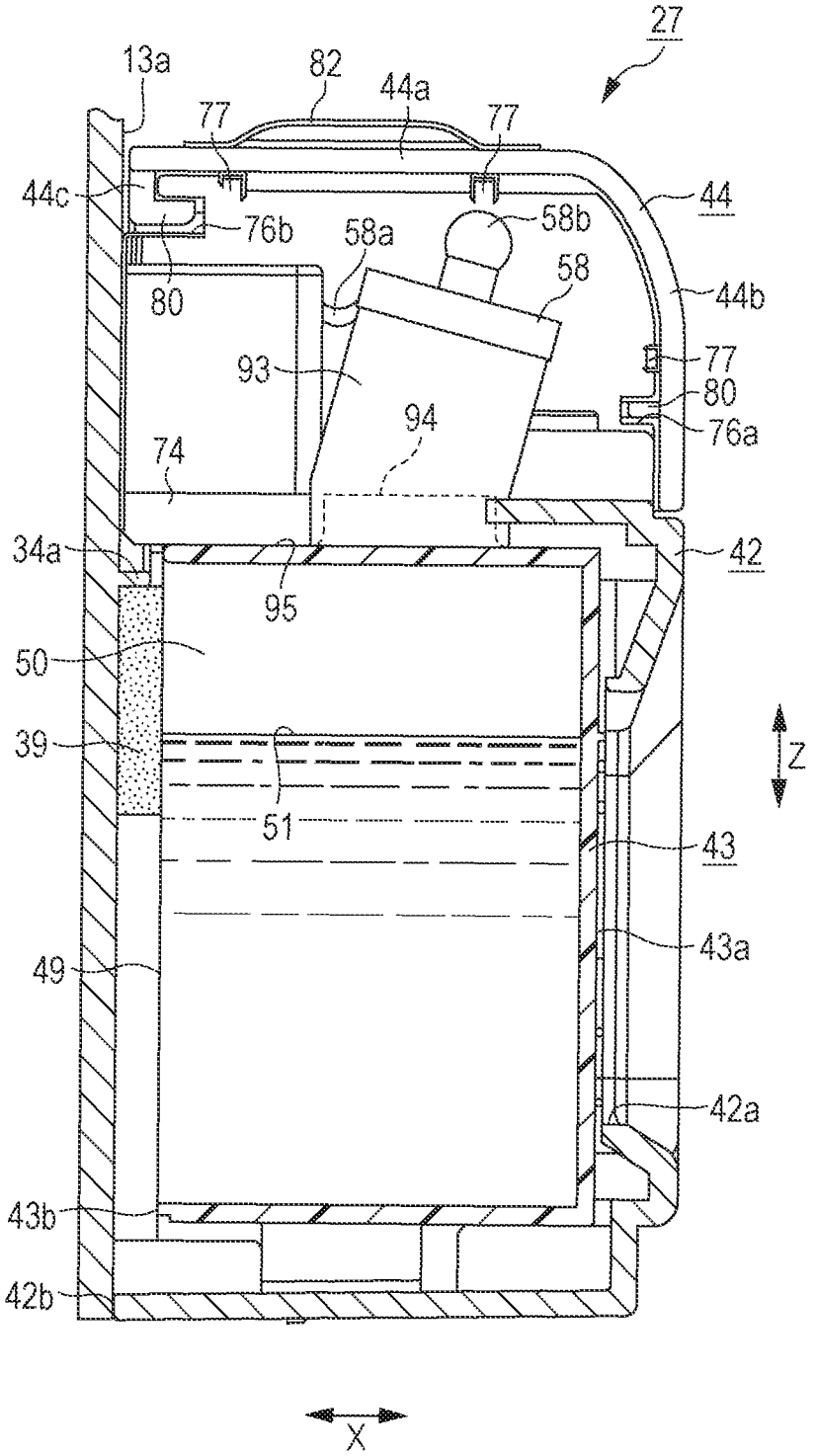
FIG. 57 is a cross-sectional view of a tank unit in a modification example.

In the embodiments and the examples, the cylinder portion 53 may be formed to protrude upward in the vertical direction Z. In this case, as illustrated in FIG. 57, it is preferable to mount a tubular-shaped attachment 93 which is curved at the intermediate position in the vertical direction Z, for example, to the cylinder portion 94. If the attachment 93 is mounted thereon, it is possible to use a hole formed on the attachment 93 as the injection port 52, and it is possible to make the end surface 52*a* of the injection port 52 non-orthogonal to the vertical direction Z (modification example). In addition, the attachment 93 may be deformable.

In the embodiments and the examples, it is possible to optionally set the protruding direction of the cylinder portion 53. For example, the cylinder portion 53, when fixedly attached to the apparatus main body 13, may protrude in the upper left direction, which is the apparatus main body 13 side. Alternately, the cylinder portion 53 may protrude in the upper front direction.

In the embodiments and the examples, the tank case 42 may be configured without the placement portion 75. The placement portion 75 may be disposed in the ink tank 43 or the cover 44 instead of in the tank case 42. In addition, since the tank unit 27 is fixedly attached to the apparatus main body 13, for example, the placement portion 75 may be disposed on the attachment surface 13*a*, and the closing member 58 may be placed thereon. In addition, the placement portion 75 may be formed at the position visible to a user who looks down on it regardless of the position of the cover 44.

In the embodiments and the examples, the cover 44 may be pivoted about the center of a shaft to move between the hiding position to hide the injection port 52 and the non-hiding position different from the hiding position. For example, the shaft may be disposed so as to follow the left/right direction X or follow the front/rear direction Y, and the cover 44 which is located in the hiding position pivoted upward into the non-hiding position. In addition, the shaft may be disposed to follow the vertical direction Z, and the cover 44 may be pivoted in the left/right direction X and the front/rear direction Y.

In the embodiments and the examples, the tank unit 27 may be configured without the cover 44.

In the embodiments and the examples, the height h1 from the lower limit scale 64*a* to the upper limit scale 64*b* in the vertical direction Z may be greater than 40 mm. If the tank unit 27 is accurately manufactured and assembled, the recording apparatuses 12 and 85 are horizontally installed, and further the fluctuation of the liquid level 51 is managed between the lower limit scale 64*a* and the upper limit scale 64*b*, it is possible to excellently supply the ink to the liquid ejecting head 32 even if the height h1 is set to 70 mm.

In the embodiments and the examples, the height h2 from the outlet port 59 to the upper limit scale 64*b* in the vertical direction Z may be greater than 55 mm. If the tank unit 27 is accurately manufactured and assembled, the recording apparatuses 12 and 85 are horizontally installed, and further the fluctuation of the liquid level 51 is managed between the outlet port 59 and the upper limit scale 64*b*, then it is possible to excellently supply the ink to the liquid ejecting head 32 even if the height h2 is set to 70 mm.

In the embodiments and the examples, the height h3 from the outlet port 59 to the injection port 52 in the vertical direction Z may be greater than 70 mm. In this case, for example, it is preferable that the liquid ejecting head 32 be arranged in accordance with the position of the injection port 52, and the lower limit scale 64*a* be formed at a position of 70 mm or less from the injection port 52 in the vertical direction Z. That is, if the liquid ejecting head 32 is arranged in accordance with the position of the injection port 52, even if the ink is injected until the ink spills out from the injection port 52, it is possible to suppress the leakage of the ink from the liquid ejecting head 32. On the other hand, if the ink is consumed and the liquid level 51 drops, there is a possibility that the ink may not be supplied to the liquid ejecting head 32 even though ink remains inside the ink chamber 50. In this regard, if the lower limit scale 64*a* is formed at a position at 70 mm or less from the injection port 52, it is possible to promote injection of ink before the ink can no longer be supplied.

In the embodiments and the examples, the width of the ink chamber 50 in the left/right direction X may be smaller than the height in the vertical direction Z. In addition, the width in the front/rear direction Y may be smaller than the height in the vertical direction Z.

In the embodiments and the examples, any one scale of the lower limit scale 64*a* and the upper limit scale 64*b* may be dispensed with. In addition, another scale may be formed in addition to the lower limit scale 64*a* and the upper limit scale 64*b*.

In the embodiments and the examples, the visible surface 43*a* may be formed to face a plurality of directions. For example, the injection port forming surface 54 may function as the visible surface 43*a*, the lower limit scale 64*a* may be formed on the visible surface 43*a*, and the upper limit scale 64*b* may be formed on the injection port forming surface 54. In addition, a window portion may be formed on the front surface or the rear surface of the tank case 42, and then the front surface and the rear surface of the ink tank 43 visible from the window portion may function as the visible surface 43*a*.

In the embodiments and the examples, the upper limit scale 64*b* may be formed at the opposite side to the side where the injection port 52 is formed in the front/rear direction Y.

In the embodiments and the examples, the width of the visible surface 43*a* in the front/rear direction Y may be smaller than the height in the vertical direction Z.

In the embodiments and the examples, the lower limit scale 64*a* may be formed at the opposite side from the side where the injection port 52 is formed in the front/rear direction Y. In addition, the lower limit scale 64*a* may be formed at the opposite side to the side where the outlet port 59 is formed in the front/rear direction Y.

In the embodiments and the examples, the lower limit scale 64*a* and the upper limit scale 64*b*, even if formed at the same side in the front/rear direction Y, may be alternately formed at different positions in the front/rear direction Y. Furthermore, the lower limit scale 64*a* and the upper limit scale 64*b* may be alternately formed at different positions from the injection port 52 in the front/rear direction Y.

In the embodiments and the examples, the injection port 52 and the outlet port 59 may be formed at different sides of the ink tank 43 in the front/rear direction Y.

In the embodiments and the examples, the tilt of the cylinder portion 53 with respect to the vertical direction Z may be different from the tilt of the injection port forming surface 54 with respect to the vertical direction Z.

In the embodiments and the examples, as illustrated in FIG. 57, the injection port forming surface 95 may be formed so as to be orthogonal to the vertical direction Z.

In the embodiments and the examples, without forming the cylinder portion 53, the injection port 52 may be formed on the injection forming surface 54. Since the injection port forming surface 54 is non-orthogonal to the vertical direction Z, the end surface 52*a* of the injection port 52 is also non-orthogonal to the vertical direction Z. In addition, the convex barrier portion 55 may be disposed at the same position as or at the further upper position than the position of the injection port 52 in the vertical direction Z.

Figure 60:
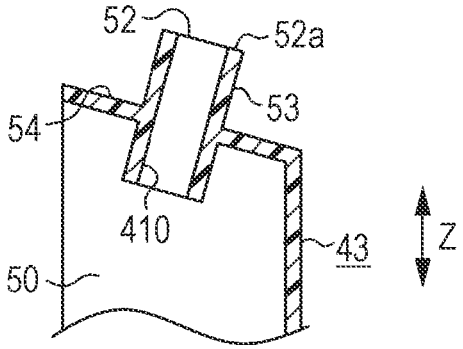
FIG. 60 is a schematic cutaway cross-sectional view of a portion of an injection port in an ink tank in a modification example.

In the embodiments and the examples, as illustrated in FIG. 60, a flow channel 410, which is an example of a second flow channel, may be formed in the cylinder portion 53, and the injection port 52 communicating with the ink chamber 50 may be formed at the front end of the flow channel 410 (modification example). The flow channel 410 is formed inside the cylinder portion 53, which extends in the obliquely rightward rising direction, which is an example of the non-orthogonal direction to the vertical direction Z. As with the cylinder portion 53, the flow channel 410 extends in the obliquely rightward rising direction. Therefore, when the ink tank 43 is fixed to the recording apparatus 12 provided with the liquid ejecting head 32, the flow channel 410 is tilted in the direction away from the recording apparatus 12 as far as the injection port 52 side. Furthermore, the cylinder portion 53 may extend outward from the ink chamber 50, and may extend inward of the ink chamber 50. That is, the flow channel 410 may extend outward from the ink chamber 50, or may extend inward of the ink chamber 50.

For example, in a case of the flow channel 410 extending in the vertical direction Z, if the ink is injected through the injection port 52 non-orthogonal to the vertical direction Z, there is a possibility that the injected ink may collide with the wall of the flow channel 410, and the splashing ink may dirty the surrounding area. In this regard, if the flow channel 410 extends in the direction non-orthogonal to the vertical direction Z, it is possible to decrease the mess caused by the splashing ink. Furthermore, since the flow channel 410 is located outside the ink chamber 50, it is possible to more easily inject ink through the injection port 52 formed at the front end of the flow channel 410. In addition, the flow channel 410 is formed to be tilted in the separating direction from the recording apparatus 12 when the ink tank 43 is fixed to the recording apparatus 12. Accordingly, it is possible to more easily inject the ink.

Figure 61:
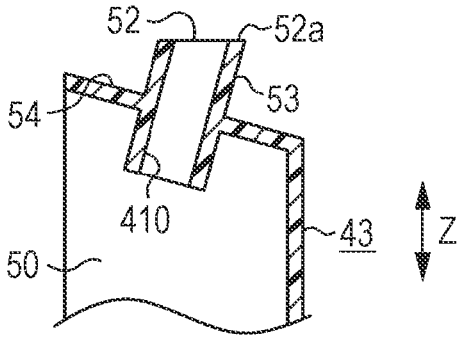
FIG. 61 is a schematic cutaway cross-sectional view of a portion of an injection port in an ink tank in a modification example.

In the embodiments and the examples, as illustrated in FIG. 61, whereas the flow channel 410 extends in the direction non-orthogonal to the vertical direction Z, the end surface 52*a* of the injection port 52 may be formed following the horizontal direction orthogonal to the vertical direction Z (modification example).

Figure 62:
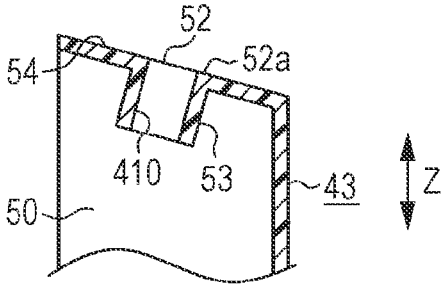
FIG. 62 is a schematic cutaway cross-sectional view of a portion of an injection port in an ink tank in a modification example.

In the embodiments and the examples, as illustrated in FIG. 62, the cylinder portion 53 may extend inward of the ink chamber 50 without extending outward from the ink chamber 50 (modification example). That is, the flow channel 410 may be formed so as to extend inward of the ink chamber 50. If the cylinder portion 53 does not extend outward from the ink chamber 50, the end surface 52*a* of the injection port 52 and the injection port forming surface 54 are matched with each other. Then, since the injection port forming surface 54 is non-orthogonal to the vertical direction Z, the end surface 52*a* of the injection port 52 is also non-orthogonal to the vertical direction Z.

When the cylinder portion 53 extends inward of the ink chamber 50 in this manner, the cylinder portion 53 is unlikely to be an obstacle, compared to a case where the cylinder portion 53 extends outward from the ink chamber 50. In addition, since the flow channel 410 extends inward of the ink chamber 50, the flow channel 410 is unlikely to be an obstacle, compared to a case where the flow channel 410 extends outward from the ink chamber 50.

Figure 63:
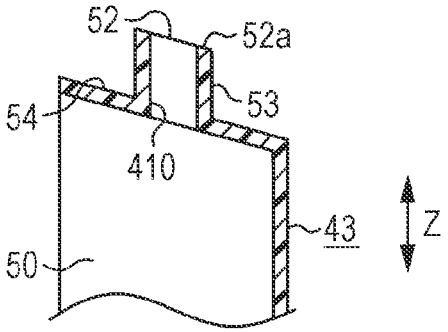
FIG. 63 is a schematic cutaway cross-sectional view of a portion of an injection port in an ink tank in a modification example.

In the embodiments and the examples, as illustrated in FIG. 63, if the cylinder portion 53 is formed to protrude upward, and the front end surface of the cylinder portion 53 is formed to be non-orthogonal to the vertical direction Z, the end surface 52*a* of the injection port 52 may be non-orthogonal to the vertical direction Z (modification example). Since the flow channel 410 extends in the vertical direction Z, it is also possible to form the cylinder portion 53 to extend in the vertical direction Z. Accordingly, since the cylinder portion 53 does not protrude in the direction other than the vertical direction Z, the cylinder portion 53 is unlikely to be an obstacle.

Figure 64:
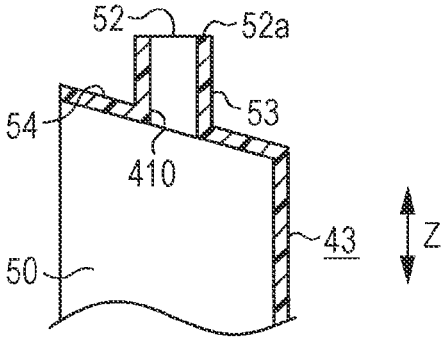
FIG. 64 is a schematic cutaway cross-sectional view of a portion of an injection port in an ink tank in a modification example.

In the embodiments and the examples, as illustrated in FIG. 64, the end surface 52*a* of the injection port 52 and the injection port forming surface 54 may be non-parallel to each other (modification example). That is, the end surface 52*a* of the injection port 52 may be formed to be orthogonal to the vertical direction Z, and the injection port forming surface 54 may be formed to be non-orthogonal to the vertical direction Z. If the injection port forming surface 54 is tilted, even if the ink leaks from the injection port 52, it is possible to cause the ink to flow down on the injection port forming surface 54.

Figure 65:
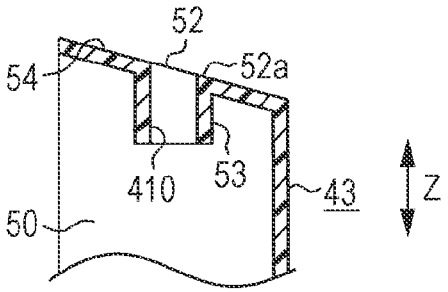
FIG. 65 is a schematic cutaway cross-sectional view of a portion of an injection port in an ink tank in a modification example.

In the embodiments and the examples, as illustrated in FIG. 65, the cylinder portion 53 extending in the vertical direction Z and the flow channel 410 formed in the cylinder portion 53 and extending in the vertical direction Z may be formed inside the ink chamber 50 (modification example). The end surface 52*a* of the injection port 52 is non-orthogonal to the vertical direction Z, similarly to the injection port forming surface 54.

Figure 66:
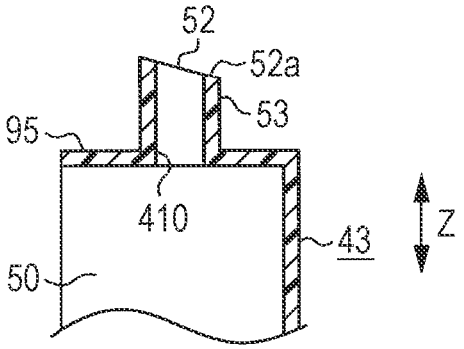
FIG. 66 is a schematic cutaway cross-sectional view of a portion of an injection port in an ink tank in a modification example.

In the embodiments and the examples, as illustrated in FIG. 66, whereas the flow channel 410 extends in the vertical direction Z, the end surface 52*a* of the injection port 52 may be formed to be non-orthogonal to the vertical direction Z (modification example). Furthermore, the injection port forming surface 95 may be formed following the horizontal direction orthogonal to the vertical direction Z.

Figure 67:
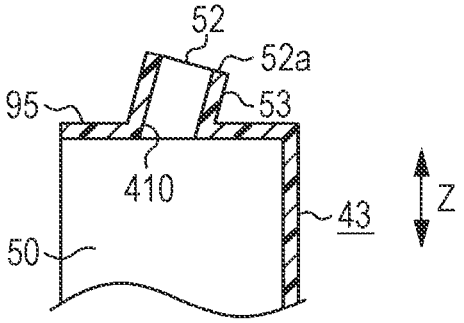
FIG. 67 is a schematic cutaway cross-sectional view of a portion of an injection port in an ink tank in a modification example.

In the embodiments and the examples, as illustrated in FIG. 67, whereas the flow channel 410 extends in the direction non-orthogonal to the vertical direction Z, the end surface 52*a* of the injection port 52 may be formed to be non-orthogonal to the vertical direction Z (modification example). Furthermore, the injection port forming surface 95 may be formed following the horizontal direction orthogonal to the vertical direction Z.

Figure 68:
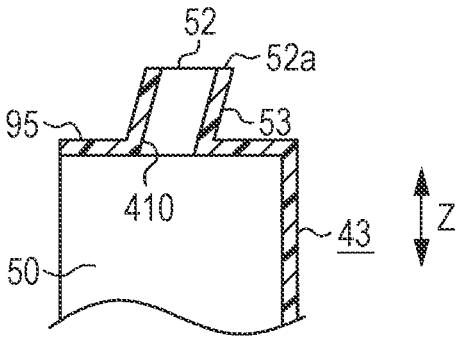
FIG. 68 is a schematic cutaway cross-sectional view of a portion of an injection port in an ink tank in a modification example.

In the embodiments and the examples, as illustrated in FIG. 68, whereas the flow channel 410 extends in the direction non-orthogonal to the vertical direction Z, the end surface 52*a* of the injection port 52 may be formed to be orthogonal to the vertical direction Z (modification example). Furthermore, the injection port forming surface 95 may be formed following the horizontal direction orthogonal to the vertical direction Z.

In the embodiments and the examples, the respective tilts of the injection port 52 and the convex barrier portion 55 with respect to the vertical direction Z may be different from each other. That is, the respective tilts of the cylinder portion 53, having the injection port 52, and the convex barrier portion 55 with respect to the vertical direction Z may be different from each other.

In the embodiments and the examples, the injection port forming surface 54 may be formed to face a plurality of directions. For example, the injection port forming surface 54 may be formed in a chevron shape or an inverse chevron shape toward the rib portion 56 from the walls located at both sides in the front/rear direction Y.

Figure 58:
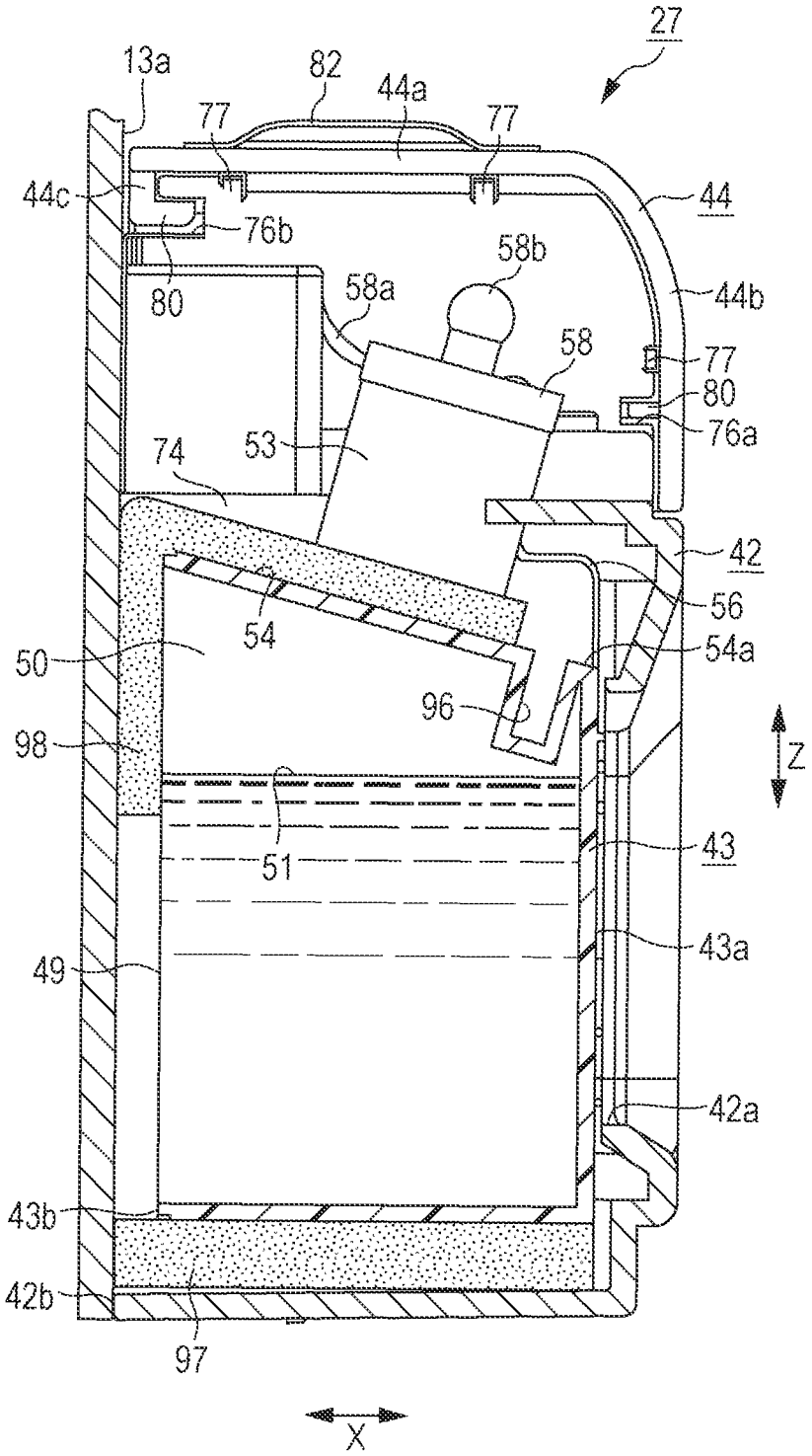
FIG. 58 is a cross-sectional view of a tank unit in a modification example.

In the embodiments and the examples, as illustrated in FIG. 58, a concave barrier portion 96, which is an example of the barrier portion, and the groove portion may be formed to be recessed on the injection port forming surface 54 (modification example). Since the leaked ink is captured by the concave barrier portion 96 formed to be recessed on the injection port forming surface 54, it is possible to block the leaked ink. In addition, the concave barrier portion 96 and the convex barrier portion 55 may be formed side by side.

In the embodiments and the examples, the injection port forming surface 54 may be an ascending slope toward the visible surface 43*a* side. Then, the convex barrier portion 55 may be located above the injection port 52. The absorbent material 39 is interposed between the apparatus main body 13 and the tank unit 27. Therefore, the ink leaking out from the injection port 52 and flowing down on the injection port forming surface 54 is absorbed by the absorbent material 39. Accordingly, the absorbent material 39 is disposed on the flow channel of the leaked ink. By attaching the absorbent material 39 onto the flow channel of the leaked ink, the absorbent material 39 can absorb the leaked ink. Accordingly, it is possible to decrease a possibility that the leaking ink may dirty the surrounding of the leaked portion.

In the embodiments and the examples, the width of the convex barrier portion 55 in the front/rear direction Y may be narrower than the width of the injection port 52 or the cylinder portion 53. In addition, the shape of the convex barrier portion 55 may be a U-shape, V-shape or W-shape. In addition, the convex barrier portion 55 may be formed in a ring shape surrounding the periphery of the injection port 52 or a C-shape where a portion thereof is separated.

In the embodiments and the examples, the convex barrier portion 55 may be formed at the end portion of the injection port forming surface 54 and may be configured not to include the stepped portion 54*a*. The stepped portion 54*a* may be formed so as to have a surface orthogonal to the vertical direction Z or a surface tilted toward the convex barrier portion 55 side.

In the embodiments and the examples, the visible surface 43*a* need not be provided. In addition, the lower limit scale 64*a* and the upper limit scale 64*b* need not be provided.

In the embodiments and the examples, as illustrated in FIG. 58, an absorbent material 97 may be interposed between the ink tank 43 and the tank case 42. In this case, the tank case 42 functions as an example of the protection member.

In the embodiments and the examples, as illustrated in FIG. 58, an absorbent material 98 to be interposed between the apparatus main body 13 and the ink tank 43 may be extended onto the injection port forming surface 54. That is, the absorbent material 98 is continuously arranged from the injection port 52 to the portion between the apparatus main body 13 and the ink tank 43, and is disposed on the flow channel of the leaked ink. In this configuration, a single absorbent material 98 can be used to absorb the leaked ink leaking from the injection port 52 or the leaked ink flowing between the ink tank 43 and the apparatus main body 13. In addition, another absorbent material may be disposed on the injection port forming surface 54 separately from the absorbent material 39 to absorb the ink leaking from the cylinder portion 53. Since the absorbent material is attached onto the injection port forming surface 54, which is the flow channel of the leaked ink, the absorbent material can absorb the leaked ink. Accordingly, it is possible to decrease a possibility that ink will cling to the vicinity of the injection port 52 when injecting the ink, or after clinging, flow and dirty the surrounding. Then, at least one of the absorbent materials 39, 97 and 98 may be attached to the ink tank 43 by being adhered or mounted. That is, the ink tank 43 may be provided with the absorbent material 39.

In addition, the absorbent material 98 may be arranged not only on the injection port forming surface 54 but also on a surface extending in the direction intersecting with the injection port forming surface 54. For example, the absorbent material 98 may be arranged on the right surface of the ink tank 43 having the visible surface 43*a* through which the liquid level 51 inside the ink chamber 50 can be visually recognized from outside. That is, when the absorbent material 98 is arranged on the right surface of the ink tank 43, the absorbent material 98 may be continuously disposed to a position close to the injection port forming surface 54, which is above the visible surface 43*a*. In addition, the absorbent material 98 may be disposed on each surface as a separate body. If the absorbent material 98 is arranged at a position between the visible surface 43*a* and the injection port forming surface 54, it is possible to decrease a possibility that the visible surface 43*a* may be contaminated by the ink leaking from the injection port 52. Accordingly, it is possible to decrease a possibility that the visibility of the liquid level 51 through the visible surface 43*a* may be degraded.

In the embodiments and the examples, the thickness of the absorbent material 39 in the left/right direction may be thinner than the width of the gap between the apparatus main body 13 and the ink tank 43. That is, if the tank unit 27 is fixedly attached to the apparatus main body 13, the absorbent material 39 may be interposed therebetween without the process of compressive deformation.

In the embodiments and the examples, the absorbent material 39 may be interposed between the apparatus main body 13 and the tank unit 27 without adhering it to the apparatus main body 13. In a state where the tank unit 27 is fixedly attached to the apparatus main body 13, the absorbent material 39 may be inserted to the gap between the apparatus main body 13 and the tank unit 27.

Figure 69:
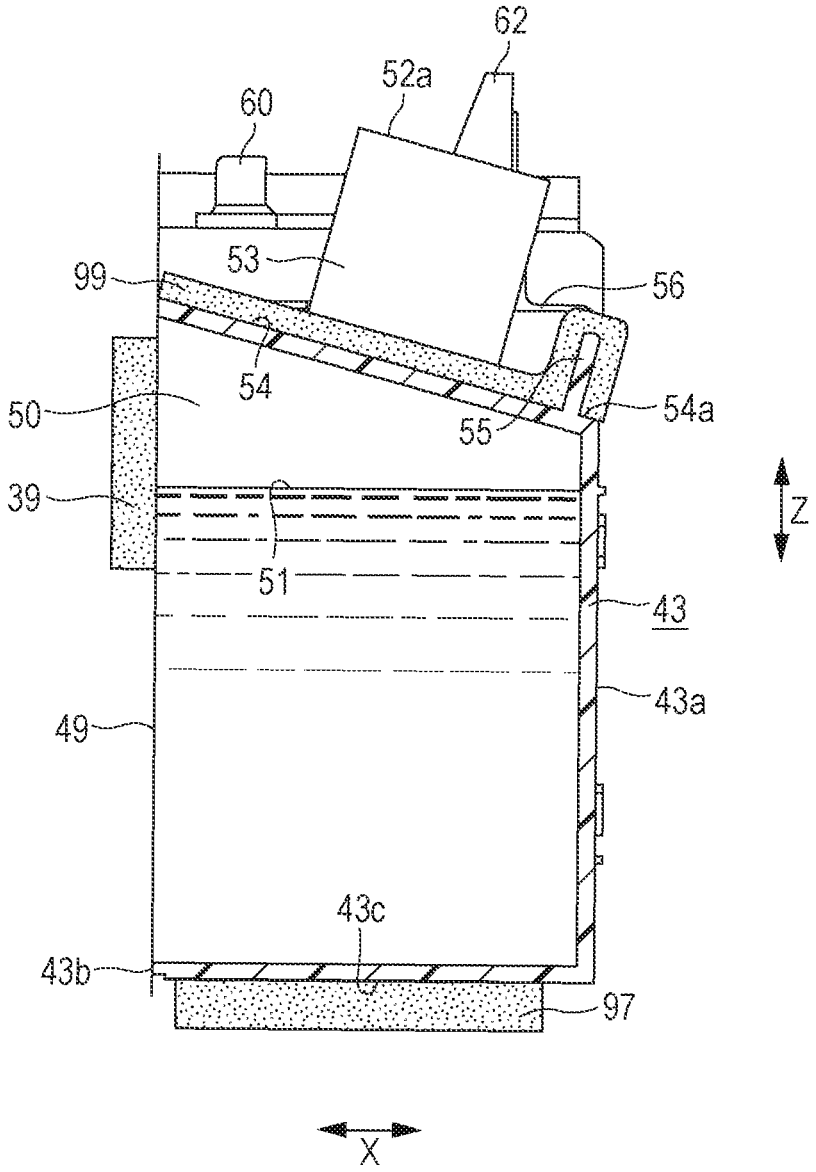
FIG. 69 is a cross-sectional view of an ink tank in a modification example.

In the embodiments and the examples, as illustrated in FIG. 69, the absorbent materials 39, 97 and 99 may be arranged on the outer surface of the ink tank 43 (modification example). That is, the absorbent materials 39, 97 and 99 may be arranged in at least one location on the outer surface of the ink tank 43. In this case, the absorbent materials 39, 97 and 99 arranged in at least one location on the outer surface of the ink tank 43 can absorb the ink clinging to the vicinity of the injection port 52 when injecting the ink, or the ink flowing down on the outer surface of the ink tank 43 after clinging. Accordingly, it is possible to decrease a possibility that the ink may contaminate the surrounding.

For example, among the outer surfaces of the ink tank 43, the absorbent material 39 may be arranged on the surface of the film 49, which is a surface (left side surface in FIG. 69)

that intersects with the injection port forming surface 54 having the injection port 52, and that is the apparatus main body 13 side of the recording apparatus 12. In this case, even if the ink adhering to the vicinity of the injection port 52 flows down on a surface formed by the film 49 among the outer surfaces of the ink tank 43, the ink is absorbed by the absorbent material 39 before the ink flows on the installation surface of the ink tank 43. Accordingly, it is possible to decrease a possibility that the ink may contaminate the surrounding.

In this case, the absorbent material 39 may be arranged on the right side surface, front surface and rear surface without being limited to the left side surface of the ink tank 43, if the surface intersects with the injection port forming surface 54 among the outer surfaces of the ink tank 43. In addition, when the absorbent materials 39, 97 and 99 are mounted on the outer surfaces of the ink tank 43 as an example arrangement, the mounting method includes bonding by a bonding agent, adhesion by using a double-sided tape or adhesive tape, engagement using hook-shaped engagement portions, or concave engagement portions, fixing by using a fixing member, and mounting it on the ink tank 43.

In addition, among the outer surfaces of the ink tank 43, the absorbent material 99 may be arranged on the injection port forming surface 54 having the injection port 52. In this case, since the absorbent material 99 is mounted on the injection port forming surface 54, the absorbent material 99 can efficiently absorb the ink clinging to the vicinity of the injection port 52 when injecting the ink.

Alternatively, the absorbent material may be arranged at a position, which is the injection port 52 side in the vertical direction, on a surface of the outer surfaces of the ink tank 43 (right side surface in FIG. 69) that configures the visible surface 43*a* through which the liquid level 51 of the ink inside the ink tank 43 can be visually recognized, and that is a surface intersecting with the injection port forming surface 54. In FIG. 69, the absorbent material arranged at such a position corresponds to one end side portion thereof (right end side portion in FIG. 69) of the absorbent material 99 arranged on the injection port forming surface 54, rides over the convex barrier portion 55 from the injection port forming surface 54 side, and hangs downward toward the visible surface 43*a* to the stepped portion 54*a* side. According to this configuration, the ink clinging to the vicinity of the injection port 52 when injecting the ink is suppressed from reaching the visible surface 43*a* through which the liquid level 51 of the ink inside the ink chamber 43 can be visually recognized. Accordingly, it is possible to decrease a possibility that the visibility of the liquid level 51 may be impaired.

Furthermore, among the outer surfaces of the ink tank 43, the absorbent material 97 may be arranged on the bottom surface 43*c* opposing the installation surface. In this case, since the absorbent material 97 is arranged on the bottom surface 43*c*, it is possible to decrease a possibility that the installation surface of the ink tank 43 may be contaminated by the ink flowing to the bottom surface 43*c*.

In the embodiment illustrated in FIG. 5, the ink tank 43 is attached to the apparatus main body 13 of the recording apparatus 12 by being accommodated inside the tank case 42. However, as illustrated in FIG. 59*xxx*, the ink tank 43 itself may be mounted on the apparatus main body 13 of the recording apparatus 12, or may be placed on a position in the vicinity of the apparatus main body 13, without being accommodated inside the tank case 42.

In the embodiments and the examples, any one or any two of the absorbent materials 39, 97 and 99 may be arranged in the ink tank 43. In addition, among the absorbent materials 39, 97 and 99, at least one type of the absorbent material may be arranged at two locations or more. Furthermore, among the absorbent materials 39, 97 and 99, at least two or three absorbent materials may be integrally formed. That is, for example, the left end of the absorbent material 97 may be extended following the film 49, which is the left side surface of the ink tank 43. In addition, the right end of the absorbent material 97 may extend following the right side surface of the ink tank 43 having the visible surface 43*a*, or similarly the front end and the rear end of the absorbent material 97 may be extended following the front surface and the rear surface of the ink tank 43.

When the absorbent materials 39, 97 and 99 are arranged on the outer surface of the ink tank 43, the absorbent materials 39, 97 and 99 need not be mounted on the outer surface of the ink tank 43, but for example, the absorbent materials 39, 97 and 99 may be arranged to be interposed between the tank case 42 and the ink tank 43.

Figure 70:
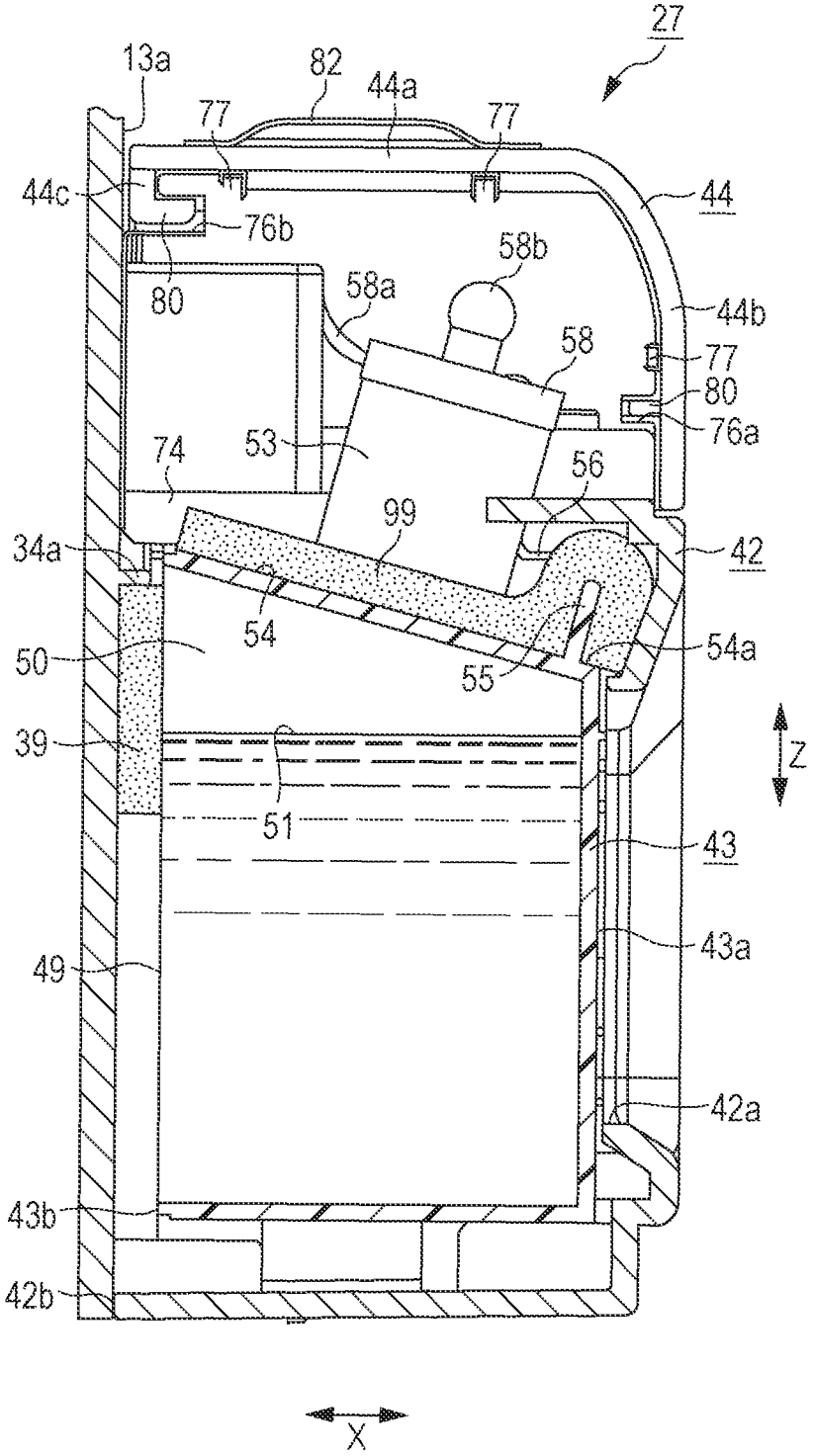
FIG. 70 is a cross-sectional view of an ink tank in a modification example.

For example, as illustrated in FIG. 70, in a case of the absorbent material 99 arranged on the injection port forming surface 54, a portion that rides over the convex barrier portion 55 from the injection port forming surface 54 side, and that hangs downward toward the visible surface 43*a* to the stepped portion 54*a* side, may be arranged to be interposed between the inner surface of the tank case 42 and the top portion of the convex barrier portion 55, and then in this state, the absorbent material 99 may be fixed onto the injection port forming surface 54. In this case, the convex barrier portion 55 and the absorbent material 99 may be bonded together by using the bonding member such as the double-sided tape.

In the embodiments and the examples, as illustrated in FIG. 69, the absorbent material 99 may be disposed so as to envelop the convex barrier portion 55. However, in this case, one end side of the absorbent material 99 need not to be extended to the stepped portion 54*a*, but for example, the right end of the absorbent material 99 may be disposed to be bent upward following the convex barrier portion 55. Furthermore, the front end or the rear end of the absorbent material 99 may also be disposed so as to bend upward following or to surround the wall located at both of the front and rear sides of the injection port forming surface 54. The absorbent material 99 in this case need not be mounted on the outer surface of the ink tank 43, but may be arranged to be interposed between the tank case 42 and the ink tank 43.

In the embodiments and the examples, the size of the absorbent materials 97 and 99 may be larger than the bottom surface 43*c* in either the left/right direction X, the front/rear direction Y, or both. In addition, the size of the absorbent material 39 may be larger than the tank opening portion 43*b* in the front/rear direction Y, the vertical direction Z, or both.

In the embodiments and the examples, the handle portion 71 may be disposed at a different position from the space between the fourth case locking portion 68*d* and the fifth case locking portion 68*e*. In addition, the handle portion 71 need not be disposed in the tank case 42.

In the embodiments and the examples, only one pair of the concave positioning portions 63*a*, 63*b* and the convex positioning portions 67*a*, 67*b* need be provided to engage each other using concavo-convexity. Three pairs or more of concave positioning portions and convex positioning portions may be provided. Furthermore, even if two or more of the concave positioning portions and the convex positioning portions are provided, a long hole need not be included in the configuration.

In the embodiments and the examples, the concave positioning portions 63*a* and 63*b*, and the convex positioning portions 67*a* and 67*b* may not be disposed in the configuration.

In the embodiments and the examples, the case opening portion 42*b* need not be larger than the right side surface of the ink tank 43. If the case opening portion 42*b* is larger than either the front surface or the rear surface of the ink tank 43, it is possible to accommodate the ink tank 43 inside the tank case 42.

In the embodiments and the examples, the tank case 42 may be integrally molded with four surfaces or three surfaces. For example, the tank case 42 may be integrally molded with the front surface, rear surface, right surface and top surface, and need not include the bottom surface in the configuration.

In the embodiments and the examples, only a portion of the ink chamber 50 in the vertical direction Z need satisfy the shape condition. That is, for example, a portion that does not satisfy the shape condition could be continuously provided to a rectangular parallelepiped-shaped portion that does satisfy the shape condition. The shape of the ink chamber 50 can be optionally changed if it satisfies the shape condition. For example, the shape in a horizontal cross-sectional view may be round, oval, rectangular, polygonal, or a shape partially having a concave-convex portion, curved portion, bent portion, arch portion, or circular arc portion. In addition, the ink chamber 50 may have a shape where the shape in a horizontal cross-sectional view changes depending on each position in the vertical direction Z.

In the embodiments and the examples, the air intake port 60 may be disposed at any position if it is located above the upper limit scale 64*b*. For example, the intake port 60 may be disposed on the right side surface of the ink tank 43.

In the embodiments and the examples, as illustrated in FIG. 1, when determining whether to inject ink or not, and when injecting the ink, the scale 28*a* may be aligned with the window portion 42*a*, and a scale mark formed on the scale 28*a* may be used as a reference.

In the embodiments and the examples, the lower limit scale 64*a* and the upper limit scale 64*b* may be formed by sticking a seal having the scale mark onto the visible surface 43*a* of the ink tank 43.

In the embodiments, the lower limit scale 64*a* and the upper limit scale 64*b* need not have a line extending in the front/rear direction, but may have only a triangular mark. In addition, the triangular mark need not be formed, but only a line extending in the front/rear direction may be formed.

In the embodiments and the examples, the number of the case locking portions 68*a* to 68*e* may be different from the number of the screw boss portions 37. If the screw 36 is screwed to at least one case locking portion out of the case locking portions 68*a* to 68*e* and the screw boss portions 37, it is possible to fixedly attach the tank unit 27 to the apparatus main body 13. The term "fixedly attached" is a state where the tank unit 27 does not separate from the apparatus main body 13 and includes a loose fit.

In the embodiments and the examples, the tank unit 27 may be fixed to the apparatus main body 13 using a fixing member such as a bolt, double-sided tape, bonding agent, adhesive tape, caulking, string, and fastening band.

In the embodiments and the examples, the ink tank 43 may be disposed inside the apparatus main body 13. That is, if the ink tank 43 is arranged outside the movement area T of the liquid ejecting head 32, it is possible to form the ink tank 43 inside the apparatus main body 13 such that the height H is larger than the depth D and the width W is larger than the height H. xxxJP551 For example, FIG. 1 illustrates an example where the tank case 42 accommodating the ink tank 43 is integrally molded with the apparatus main body 13, which is the housing of the recording apparatus 12, and the slidable cover 44 is integrally molded with the tank case 42. In this manner, since the ink tank 43 is accommodated inside the housing common to the liquid ejecting head 32, it is possible to have dimensions that enable easy management of the water head difference between the nozzle forming surface of the liquid ejecting head 32 and the liquid level 51 of the ink inside the ink tank 43. Accordingly, the same advantageous effect as that described in the above (52) can be obtained.

Figure 71:
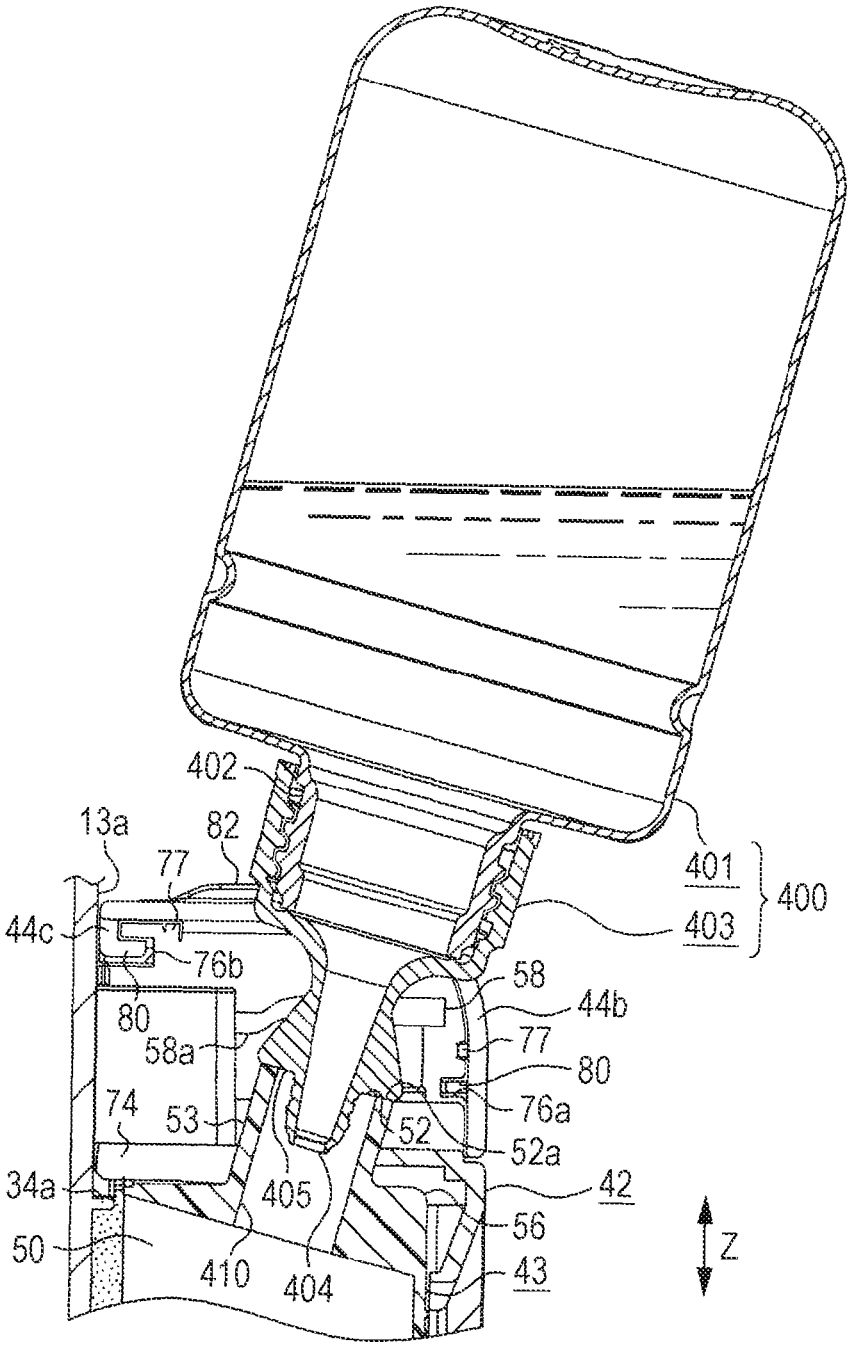
FIG. 71 is a partial cutaway cross-sectional view of an ink container and a tank unit when injecting an ink.

In the embodiments and the examples, as illustrated in FIG. 71, when injecting the ink, the ink may be injected to the ink tank 43 from an ink container 400 having relatively large capacity and containing the ink for injection. In this case, the ink container 400 includes a bottle-shaped main body portion 401 and a cap member 403 to be screwed to a bottle mouth portion 402 of the main body portion 401, and the front end side of the cap member 403 has a cylindrical shape with a smaller diameter than that of the base end side screwed to the bottle mouth portion 402. When the ink is to be injected, the front end side of the cap member 403 is cut to form in the ink container 400 a spout 404 communicating with the inside of main body portion 401 containing the ink. In addition, a contact portion 405 further protruding outward than the spout 404 is formed at a position slightly separated from the front end portion to the base end side, in the cylindrical portion having the small diameter in the cap member 403. When the spout 404 of the ink container 400 is inserted to the injection port 52 of the ink tank 43, the contact portion 405 comes into contact with the end surface 52*a* of the cylinder portion 53 having the injection port 52. If in this way the contact portion 405 abuts against the end surface 52*a* of the cylinder portion 53 and the spout 404 is inserted to the injection port 52, the ink contained inside the main body portion 401 is injected to the ink chamber 50 of the ink tank 43.

Here, a flow channel 410, which has the injection port 52 at its foremost end, protrudes in a direction non-orthogonal to the vertical direction Z. Therefore, when injecting the ink into the ink chamber 50 by aligning the spout 404 of the ink container 400, which contains the ink inside, with the injection port 52, it is possible to decrease a possibility that a member located around the injection port 52 may abut agains ink container 400 and interfere with injection of ink. Accordingly, it is possible to easily inject the ink.

Figure 72:
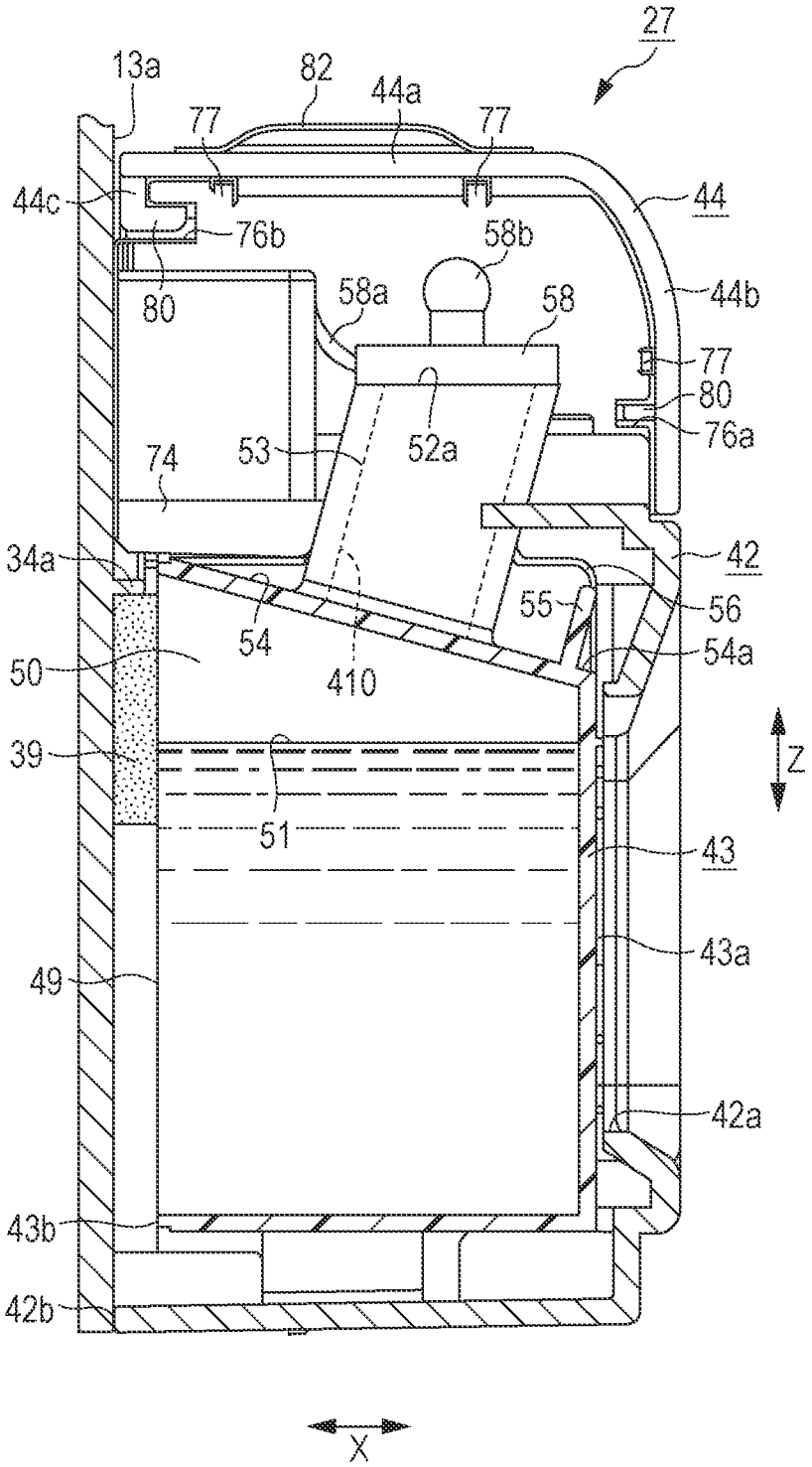
FIG. 72 is across-sectional view of a tank unit in a modification example.

In the embodiments and the examples, as illustrated in FIG. 72, the ink tank 43 may have the cylinder portion 53, which has the injection port 52 at the front end, that protrudes in a direction non-orthogonal to the vertical direction Z, and an end surface 52*a* that is orthogonal to the vertical direction Z. A flow channel 410 extending in the direction non-orthogonal to the vertical direction Z may be formed in the cylinder portion 53. Even if the end surface 52*a* is orthogonal to the vertical direction Z, the injection port forming surface 54 may face any direction, and for example, the injection port forming surface 54 may be non-orthogonal to the vertical direction Z. In addition, the cylinder portion 53 may be tilted in any direction, and for example, may be tilted in a direction away from the apparatus main body 13.

Here, the end surface 52*a* of the injection port 52 is orthogonal to the vertical direction Z (that is, horizontal). Therefore, a user, when injecting the ink, inserts the spout 404 of the ink container 400 containing the ink inside to the injection port 52, and then can support the ink container 400 in a state where a portion of the ink container 400 (in this case, the contact portion 405) is placed on the horizontal end surface 52*a* in the cylinder portion 53 having the injection port 52. Accordingly, it is possible to easily inject the ink.

In the embodiments and the examples, the cylinder portion 53 may be bent or curved. That is, for example, the base end side of the cylinder portion 53, which is the injection port forming surface 54 side, may be formed to be non-orthogonal to the vertical direction Z, and the front end side of the cylinder portion 53 may be formed in the vertical direction Z. In this manner, if a portion of the cylinder portion 53 is non-orthogonal to the vertical direction Z, the end surface 52*a* may be orthogonal in the vertical direction Z.

In the embodiments and the examples, the configuration need not be provided with the tank case 42. That is, for example, the screw boss portion 37 in the apparatus main body 13 may be formed at a position corresponding to the tank locking portion 62 of the ink tank 43, and the ink tank 43 may be directly fixed to the apparatus main body 13.

Figure 73:
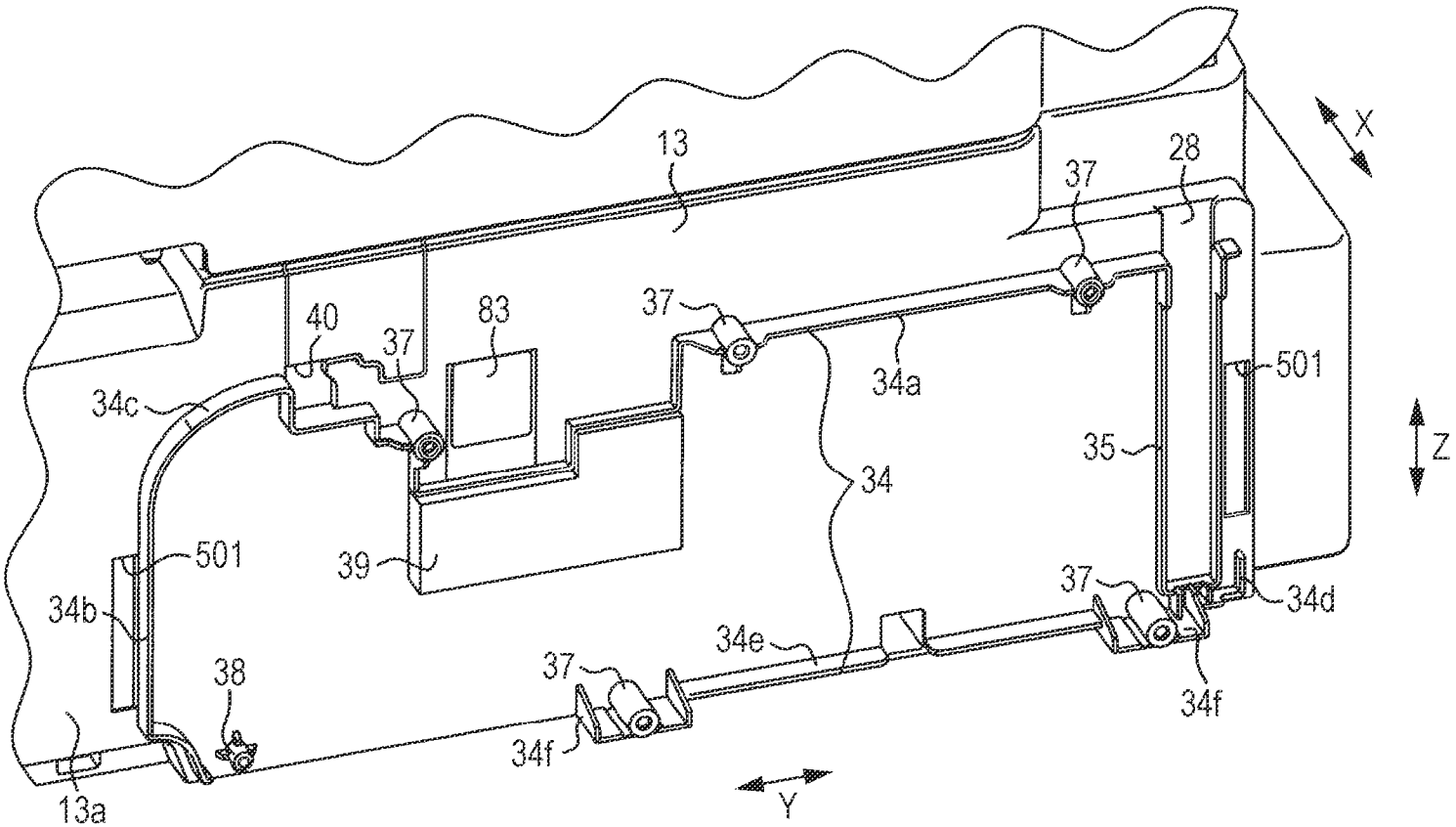
FIG. 73 is a cutaway perspective view of an attachment surface in an apparatus main body in a modification example.
Figure 74:
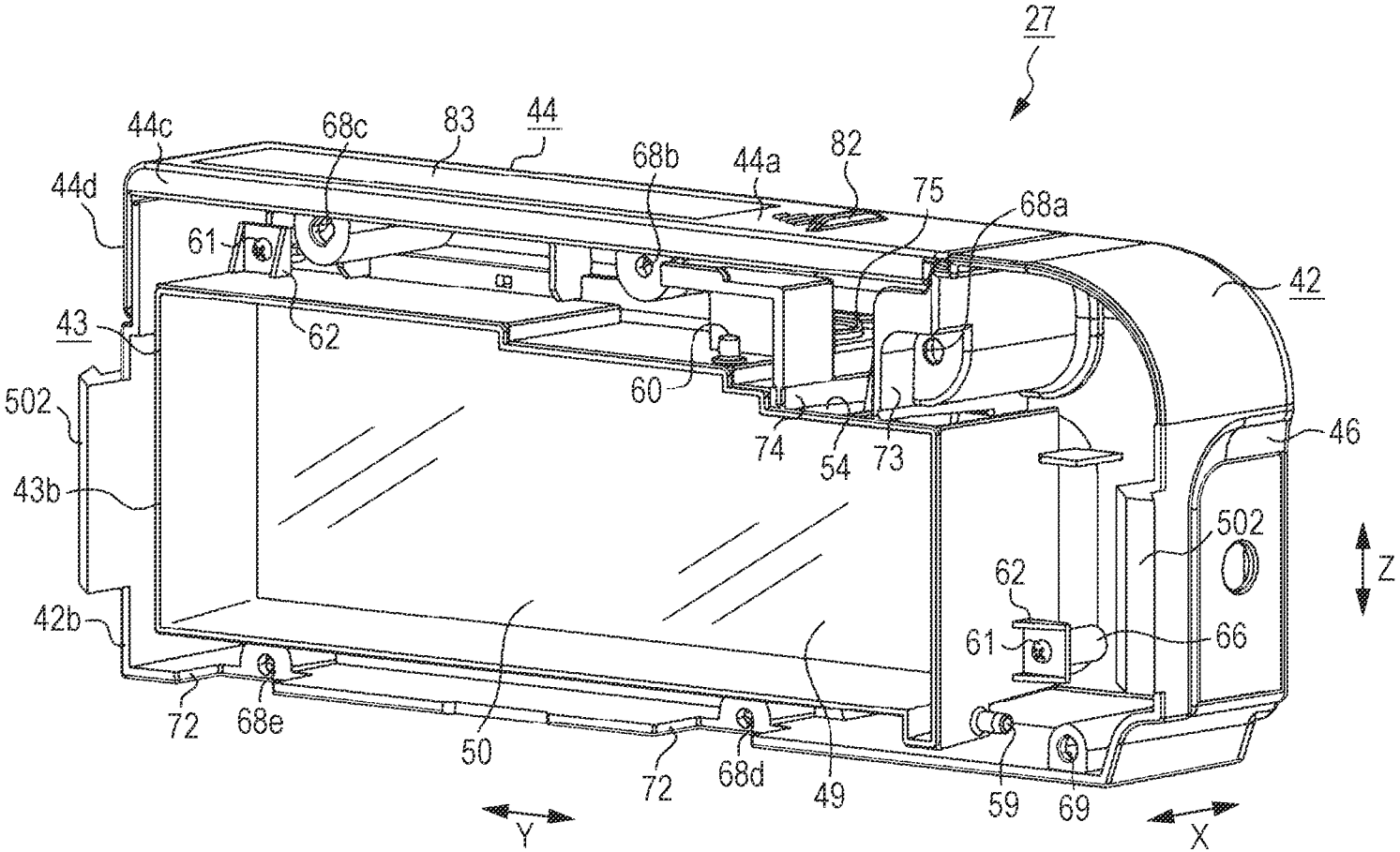
FIG. 74 is a perspective view seen from a left front position of a tank unit in a modification example.

In the embodiments and the examples, as illustrated in FIGS. 73 and 74, hole portions 501, which are examples of a first engagement portion, and hook portions 502, which are examples of a second engagement portion, may be respectively disposed on the attachment surface 13*a* of the apparatus main body 13 and the tank case 42 (modification example). That is, as illustrated in FIG. 73, at least one (two in the modification example) of the hole portions 501 may be disposed at a front side position of the front rib portion 34*b* of the attachment portion 13*a*, and at an upper side position of the rear rib portion 34*d*. Furthermore, as illustrated in FIG. 74, at least one (two in the modification example) of the hook portions 502 may be formed so as to protrude leftward at the front end position and the rear end position of the case opening portion 42*b*, which are positions corresponding to the hole portions 501. In this case, if the tank case 42 is moved toward the apparatus main body 13 in a state where the hole portions 501 and the hook portions 502 have a positional correspondence to each other, the hook portions 502 against the hole portions 501 (specifically, the edge portions of the hole portions), are elastically deformed, and then return elastically the initial shape. In this manner, the hole portions 501 and the hook portions 502 enter an engagement state from a disengagement state. Accordingly, it is possible to easily and fixedly attach the tank unit 27 to the apparatus main body 13 without using a specific fixing member.

The hook portions 502 may be provided in the apparatus main body 13, and engagement portions, such as hole portions that engage with the hook portions 502, may be provided in the tank case 42. In addition, the hook portions 502 may be disposed in both the apparatus main body 13 and in the tank case 42, such that the hook portions 502 engage with each other. In this case, the hook portions 502 function as examples of first and second engagement portions.

Furthermore, when the hole portions 501 and the hook portions 502 are provided, there is no need to provide the case locking portions 68*a* to 68*e* to the tank case 42. In addition, in place of the case locking portions 68*a* to 68*e*, the hook portions 502 capable of engaging with the engagement portion of the apparatus main body 13 side or the engagement portion may be disposed in the tank case 42.

In the embodiments and the examples, two or more tank cases 42, which are examples of protection cases, may be provided. After each ink tank 43 is accommodated inside its respective tank case 42, one tank case 42 is fixedly attached to the attachment surface 13*a* of the apparatus main body 13 and another tank case 42 can be connected so as to be adjacent, in the left/right direction X, to the side surface of the one tank case 42. In this case, whereas a hole portion, which is an example of the first engagement portion, may be disposed on the side surface of one tank case 42, a hook portion, which is an example of the second engagement portion, may be disposed on the side surface opposing the other tank case 42. That is, the tank case accommodating the ink tank may be configured such that one tank case includes one of the first and second engagement portions, at least one of which is elastically deformed for the engagement, and the other of the first and second engagement portions is provided in the other tank case that covers the other ink tank. In this case, at least one of the first engagement portion provided in one tank case and the second engagement portion provided in the other tank case is elastically deformed to engage with each other. In this manner, it is possible to increase the number of the tank case by connecting the adjacent tank cases to each other.

Figure 75:
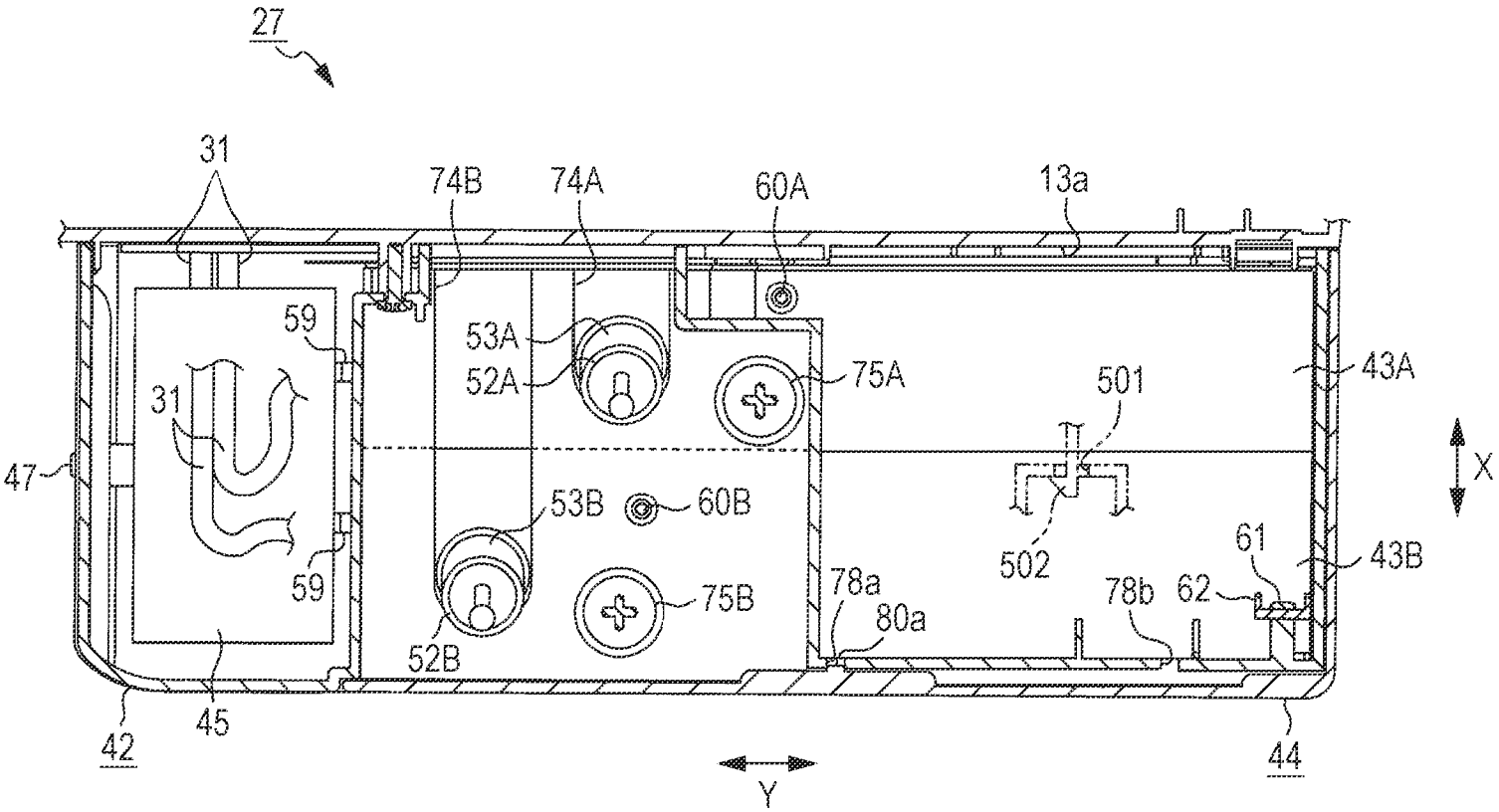
FIG. 75 is a plane cross-sectional view of a tank unit in a modification example.

In addition, as illustrated in FIG. 75, the tank case 42, which is an example of the protection case, may be fixedly attached to the attachment surface 13*a* of the apparatus main body 13 while accommodating two or more (two in FIG. 75) ink tanks 43A and 43B. In this case, it is possible to easily increase the number of ink tanks, which are examples of a liquid container. The number of ink tanks to be accommodated in the tank case 42 depends on the size of the tank case 42, and thus it is possible to accommodate two or more ink tanks such as three or four ink tanks.

In addition, as illustrated in FIG. 75, in a state where two or more ink tanks 43A and 43B are accommodated in the tank case 42, two of the ink tanks 43A and 43B which are adjacent to each other in the horizontal direction (left/right direction X) intersecting with the longitudinal direction (front/rear direction Y) may be configured such that individual injection ports 52A and 52B are disposed at positions which are offset by each other in the longitudinal direction. In this case, compared to a case where the individual injection ports 52A and 52B in two or more adjacent ink tanks 43A and 43B are arrayed side by side in the horizontal direction intersecting with the longitudinal direction, it is possible to suppress that the other adjacent injection port becomes an obstacle. Accordingly, it is possible to easily perform the injection of the ink to the individual injection ports 52A and 52B. In addition, compared to a case where the liquid injection ports are arrayed side by side, it is possible to prevent erroneous injection to the other injection port.

In addition, as illustrated in FIG. 75, at positions corresponding to the injection ports 52A and 52B in two or more ink tanks 43A and 43B to be accommodated inside the tank case 42, the tank case 42 may include accommodation portions 74A and 74B which are formed to be notched in a U-shape from the case opening portion 42*b* side of the tank case 42 so as to expose the upper side of the individual injection ports. In this case, as illustrated in FIG. 75, for example, even if the injection ports 52A and 52B are provided at the front end of cylinder portions 53A and 53B, when loading the ink tanks 43A and 43B into the tank case 42, the cylinder portions 53A and 53B can be inserted into the accommodation portions 74A and 74B from the case opening portion 42*b* side. Therefore, it is possible to smoothly accommodate the ink tanks 43A and 43B inside the tank case 42.

In addition, as illustrated in FIG. 75, in a state where the tank case 42 accommodates two or more ink tanks 43A and 43B inside, the tank case 42 may be formed such that the accommodation portion 74B corresponding to the injection port 52B of the ink tank 43B is sized to overlap above the ink tank 43A in the left/right direction X. That is, the accommodation portion 74B, which is at position corresponding to the injection port 52B of the ink tank 43B, which is an ink tank other than the ink tank 43A located closest to the case opening portion 42*b*, overlaps with the other ink tank 43A, which is adjacent to the case opening portion 42*b* side. In this case of two adjacent ink tanks, even if the cylinder portions 53A and 53B, which are provided with injection ports at their respective front ends, are juxtaposed side by side in a horizontal direction (left/right direction X) that intersects the longitudinal direction (front/rear direction Y) for example, it is possible to easily insert the respective cylinder portions in two adjacent ink tanks into one accommodation portion from the case opening portion 42*b* side.

In addition, as illustrated by two-dot chain line in FIG. 75, the respective ink tanks 43A and 43B may have the hole portion 501 and the hook portion 502 mutually provided in the respective ink tanks 43A and 43B, as an example of a connection portion enabling the connection where another ink tank is adjacent thereto. In this case, after two or more ink tanks are connected to each other in advance so as to be adjacent to each other in the horizontal direction (left/right direction X), which intersects the longitudinal direction (front/rear direction Y), the ink tanks are collectively inserted into the tank case 42. In this manner, it is possible to easily accommodate two or more ink tanks into the tank case.

In addition, as illustrated in FIG. 75, when the tank case 42 accommodating two or more ink tanks 43A and 43B inside, the valve lever 47, which is an operation portion of the choke valve 45 to be attached to the tubes 31, which is an example of the flow channel extending from the ink tank, may be disposed as the operation portion shared by all the tubes 31 corresponding to respective ink tanks. In this case, if the single valve lever 47, which is the shared operation portion, is operated, it is possible to collectively open and close the choke valve 45 of the tubes 31, which correspond to two ink tanks or more. Accordingly, it is possible to reduce the number of parts.

EXAMPLE 2

Next, Example 2 of the invention will be described with reference to the accompanying drawings. Example 2 is different from the first embodiment in the shape of the container case 125. Since the other elements are substantially the same as those of the first embodiment, including the internal configuration of the container case 125, repeated description will be omitted by giving the same reference numerals to the same configuring elements.

Figure 76:
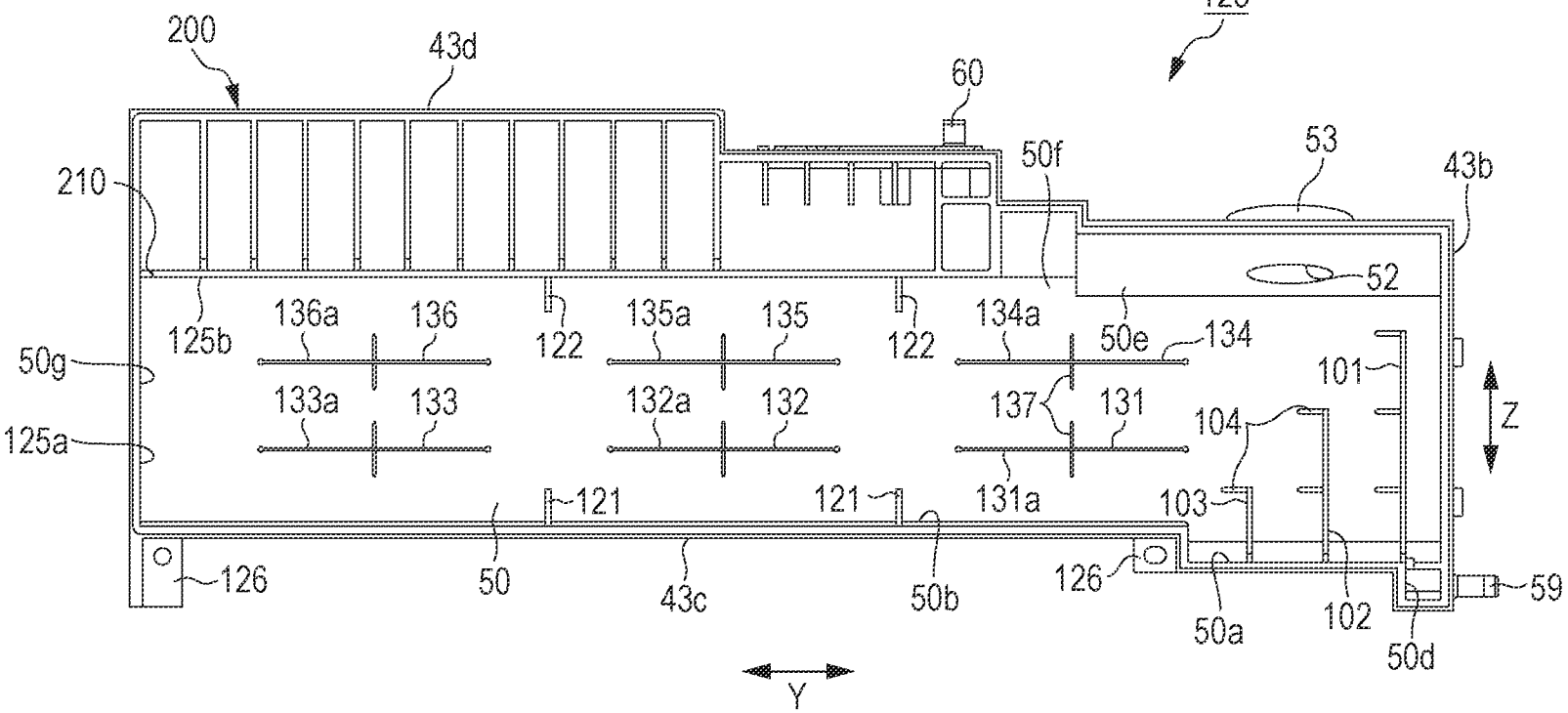
FIG. 76 is a side view of a container case in Example 2.

As illustrated in FIG. 76, the container case 125 forms a bottomed box-shape having a container opening portion 125*a*. Furthermore, at least one (two in the embodiment) tank locking portion 126, which locks the mounting screw 61 to be attached when being fixedly attached to a tank case (not illustrated), is formed at the lower side of the container case 125. A screw potion (not illustrated) to which the mounting screw 61 can be screwed is formed at the position corresponding to the tank locking portion 126 in the tank case (not illustrated).

Figure 77:
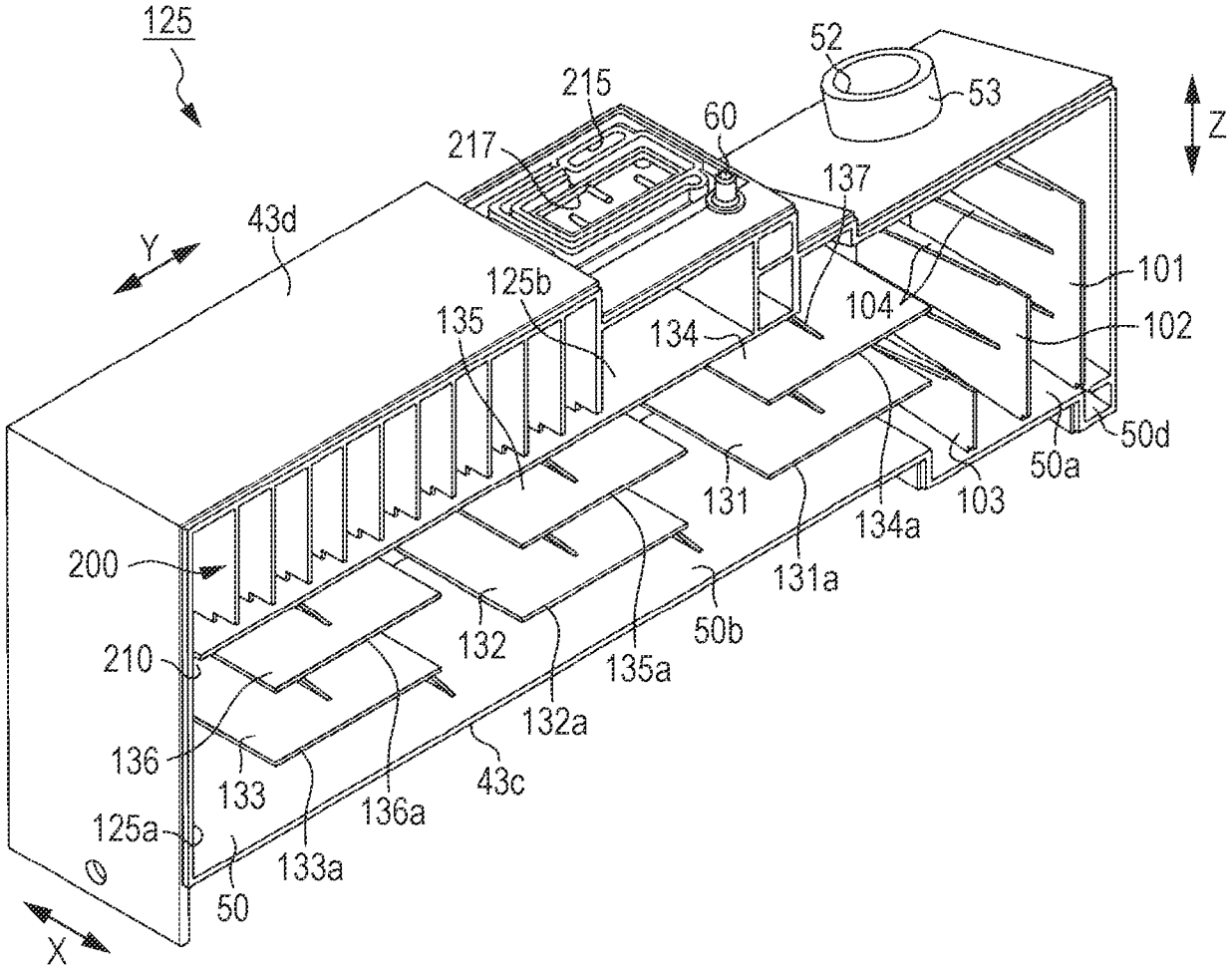
FIG. 77 is a perspective view of a container case.
Figure 78:
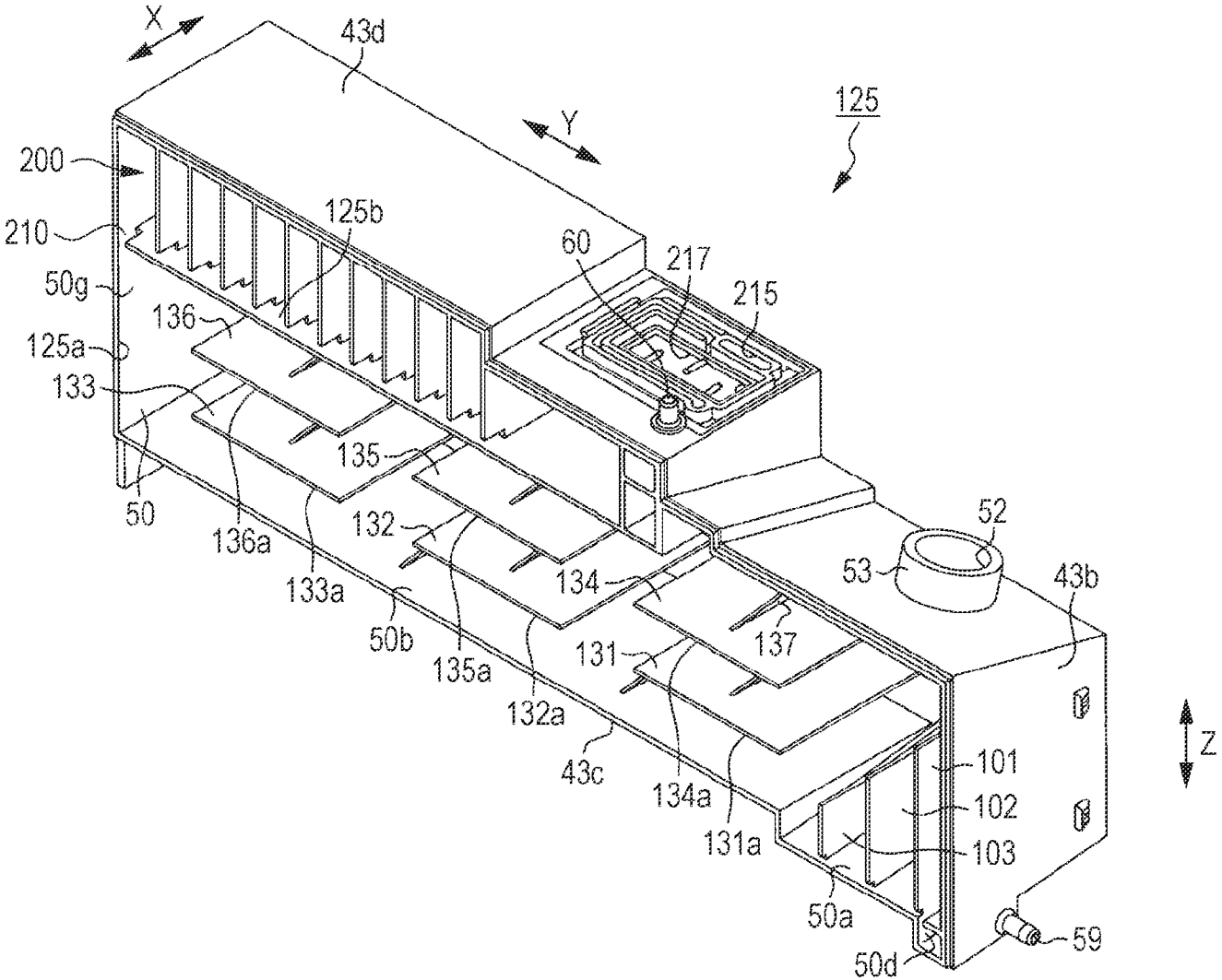
FIG. 78 is a perspective view of a container case.

As illustrated in FIGS. 76 to 78, the ink chamber 50 has at least two (six in the embodiment) horizontal ribs 131 to 136, which is an example of a first rib. The horizontal rib portions 131 to 136 extend in the direction following the stepped bottom surface 50*b*. That is, the horizontal rib portions 131 to 136 extend in the front/rear direction Y and the left/right direction X, and are disposed at opposite positions from the outlet port 59, as viewed from the injection port 52 in the front/rear direction Y.

The horizontal rib portions 131 to 136 are formed in at least xxxJP571one row (two rows in the embodiment) with a space therebetween in the vertical direction Z. Then, the horizontal rib portions 131 to 136 are located between the injection port 52 and the stepped bottom surface 50*b* in the direction of gravity. In addition, the respective (three in the embodiment) horizontal rib portions configuring each row are formed to have space between each other in the front/rear direction Y, and to have a space at a rear side surface 50*g* of the ink chamber 50 in the front/rear direction Y. That is, the first to third horizontal rib portions 131 to 133 have spaces between each other in the front/rear direction Y, and the fourth to sixth horizontal rib portions 134 to 136 have spaces between each other in the front/rear direction Y at position higher up than the first to third horizontal rib portions 131 to 133.

That is, since the horizontal rib portions 131 to 136 are formed to have a gap between the stepped bottom surface 50*b* and a partition wall 125*b*, horizontal rib portions 131 to 136 are located by being spaced upward from the stepped bottom surface 50*b*.

A third extension portion 137 A third extension portion 137 is formed to be orthogonal to the right side surface 50*f* at both upper and lower sides of each of the horizontal rib portions 131 to 136. Each of the third extension portions 137 forms a substantially right-angled triangle shape in a front view such that the width in the front/rear direction Y gradually broadens from the container opening portion 125*a* side of the container case 125 to the right side surface 50*f* side (right side).

The horizontal rib portions 131 to 136 and the third extension portions 137 are integrally molded with the container case 125 so as to be orthogonal to the right side surface 50*f* of the container case 125 and to protrude from the right side surface 50*f* toward the container opening portion 125*a* side. In other words, the horizontal rib portions 131 to 136 and the third extension portions 137 are formed to protrude from the right side surface 50*f*.

The width of the horizontal rib portions 131 to 136 in the left/right direction X is substantially equal to the width from the right side surface 50*f* of the container case 125 to the container opening portion 125*a*. Therefore, if the film 49 adheres to the container opening portion 125*a*, the film 49 also adheres to adhesion surfaces 131*a* to 136*a*, which are the left ends of the horizontal rib portions 131 to 136.

Next, an operation inside the ink chamber 50 to which the ink is injected will be described.

As illustrated in FIG. 76, the ink injected through the injection port 52 flows rearward following the stepped bottom surface 50*b*. Therefore, when the liquid level (not illustrated) inside the ink chamber 50 rises in accordance with the injection of the ink, and reaches the position where the horizontal rib portions 131 to 136 are formed, the flow of ink passing through the lower side of the horizontal rib portions 131 to 136 and heading rearward changes to flow upward following the rear side surface 50*g*, which intersects the flowing direction of the ink. Furthermore, the ink passes through the upper side of the first to third horizontal rib portions 131 to 133 located at the lower side.

Accordingly, inside the ink chamber 50, the ink flows at a faster flow rate than that in a case where the vertical rib portions 111 to 118 are formed to interfere with the flowing. Therefore, for example, when the ink is partially injected several times, the previously injected ink is pushed and caused to flow by the subsequently injected ink. That is, the remaining ink inside the ink chamber 50 is stirred up by newly injecting the ink through the injection port 52. Thus, even if there is unevenness in the density of the ink inside the ink chamber 50, the unevenness in the density of the ink decrease.

Then, if ink is further injected so that the liquid level 51 of the ink rises, an ink flow passing through the fourth to sixth horizontal rib portions 134 to 136 is generated in addition to the ink flowing through the upper side of the first to third horizontal rib portions 131 to 133.

According to Example 2 described above, the following advantageous effects can be obtained.

(2-1) By means of the horizontal rib portions 131 to 136 extending in the direction following the stepped bottom surface 50*b*, it is possible to cause the ink to further flow following the horizontal rib portions 131 to 136 after the flow of ink that flows following the stepped bottom surface 50*b* changes to flow upward in a direction that intersects with the stepped bottom surface 50*b*. Accordingly, it is possible to suppress collision of the flowing of the ink. Therefore, it is possible to increase the flow rate of the ink flowing in the direction following the stepped bottom surface 50*b*.

The embodiments and the examples may be modified as follows.

In the embodiments, the tube 31 supplying the ink contained in the ink chamber 50 of the tank unit 27 to the liquid ejecting head 32 need not be provided. For example, the tank unit 27 may be configured to be arranged on the carriage 29.

In the embodiments and the examples, the gap which can accommodate the opening area external portions 49*a*, 49*b*, 49*c* and 49*d* of the film 49 need not be disposed between the ink tank 43 and the tank case 42. For example, if the width that the opening area external portions 49*a*, 49*b*, 49*c* and 49*d* of the film 49 protrude from the container opening portion 48*a* is narrow so that appearance is not a concern, it is not necessary to provide gaps between the ink tank 43 and the tank case 42.

In the embodiments and the examples, the through holes 49H may not be necessarily disposed at two positions of the film 49 that are separated from each other in the longitudinal direction of the container opening portion 48*a*. For example, the through holes 49H may be disposed at two positions of the film 49 that are separated from each other in the short direction of the container opening portion 48*a*. Furthermore, the through holes 49H may be disposed at two positions or more (for example, three positions).

In the embodiments and the examples, the through holes 49H may be disposed at only one portion among the opening area external portions 49*a*, 49*b*, 49*c* and 49*d*. In addition, the shape of the through holes 49H may be a rectangular-shaped hole such as a quadrangle other than a circular-shaped hole. Alternatively, it may be a mutually different shape or size. In brief, if the shape enables the positioning, any shape may be adopted.

Figure 79:
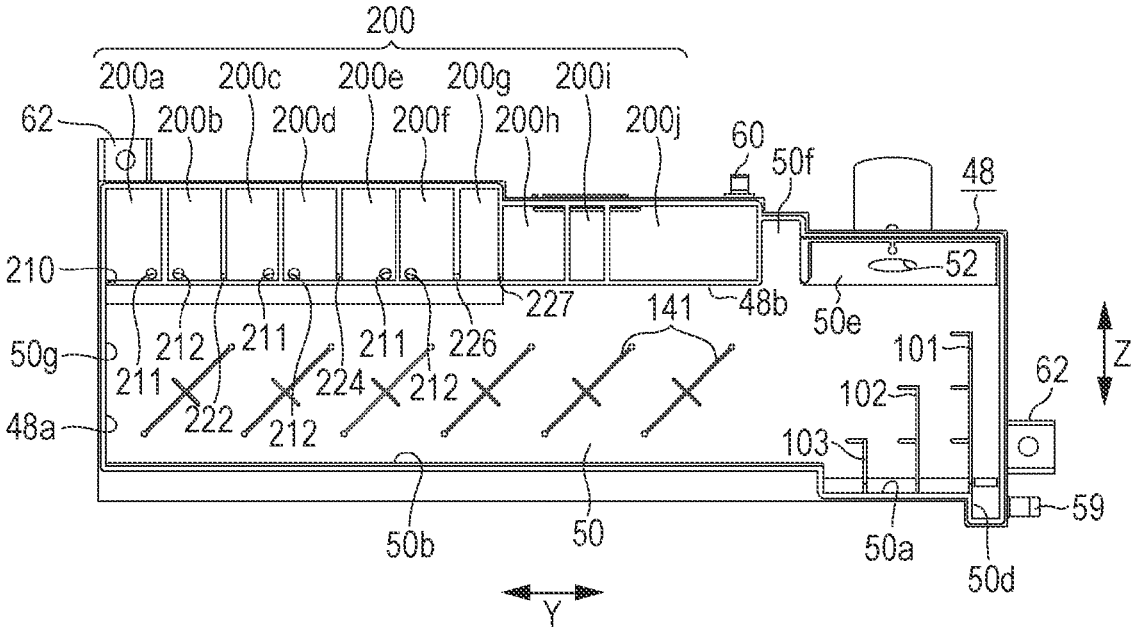
FIG. 79 is a side view of a container case in a first modification example.

In the embodiments and the examples, as illustrated in FIG. 79, first oblique rib portions 141 which are tilted with respect to the stepped bottom surface 50*b* may be formed inside the ink chamber 50 (first modification example). That is, the first oblique rib portions 141 extend in the left/right direction X, and are tilted with respect to the vertical direction Z such that the upper end is located at the further front side than the lower end. At least one or at least two (six in FIG. 79) of the first oblique rib portions 141 are disposed, apart from the stepped bottom surface 50*b* and the partition wall 48*b*, and formed to have an interval with each other in the front/rear direction Y. In addition, the first oblique rib portions 141 have an interval with the rear side surface 50*g* of the ink chamber 50 in the front/rear direction Y.

Figure 80:
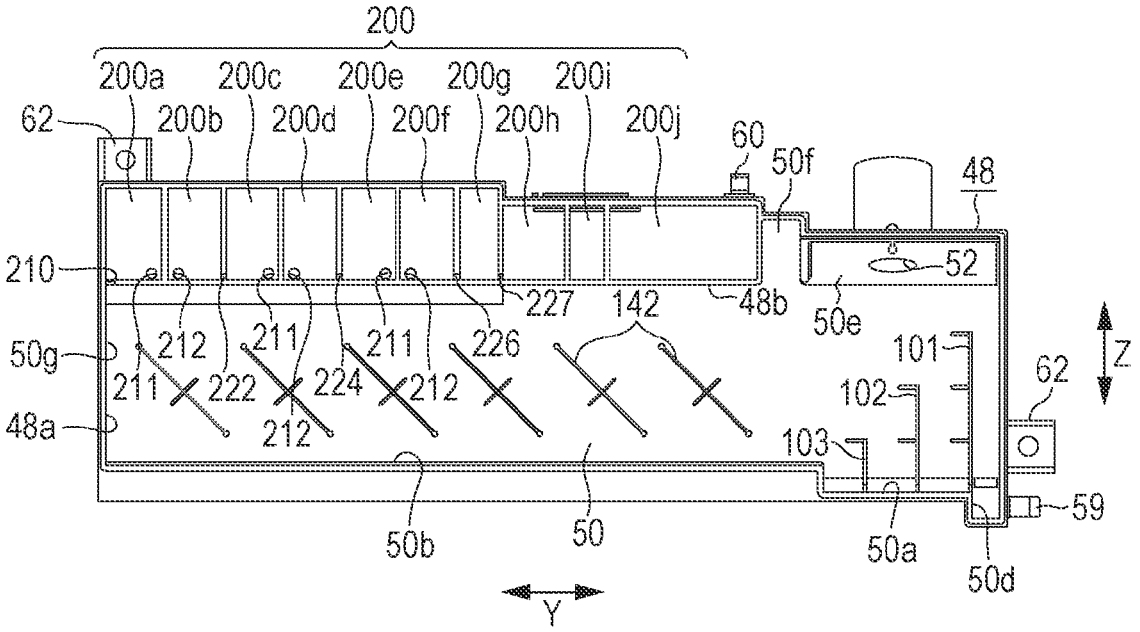
FIG. 80 is a side view of a container case in a second modification example.

In the embodiments and the examples, as illustrated in FIG. 80, second oblique rib portions 142 which are tilted with respect to the stepped bottom surface 50*b* may be formed inside the ink chamber 50 (second modification example). That is, the second oblique rib portions 142 extend in the left/right direction X, and are tilted with respect to the vertical direction Z such that the lower end is located at the further front side than the upper end. At least one or at least two (six in FIG. 80) of the second oblique rib portions 142 are disposed, apart from the stepped bottom surface 50*b* and the partition wall 48*b*, and formed to have an interval with each other in the front/rear direction Y. In addition, the second oblique rib portions 142 have an interval with the rear side surface 50*g* of the ink chamber 50 in the front/rear direction Y.

Figure 81:
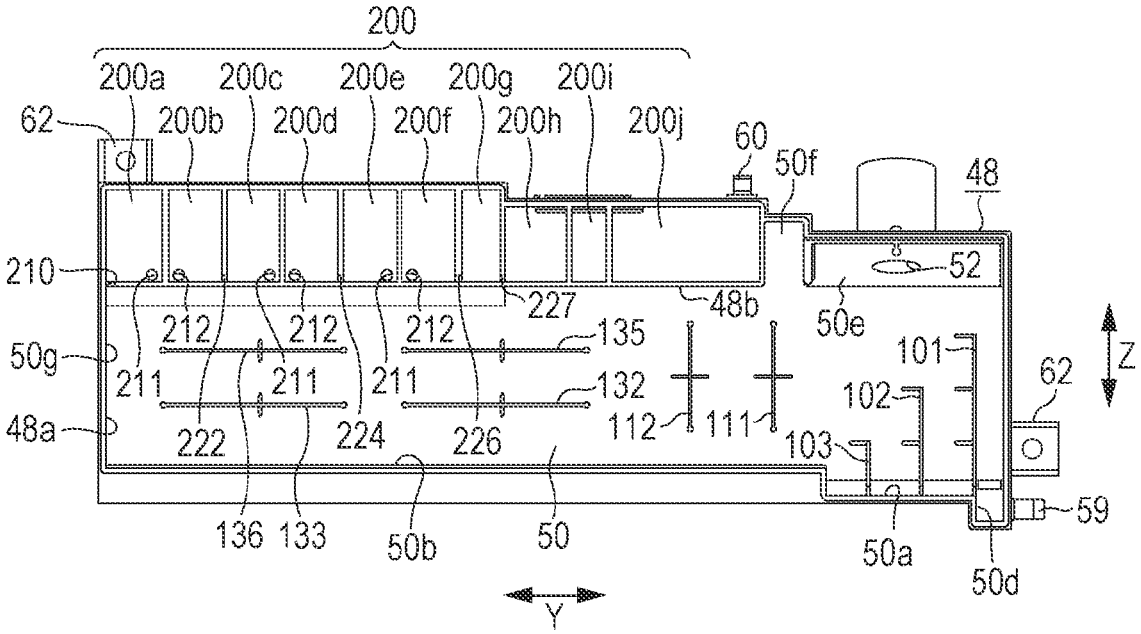
FIG. 81 is a side view of a container case in a third modification example.

In the embodiments and the examples, as illustrated in FIG. 81, the first vertical rib portion 111, the second vertical rib portion 112, the second horizontal rib portion 132, the third horizontal rib portion 133, the fifth horizontal rib portion 135 and the sixth horizontal rib portion 136 may be disposed inside the ink chamber 50 (third modification example). That is, the vertical rib portions 111 to 118 and the horizontal rib portions 131 to 136 may be provided in any combination. In addition, it is possible to arbitrarily select the number of the vertical rib portions 111 to 118 and the horizontal rib portions 131 to 136.

That is, for example, the rear rib portion may be disposed at the rear side and the horizontal rib portion may be disposed at the front side. In addition, the vertical rib portion and the horizontal rib portion may be alternately disposed in the front/rear direction Y.

Figure 82:
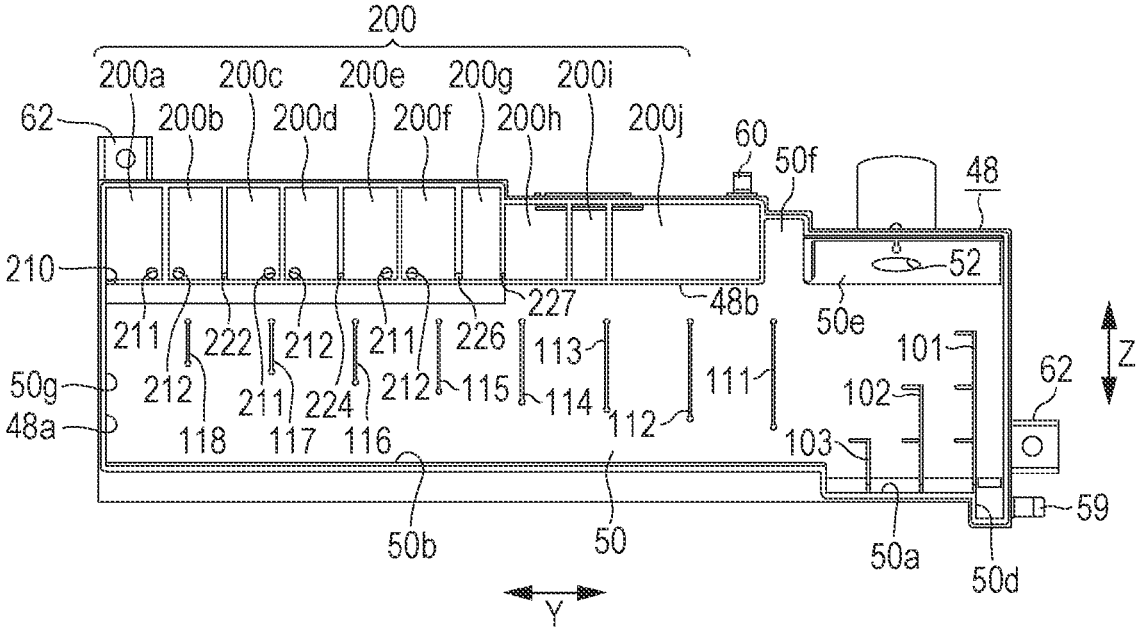
FIG. 82 is a side view of a container case in a fourth modification example.

In the embodiments and the examples, as illustrated in FIG. 82, the sizes of the vertical rib portions 111 to 118 in the vertical direction Z may be different from each other (fourth modification example). That is, for example, the vertical rib portions 111 to 118 may be sizes in the vertical direction Z such that the first vertical rib portion 111 located at the position (front side) close to the injection port 52 has the largest size and the sizes may be gradually decreased toward the eighth vertical rib portion 118 located at the position (rear side) remote from the injection port 52. The vertical rib portions 111 to 118 are disposed farther apart from the stepped bottom surface 50*b* as the sizes in the vertical direction Z decrease.

The vertical rib portions 111 to 118 located at the position apart from the injection port 52 are far apart from the stepped bottom surface 50*b*. Thus, it is possible to generate a vortex at the position apart from the stepped bottom surface 50*b*. Accordingly, it is possible to stir up the thick density ink near the stepped bottom surface 50*b* and the thin density ink near the liquid level 51 at positions remote from the injection port 52, where ink density tends to be considerably uneven. Therefore, it is possible to further decrease the unevenness in the density of the ink.

Figure 83:
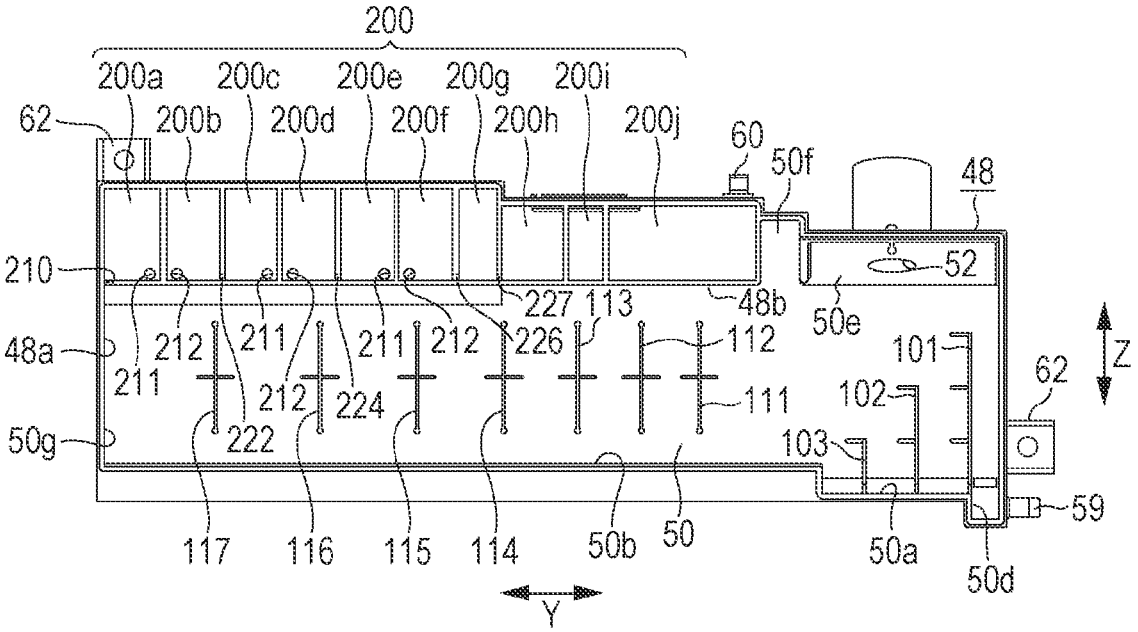
FIG. 83 is a side view of a container case in a fifth modification example.

In the embodiments and the examples, as illustrated in FIG. 83, intervals of the vertical rib portions 111 to 117 which are adjacent to each other in the front/rear direction Y may be different from each other (fifth modification example). That is, the vertical rib portions 111 to 117 are disposed such that the interval between the first vertical rib portion 111 located at the front side and the second vertical rib portion 112 is narrowest, and the interval is further increased as it is located at the further rear side. That is, the rear side interval of the vertical rib portions adjacent to each other in the front/rear direction Y is wider than the front side interval. In addition, it is possible to arbitrarily select the number of the vertical rib portions, if the number is three or more.

The vortex-shaped flow generated by interference of the vertical rib portions 111 to 117 is generated between the vertical rib portions 111 to 117 adjacent to each other in the front/rear direction Y, which is the flowing direction of the ink. As the interval between the vertical rib portions 111 to 117 widens, the vortex-shaped flow increases. In this regard, the interval between the vertical rib portions 111 to 117 adjacent to each other at positions remote from the injection port 52 is wider. Thus, it is possible to generate a larger vortex-shaped flow at the position apart from the injection port 52. Accordingly, it is possible to cause the thin density ink near the liquid level 51 to flow further, in the position remote from the injection port 52 where the density of the ink tends to be considerably uneven. Therefore, it is possible to further decrease unevenness in ink density.

Figure 84:
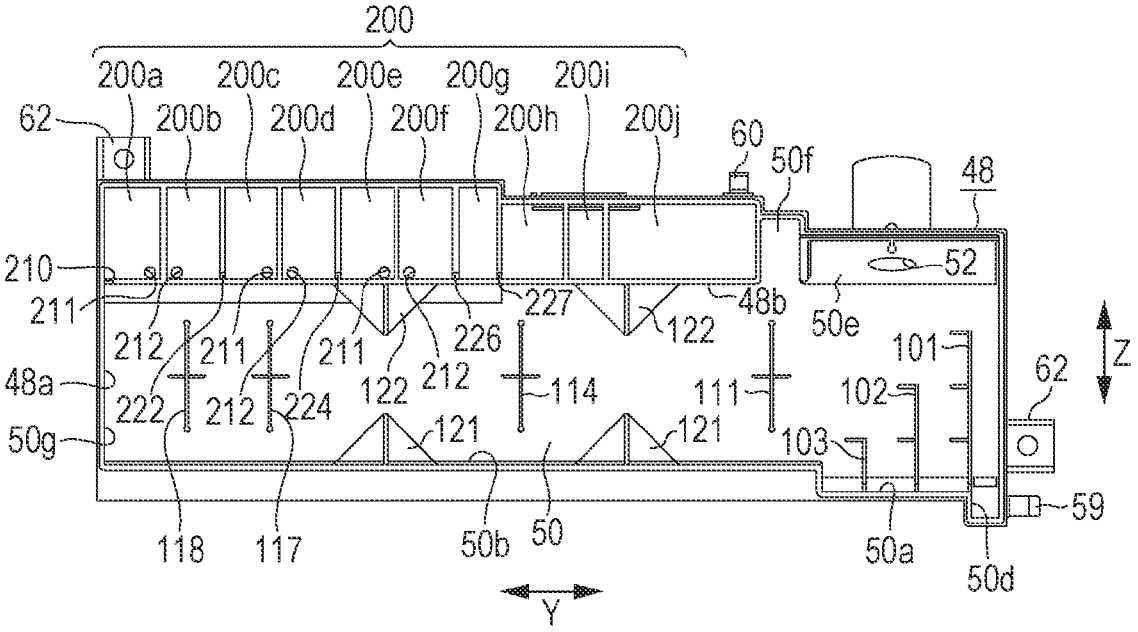
FIG. 84 is a side view of a container case in a sixth modification example.

In the embodiments and the examples, as illustrated in FIG. 84, the front side surface of the protrusion portions 121 and 122 may be disposed to intersect with the stepped bottom surface 50*b* so as to form an acute angle in the rearward direction remote from the injection port 52 (sixth modification example). The rear side surface of the protrusion portions 121 and 122 may intersect with the stepped bottom surface 50*b* so as to form an acute angle in the forward direction close to the injection port 52.

The ink injected through the injection port 52 flows following the stepped bottom surface 50*b*. Then, the front side surface of the protrusion portion 121 intersects with the stepped bottom surface 50*b* so as to form an acute angle in the rearward direction which is the flowing direction of the ink. That is, since the flow channel resistance decreases, it is possible to cause the ink injected into the ink chamber 50 to excellently flow to the rear side apart from the injection port 52, while ensuring rigidity of the ink tank 43. In addition, since the rear side surface of the protrusion portions 121 intersects with the stepped bottom surface 50*b* so as to form an acute angle in the forward direction, it is possible to further decrease the flow channel resistance.

In the embodiments and the examples, as illustrated in FIG. 84, when the protrusion portions 121 are provided, there is no need to provide vertical rib portions at the position close to the first protrusion portions 121 in the front/rear direction Y. That is, for example, the first vertical rib portion 111, the fourth vertical rib portion 114, the seventh vertical rib portion 117, and the eighth vertical rib portion 118 may be provided inside the ink chamber 50. In this case, the interval between the first vertical rib portion 111 and the fourth vertical rib portion 114, which interpose the first protrusion portion 121, therebetween in the front/rear direction Y, and the interval between the fourth vertical rib portion 114 and the seventh vertical rib portion 117, are wider than the interval between the seventh vertical rib portion 117 and the eighth vertical rib portion 118.

If the interval of the vertical rib portions arranged to interpose the protrusion portion 121 therebetween is increased, it is possible to decrease a possibility that the vertical rib portions may interfere with the ink flow whose flowing direction is changed by the protrusion portion 121. That is, compared to a case where the interval of the vertical rib portions arranged to interpose the protrusion portion 121 therebetween is decreased, it is possible to decrease the flow channel resistance flowing in the rearward direction apart from the injection port 52. Accordingly, it is possible to cause the ink injected into the ink chamber 50 to excellently flow to a direction apart from the injection port 52, while ensuring the rigidity of the ink tank 43.

Figure 85:
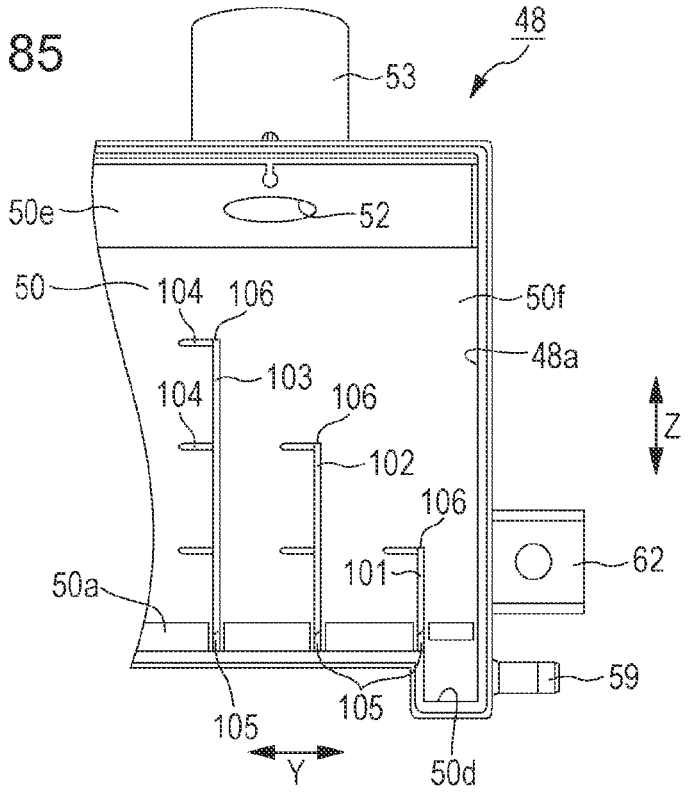
FIG. 85 is a partial cutaway view of a container case in a seventh modification example.

In the embodiments and the examples, the heights of the intersecting rib portions 101 to 103 may be arbitrarily changed. For example, as illustrated in FIG. 85, the protruding height of the intersecting rib portions 101 to 103 from the basal surface 50*a* may further decrease as the rib portion with proximity to the front side (seventh modification example). That is, the protruding height of the second intersecting rib portion 102 may be higher than the protruding height of the first intersecting rib portion 101, and may be lower than the protruding height of the third intersecting rib portion 103.

Figure 86:
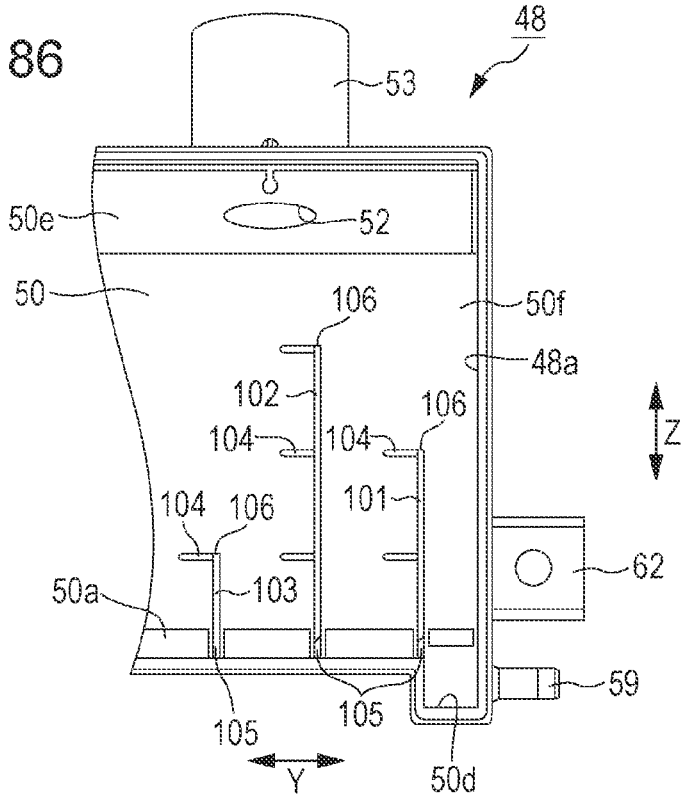
FIG. 86 is a partial cutaway view of a container case in an eighth modification example.

In addition, as illustrated in FIG. 86, the protruding height of the first intersecting rib portion 101 may be lower than the protruding height of the second intersecting rib portion 102, and may be higher than the protruding height of the third intersecting rib portion 103 (eighth modification example).

Even if the heights of the intersecting rib portions 101 to 103 are changed, the ink contained in the ink chamber 50 passes through the communication portions 105 and 106 of the respective intersecting rib portions 101 to 103 according to the height of the liquid level 51. Accordingly, even if the liquid level 51 fluctuates, it is possible to cause the ink to pass through different positions in the vertical direction Z.

In the embodiments and the examples, the protrusion portions 121 and 122 need not be provided. A protrusion portion 121 is preferably disposed on the basal surface 50*a* or the stepped bottom surface 50*b*. If the protrusion portion 121 protrudes from the basal surface 50*a* or the stepped bottom surface 50*b*, regardless of what direction the protrusion portion 121 extends, it is possible to enhance the rigidity of the ink tank 43. That is, the protrusion portions 121 may be formed following the front/rear direction Y and the vertical direction Z. In addition, the protrusion portion 121 may be formed to be tilted with respect to the vertical direction Z.

In the embodiments and the examples, the first extension portion 104, the second extension portion 119 and the third extension portion 137 need not be provided.

In the embodiments and the examples, the intersecting rib portions 101 to 103 may be formed in a curved shape or bent shape. In this case, it is preferable that the intersecting rib portions 101 to 103 be curved or bent rearward. If the upper end of the intersecting rib portions 101 to 103 is located at the further rear side than the lower end, it is possible to decrease a possibility that the ink injected through the injection port 52 may ride across the intersecting rib portions 101 to 103. Accordingly, it is possible to induce the ink to flow rearward.

In the embodiments and the examples, the protruding heights of the intersecting rib portions 101 to 103 from the basal surface 50*a* may be the same as each other.

In the embodiments and the examples, the intersecting rib portions 101 to 103 may be disposed apart from the basal surface 50*a*. That is, the vertical rib portions 111 to 118 may be disposed between the injection port 52 and the outlet port 59 in the front/rear direction Y.

In the embodiments and the examples, one intersecting rib portion out of the intersecting rib portions 101 to 103 may be disposed in the configuration. In addition, if one of the intersecting rib portions 101 to 103 is disposed, it is preferable to dispose the first intersecting rib portion 101 located at the position close to the outlet port 59. In addition, the first intersecting rib portion 101 and the second intersecting rib portion 102 need not include the second communication portion 106 in the configuration. That is, the first intersecting rib portion 101 and the second intersecting rib portion 102 may be formed to protrude from the upper surface 50*e*. If the first intersecting rib portion 101 and the second intersecting rib portion 102 may be formed to protrude from the upper surface 50*e*, it is possible to decrease a possibility that the ink injected through the injection port 52 may flow to the outlet port 59 side across the first intersecting rib portion 101 and the second intersecting rib portion 102. Furthermore, the second communication portion 106 may be disposed at the respective spaces between the upper surface 50*e*, the first intersecting rib portion 101 and the second intersecting rib portion 102. If the second communication portion 106 is disposed on the upper surface 50*e* side, it is possible to align the position of the liquid level 51 of the ink in the vertical direction Z on the first area and the second area which are partitioned by the first intersecting rib portion 101 and the second intersecting rib portion 102.

In the embodiments and the examples, similarly to the first communication portion 105, the second communication portion 106 may be disposed by forming the intersecting rib portions 101 to 103 to be recessed on the adhesion surfaces 101*a* to 103*a*.

In addition, similarly to the second communication portion 106, the first communication portion 105 may be disposed following the left/right direction X in the ink chamber 50.

In the embodiments and the examples, the vertical rib portions 111 to 118 may protrude from the partition wall 48*b*. In addition, the intersecting rib portions 101 to 103 may protrude from the upper surface 50*e* of the ink chamber 50. In this case, it is preferable to form a communication portion which enables the air ventilation between the areas partitioned by the vertical rib portions 111 to 118 and the intersecting rib portions 101 to 103.

In the embodiments and the examples, the intersecting rib portions 101 to 103 may not be disposed in the configuration.

In the embodiments and the examples, two vertical rib portions may be disposed by being apart from each other in the front/rear direction Y, and may be disposed to have a mutually different position in the vertical direction Z. That is, for example, the vertical rib portions having the same size in the vertical direction Z may be disposed to have a mutually different distance apart from the basal surface 50*a*.

In example 2 described above, the horizontal rib portions 131 to 136 may be disposed in one row. In addition, the horizontal rib portions 131 to 136 in the same row may be one horizontal rib portion which is continuous in the front/rear direction Y. In addition, any one of the vertical rib portions 111 to 118 may be disposed in the configuration.

In the embodiments and the examples, the vertical rib portions 111 to 118 or the horizontal rib portions 131 to 136 may be fixedly attached to the right side surface 50*f* of the container cases 48 and 125 by means of the adhesion or engagement. In addition, the vertical rib portions 111 to 118 or the horizontal rib portions 131 to 136 may be disposed on the film 49.

Figure 87:
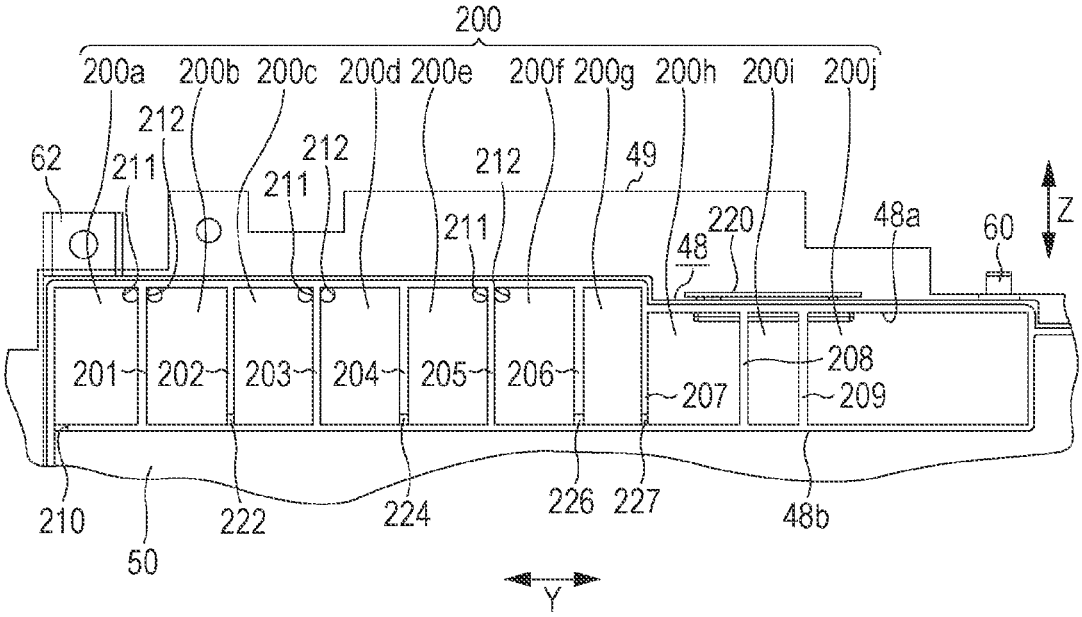
FIG. 87 is a partial cutaway view of a left side surface of an ink tank in a posture state when in use in a ninth modification example.

In the embodiments and the examples, the first opening 211 and the second opening 212 may be respectively formed near the top surface farthest apart from the partition wall 48*b* in the respective surface portions of the innermost side of two adjacent small air chambers (for example, the first small air chamber 200*a* and the second small air chamber 200*b*). That is, as is in a ninth modification example illustrated in FIG. 87, the first opening 211 and the second opening 212 may be respectively formed at the respective positions of the corner near the wall surface of the division wall (for example, the first division wall 201) between two small air chambers (for example, the first small air chamber 200*a* and the second small air chamber 200*b*), that is, at the respective positions which are line-symmetrical with each other based on the division wall 201.

Figure 88:
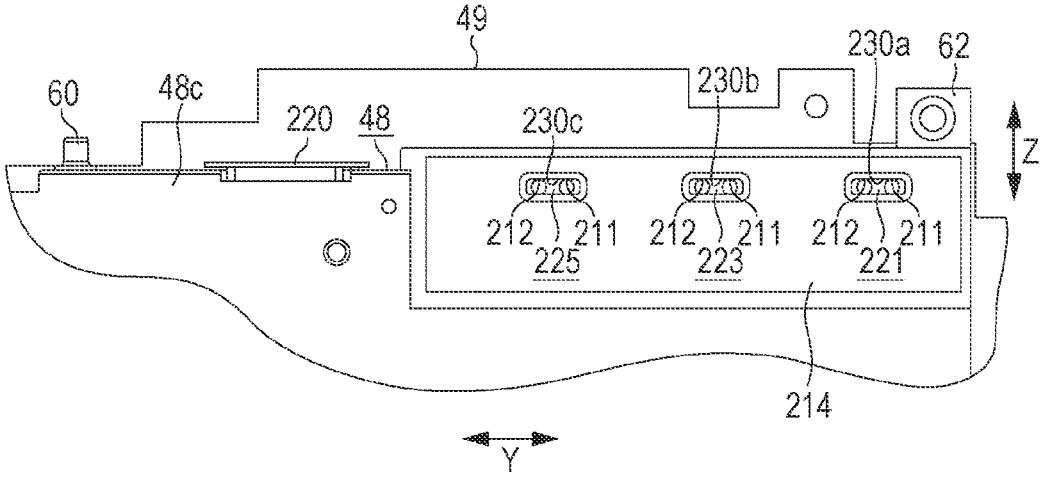
FIG. 88 is a partial cutaway view of a right side surface of the ink tank in the state in FIG. 87.
Figure 89:
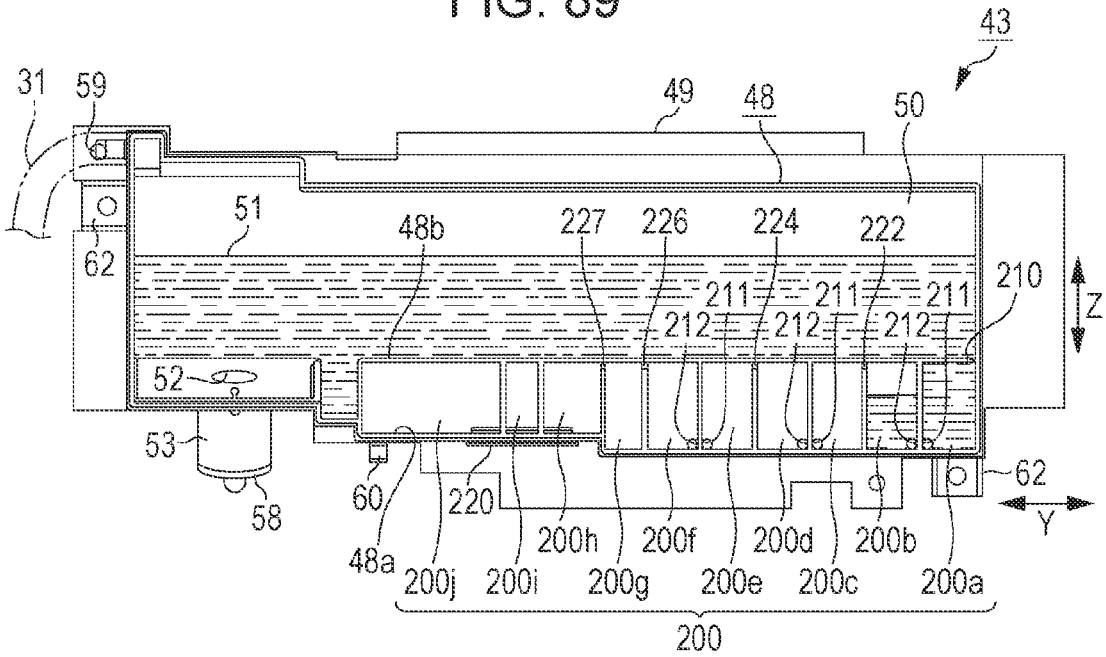
FIG. 89 is a left side view in a state where the ink tank in the ninth modification example is inverted upside down.

In addition, in this case, the long groove portion to be formed on the outer surface of the side wall 48*c* of the container case 48 may be formed to be linear-shaped long groove portions 230*a* to 230*c* as illustrated in FIG. 88. Even in this case, when the ink tank 43 is inverted, as illustrated in FIG. 89, the air chamber 200 side is filled with the ink which is allowed to flow in by the first small air chamber 200*a* directly communicating with the ink chamber 50 via the communication port 210. Then, furthermore, the ink flows little by little from the first small air chamber 200*a* into the second small air chamber 200*b* communicating with the first small air chamber 200*a* via the linear-shaped communication channel 221 corresponding to the long groove portion 230*a*.

However, even in this case, since a portion of the linear-shaped communication channel 221 is located at the lowest side in the inverted state, if the portion of the communication channel 221 is filled with the ink, the air-liquid exchange is not available inside the communication channel 221. As a result, the negative pressure is generated in the ink chamber 50, the negative pressure and the water head pressure are balanced with each other, and then the ink stops flowing to the air chamber 200 side.

Figure 90:
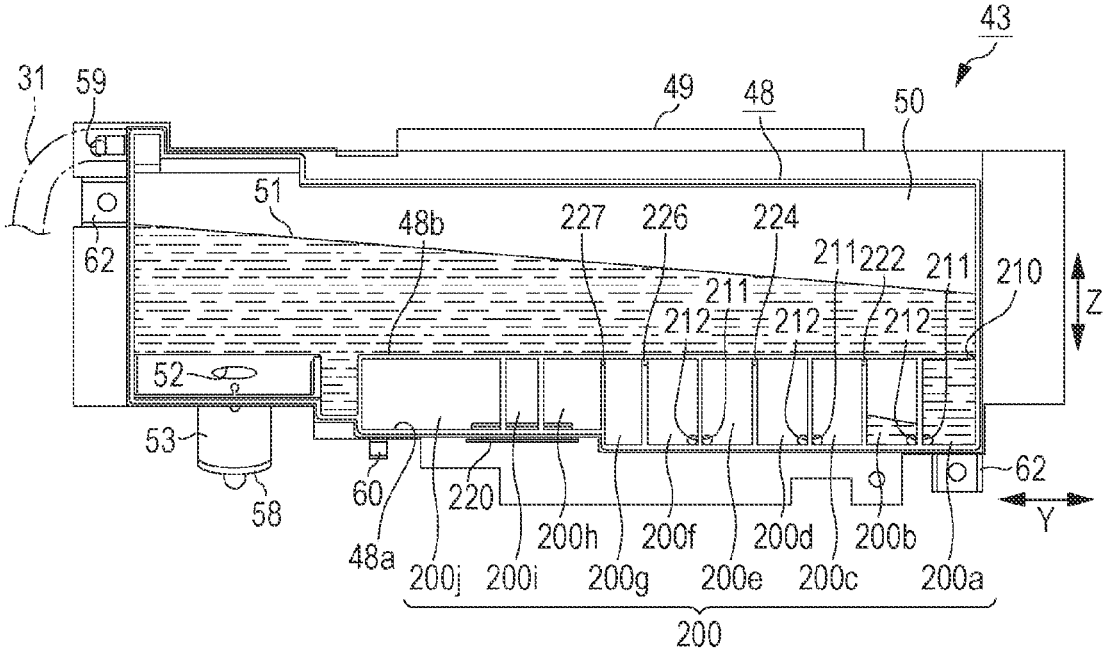
FIG. 90 is a left side view of the ink tank in a case where the ink tank is caused to vibrate so that the acceleration is applied to the rear side in the state in FIG. 89.
Figure 91:
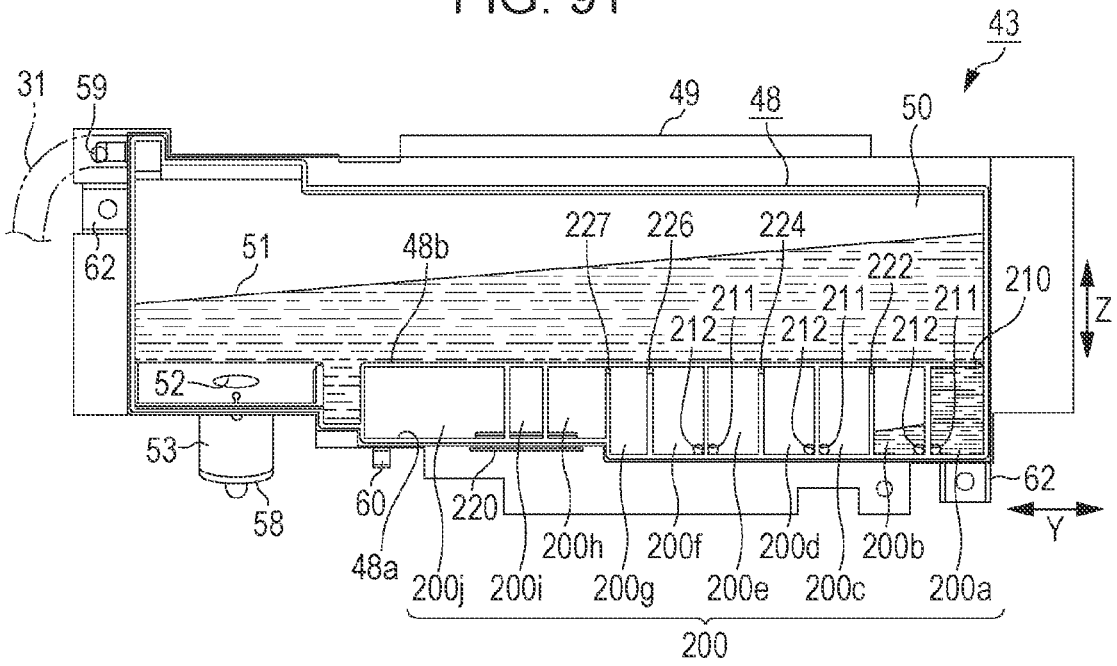
FIG. 91 is a left side view of the ink tank in a case where the ink tank is caused to vibrate so that the acceleration is applied to the front side in the state in FIG. 89.

In addition, even if in this state, the accelerated vibration is applied in the front/rear direction Y, as illustrated in FIGS. 90 and 91, the ink flowing in the first small air chamber 200*a* and the second small air chamber 200*b* which are connected to each other by the communication channel 221 only flows in the accelerated direction, but does not further flow out into the third small air chamber 200*c* which is the air opening port 60 side.

In the embodiments and the examples, in the first opening 211 and the second opening 212, the respective distances from the partition wall 48*b* may not be equal to each other. For example, as is in a tenth modification example illustrated in FIG. 92, whereas the first opening 211 may be formed near the top surface farthest apart from the partition wall 48*b*, the second opening 212 may be formed close to the partition wall 48*b*. In this case, as illustrated in FIG. 93, the long groove portion to be formed on the outer surface of the side wall 48*c* of the container case 48 may be formed to be the tilting linear-shaped long groove portions 230*a* to 230*c*.

Even in this case, since a portion of the first opening 211 in the communication channel 221 corresponding to the linear-shaped long groove portion 230*a* is located at the lowest side in the inverted state, if the portion of the first opening 211 of the communication channel 221 is filled with the ink, the air-liquid exchange is not available inside the communication channel 221. Accordingly, the negative pressure is generated in the ink chamber 50, the negative pressure and the water head pressure are balanced with each other, and then the ink stops flowing to the air chamber 200 side.

Figure 94:
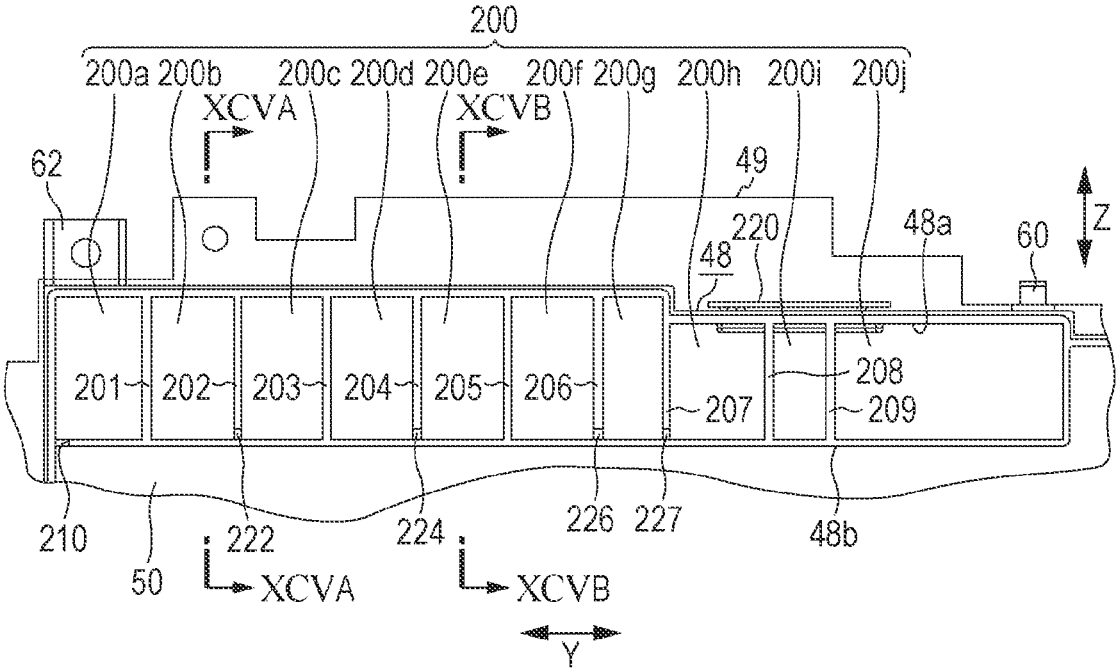
FIG. 94 is a partial cutaway view of a left side surface in a posture state when using an ink tank in an eleventh modification example.
Figure 95A:
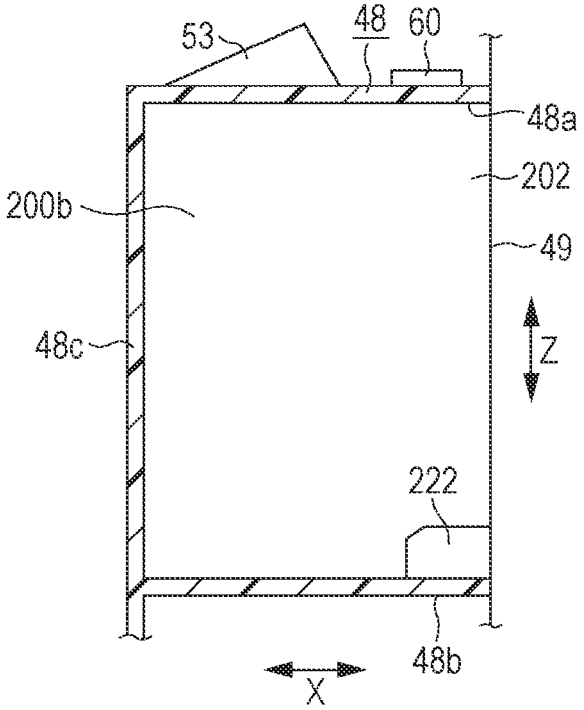
FIG. 95A is a cross-sectional view taken along the line XCVA-XCVA in FIG. 94.
Figure 95B:
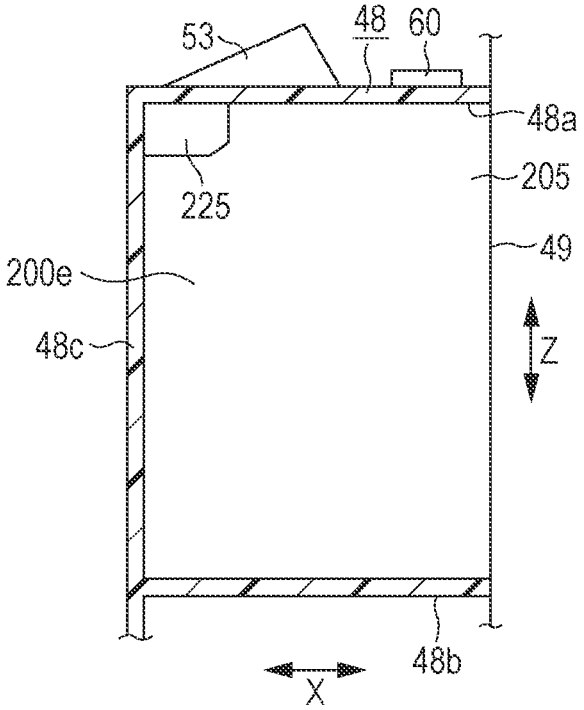
FIG. 95B is a cross-sectional view taken along the line XCVB-XCVB in FIG. 94.

In the embodiments and the examples, the communication channels 221, 223 and 225 respectively communicating with the first small air chamber 200*a*, the second small air chamber 200*b*, the third small air chamber 200*c*, the fourth small air chamber 200*d*, the fifth small air chamber 200*e* and the sixth small air chamber 200*f* may be formed to pass through the division walls 201, 203 and 205 dividing the respective small air chambers. For example, as illustrated in FIG. 94, the first opening 211 and the second opening 212 may not be formed on the innermost side surface of both small air chambers according to an eleventh modification example, which are adjacent to each other as the boundary of the respective first, third and fifth division walls 201, 203 and 205. As illustrated in FIGS. 95A and 95B, the communication channels having a mutually different distance from the partition wall 48*b* may be formed to pass through both of the division walls adjacent to each other in the front/rear direction Y.

Incidentally, FIG. 95A illustrates a state where the communication channel 222 is formed to pass through the corner portion, in the front/rear direction Y, which is the container opening portion 48*a* side close to the partition wall 48*b* in the second division wall 202 even-numbered (the second) from the first small air chamber 200*a* side. In addition, FIG. 95B illustrates a state where the communication channel 225 is formed to pass through the corner portion, in the front/rear direction Y, which is the innermost side surface side of the fifth small air chamber 200*e* close to the top surface which is farthest apart from the partition wall 48*b* in the fifth division wall 205 odd-numbered (the fifth) from the first small air chamber 200*a* side.

In other words, the communication channels 221, 223 and 225, which are examples of the first communication channel, are formed to pass through one corner on the wall surface of the odd-numbered division wall forming a rectangular shape. On the other hand, when the wall surface of the odd-numbered division wall is projected on the wall surface of the even-numbered division wall having the same rectangular shape and opposing the wall surface in the front/rear direction Y, the communication channels 222, 224 and 226, which are examples of the second communication channel, are formed at the other corner located at one diagonal corner on the wall surface of the even-numbered division wall forming a rectangular shape.

In a case of this configuration, if the communication channels 221, 223 and 225 formed to pass through the odd-numbered division wall are set to the first communication channel, and the communication channels 222, 224 and 226 formed to pass through the even-numbered division wall are set to the second communication channel, when the ink tank 43 is inverted, a portion of any one communication channel between the first communication channel and the second communication channel moves away from the air-liquid interface. Accordingly, even in this case, it is possible to generate the negative pressure in the ink chamber 50. Thus, it is possible to suppress the ink from flowing out from the ink chamber 50. Without being limited to a case of alternately forming the first communication channel and the second communication channel on the respective division walls 201 to 209 which are continuous in the front/rear direction Y, for example, in the first communication channel and the second communication channel, the first communication channel may be formed on at least two division walls which are continuous in the front/rear direction Y, and the second communication channel may be formed on at least one of other division walls which is subsequently continuous in the front/rear direction Y.

In addition, in this case, it is not necessary to form the long groove portions 213*a* to 213*c* connecting the first opening 211 and the second opening 212 to each other. In addition, it is not necessary for the film 214 to cover and adhere to the opening of the long groove portions 213*a* to 213*c*. Thus, it is possible to conveniently obtain the configuration of the communication channel. Moreover, the communication channel may be formed to pass through the corner of the diagonal positions on the rectangular-shaped division wall. Accordingly, it is possible to conveniently realize a configuration capable of suppressing the leakage of the ink when the ink tank 43 is inverted.

Furthermore, in this case, the first communication channel (for example, the communication channel 225) and the second communication channel (for example, the communication channel 222) are arranged at a mutually different position in a direction (the vertical direction Z and the left/right direction X, as an example) where the first division wall and the partition wall 48*b* are in parallel with each other. Accordingly, not only when the ink tank 43 is inverted upside down, but also when the ink tank 43 is placed sideways, it is possible to preclude the air-liquid exchange at the portion of the communication channel moving away from the air-liquid interface between the first communication channel and the second communication channel. Therefore, it is possible to suppress the leakage of the ink from the ink chamber 50 by generating the negative pressure in the ink chamber 50.

In the eleventh modification example illustrated in FIGS. 94, 95A and 95B, the first communication channel and the second communication channel, without being limited to the diagonal positions of the rectangular-shaped division wall, may be respectively formed at mutually different positions in the vertical direction Z and the left/right direction X. In addition, when inverted, any one of the first communication channel and the second communication channel may be located at a position away from the air-liquid interface. Accordingly, in that sense, the first communication channel and the second communication channel may be respectively formed at mutually different positions in the vertical direction Z, and in that case, any communication channel may be located at the further upper side.

Figure 92:
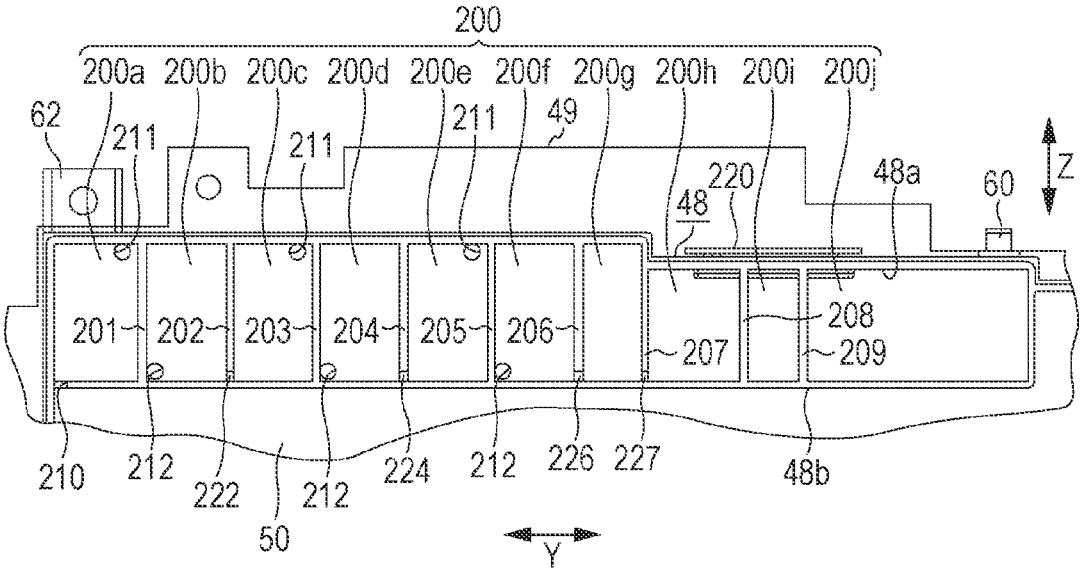
FIG. 92 is a partial cutaway view of a left side surface of an ink tank in a posture state when in use in a tenth modification example.
Figure 93:
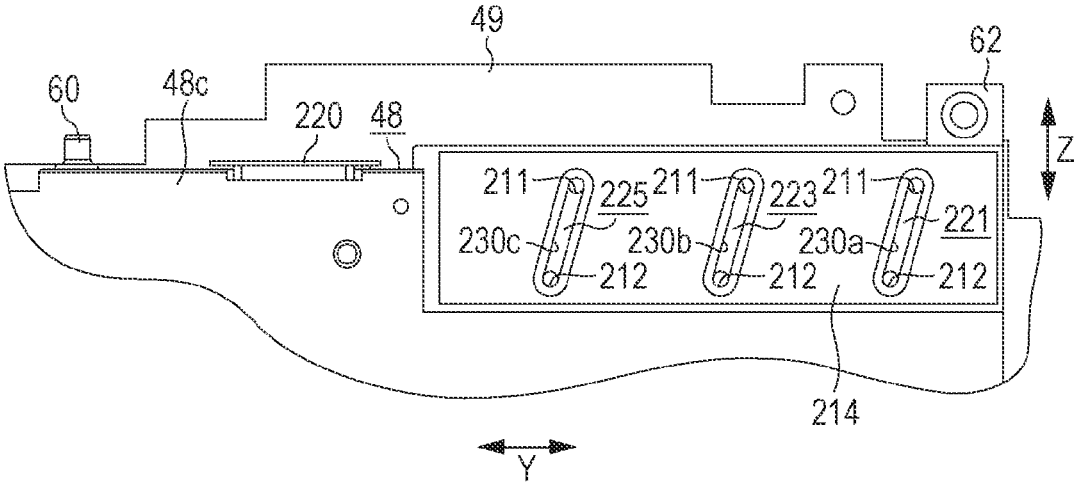
FIG. 93 is a partial cutaway view of a right side of the ink tank in the state in FIG. 92.

In the tenth modification example illustrated in FIGS. 92 and 93, the first opening 211 and the second opening 212 may be configured such that the second opening 212 is located at the further upper side than the first opening 211 in a posture state when in use.

In the embodiments, the examples and the modification examples, the meandering-shaped long groove portions 213*a* to 213*c* and the meandering-shaped narrow groove 219 are formed to be a groove in a curved shape such as an arc-shape and V-shape. In addition, the linear-shaped narrow groove 215 and the linear-shaped long groove portions 230*a* to 230*c* may be formed to be a groove in non-linear shape such as the meandering shape and the curved shape. Furthermore, the covering member covering and adhering to these grooves may be a thin resin sheet or plate, for example, in addition to the film.

In the embodiments, the examples and the modification examples, the communication channel formed to pass through the division walls 201 to 209 may be formed by cutting away the corner of the division wall in a rectangular shape, and alternatively may be a through hole passing through the surface portion other than the corner of the division wall in the thickness direction.

In the embodiments, the examples and the modification examples, the flow channel portions 221*a*, 223*a* and 225*a* apart from the partition wall 48*b* in the communication channels 221, 223 and 225 corresponding to the long groove portions 213*a* to 213*c* may form a non-linear shape. In addition, in the communication channels 221, 223 and 225, a portion where the distance from the partition wall 48*b* is longer than the distance from the partition wall 48*b* to the first opening 211 may not be necessarily the flow channel portions 221*a*, 223*a* and 225*a* extending in the horizontal direction, but at least a portion of the flow channel portions 221*a*, 223*a* and 225*a*.

In the embodiments and the examples, the choke valve 45 may be installed inside the ink tank 43 or may be attached to the outer surface of the ink tank 43.

In the embodiments, two or more ink tanks 43 may be arranged side by side and connected to each other to configure an assembly which is to be accommodated in the tank case 42. In this case, it is preferable that the choke valve 45 be arranged between another side surface in the assembly and the tank case 42, other than the bottom surface of the assembly, which is configured by the bottom surface 43*c* of the respective ink tanks 43, and other than the top surface of the assembly, which is configured by the top surface 43*d* of the respective ink tanks 43.

In the embodiments and the examples, when the slider 310 is located at the valve closing position, in the outer peripheral surface of the cam 345, the surface portion with which the ridge 317 of the slider 310 comes into contact may have a curved surface shape.

In the embodiments and the examples, when the choke valve 45 is switched over from the closed valve state to the open valve state, in the convex portion 350, the curved surface 351 with which the ridge 317 of the slider 310 comes into sliding contact may be curved so as to form a convex shape. In addition, when the choke valve 45 is switched over from the open valve state to the closed valve state, in the convex portion 350, the curved surface 352 with which the ridge 317 of the slider 310 comes into sliding contact may be curved so as to form a concave shape.

In this configuration, the pivotal resistance acting on the outer peripheral surface of the cam 345 from the slider 310 when the ridge 317 of the slider 310 rides across the convex portion 350 of the cam 345 is increased more when the choke valve 45 is switched over from the open valve state to the closed valve state, than when the choke valve 45 is switched over from the closed valve state to the open valve state. Therefore, when the slider 310 is displaced from the valve opening position, following the pivotal movement of the cam 345 according to the manual operation, the magnitude of the pivotal torque to be applied to the cam 345 in order for the slider 310 to ride across the curved surface 355 of the convex portion 350 is relatively increased. Accordingly, since the convex portion 350 of the cam 345 is stably locked by the ridge 317 of the slider 310, it is possible to reliably maintain the choke valve 45 in the open valve state.

In the embodiments and the examples, in the convex portion 350 of the cam 345, when the choke valve 45 is switched over between the open valve state and the closed valve state, the surface with which the slider 310 comes into sliding contact may not necessarily form a curved surface shape, but for example, may form a bent surface shape or a flat surface shape.

In the embodiments and the examples, in the convex portion 350 of the cam 345, the surface with which the ridge 317 of the slider 310 comes into sliding contact when the choke valve 45 is switched over from the closed valve state to the open valve state, and the surface with which the ridge 317 of the slider 310 comes into sliding contact when the choke valve 45 is switched over from the open valve state to the closed valve state, may have the same shape as each other.

In the embodiments and the examples, within the outer surface of the cam 345, the convex portion 350 may be formed in the vicinity of the surface portion farthest apart from the pivot shaft 331, which is the surface portion to which the slider 310 comes into contact when the slider 310 is located at the valve closing position.

In this configuration, when displacing the slider 310 to the valve closing position, it is necessary for the slider 310 to ride across the convex portion 350 of the cam 345. Thus, the pivotal torque to be applied to the cam 345 is increased. Therefore, when the slider 310 is displaced to the valve closing position, following the pivotal movement of the cam 345 according to a manual operation, a sense of resistance in the pivotal operation of the cam 345 changes. Accordingly, it is possible to easily recognize that the slider 310, which is to be displaced in order to switch the flowing state of the ink, has been displaced to the valve closing position according to the manual operation.

Figure 96:
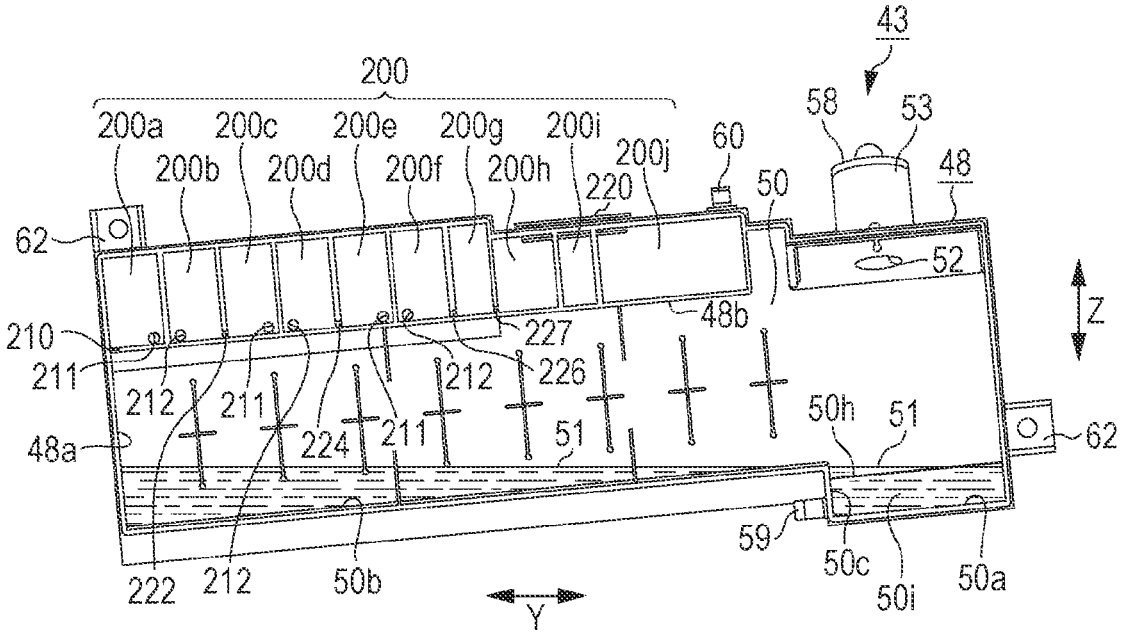
FIG. 96 is a side view illustrating a configuration of an ink tank in a twelfth modification example.
Figure 97:
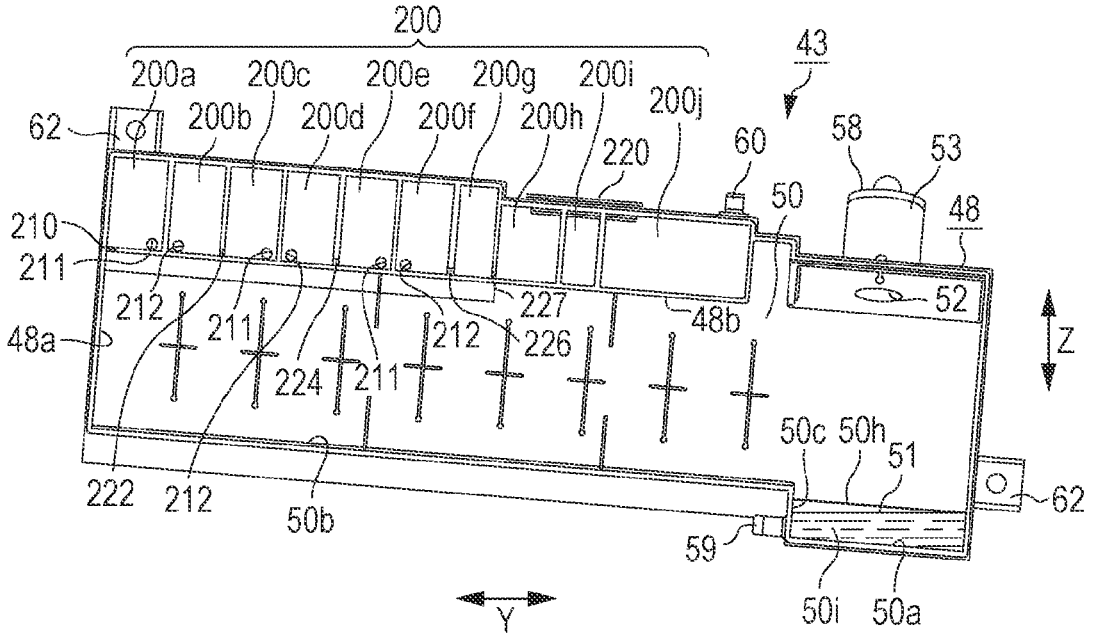
FIG. 97 is a side view in a case where a tilted state of the ink tank in FIG. 96 is changed.

In the ink tank 43 of the embodiments and the examples, as is illustrated in a twelfth modification example in FIG. 96, without disposing the liquid collecting concave portion 50*d* (refer to FIG. 5) on the basal surface 50*a* disposed at the first end side (right end side in FIG. 96) in the longitudinal direction (front/rear direction Y), the outlet port 59 may be disposed at the second end side (stepped side surface 50*c* side which is the left end side in FIG. 96) of the basal surface 50*a* in the front/rear direction Y. In FIGS. 96 and 97, the film 49 (refer to FIG. 4) is not illustrated.

In this case, when the ink chamber 50 is in a tilted state such that the basal surface 50*a* side of the ink tank 43 is located higher than the stepped bottom surface 50*b* side, the flowing of the ink to the stepped bottom surface 50*b* side is suppressed by the stepped side surface 50*c*. Since the outlet port 59 is disposed on the stepped side surface 50*c* side (left end side in FIG. 96) of the basal surface 50*a* in the longitudinal direction (front/rear direction Y), it is possible to cause the ink blocked in the basal surface 50*a* side by the stepped side surface 50*c* to flow out from the outlet port 59.

On the other hand, as illustrated in FIG. 97, when the ink tank 43 is in a tilted state such that the stepped bottom surface 50*b* side of the ink tank 43 is located higher than the basal surface 50*a* side, the ink flows from the stepped bottom surface 50*b* side to the basal surface 50*a* side. Therefore, it is possible to cause the ink contained in the ink chamber 50 to flow out through the outlet port 59.

In the ink tank 43 of the embodiments and the examples, in the bottom portion of the ink chamber 50, a plurality (at least two or more) of the stepped bottom surfaces 50*b* may be disposed in a step-wise manner in the front/rear direction Y. In this case, since two or more of the stepped bottom surfaces 50*b* are disposed in the step-wise manner in the front/rear direction Y, it is possible to reduce the amount of the ink accumulated on the stepped bottom surface 50*b* side due to the tilting rather than stepped side surface 50*c* by the volume equivalent to the step forming. Accordingly, it is possible to reduce the amount of ink remaining without ink flowing out from the outlet port 59 when the ink chamber 50 is in the tilted state.

In the embodiments and the examples, the stepped bottom surface 50*b* disposed in the ink tank 43 may be tilted such that the basal surface 50*a* side is lower. In this case, it is possible to cause the ink located at the stepped bottom surface 50*b* side to flow to the basal surface 50*a* side following the tilt. Accordingly, even if the ink tank 43 is in the tilted state, it is possible to reduce the amount of the ink remaining in the bottom portion of the ink chamber 50.

In the ink tank 43 of the embodiments and the examples, the upper end side of the stepped side surface 50*c* may be tilted in the direction where the length of the stepped bottom surface 50*b* in the longitudinal direction is decreased.

In the ink tank 43 of the embodiments, the basal surface 50*a* may be tilted such that the outlet port 59 side in the longitudinal direction (front/rear direction Y) is lower.

In the ink tank 43 of the embodiments and the examples, the basal surface 50*a* may not be tilted.

In the ink tank 43 of the embodiments and the examples, the lengths of the basal surface 50*a* and the stepped bottom surface 50*b* in the longitudinal direction (front/rear direction Y) may be equal to each other, or the length of the basal surface 50*a* in the front/rear direction Y may be longer than the length of the stepped bottom surface 50*b*.

In the ink tank 43 of the embodiments and the examples, the basal surface 50*a* may be disposed in the vicinity of the center of the ink chamber 50 in the longitudinal direction (front/rear direction Y), and the stepped bottom surface 50*b* may be disposed at both end sides thereof. In this case, when the ink tank 43 is tilted, even if any end portion side in the longitudinal direction becomes higher, it is possible to cause the ink to flow on the basal surface 50*a*. Accordingly, it is possible to reduce the amount of the ink remaining without flowing out from the outlet port 59 disposed in the vicinity of the basal surface 50*a*.

In the ink tank 43 of the embodiments and the examples, the outlet port 59 may be open downward.

In the ink tank 43 of the embodiments and the examples, the outlet port 59 may be disposed in the vicinity of the center of the basal surface 50*a* in the longitudinal direction (front/rear direction Y).

In the ink tank 43 of the embodiments and the examples, if the stepped bottom surface 50*b* is set to a first stepped bottom surface 50*b*, and the stepped side surface 50*c* is set to a first stepped side surface 50*c*, as is in the twelfth modification example illustrated in FIGS. 96 and 97, a second stepped bottom surface 50*h* and a second stepped side surface 50*i* which are parallel with the basal surface 50*a* in the short direction (left/right direction X which is the direction orthogonal to the paper surface in FIGS. 96 and 97) may be disposed in the ink chamber 50. The second stepped bottom surface 50*h* is disposed in the ink chamber 50 with a step such that the second stepped bottom surface 50*h* is higher than the basal surface 50*a* and lower than the first stepped bottom surface 50*b*. In addition, in the second stepped side surface 50*i*, whereas the upper end side intersects with the second stepped bottom surface 50*h*, the lower end side intersects with the basal surface 50*a*. Then, in this case, in the bottom portion of the ink chamber 50, it is preferable to dispose outlet port 59 on the basal surface 50*a* side in the short direction. Furthermore, the second stepped bottom surface 50*h* may be tilted such that the basal surface 50*a* side is lower.

In this case, when the ink chamber 50 is in the tilted state such that the basal surface 50*a* side is higher than the second stepped bottom surface 50*h* in the short direction, the flowing of the ink to the second stepped bottom surface 50*h* side is suppressed by the second stepped side surface 50*i*. Then, the outlet port 59 is disposed basal surface 50*a* side of the bottom portion in the short direction. Thus, it is possible to cause the ink blocked in the basal surface 50*a* side by the second stepped side surface 50*i* to flow out from the outlet port 59. Accordingly, even if the ink chamber 50 is in the tilted state in the short direction, it is possible to reduce the amount of the ink remaining at the bottom portion of the ink chamber 50.

In the ink tank 43 of the embodiments and the examples, the basal surface 50*a* and the stepped side surface 50*c* may be subjected to liquid-repellent treatment. In this case, it is possible to cause the ink accumulated on the basal surface 50*a* and the stepped side surface 50*c* to rapidly flow inside the liquid collecting concave portion 50*d* to flow out from the outlet port 59.

In the embodiments and the examples, the ink tank 43 may be disposed inside the apparatus main body 13.

In the embodiments and the examples, the tank case 42 may not be included in the configuration. That is, for example, the screw boss portion 37 in the apparatus main body 13 may be formed at a position corresponding to the tank locking portion 62 of the ink tank 43, and then the ink tank 43 may be directly fixed to the apparatus main body 13.

Third Embodiment

Figure 98:
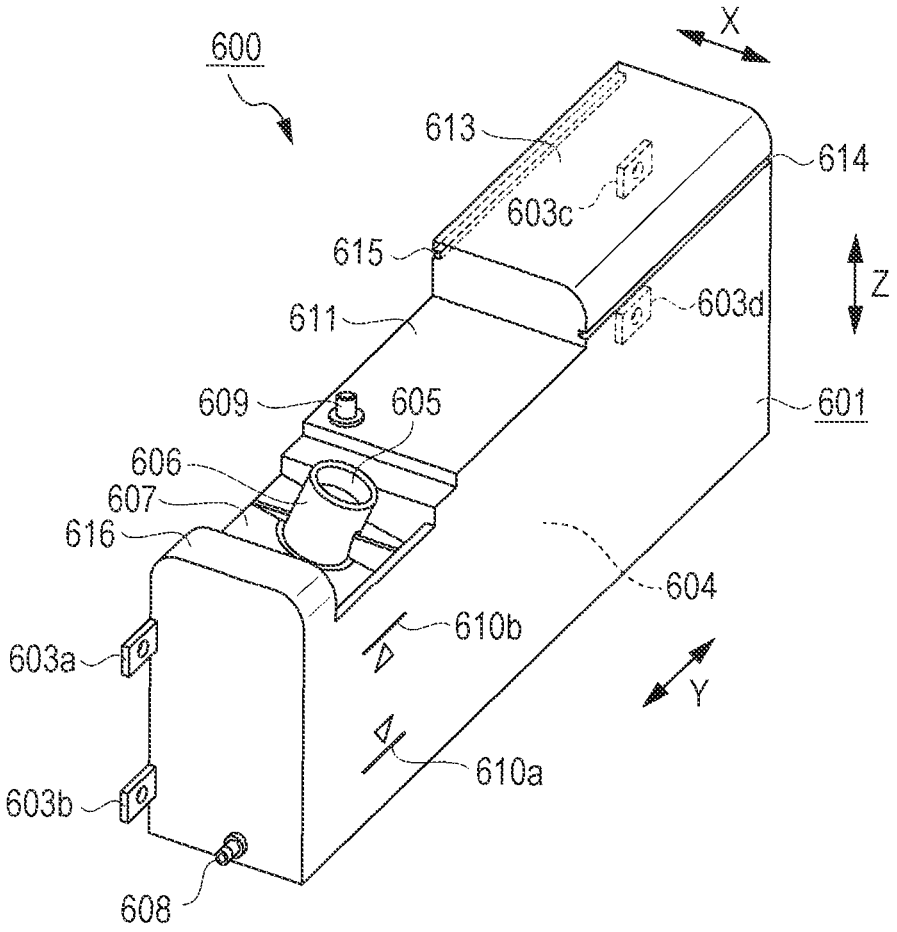
FIG. 98 is a perspective view of a tank unit in a third embodiment.

In the embodiments and the examples, the recording apparatuses 12 and 85 including the tank unit 27 having the tank case 42 as the protection case, and the cover 44 provided in the tank case 42 has been described. In contrast, in a third embodiment, a recording apparatus having no tank case provided in a tank unit and including the cover 44 provided in an ink tank will be described. FIG. 98 is a perspective view of a tank unit 600, which is an example of a liquid container unit in the third embodiment.

An ink tank 601, which is an example of the liquid container, has tank locking portions 603*a*, 603*b*, 603*c* and 603*d* on both side surface in the front/rear direction Y. The tank unit 600 is attached to the attachment surface 13*a* of the recording apparatus 12 in the first embodiment, or to the attachment surface 87*a* of the recording apparatus 85 in the second embodiment by means of the tank locking portions 603*a*, 603*b*, 603*c* and 603*d*, and the screws (not illustrated).

The ink tank 601 is integrally molded, and has an ink chamber 604 configured by a film and the like inside thereof as an example of the liquid containing chamber containing the ink. The ink tank 601 is made of a transparent or translucent resin, and allows the ink contained inside the ink chamber 604 and the liquid level of the ink to be visually recognized from the outside of the ink tank 601.

An injection port 605, which is an example of the liquid injection port through which the ink can be injected into the ink chamber 604, is formed on the upper portion of the ink tank 601. The injection port 605 is formed at one side (front side in the embodiment) of the ink tank 601 in the front/rear direction Y which is the longitudinal direction.

The injection port 605 protrudes outward from the ink chamber 604, and is formed to be open at the front end of a cylinder portion 606 protruding toward the upward right direction which is non-orthogonal to the vertical direction Z and the further upward direction than the horizontal direction.

An injection port forming surface 607 where the injection port 605 and the cylinder portion 606 are formed on the upper portion of the ink tank 601 is formed toward the upward right direction (one direction) intersecting with the vertical direction Z. That is, the injection port forming surface 607 is tilted such that the right side in the left/right direction X is lower than the position having the base end portion of the cylinder portion 606, and in non-orthogonal to the vertical direction Z. The closing member 58 (refer to FIG. 14) capable of closing the injection port 605 is detachably attached to the front end of the cylinder portion 606.

An outlet port 608, which is an example of the liquid outlet port from which the ink contained in the ink chamber 604 flows to the tube 31 (refer to FIGS. 1 and 53) side, is formed at the lower side position of the front surface of the ink tank 601. An air intake port 609 which takes the air into the ink chamber 604 from the further upper position than that of the liquid level of the ink when containing the ink inside the ink chamber 604 is formed in the ink tank 601. That is, the air intake port 609 takes the outside air into the ink chamber 604 from the further upper position than that of the liquid level, when the ink contained in the ink chamber 604 is decreased due to the consumption of the ink by the liquid ejecting head 32 in FIG. 1.

A lower limit scale 610*a*, which is an example of the scale, and an upper limit scale 610*b*, which is an example of the scale, are formed to protrude from the front side on the right side surface of the ink tank 601. The lower limit scale 610*a* indicates a lower limit amount which is the reference for injecting the ink to the ink chamber 604. In addition, the upper limit scale 610*b* indicates an upper limit amount of the ink injected through the injection port 605 and to be contained inside the ink chamber 604.

A stepped portion 613 protruding further upward than an air intake port forming surface 611 on which the air intake port 609 is formed is formed at the rear side in the upper portion of the ink tank 601. A first rail portion 614 having a groove portion extending in the front/rear direction Y is disposed at the right side of the stepped portion 613 in the left/right direction X. A second rail portion 615 having a groove portion extending in the front/rear direction Y is disposed at the left side of the stepped portion 613 in the left/right direction X.

A pair of sliding contact portions 80 formed on the inner surface which is a surface of the left wall 44*c* side in the right wall 44*b* of the cover 44 in FIG. 15 engages and comes into contact with the first rail portion 614. In addition, a pair of sliding contact portions 80 formed on the inner surface which is a surface of the right wall 44*b* side in the left wall 44*c* engages and comes into contact with the second rail portion 615.

In this manner, the stepped portion 613 has the first rail portion 614 and the second rail portion 615 as a support portion supporting the cover 44 so as to be slidable in the front/rear direction Y. If the cover 44 is slid forward and the front side end portion of the upper wall 44*a* covers a protrusion portion 616 formed at the front side of the ink tank 601, the cylinder portion 606 having the injection port 605 is hidden by the cover 44. If the cover 44 is slid rearward, the cylinder portion 606 having the injection port 605 is exposed.

The first rail portion 614 has a pair of concave stopper portions (not illustrated) which are apart from and in parallel with each other in the front/rear direction Y, and can engage with the convex stopper portion 80*a* in FIG. 15. At the position where the convex stopper portion 80*a* engages with the front side concave stopper portion between a pair of the concave stopper portions, the cylinder portion 606 is in a hiding state by the cover 44. At the position where the convex stopper portion 80*a* engages with the rear side concave stopper portion between a pair of the concave stopper portions, the cylinder portion 606 is in an exposure state, that is a non-hiding state.

Hitherto, the tank unit 600 to be attached to the recording apparatuses 12 and 85 described in the embodiment includes the ink chamber 604 containing the ink to be supplied via the tube 31 to the liquid ejecting head 32 consuming the ink; the outlet port 608 from which the ink contained in the ink chamber 604 flows to the tube 31 side; the ink tank 601 having the injection port 605 through which the ink can be injected into the ink chamber 604; and the cover 44 provided in the ink tank 601 and capable of hiding the injection port 605.

In this case, a user, if the cover 44 is in a state to expose the injection port 605, it is possible to inject the ink to the ink chamber 604 through the injection port 605 formed on the ink tank 601. In addition, since the tank unit 600 is mounted on the apparatus main bodies 13 and 87, when the user carries the multi-function printer 11 or the recording apparatus 85, it is possible to decrease a possibility that the tank unit 600 may be separated from the apparatus main bodies 13 and 87. Accordingly, it is possible to improve the portability of the multi-function printer 11 or the recording apparatus 85 including the tank unit 600 capable of injecting the ink.

In addition, in the tank unit 600, the cover 44 is provided so as to be slidable in the front/rear direction Y which is the longitudinal direction of the ink tank 601. In this case, a user's operability is facilitated when hiding or exposing the injection port 605.

In addition, in the tank unit 600, the injection port 605 is provided further to one side (front side in the front/rear direction Y) of the ink tank 601 in the longitudinal direction than the center thereof. In the embodiment, the injection port 605 is disposed in the vicinity of the rear side of the protrusion portion 616 disposed at the position of the front side end portion.

In this case, if the front side end portion of the upper wall 44*a* of the cover 44 is moved from the position to cover the protrusion portion 616 to the further rear side position than the position of the injection port 605 disposed in the vicinity of the rear side of the protrusion portion 616, the injection port 605 is exposed. Accordingly, it is possible to shorten the travel of the cover 44 when a user slides the cover 44 to hide or expose the injection port 605. In addition, it is possible to dispose the first rail portion 614 and the second rail portion 615 as the protection portions for supporting the cover 44 to be slidable in the stepped portion 613, at the opposite side (rear side in the front/rear direction Y) to the injection port 605 in the longitudinal direction.

What is claimed is:

1. A liquid container comprising:

a liquid containing chamber for containing a liquid to be supplied via a tube to a liquid consuming unit consuming the liquid;

a liquid outlet port from which the liquid contained in the liquid containing chamber flows to the tube;

a liquid injection port through which the liquid can be injected into the liquid containing chamber; and an air intake port taking air into the liquid containing chamber from a further vertically upper position than a liquid level of the liquid when the liquid is contained in the liquid containing chamber, wherein the liquid container has an area where, if a volume of liquid equal to 5% of the containing capacity of the liquid containing chamber flows from the liquid outlet port, a fluctuation range of the liquid level of the liquid inside the liquid containing chamber is 5% or less of the cubic root of the containing capacity, and wherein the liquid containing chamber has a height of 70 mm or less from a bottom surface to the liquid injection port in the vertical direction.

2. The liquid container according to claim 1, the liquid containing chamber has a width in a direction intersecting with the vertical direction that is larger than the height of liquid containing chamber in the vertical direction.

3. A liquid consuming apparatus comprising:

a liquid consuming unit;

a tube; and the liquid container according to claim 1.

4. A liquid container comprising:

a liquid containing chamber for containing a liquid to be supplied via a tube to a liquid consuming unit consuming the liquid;

a liquid outlet port from which the liquid contained in the liquid containing chamber flows to the tube;

a liquid injection port through which the liquid can be injected into the liquid containing chamber;

an air intake port taking air into the liquid containing chamber from a further vertically upper position than a liquid level of the liquid when the liquid is contained in the liquid containing chamber; and a visible surface through which the liquid level of the liquid contained in the liquid containing chamber can be visually recognized from a direction intersecting with the vertical direction, wherein the liquid container has an area where, if a volume of liquid equal to 5% of the containing capacity of the liquid containing chamber flows from the liquid outlet port, a fluctuation range of the liquid level of the liquid inside the liquid containing chamber is 5% or less of the cubic root of the containing capacity, wherein the visible surface has an upper limit scale indicating an upper limit amount of the liquid which is injected through the liquid injection port and contained in the liquid containing chamber, and wherein the height from a bottom surface of the liquid containing chamber in the vertical direction to the upper limit scale is 55 mm or less.

5. The liquid container according to claim 4, wherein the visible surface further has a lower limit scale at a position vertically lower than position of the upper limit scale, and wherein the height in the vertical direction from the lower limit scale to the upper limit scale is 40 mm or less.

6. A liquid consuming apparatus comprising:

a liquid consuming unit;

a tube; and the liquid container according to claim 4.

7. A liquid supply system comprising:

a liquid ejecting apparatus including:

a liquid ejecting head movable in a main scanning direction;

a transportation mechanism transporting a recording medium in a transport direction intersecting with a main scanning direction; and a tube for supplying a liquid to the liquid ejecting head, the tube being drawn to a front side, which is downstream in the transport direction of the recording medium than a movement area of the liquid ejecting head; and a liquid container for containing ink, the liquid container being arranged following the transport direction at a location outside the movement area of the liquid ejecting head in the main scanning direction, the liquid container includes:

a liquid containing chamber capable of containing the liquid;

a liquid injection port through which the liquid can be injected into the liquid containing chamber;

an air intake port taking air into the liquid containing chamber; and a liquid outlet port from which the liquid contained in the liquid containing chamber flows to the tube, wherein the liquid containing chamber is smaller in a first dimension than in a second dimension, which is orthogonal to the first dimension and to a third dimension, wherein the liquid containing chamber is smaller in the second dimension than in the third dimension, and wherein the liquid outlet port is arranged further to one side than the center of the liquid containing chamber in the third dimension, wherein an operation portion of a valve is disposed in a front surface of the liquid container, the valve being capable of squeezing the tube connected to the liquid outlet port in order to block the supply of the ink.

8. The liquid supply system according to claim 7, wherein the liquid container is arranged outside a housing of the liquid ejecting apparatus, the housing accommodating the liquid ejecting head in a movable state.

9. The liquid supply system according to claim 7, wherein the first dimension extends in the main scanning direction, the second dimension extends in a height direction, and the third dimension extends in the transport direction.

* * * * *